US010382855B2

(12) United States Patent
Willis et al.

(10) Patent No.: US 10,382,855 B2
(45) Date of Patent: Aug. 13, 2019

(54) ATTACHMENT APPARATUS

(71) Applicant: Human, Incorporated, Seattle, WA (US)

(72) Inventors: Benjamin S. Willis, Bellevue, WA (US); Adam Abraham Jossem, Seattle, WA (US); Stephen John Minarsch, Seattle, WA (US); Dae Il Kwon, Edmonds, WA (US); Francesca Alyssum Quaglia, Seattle, WA (US); Lea Martin, Seattle, WA (US)

(73) Assignee: Human, Incorporated, Seattle, WA (US)

( * ) Notice: Subject to any disclaimer, the term of this patent is extended or adjusted under 35 U.S.C. 154(b) by 0 days.

(21) Appl. No.: 15/659,531

(22) Filed: Jul. 25, 2017

(65) Prior Publication Data

US 2018/0077478 A1 Mar. 15, 2018

Related U.S. Application Data

(63) Continuation of application No. 15/494,112, filed on Apr. 21, 2017, now Pat. No. 9,807,493.
(Continued)

(51) Int. Cl.
*H04R 1/10* (2006.01)
*A45F 5/00* (2006.01)

(52) U.S. Cl.
CPC ..... *H04R 1/105* (2013.01); *A45F 5/00* (2013.01); *H04R 1/1008* (2013.01); *H04R 1/1066* (2013.01); *A45F 2200/0508* (2013.01)

(58) Field of Classification Search
CPC combination set(s) only.
See application file for complete search history.

(56) References Cited

U.S. PATENT DOCUMENTS 2,763,334 A 9/1956 Starkey
2,778,889 A 1/1957 Hausdorf
(Continued)

FOREIGN PATENT DOCUMENTS

CN 2430819 Y 5/2001
CN 2465432 Y 12/2001
(Continued)

OTHER PUBLICATIONS

International Form PCT/ISA/206, "Invitation to Pay Additional Fees and, Where Applicable, Protest Fee," mailed Jul. 24, 2017, for International Application No. PCT/US2017/028972, 22 pages.
(Continued)

*Primary Examiner* — Amir H Etesam
(74) *Attorney, Agent, or Firm* — Seed IP Law Group LLP

(57) ABSTRACT

Various embodiments provide for an improved attachment apparatus for attaching the attachment apparatus to an ear of a user using a hook body. The hooking body may be secured to the user's ear, such as in response to receiving a deforming force from the user that causes the hooking body to deform in conformity with at least a portion of the root of the user's ear. In some embodiments, the hooking body may be coupled to the attachment body via the bridging member of the attachment body. Accordingly, the hooking body may be configured to secured the attachment apparatus to the user's ear. In some embodiments, a sealing body may be coupled to the plate member of the attachment body, and the cover body may form at least a partial acoustic seal around the user's ear while the hooking body is secured to the attachment apparatus to the ear.

24 Claims, 51 Drawing Sheets

Related U.S. Application Data

(60) Provisional application No. 62/474,521, filed on Mar. 21, 2017, provisional application No. 62/430,315, filed on Dec. 5, 2016, provisional application No. 62/395,303, filed on Sep. 15, 2016, provisional application No. 62/325,904, filed on Apr. 21, 2016.

(56) References Cited

U.S. PATENT DOCUMENTS 2,802,214 A 8/1957 Hanks
3,862,378 A 1/1975 Norris
3,869,584 A 3/1975 Wilde
3,915,166 A 10/1975 McCrink
4,453,050 A 6/1984 Enokido
4,529,058 A 7/1985 Emery
4,713,843 A 12/1987 Duncan
4,872,219 A 10/1989 Duncan
4,935,965 A 6/1990 Wassell
4,972,468 A 11/1990 Murase et al.
D317,610 S 6/1991 Jahnke
5,333,206 A 7/1994 Koss
5,339,467 A 8/1994 Brinkley
D357,479 S 4/1995 Coomans
5,412,736 A 5/1995 Keliiliki
5,446,788 A 8/1995 Lucey et al.
D375,258 S 11/1996 Weder et al.
5,655,026 A 8/1997 Peters et al.
5,673,438 A 10/1997 Lambert
5,737,436 A 4/1998 Boyden
5,757,944 A 5/1998 Jensen et al.
5,761,298 A 6/1998 Davis et al.
5,790,683 A 8/1998 Salzani
5,898,945 A 5/1999 Weiser
D420,010 S 2/2000 Pitel
6,029,282 A 2/2000 Buschman
6,035,961 A 3/2000 Sun
6,055,672 A 5/2000 Natvig
6,078,825 A 6/2000 Hahn et al.
6,230,029 B1 5/2001 Hahn et al.
6,320,960 B1 11/2001 Lathrop, III et al.
6,418,230 B1 7/2002 McDonald et al.
6,434,250 B1 8/2002 Tsuhako
6,434,251 B1 8/2002 Jensen et al.
D462,944 S 9/2002 Yuen
6,449,374 B1 9/2002 Skulley et al.
6,480,611 B2 11/2002 Hashimoto et al.
D472,889 S 4/2003 Tanaka et al.
6,580,800 B1 6/2003 Yamasaki et al.
6,728,388 B1 4/2004 Nageno et al.
6,751,331 B2 6/2004 Eisenbraun
6,772,853 B2 8/2004 Yang
6,785,396 B2 8/2004 Shirata
6,804,364 B1 10/2004 De Jonge
6,914,997 B2 7/2005 MacDonald et al.
7,006,649 B2 2/2006 Natvig
7,013,018 B2 3/2006 Bogeskov-Jensen
7,046,799 B2 5/2006 Ma
7,050,598 B1 5/2006 Ham
7,106,877 B1 9/2006 Linville
7,110,535 B2 9/2006 Bodley et al.
7,110,563 B2 9/2006 Bergere
7,120,268 B2 10/2006 Murozaki et al.
7,130,419 B2 10/2006 Bodley et al.
7,146,004 B2 12/2006 Bodley et al.
7,184,565 B2 2/2007 Ohta
D541,485 S 4/2007 Birgersson et al.
7,221,771 B1 5/2007 DeKalb et al.
7,231,056 B2 6/2007 Chen
7,346,180 B2 3/2008 Ham
7,356,362 B2 4/2008 Chang et al.
7,366,298 B2 4/2008 Pedersen et al.
7,391,862 B2 6/2008 Rath et al.
7,409,234 B2 8/2008 Glezerman
7,489,795 B2 2/2009 Ito
7,492,917 B2 2/2009 Ito
D588,112 S 3/2009 Komiyama
7,542,564 B2 6/2009 Jaakkola
7,542,582 B2 6/2009 Connors et al.
7,580,541 B2 8/2009 Hlas et al.
7,590,255 B2 9/2009 Nielsen
7,609,845 B2 10/2009 Chang
7,613,292 B2 11/2009 te Riet
7,646,879 B2 1/2010 Huang
7,664,287 B2 2/2010 Neu et al.
7,703,572 B2 4/2010 Du et al.
7,708,110 B2 * 5/2010 Leong ..... A61F 11/08 128/867
7,720,244 B2 5/2010 Espersen et al.
7,778,435 B2 8/2010 Smith et al.
7,854,294 B2 12/2010 Du et al.
7,869,615 B2 1/2011 Chang
7,873,395 B2 1/2011 Kim et al.
7,920,902 B2 4/2011 Carroll
7,925,037 B2 4/2011 Te Riet
7,949,127 B2 5/2011 Pedersen et al.
7,995,746 B2 8/2011 Rath et al.
8,000,492 B2 8/2011 Kao et al.
8,094,852 B2 1/2012 Ikuma et al.
8,139,808 B2 3/2012 Liu et al.
8,150,090 B2 4/2012 Ito
8,213,632 B2 7/2012 Yamagishi et al.
8,249,286 B2 * 8/2012 Nault ..... H04R 1/1033 381/182
8,265,328 B2 9/2012 Milde et al.
8,320,602 B2 11/2012 Liu et al.
8,340,339 B2 12/2012 Neu et al.
8,428,289 B2 4/2013 Wengreen
8,452,039 B2 5/2013 Wright
8,472,660 B2 6/2013 Wengreen
8,503,688 B2 8/2013 DiRusso
8,542,845 B2 9/2013 Cho
8,605,934 B2 12/2013 Hagberg et al.
8,630,406 B2 1/2014 Rath et al.
8,655,005 B2 2/2014 Birger et al.
8,688,036 B2 4/2014 Parkins et al.
8,818,012 B2 8/2014 Pelland et al.
8,818,461 B2 8/2014 Cybart et al.
8,837,766 B2 9/2014 Liu et al.
8,908,895 B2 12/2014 Würfel
8,913,772 B2 12/2014 Yamaguchi et al.
8,934,638 B2 1/2015 Kimura
8,976,995 B2 3/2015 Berg
D734,294 S 7/2015 Euler et al.
9,106,997 B2 8/2015 Burgett et al.
9,167,329 B2 10/2015 Honeycutt
9,167,334 B2 10/2015 Triato
9,210,495 B2 12/2015 Akino
9,288,566 B2 3/2016 Minarik et al.
9,288,569 B2 3/2016 Reimert
9,301,040 B2 3/2016 Annunziato et al.
9,332,337 B2 5/2016 Ridler
9,426,558 B2 8/2016 Burt et al.
9,521,478 B2 * 12/2016 Jiang ..... H04R 1/105
9,584,897 B2 2/2017 Ushakov
2002/0041697 A1 * 4/2002 MacDonald ..... H04R 1/10 381/381
2002/0090105 A1 7/2002 Jensen et al.
2002/0096391 A1 7/2002 Smith et al.
2002/0102005 A1 8/2002 Lin
2002/0106100 A1 8/2002 Kao
2003/0012396 A1 1/2003 Smith
2003/0048916 A1 3/2003 Chen
2003/0169896 A1 9/2003 Kirk, III et al.
2004/0032965 A1 2/2004 Ito
2004/0052363 A1 3/2004 Bodley et al.
2004/0091129 A1 5/2004 Jensen et al.
2004/0197001 A1 10/2004 Terrell
2005/0271234 A1 * 12/2005 Bogeskov-Jensen .... H04R 1/10 381/381
2006/0198544 A1 9/2006 Yueh
2006/0239446 A1 10/2006 Gunter et al.
2006/0262949 A1 11/2006 Cho et al.
2007/0003092 A1 1/2007 Shen
2007/0036376 A1 2/2007 Fried

(56) References Cited

U.S. PATENT DOCUMENTS

| | | | |
|---|---|---|---|
| 2007/0049361 | A1 | 3/2007 | Coote et al. |
| 2007/0104345 | A1 | 5/2007 | Yang |
| 2007/0223765 | A1 | 9/2007 | Wang |
| 2007/0258613 | A1 | 11/2007 | Wright |
| 2008/0019557 | A1 | 1/2008 | Bevirt et al. |
| 2008/0132292 | A1 | 6/2008 | Hansen et al. |
| 2008/0143954 | A1 | 6/2008 | Abreu |
| 2008/0152183 | A1 | 6/2008 | Janik et al. |
| 2008/0178435 | A1 | 7/2008 | Liu et al. |
| 2008/0192951 | A1 | 8/2008 | Moura |
| 2008/0260197 | A1 | 10/2008 | Polito |
| 2008/0263749 | A1 | 10/2008 | Leong et al. |
| 2008/0298626 | A1 | 12/2008 | Dean |
| 2009/0041288 | A1 | 2/2009 | Liu et al. |
| 2009/0116678 | A1 | 5/2009 | Bevirt et al. |
| 2010/0008530 | A1 | 1/2010 | Hlas et al. |
| 2010/0061581 | A1 | 3/2010 | Soetejo et al. |
| 2011/0007926 | A1 | 1/2011 | Murozaki |
| 2012/0070027 | A1 | 3/2012 | Ridler |
| 2012/0124719 | A1 | 5/2012 | Michlitsch et al. |
| 2012/0230532 | A1 | 9/2012 | Howell |
| 2012/0243723 | A1 | 9/2012 | Halkosaari et al. |
| 2013/0010997 | A1 | 1/2013 | Tanaka et al. |
| 2013/0108070 | A1 | 5/2013 | Neu et al. |
| 2013/0208910 | A1 | 8/2013 | Hansen et al. |
| 2013/0208940 | A1 | 8/2013 | Hansen et al. |
| 2014/0140561 | A1 | 5/2014 | Lee et al. |
| 2014/0198929 | A1 | 7/2014 | Honeycutt |
| 2015/0195639 | A1 | 7/2015 | Azmi et al. |
| 2015/0237434 | A1 | 8/2015 | Tran et al. |
| 2016/0007111 | A1 | 1/2016 | Honeycutt |
| 2016/0063290 | A1 | 3/2016 | Miyazaki et al. |
| 2016/0192059 | A1 | 6/2016 | Smith et al. |
| 2016/0219355 | A1 | 7/2016 | Hansen et al. |
| 2016/0269818 | A1 | 9/2016 | Mackay |
| 2016/0277824 | A1 | 9/2016 | Ushakov |
| 2016/0381448 | A1 | 12/2016 | Qian et al. |
| 2017/0064436 | A1 | 3/2017 | Tamura et al. |

FOREIGN PATENT DOCUMENTS

| | | | |
|---|---|---|---|
| CN | 1964577 | A | 5/2007 |
| CN | 101595738 | A | 12/2009 |
| EP | 0 690 654 | A2 | 1/1996 |
| EP | 1 874 078 | A1 | 1/2008 |
| EP | 2 028 874 | A1 | 2/2009 |
| JP | 4-319841 | A | 11/1992 |
| JP | 10-257145 | A | 9/1998 |
| JP | 2000-244621 | A | 9/2000 |
| JP | 2002-112377 | A | 4/2002 |
| JP | 2010-206765 | A | 9/2010 |
| WO | 00/01199 | A1 | 1/2000 |
| WO | 2016/092817 | A1 | 6/2016 |

OTHER PUBLICATIONS

K Multifunctional V4.2 stereo bluetooth headset sport earphone cool earbuds for girls mini style with great price, URL=http://www.dhgate.com/product/k-multifunctional-v4-2-stereo-bluetooth-headset/396797940.html, download date Jun. 19, 2017, 3 pages.

* cited by examiner

ATTACHMENT APPARATUS

RELATED APPLICATIONS

This application is a continuation of U.S. application Ser. No. 15/494,112 entitled "ATTACHMENT APPARATUS," filed on Apr. 21, 2017, which claims the benefit of priority to U.S. Provisional Application No. 62/325,904 entitled "HEAD-WORN AUDIO SYSTEM," filed on Apr. 21, 2016; U.S. Provisional Application No. 62/395,303 entitled "ATTACHMENT APPARATUS," filed on Sep. 15, 2016; U.S. Provisional Application No. 62/430,315 entitled "ATTACHMENT APPARATUS," filed on Dec. 5, 2016; U.S. Provisional Application No. 62/474,521 entitled "ATTACHMENT APPARATUS," filed on Mar. 21, 2017, the entire contents of all of the foregoing hereby incorporated by reference.

BACKGROUND

Users of wearable audio systems—such as headphones and earphones—can choose between several different styles. However, current wearable audio systems typically utilize one of only a few common attachment mechanisms to secure these systems to the user. For example, one type of wearable audio system can be attached to a user's head via a headband that maintains the position of speakers on either side of the user's head. Another type of wearable audio system can be attached to a user's head by clipping the system to the back of the user's ear. Yet another type of wearable audio system can be attached to the user by inserting the system into the user's ear canal. Current attachment mechanisms, including those described above, are often uncomfortable to wear, provide a suboptimal listening experience, or both. As such, developing an attachment mechanism that achieves a strong attachment to a user and that improves the user's comfort and overall listening experience continues to be a design challenge.

SUMMARY

Various embodiments provide for an attachment apparatus configured to couple to an ear of a user. In some embodiments, the attachment apparatus may include an attachment body. The attachment body may include a plate member and a bridging member, an engaging portion coupled to a mid-ear portion of the plate member, and a hooking body coupled to the bridging member. In such embodiments, the engaging portion may be configured to protrude from the mid-ear portion of the plate member in a direction towards the hooking body, the engaging portion and the hooking body may be configured to define a first space suitable for receiving an interior portion of the ear, and the plate member and the hooking body may be configured to define a second space suitable for receiving a posterior portion of the ear. In some embodiments, while the attachment apparatus is secured to the ear of the user, the bridging member may be configured to engage a root of an upper portion of the ear, the hooking body may be configured to engage a root of the posterior portion of the ear positioned in the second space, the engaging portion may be configured to protrude into an interior portion of the ear and to engage the interior portion of the ear proximal to the hooking body, and the hooking body and the engaging portion are collectively configured to apply a compressive force to at least part of the interior portion of the ear positioned in the first space.

In some embodiments, the attachment apparatus may include a sealing body coupled to the plate member, and the sealing body may be configured to define a chamber suitable for encapsulating the hooking body and at least a portion of the ear while the attachment apparatus is secured to the ear. The attachment apparatus may include a speaker system coupled to a side of the mid-ear portion of the plate member that does not face a median plane of the user. In some embodiments, the engaging portion may be configured to receive a force from an anterior portion of the ear while the posterior portion of the ear is passing through the second space and move in a direction towards the plate member in response to receiving the force from the anterior portion of the ear. In such embodiments, the force received by the engaging portion from the anterior portion of the ear may be removed or substantially reduced when at least a majority of the posterior portion of the ear passes through the second space, and the engaging portion may be configured to move into engagement with an interior portion of the ear in proximity to the hooking body when the force is removed or substantially reduced.

Various embodiments may further provide for an attachment apparatus that includes an attachment body having a first engaging portion and a hooking body coupled to the attachment body. In such embodiments, the first engaging portion and the hooking body may be configured to define a first space suitable for receiving an interior portion of the ear, the attachment body and the hooking body may be configured to define a second space suitable for receiving a posterior portion of the ear, the hooking body and the first engaging portion may be collectively configured to secure the attachment apparatus to at least part of the interior portion of the ear positioned in the first space, and the hooking body may be configured to secure the attachment apparatus to at least part of the posterior portion of the ear that is positioned in the second space. In some embodiments, the first engaging portion may be configured to protrude from the attachment body in a direction towards the hooking body that intersects with a directional plane of the attachment body. In some embodiments, the first engaging portion may be configured to engage a surface of the interior portion of the ear proximal to the hooking body and configured not to engage a surface of the interior portion of the ear distal to the hooking body. In some further embodiments, the first engaging portion and the hooking body may be collectively configured to apply a compressive force to at least part of the interior portion of the ear positioned in the first space.

In some embodiments, the hooking body may be configured to move between an initial configuration and a deformed configuration in response to receiving an external force, the external force may cause the hooking body to move in a direction towards the first engaging portion, and a dimension of the first space defined by the hooking body and the first engaging portion may be smaller while the hooking body may be configured in the deformed configuration than while the hooking body may be configured in the initial configuration. In some embodiments, the attachment apparatus may include a second engaging portion, the first engaging portion may be configured to protrude in a first direction that intersects with a directional plane of the plate member, the second engaging portion may be configured to protrude in a second direction that intersects with the directional plane of the plate member, and the first direction may be distinct from the second direction. In some embodiments, the attachment apparatus may include a second engaging portion, the first engaging portion may be configured to engage a first portion of the interior portion of the ear, and the second engaging portion may be configured to engage a second portion of the interior portion of the ear distinct from the first portion of the interior portion of the ear.

In some embodiments, when the attachment apparatus is secured to the ear, the first engaging portion may be configured to at least partially restrict movement of the attachment apparatus in a first direction, the hooking body may be configured to at least partially restrict movement of the attachment apparatus in a second direction, the first direction is at least substantially parallel to a directional plane of the attachment body, and the second direction is at least substantially perpendicular to the directional plane of the attachment body. In some embodiments, while the attachment apparatus is secured to the ear, at least one of an anterior portion or the interior portion of the ear may engage with and cause the first engaging portion to move in a direction towards the attachment body, and while displaced in the direction towards the attachment body, the first engaging portion may urge the attachment apparatus away from the ear, thereby causing the hooking body to one of engage or further engage the posterior portion of the ear. In some embodiments, while the attachment apparatus is secured to the ear, at least one of an anterior portion or the interior portion of the ear may engage with and cause the first engaging portion to move in a direction towards the attachment body, and while displaced in the direction towards the attachment body, the first engaging portion may cause the attachment apparatus to pivot towards a face of the user.

In some embodiments, the first engaging portion may be configured to define an opening, and the opening may be configured to enable sound to pass through the opening. In such embodiments, the attachment apparatus may also include a speaker system coupled to the attachment body and configured to output sound through the opening of the first engaging portion. The speaker system may be coupled to a side of the attachment body facing away from a median plane of the user, and the first engaging portion may be coupled to a side of the attachment body facing the median plane of the user. In some embodiments, the first engaging portion may be configured to transition between an initial configuration and a displaced configuration in response to receiving an external force, and the first engaging portion may receive the external force from an anterior portion of the ear while the posterior portion of the ear is passing through the second space. In such embodiments, when the first engaging portion is configured in the displaced configuration, the first engaging portion may be configured to urge the attachment apparatus in a direction away from the median plane of the user, and the hooking body may be configured to at least partially restrict movement of the attachment apparatus in the direction. In some further embodiments, the force received by the first engaging portion from the anterior portion of the ear may be removed or at least partially reduced when at least a majority of the posterior portion of the ear passes through the second space, and the first engaging portion may be configured to move into engagement with at least part of the interior portion positioned in the first space when the force is removed.

In some embodiments, the first engaging portion may be configured to at least partially restrict movement of the attachment apparatus while the attachment apparatus is secured to the ear by engaging the interior portion of the ear. In such embodiments, the movement that is restricted may be at least one of a rotational movement of the attachment apparatus around a first directional axis at least substantially perpendicular to a median plane of the user, or a linear movement of the attachment apparatus in at least one of a second directional axis and a third directional axis distinct from the second directional axis. In such embodiments, the second directional axis and the third directional axis may be at least substantially parallel to the median plane of the user.

Various embodiments may further provide for a system that includes a first attachment apparatus. The first attachment apparatus may include an attachment body having an engaging portion and a hooking body coupled to the attachment body. In such embodiments, the engaging portion and the hooking body may be configured to define a first space suitable for receiving an interior portion of the ear, the attachment body and the hooking body may be configured to define a second space suitable for receiving a posterior portion of the ear, the hooking body and the engaging portion may be collectively configured to secure the attachment apparatus to at least part of the interior portion of the ear positioned in the first space, and the hooking body may be configured to secure the attachment apparatus to at least part of the posterior portion of the ear that is positioned in the second space.

In some embodiments, the first attachment apparatus may include a compliant member coupled to the engaging portion. While the first attachment apparatus is secured to the ear of the user, the compliant member may engage and may be deformed to a first extent by a force received from at least a part of the interior portion of the ear positioned in the first space. In such embodiments, the compliant member may be configured to at least substantially conform to a shape of at least part of the interior portion of the ear positioned in the first space in response to receiving the force. In some embodiments, the compliant member may be configured to transfer a portion of the force received from at least part of the interior portion of the ear to the engaging portion, the engaging portion may be configured to deform to a second extent by the portion of the force received from the compliant member force, and the first extent to which the compliant member deforms may be greater than the second extent to which the engaging portion deforms. In some embodiments, an elasticity of the compliant member may be greater than an elasticity of the engaging portion.

In some embodiments, the system may also include a second attachment apparatus. In such embodiments, the second attachment apparatus may be configured as a mirror image of the first attachment apparatus. In some embodiments, the first attachment apparatus may include a first coupling device, and the second attachment apparatus may include a second coupling device. In such embodiments, the second coupling device may be configured to couple to the first coupling device.

BRIEF DESCRIPTION OF THE DRAWINGS

The foregoing embodiments and many of the attendant advantages will become more readily appreciated as the same become better understood by reference to the following detailed description, when taken in conjunction with the accompanying drawings, wherein.

DETAILED DESCRIPTION

Figure 1A:
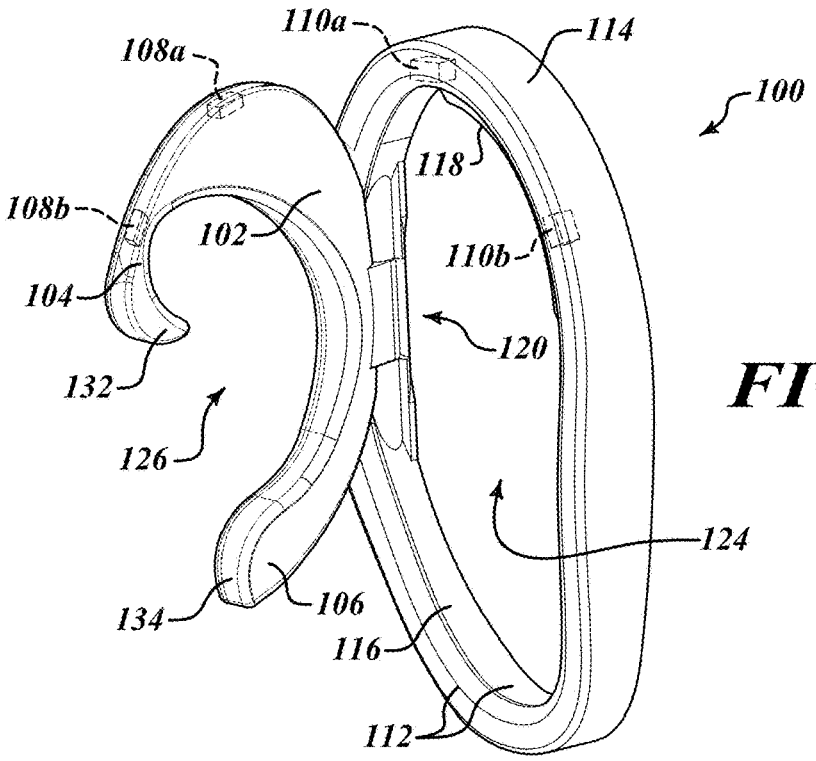
FIGS. 1A-1D are exterior views of an attachment apparatus, according to some embodiments.

Various embodiments of the attachment apparatus may be described with reference to certain anatomical features of a human user's ear. For ease of reference, the anatomical features of a user's ear may be referred to in this disclosure using the following terms. The term "root of an ear" refers to a portion of the ear that is proximal to the user's head. Specifically, the root of a user's ear may be a portion or structure of the ear that secures the ear to the user's head. Also, as used herein, the term "outer ear" refers to the portion of the ear that is distal to the user's head as compared to the root of the ear. The outer ear may include or otherwise be defined by at least a portion of the ear's auricle, helix, and/or lobule. Typically, the perimeter of the outer ear of an ear is greater than the perimeter of the root of the ear. The term "upper root portion of the ear" generally refers to a portion of the root of the ear that is proximal to the top of the user's head. In contrast, the term "lower root portion of the ear" refers to a portion of the root of the ear that is distal to the top of the user's head. Further, the terms "front of an ear" and "anterior portion of an ear" are used interchangeably and refer to a portion of the ear that is proximal to a user's face and distal to the back of the user's head. The front of the ear may include portions of the helix, the antihelix, tragus, and antitragus that are proximal to the user's face. The term "anterior root portion of the ear" generally refers to a portion of the root of the ear corresponding to the anterior portion of the ear. The terms "back of an ear" and "posterior portion of an ear" are used interchangeably and refer to a portion of the ear that is proximal to the back of the user's head and distal to the user's face. The back of the ear may include portions of the helix and the antihelix proximal to the back of the user's head. Similarly, the term "posterior root portion of the ear" generally refers to a portion of the root of the ear corresponding to the posterior portion of the ear. The term "interior portion of an ear" refers to a portion of the outer ear proximal to, but not including, the ear canal. The interior portion of an ear may include, without limitation, at least part of one or more of the concha, anti-helix, anti-tragus, and tragus. Further descriptions and references to the foregoing terms are provided herein.

As generally described above, current attachment mechanisms used to secure wearable audio systems to users are often suboptimal. For example, some wearable audio systems implement a type of attachment mechanism commonly referred to as an "over-the-ear" design. A wearable audio system that utilizes an over-the-ear design is worn by a user by placing ear cups of the wearable audio system over and around the ears of the user. The ear cups are coupled to a headband positioned on the top or to the back of the user's head. The headband applies a compressive force to the user's head in order to secure the ear cups to the user, often resulting in headaches or general discomfort over time. This pressure is especially noticeable in some over-the-ear wearable audio systems that apply a substantial amount of pressure on the user to ensure that an acoustic seal is formed around the ear cups.

Other suboptimal wearable audio systems are also available. For example, some wearable audio systems are secured to users via insertion into users' ear canals. Often, such wearable audio systems cause users to experience discomfort over time by exerting a constant pressure against the ear canal walls. Further, while these systems can acoustically isolate the inner ear from external sounds, the seal is formed inside the ear canal, leading to an increased risk that audio played from such systems and directed into the ear canal will cause users to suffer hearing damage.

In overview, aspects of the present disclosure include attachment apparatuses and wearable audio systems that include attachment mechanisms that feature improvements over current attachment mechanisms, such as those described above. Specifically, according to various embodiments described herein, such attachment apparatuses may enable users to secure the attachment apparatuses to the users' ears more easily than currently available attachment mechanisms. Additionally (or alternatively), users may wear such attachment apparatuses with less discomfort than currently available attachment mechanisms.

In some embodiments, an attachment apparatus may include an attachment body that secures the attachment apparatus to at least an upper root portion of the user's ear and a posterior root portion of the user's ear. The attachment body may be coupled to a sealing body via a joint (e.g., a hinge or the like) that limits the range of movement of the sealing body in relation to the attachment body. While the attachment body is secured to the user's ear, the attachment apparatus may be configured in an open configuration in which the sealing body is rotated or otherwise positioned away from the attachment body, and in some instances, may be biased away from engagement with the attachment body. The attachment apparatus may transition from an open configuration to a closed configuration in which the sealing body physically engages the attachment body by an external force or a biasing member (e.g., torsional spring). While the attachment apparatus is configured in a closed configuration, the sealing body (and, in some embodiments, the attachment body) may form at least a partial acoustic seal around the user's ear.

In some embodiments, the attachment body may be secured to the user's ear by placing the attachment body around some of all of the root of the user's ear, such as by sliding the user's ear through an opening formed between respective ends of first and second attachment portions of the attachment body. The first attachment portion of the attachment body may be shaped to conform substantially to the upper root portion of the user's ear. By way of a non-limiting example, the first attachment portion may have a curved shape suitable for wrapping or hooking around the upper root portion of the user's ear. The second attachment portion of the attachment body may be shaped to conform, at least substantially, to a posterior portion of the root of the ear. In such embodiments, the second attachment portion may be configured to engage physically at least the posterior root portion of the user's ear. The first attachment portion and second attachment portion may be configured to counterbalance each other to reduce or limit movement of the attachment body around the user's ear. For example, the first attachment portion may secure the attachment body to the user's ear (e.g., as described above), and the second attachment portion may act as a counterweight to the first attachment portion in order to stabilize the attachment of the attachment body to the user's ear. Further, the force resulting from the interaction between the user's ear and the first and second attachment portions of the attachment body may be substantially distributed to at least the upper and lower portions of the user ear, thereby providing the user with a secure attachment to the attachment apparatus with minimal discomfort.

The attachment body may be made from various elastic or non-elastic materials or combinations thereof. In some embodiments, the attachment body may be configured to apply a compressive force between the first and second attachment portions when a tensile or other external deforming force is removed from the attachment body. For example, the attachment body may be stretched or pulled apart, which may cause a distance between the respective ends of the first and second attachment portions to increase in at least one dimension. As a result of stretching or other deformation of the attachment body, the attachment body may transition from a resting configuration in which the attachment body exerts little or no compressive force between the first and second attachment portions to a deformed configuration in which the attachment body exerts compressive force (or a larger amount of compressive force) between the first and second attachment portions. In such embodiments, while the attachment body is stretched, at least one dimension of the opening formed between respective ends of the first and second attachment portions may be larger, thereby enabling the attachment body to engage the user's ear more easily. Because the attachment body returns to the resting configuration when the tensile or other deforming force is removed, at least one dimension of the opening may decrease, thereby preventing the user's ear from passing back through the opening easily and, as a result, further securing the attachment apparatus to the user.

As described, the sealing body may be coupled to the attachment body via a joint. As used herein, the term "joint" may generally refer to a mechanism or device that couples the sealing body to the attachment body and that enables the sealing body to move (e.g., pivot, rotate) in a direction towards and a direction away from engagement with the attachment body. For example, a joint may include a pin hinge, a ball-and-socket joint, a tension hinge, other mechanical hinge, or one of various other types of devices configured to movably couple the attachment body and the sealing body together and configured to limit the movement of the sealing body in relation to the attachment body. In some embodiments, the joint may be configured to enable the attachment apparatus to transition between an open configuration and a closed configuration. When the attachment apparatus is in an open configuration, the sealing body is moved away from engagement with the attachment body. For example, the sealing body may receive a force that causes the sealing body to swing away from the attachment body about the joint. When the attachment apparatus is in a closed configuration, the sealing body and the attachment body are physically engaged. For example, the sealing body may receive a force that causes the sealing body to move in a direction towards the attachment body until the sealing body physically engages the attachment body in a closed configuration. In some instances, a biasing member (e.g., torsional spring) may be provided to urge the attachment apparatus into an open configuration and one or more locking features may be provided to hold the attachment apparatus in a closed configuration against the force of the biasing member. In other instances, a biasing member (e.g., torsional spring) may be provided to urge the attachment apparatus into a closed configuration and a user may be required to overcome the force of the biasing member in order to transition the attachment apparatus to an open configuration.

In some embodiments, each of the attachment body and the sealing body may include one or more coupling devices. In such embodiments, one or more first coupling devices of the sealing body may be configured to engage one or more second coupling devices of the attachment body in order to fasten or otherwise secure the sealing body to the attachment body. Accordingly, in some embodiments, the attachment apparatus may be deemed to be in a closed configuration when the one or more first coupling devices engage the one or more second coupling devices, and the attachment apparatus may be deemed to be in an open configuration when the one or more first coupling devices are released from or are not otherwise engaged with the one or more second coupling devices.

In some further embodiments, while the attachment body is coupled to the user's ear and while the attachment apparatus is in a closed configuration, a surface of the attachment body proximal to the median plane of the user may be flush or substantially flush with a surface of the sealing body that is proximal to the median plane of the user's body. Thus, while the attachment apparatus is in a closed configuration, the surface of the sealing body proximal to the median plane of the user's body may engage the user's anatomy and form at least a partial acoustic seal around the root of the user's ear. Additionally (or alternatively), the surface of the attachment body proximal to the median plane of the user's body may form at least a partial acoustic seal around the user's ear.

In some embodiments, while the attachment apparatus is closed and secured to the user's ear, an elastic or semi-elastic biasing portion of the sealing body may physically engage or otherwise contact the area around the user's ear and be compressed against the head of the user. While the attachment apparatus is in a closed configuration and secured to the user's ear, the biasing portion of the sealing body may attempt to return to its non-compressed configuration through expansion, stretching, or other spring-like movement. However, because the attachment body and sealing body are firmly secured to the user's ear, the biasing portion of the sealing body may remain in a compressed state as long as the attachment apparatus is configured in a closed configuration. As such, the biasing portion of the sealing body may continuously press against the user's body while in the compressed state, thereby forming at least a partial acoustic seal around the user's ear while the attachment apparatus is in a closed configuration.

In some embodiments, the attachment apparatus may include a cover body coupled to the sealing body. In such embodiments, the cover body and the sealing body may define a chamber. The chamber may be configured to accommodate the user's ear while the attachment apparatus is secured to the user and while the attachment apparatus is configured in a closed configuration. Specifically, once the user's ear passes through the opening defined by the attachment body and while the attachment apparatus is in a closed configuration, the user's ear may be positioned substantially in the chamber formed by the sealing body and the cover body. In such embodiments, the sealing body and the cover body may substantially encapsulate the ear of the user. As a result, the sealing body and the cover body may collectively form an acoustic seal, entirely or substantially, around the user's ear. For example, the sealing body may engage the user's anatomy to form a partial acoustic seal against the user, and the material structures of the cover body and the sealing body may prevent (or reduce) ambient sound external to the chamber from reaching the user's ear.

In some embodiments, the attachment body may be configured to reduce or limit movement of the attachment apparatus once the attachment body is secured to the ear of the user. Specifically, as described, the attachment body may form an opening between the first and second portions of the attachment body that may enable a majority of the user's ear to pass through the opening. The first attachment portion may then be hooked or attached to the upper root portion of the user's ear, and the second attachment portion may simultaneously engage the posterior root portion of the user's ear. While the attachment body is secured to the user's ear, at least the first attachment portion of the attachment body may be configured to limit or prevent clockwise and/or counterclockwise rotation of that attachment apparatus about the user's ear. In such embodiments, the attachment body may be configured to reduce or prevent clockwise rotation of the attachment apparatus for a left ear device and counterclockwise rotation of the attachment apparatus for a right ear device while the attachment apparatus is in either an open configuration or a closed configuration. Further, while secured to the ear, the first and second attachment portions of the attachment body may keep the attachment apparatus from being removed from the ear of the user.

In some embodiments, the attachment body and the sealing body may be configured, collectively, to prevent or reduce both counterclockwise and clockwise rotation of the attachment apparatus around the user's ear. Specifically, while the attachment apparatus is in a closed configuration, the attachment body may be configured to engage the user's ear physically such that clockwise rotation of the attachment apparatus is limited or prevented for a left ear device and counterclockwise rotation of the attachment apparatus is limited or prevented for a right ear device (e.g., as described above). At the same time, the sealing body may be configured to engage the user's ear physically (e.g., at least a lower root portion of the user's ear) in order to prevent or limit rotation of the attachment apparatus around the user's ear in the opposite rotational direction (i.e., counterclockwise for a left ear device and clockwise for a right ear device). While the attachment apparatus is in an open configuration, the sealing body may not engage the user's ear (or may engage the user's ear to a lesser extent), and as a result, the sealing body may not prevent or limit such rotation of the attachment apparatus of the attachment apparatus around the user's ear in the opposite rotational direction or may limit rotation to a lesser extent than when the attachment body is in a closed configuration.

According to some embodiments, the attachment apparatus for an example left ear device may be secured to the ear of the user by configuring the attachment apparatus in an open configuration, hooking the attachment body to the upper root portion of the user's ear, and rotating the attachment body clockwise until the second portion of the attachment body engages the posterior root portion of the user's ear. Once the second portion of the attachment body engages the posterior root portion of the user's ear, the attachment body may not be able to continue rotating clockwise around the user's ear. The attachment apparatus may be transitioned to a closed configuration by moving (e.g., swinging) the sealing body towards engagement with the attachment body until the sealing body fastens to or otherwise engages the attachment body. In such embodiments, a surface of the sealing body may form at least a partial acoustic seal around the ear of the user while the attachment apparatus is in a closed configuration. The attachment apparatus may be unsecured and removed from the user's ear by performing the inverse of the above steps. Specifically, the attachment apparatus may be transitioned from a closed configuration to an open configuration by unfastening or disengaging the sealing body from the attachment body and moving (e.g., swinging) the sealing body away from engagement with the attachment body. The attachment apparatus may then be removed from the user's ear in part by rotating the attachment body counterclockwise to disengage the first and/or second portions of the attachment body from the user's ear.

In some embodiments, the attachment apparatus may be configured as a wearable audio system. In such embodiments, the cover body may include one or more audio components. By way of non-limiting examples, the audio components may include a speaker system, memory, a processing unit (e.g., a digital signal processor or central processing unit), a transceiver configured to receive audio data from external computing devices, or the like. The cover body may be coupled to the sealing body such that a speaker is positioned in proximity to an ear canal of the user's ear. Further, because the cover body and the sealing body may collectively form an acoustic seal around the user's ear, the attachment apparatus may provide the user with an exceptional audio experience because external sounds are blocked (or reduced) from reaching the user's ear when the attachment apparatus is secured to the user's ear and configured in a closed configuration.

In some alternative (or additional) embodiments, the attachment apparatus may include an attachment body that is coupled to a hooking body. The attachment body may include a plate member and a bridging member. The hooking body may include a deformable core and a cushioning portion. The plate member may optionally include a mid-ear portion that may be suitable for mounting other components (e.g., a speaker system). The plate member may include one or more facets configured to enable various components (e.g., batteries, printed circuit boards, etc.) or chassis to be mounted to the plate member.

The deformable core may be a deformable metal piece (e.g., a metal rod) that is embedded within the cushioning portion of the hooking body. The cushioning portion of the hooking body may be configured to come into physical contact with the user's ear while the attachment apparatus is secured to the user's ear. A first end of the deformable core may be embedded within the bridging member to anchor the hooking body to the bridging member and the plate member. A second end of the deformable core may not be coupled to a structure and thus may be free to be deformed, such as within the preconfigured range of movement. In some embodiments, the deformable core may not be resilient (or is minimally resilient) and thus may substantially remain in a position once moved to that position, in contrast to springs or other elastic components that may revert to an initial or resting position when external force is removed. The cushioning portion may optionally include a cutout portion that provides a tactile indication or guide to indicate to the user where to press against the hooking body to manipulate the position of the hooking body.

In some embodiments, a user may don the unit by sliding the user's ear through the space formed between the hooking body and the plate member of the attachment body until the hooking body (and/or the bridging member of the attachment body) engages a back surface of the user's ear (e.g., the surface of the posterior root portion of the ear). The user may then manually adjust the deformable core of the hooking body by moving the free end of the deformable core in at least one direction along at least one range of movement until the hooking body is comfortably secured to the user's ear. In such embodiments, because the deformable core of the hooking body is not resilient (or is only minimally resilient), the hooking body may remain in the position set by the user until the user doffs the unit or further adjusts the position of the hooking body (e.g., via a pulling or pushing force applied directly or indirectly to the hooking body).

In some embodiments, the attachment apparatus may include an attachment body, a hooking body, and a sealing body. In such embodiment, the sealing body and the hooking body may be configured collectively to ensure that the attachment apparatus is comfortably and securely attached to the user's ear, while also providing at least partial encapsulation of the user's ear by forming at least a partial acoustic seal around or against the user's ear. In some embodiments, the sealing body may be coupled to an edge of the plate member (or, alternatively, to an optional sealing body frame that, in turn, is coupled to the plate member) to create a cavity that houses the bridging member of the attachment body, as well as the hooking body. In such embodiments, the user may insert the user's ear into the cavity created or defined by the sealing body such that a substantial portion of the ear is encapsulated within the space between the hooking body and the plate member (e.g., as described above). While the user is wearing the unit, the sealing body engages the area of the user's anatomy around the user's ear to form an acoustic seal.

In some embodiments, the sealing body may optionally include a cutout portion that is configured to provide the user with access to the hooking body while the user is wearing the attachment apparatus. Specifically, the cutout portion of the sealing body may enable the user to press the hooking body tightly against a back surface of the user's ear (e.g., using the user's thumb) to create a secure attachment. In such configurations, the sealing body and the back surface of the user's ear in proximity to the cutout portion may form at least a partial acoustic seal around the ear canal of the user's ear, thereby reducing or preventing ambient noise from reaching the user's ear canal. In some embodiments, a surface of the sealing body may be coupled to a surface of the hooking body such that the sealing body is moved when the hooking body is biased. In some alternative embodiments, the sealing body may not be coupled to the hooking body, thereby enabling the hooking body to move independently of the sealing body, for example, in response to receiving a force from a user on the hooking body (either directly or indirectly by pushing the sealing body).

In some embodiments, an optional mid-ear portion of the plate member may be configured to engage the anterior portion of the user's ear when the attachment apparatus is secured to the user's ear. Specifically, while the user is wearing the unit, the bridging member may engage and secure the user's ear. Additionally, the user's ear may bias the mid-ear portion of the earpad away from the user's ear. Accordingly, the mid-ear portion may cause the unit to pivot about the bridging member such that the unit is urged towards the face of the user. Further, at least the mid-ear portion of the earpad may be configured to allow sound to pass through from a speaker mounted, directly or indirectly, to the attachment body to reach the user's ear canal.

In some additional (or alternative) embodiments, the mid-ear portion may include one or more engaging portions configured (individually or collectively) to secure (or further secure) the attachment apparatus to a user's ear. The one or more engaging portions may be configured to limit movement of the attachment apparatus about the user's ear by engaging or extending into an interior portion of the user's ear while the attachment apparatus is secured to the user's ear. In some embodiments, the one or more engaging portions may be configured so that a space is formed between the hooking body and the one or more engaging portions. The space may accommodate a portion of the user's ear that is securely held between the hooking body and the one or more engaging portions. In some embodiments, the hooking body may be urged towards the one or more engaging portions while the user's ear is occupying the space, thereby increasing a compressive force applied to the user's ear by the hooking body and the one or more engaging portions that further secures the attachment apparatus to the user's ear.

In some embodiments in which the one or more engaging portions are made from or includes elastic material or materials, the one or more engaging portions may be configured to be moved form a resting configuration by a portion of the user's ear while the attachment apparatus is being attached to a user's ear or while the attachment apparatus is attached to the user's ear. For example, the user's tragus may press against the one or more engaging portions while the user's ear is partially inserted into the space formed between the one or more engaging portions and the hooking body, causing the one or more engaging portions to be biased away from the user's ear. Once the user's ear is inserted fully into the space (e.g., when the root of the ear contacts the hooking body), the portion of the user's ear that was biasing the one or more engaging portions may be removed from and no longer engage the one or more engaging portions, or may engage the one or more engaging portions to a lesser extent. As a result, the one or more engaging portions may elastically transition from a displaced configuration to an initial or resting configuration in which the one or more engaging portions protrude into or engage with (at least substantially) the interior portion the user's ear outside of the ear canal. Once inserted in or engaged with the interior portion of the user's ear, the one or more engaging portions may secure or further secure the attachment apparatus to the ear.

In some embodiments, at least the hooking body of an attachment apparatus may include one or more magnets. In such embodiments, a first attachment apparatus may be configured to magnetically couple to a second attachment apparatus that is a mirror image of the first attachment apparatus. By way of a non-limiting example, the first attachment apparatus may be configured to be secured to a left ear of a user, and the second attachment apparatus may be configured to be secured to a right ear of a user (or vice versa). In such embodiments, a first magnetic element included in a first hooking body of the first attachment apparatus may be configured to magnetically couple to a second magnetic element included in a second hooking body of the second attachment apparatus. Further, in response to receiving a force that decouples the first and second hook bodies, the first and second hook bodies may each be configured to move in a direction opposite of the attachment body (or, in other words, in the opposite direction of the separating force that is received) until a threshold separating force is reached to overcome the magnetic attraction. Specifically, the first and second hook bodies may be held together while the separating force is being applied to the first and second attachment apparatuses as a result of the magnetic attraction of the magnetic elements included in the first and second hook bodies until the separating force overcomes the magnetic attraction. Once decoupled, the first and second hook bodies may not revert to a previous position (or may revert only slight). Thus, in such embodiments, the separating force may cause the first and second hook bodies to transition to an open configuration that may be suitable (or more suitable) for enabling a user to insert the user's ears into the spaces between the respective hook bodies and their corresponding attachment bodies than when the first and second hook bodies are not in an open configuration (e.g., while the first and second hook bodies are biased towards their respective attachment bodies). Once the user's ears are inserted into the attachment apparatuses, the user may then adjust the first and/or second hook bodies to create a secure and comfortable attachment to the user's ears.

Various embodiments will be described in detail with reference to the accompanying drawings. Wherever possible, the same reference numbers will be used throughout the drawings to refer to the same or like parts. References made to examples and implementations are for illustrative purposes and are not intended to limit the scope of the invention or the claims.

FIGS. 1A-1D illustrate exterior views of an attachment apparatus 100, according to some embodiments. The attachment apparatus 100 may include a plurality of structural features, including without limitation: an attachment body 102, a joint 120, and a sealing body 112. The attachment body 102 may include a first attachment portion 104, a second attachment portion 106, and one or more coupling devices, such as coupling devices 108*a* and 108*b*. The sealing body 112 may include sealing material 114, a sealing frame 116, and one or more coupling devices, such as coupling devices 110*a* and 110*b*. The various features of the attachment apparatus 100 are further described as follows.

Figure 1B:
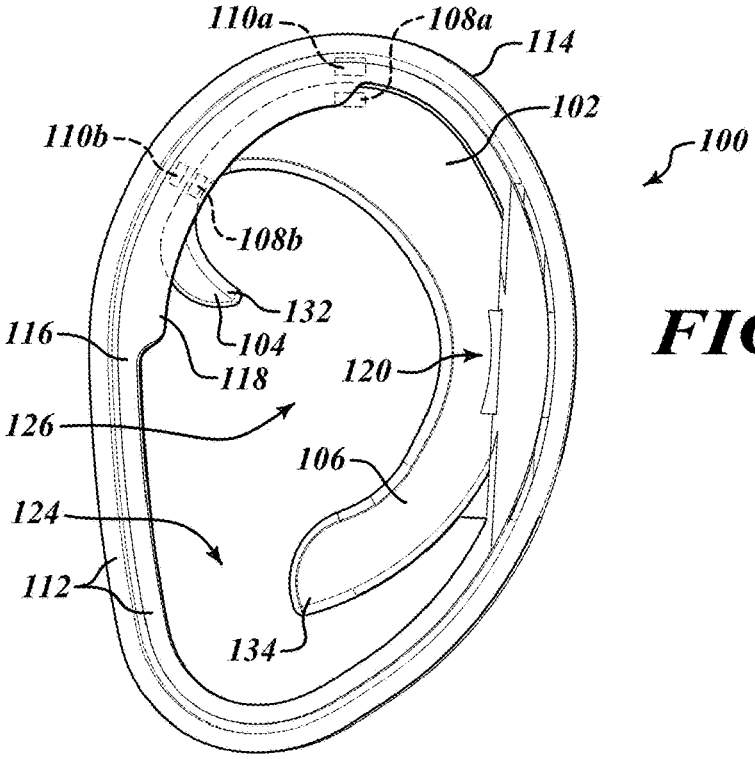

FIG. 1A illustrates an exterior view of a front side of the attachment apparatus 100 while the attachment apparatus 100 is configured in an open configuration, and FIG. 1B illustrates an exterior view of the front side of the attachment apparatus 100 while the attachment apparatus 100 is configured in a closed configuration, according to some embodiments. With reference to the examples illustrated in FIGS. 1A and 1B, the attachment body 102 of the attachment apparatus 100 may be configured to have a shape that approximates a profile of a root of a human ear. This shape may be referred to generally as a C-shape. The first attachment portion 104 of the attachment body 102 may generally correspond to a top portion of the attachment body 102 that, when secured to a user's ear, is positioned proximal to the top root portion of the user's ear. The second attachment portion 106 of the attachment body 102 may generally correspond with a back and/or bottom portion of the attachment body 102. When the attachment body 102 is secured to the user's ear, the second attachment portion 106 may be positioned proximal to and/or may engage a surface of the back and/or bottom root portion of the user's ear.

Each of the first attachment portion 104 and the second portion 106 may, in some embodiments, include an end portion. In the example illustrated in FIG. 1A, an end 132 of the first attachment portion 104, an end 134 of the second attachment portion 106, and the attachment body 102 may, at least in part, define an opening 126. Specifically, the attachment body 102 may be configured such that the opening 126 enables a portion of a human ear to pass through the opening 126 and enables surfaces of the root of the ear to come into physical contact with one or more surfaces of the attachment body 102. In some embodiments, the perimeter or size of opening 126 may be greater than the perimeter or size of the root of a user's ear. Additionally, the perimeter or size of the opening 126 may be less than the perimeter or size of the perimeter or size of the outer portion of a human ear, which may aid in securing the attachment body 102 to the user's ear. Securing the attachment body 102 to a user's ear is further described herein (e.g., with reference to FIGS. 2A-2C).

The sealing frame 116 of the sealing body 112 may be configured to have a shape that, at least substantially, conforms to the profile shape of the outer ear of a user. In some embodiments, the sealing frame 116 may have a roughly elliptical shape, such as a D-shape. The sealing frame 116 may define an opening 124 within the sealing body 112. The opening 124 may be suitable for allowing a majority of the outer portion of a human ear to pass through the opening 124. In such embodiments, the perimeter of the opening 124 may generally be larger than the perimeter of the outer ear of the user's ear in order to enable a majority of the outer portion of the human ear to pass through the opening 124. The perimeter or size of the opening 124 may also be larger than the perimeter or size of the opening 126 in the attachment body 102. The sealing frame 116 may be made from elastic, semi-elastic, or non-elastic materials, such as rubber, metal, wood, plastic, or a combination thereof. In some embodiments, the sealing frame 116 may be coupled to a cover body (not shown in FIGS. 1A-1D) that, in conjunction with the sealing body 112, encapsulates or substantially encapsulates the user's ear (e.g., as generally described with reference to FIG. 3A-4B).

The sealing body 112 may include the sealing material 114. The sealing material 114 may be made from one or more materials that may be suitable for forming at least a partial acoustic seal around the ear of a user. By way of a non-limiting example, the sealing material 114 may include one or more of rubber, foam, soft plastic, polystyrene, silicone, or one or more other sound- or vibration-absorbing materials or combinations of materials. The sealing frame 116 may be coupled to the sealing material 114. For example, the sealing material 114 may be coupled to the sealing frame 116 via mechanical fasters, adhesives, overmolding, or the like. In some embodiments, the sealing material 114 may be coupled to the sealing frame 116 such that the sealing frame 116 is at least partially covered by the sealing material 114. For example, as illustrated in the examples depicted in FIGS. 1A and 1B, the sealing material 114 may be coupled or applied to one or more surfaces of the sealing frame 116 (e.g., a surface proximal to the median plane of the user when the attachment apparatus 100 is secured to the user). In this example, the sealing material 114 may be positioned on the sealing frame 116 in a way that enables or enhances the ability of the sealing material 114 to form at least a partial acoustic seal against the user's body when the attachment apparatus 100 is secured to the user's ear. In a further example, the sealing material 114 may not cover or may only partially cover a surface of the sealing frame 116 distal from the attachment body 102 in order to enable a cover body (e.g., as illustrated in FIGS. 3A-4B) to be coupled to the sealing frame 116. Additionally, the sealing material 114 may not be coupled to a surface of the sealing frame 116 that is proximal to the opening 124 to enable the attachment body 102 to fit within a grooved area of the sealing frame 116 (e.g., a groove 118), which may define a ledge or other structure that the attachment body 102 may abut when in a closed configuration, as further described herein.

The sealing frame 116 and the sealing material 114 may be made from the same material or combination of materials, or from different materials or combinations of materials. In some embodiments, the sealing frame 116 and the sealing material 114 may be formed or molded as a single structural component. In such embodiments, a portion of the sealing frame 116 may be configured to be suitable for forming at least a partial acoustic seal around the ear of the user without separately requiring the sealing material 114.

In some embodiments, the sealing frame 116 of the sealing body 112 may be coupled to the attachment body 102 via the joint 120. For example, the joint 120 may be one of various types of hinges (e.g., a tension hinge), or other joints (e.g., a ball-and-socket joint), or the like. In some embodiments, the joint 120 may be configured to couple the sealing frame 116 of the sealing body 112 to the attachment body 102 so that movement of one of the sealing body 112 and the attachment body 102 is limited in relation to each other. Specifically, the joint 120 may be configured to enable the sealing body 112 to be moved (e.g., swung, rotated, or pivoted) away from the attachment body 102 to cause the attachment apparatus 100, for example, to transition from a closed configuration (e.g., as illustrated in FIG. 1B) to an open configuration (e.g., as illustrated in FIG. 1A). The joint 120 may also be configured to enable the sealing body 112 to be moved (e.g., swung, rotated, or pivoted) back towards the attachment body 102, for example, to transition the attachment apparatus 100 from an open configuration (e.g., as illustrated in FIG. 1A) to a closed configuration (e.g., as illustrated in FIG. 1B).

In some embodiments, the joint 120 may be configured to limit the extent to which the sealing body 112 and the attachment body 102 may be moved toward and away from each other. In the example illustrated in FIG. 1A, the position of the sealing body 112 relative to the attachment body 102 may depict the furthest extent to which the sealing body 112 may be moved away from the attachment body 102. Accordingly, in this example, the attachment apparatus 100 may be in a "fully open" configuration because the joint 120 is preventing the sealing body 112 from being moved further away from the attachment body 102. Because the sealing body 112 is prevented from being moved away from the attachment body 102 any further, the joint 120 may prevent a portion of the sealing body 112 from unintentionally contacting the user physically.

In some embodiments, the sealing frame 116 of the sealing body 112 may be configured to include a curved groove or channel (e.g., the groove 118) that extends along at least a portion of the sealing frame 116. The groove 118 may be a recessed area extending around at least a portion of the sealing frame 116, which may define a ledge or other structure that the attachment body 102 may abut when in the closed configuration. As illustrated in the example depicted in FIG. 1B, the groove 118 of the sealing frame 116 may be configured to accommodate at least a portion of the attachment body 102 when the attachment apparatus 100 is configured in the closed configuration. Specifically, at least one surface of the attachment body 102 may come into physical contact with at least one surface defined by the groove 118 while the attachment apparatus 100 is configured in the closed configuration. The groove 118 may be configured to have dimensions (e.g., a depth) suitable for accommodating the attachment body 102. For example, the groove 118 may be configured to have a depth that may accommodate the depth of the attachment body 102 (e.g., as further described with reference to FIG. 1D). The sealing material 114 may or may not be present within the groove 118. In some embodiments, the groove 118 may be configured to limit the extent to which the sealing body 112 can be moved towards the attachment body 102. Specifically, once the surface or surfaces of the attachment body 102 physically contacts the surface defined by the groove 118 of the sealing body 112 as described, the sealing body 112 may not be moved towards the attachment body 102 further. In this configuration, the attachment apparatus 100 may be deemed to be in a closed configuration.

In some embodiments, once the attachment body 102 has been positioned near or has physically contacted the sealing body 112, the coupling devices 108*a*, 108*b* may engage the coupling devices 110*a*, 110*b*. For example, the sealing body 112 may be moved towards the attachment body 102 along the range of movement enabled by the joint 120 until the coupling devices 108*a*, 108*b* physically engage the coupling devices 110*a*, 110*b*. In some embodiments, the attachment apparatus 100 may be deemed to be in a closed configuration while the coupling devices 108*a*, 108*b* have engaged the coupling devices 110*a*, 110*b*. Once engaged, the coupling devices 108*a*, 108*b*, 110*a*, 110*b* may be configured to resist forces that would otherwise separate the attachment body 102 and the sealing body 112 away from each other. In other words, the coupling devices 108*a*, 108*b*, 110*a*, and 110*b* may be configured to ensure that the attachment apparatus 100 enters and/or remains in a closed configuration. In some embodiments, the sealing body 112 may be moved away from the attachment body 102 by disengaging the coupling devices 108*a*, 108*b*, 110*a*, and 110*b*, thereby enabling the attachment apparatus 100 to transition from a closed configuration to an open configuration. This may include applying an external force to overcome a threshold resistive force provided by the coupling devices 108*a*, 108*b*, 110*a*, and 110*b*.

In some embodiments, the coupling devices 108*a*, 108*b* and the coupling devices 110*a*, 110*b* may be complementary fasteners. For example, the coupling devices 108*a*, 108*b* may be configured to mate physically with the coupling devices 110*a*, 110*b* via one or more attachment systems, such as male/female interlocking components, hook-and-loop fasteners, non-permanent or reusable adhesives, clips, pins, latches, detent mechanisms or the like. In such embodiments, the coupling devices 108*a*, 108*b*, 110*a*, 110*b* may include a release mechanism, such as a switch, lever, or the like that may unfasten the coupling devices 108*a*, 108*b*, 110*a*, 110*b* once they are fastened together. Alternatively (or additionally), once coupled together, the coupling devices 108*a*, 108*b*, 110*a*, 110*b* may be decoupled by pulling the sealing body 112 away from the attachment body 102 with a force that is greater than the resistive force provided by the coupling devices 108*a*, 108*b*, 110*a*, and 110*b*.

In some embodiments, the coupling devices 108*a*, 108*b*, 110*a*, 110*b* may include magnetic elements or have magnetic properties. The coupling devices 108*a* and 108*b* may be configured to have a magnetic polarity that is opposite of the magnetic polarity of the coupling devices 110*a* and 110*b*. As such, as the sealing body 112 is moved towards the attachment body 102, the coupling devices 108*a* and 110*a* and the coupling devices 108*b* and 110*b* may pull towards each other, thereby urging the sealing body 112 towards the attachment body 102. In embodiments in which the coupling devices 108*a*, 108*b*, 110*a*, 110*b* are affixed to a surface of the attachment body 102 and/or the sealing body 112, the coupling devices 108*a*, 108*b*, 110*a*, 110*b* may be configured to come into physical contact with each other as a result of the magnetic attraction. In alternative embodiments in which the coupling devices 108*a*, 108*b*, 110*a*, 110*b* are embedded within the attachment body 102 and/or the sealing body 112, the coupling devices 108*a*, 108*b*, 110*a*, 110*b* may not come into physical contact with each other but may instead cause portions of the attachment body 102 and the sealing body 112 in proximity to the coupling devices 108*a*, 108*b*, 110*a*, 110*b* to come into physical contact, thereby causing the attachment apparatus 100 to transition to and remain in a closed configuration. In such embodiments, the coupling devices 108*a*, 108*b*, 110*a*, 110*b* may be decoupled by pulling the sealing body 112 away from the attachment body 102 with a force that exceeds the magnetic forces holding the coupling devices 108*a*, 108*b*, 110*a*, and 110*b* together.

In some optional embodiments, the attachment body 102 and/or the sealing frame 116 may be configured with a rounded edge that extends along at least a portion of the perimeter of the opening 126 and/or the opening 124. The rounded edge may be configured to reduce or avoid angled or sharp edges around the opening 126 and/or opening 124. As such, the rounded edge(s) may reduce the overall impingement on the user's ear and discomfort experienced by the user.

Figure 1C:
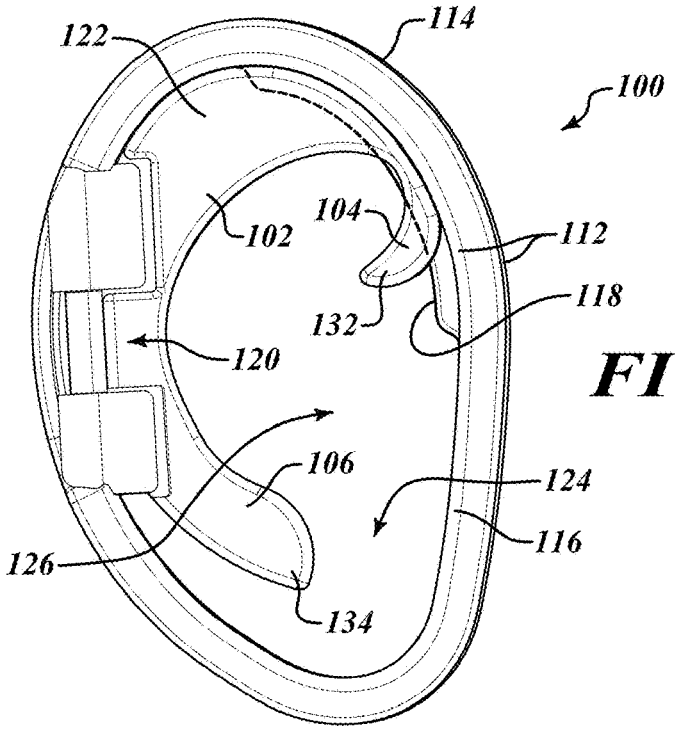

FIG. 1C illustrates an exterior view of a back side of the attachment apparatus 100 while the attachment apparatus 100 is in a closed configuration, according to some embodiments. In the example illustrated in FIG. 1C, the attachment body 102 may include sealing material 122 that is coupled or affixed to a back surface of the attachment body 102 that is proximal to the median plane of the user's body when the attachment body 102 is secured to the ear of the user. In some embodiments, the sealing material 122 may be made from the same or similar materials or combinations of materials as the sealing material 114. As such, the sealing material 122 may be configured to form, alone or in conjunction with the sealing material 114, at least a partial acoustic seal against the anatomy of the user when the attachment body 102 is secured to the user's ear. By way of a non-limiting example, the sealing material 122 may form at least a partial acoustic seal surrounding at least a portion of the root of the user's ear. In some embodiments, the sealing materials 114 and 122 may be configured to form, collectively, an acoustic seal around all or substantially all of the root of the user's ear.

In some optional embodiments, a back surface of the attachment body 102 and/or a back surface of the sealing body 112 may be configured to include a texture or material that may increase an amount of friction that is created between the attachment body 102 and/or the sealing body 112 and the user, thereby improving the overall security of the attachment apparatus 100 to the user. For example, a surface of the sealing material 122 may be configured to include one or more traction patterns that include ridges, dimples, and/or recesses in the surface that may engage the surface of the user's body and that may increase the amount of friction generated between the surface of the sealing material 122 and the surface of the user.

Figure 1D:
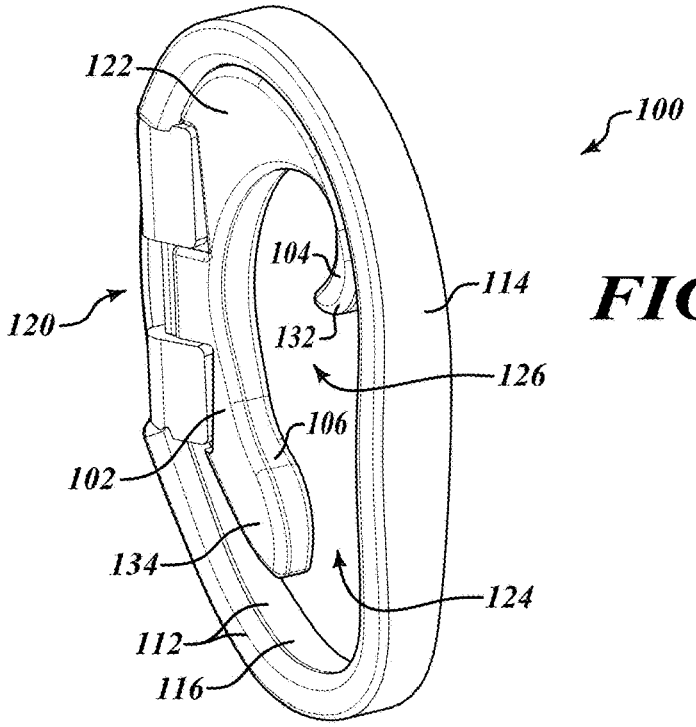

FIG. 1D illustrates a perspective view of a back side of the attachment apparatus 100 while the attachment apparatus 100 is in a closed configuration, according to some embodiments. As described (e.g., with reference to FIGS. 1A and 1B), the sealing frame 116 may include the groove 118, which may be configured to accommodate at least a portion of the attachment body 102 while the attachment apparatus 100 is in a closed configuration. In the example illustrated in FIG. 1D, the first attachment portion 104 of the attachment body 102 may be in physical contact with one or more surfaces defined by the groove 118. The groove 118 may be configured to accommodate the attachment body 102 such that, while the attachment body 102 is positioned in the groove 108 and secured to the user's ear, a surface of the attachment body 102 proximal to the center plain of the user's body may be flush or substantially flush with the edge of the sealing body 112 nearest the user's body (e.g., as illustrated in FIG. 1D). As such, the depth of the groove 118 in the sealing frame 116 may be based at least in part on the width of the attachment body 102 or, in some embodiments, based on the specific width of the first attachment portion 104 so that the entire attachment apparatus 100 facing the user is flush against the user's anatomy when secured to the user's ear, thereby creating at least a partial acoustic seal against the user's anatomy.

In some embodiments, the back surface of the attachment body 102 and the sealing frame 116 (or, alternatively, back surfaces of the sealing materials 114 and 122) may be configured to engage physically with a surface of the user's anatomy when the attachment apparatus 100 is coupled to the user's ear. As such, the back surface of the attachment apparatus 100 may be generally configured to have a shape that conforms to a user's anatomy, such as a shape that contours to the general anatomy of a user's head around the user's ear. For example, portions of the back surfaces of the attachment body 102 and the sealing body 112 may be configured to have a concave shape suitable for accommodating the user's anatomy close to the user's ear. Further, as described, the back surfaces of the attachment body 102 and/or the sealing body 112 may be configured to contact a surface of the user's anatomy in order to form at least a partial acoustic seal. In such embodiments, the curvature of the attachment body 102 (e.g., as illustrated in FIG. 1C) may facilitate the formation of the at least partial acoustic seal around the user's ear.

Figure 2A:
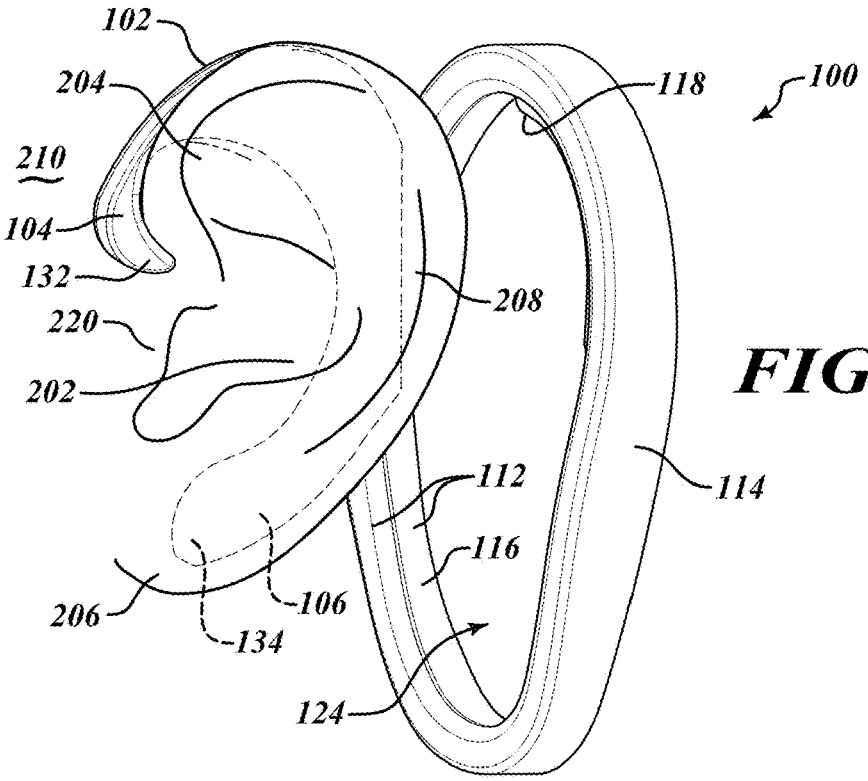
FIGS. 2A-2C are exterior views of the attachment apparatus depicted in FIGS. 1A-1D while the attachment apparatus is secured to an ear of a user, according to some embodiments.
Figure 2B:
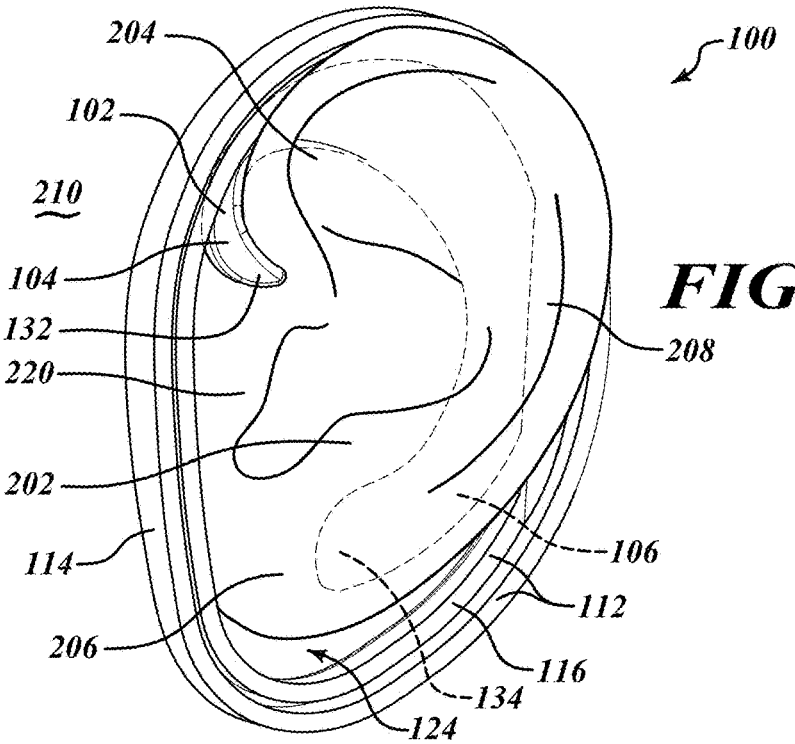
Figure 2C:
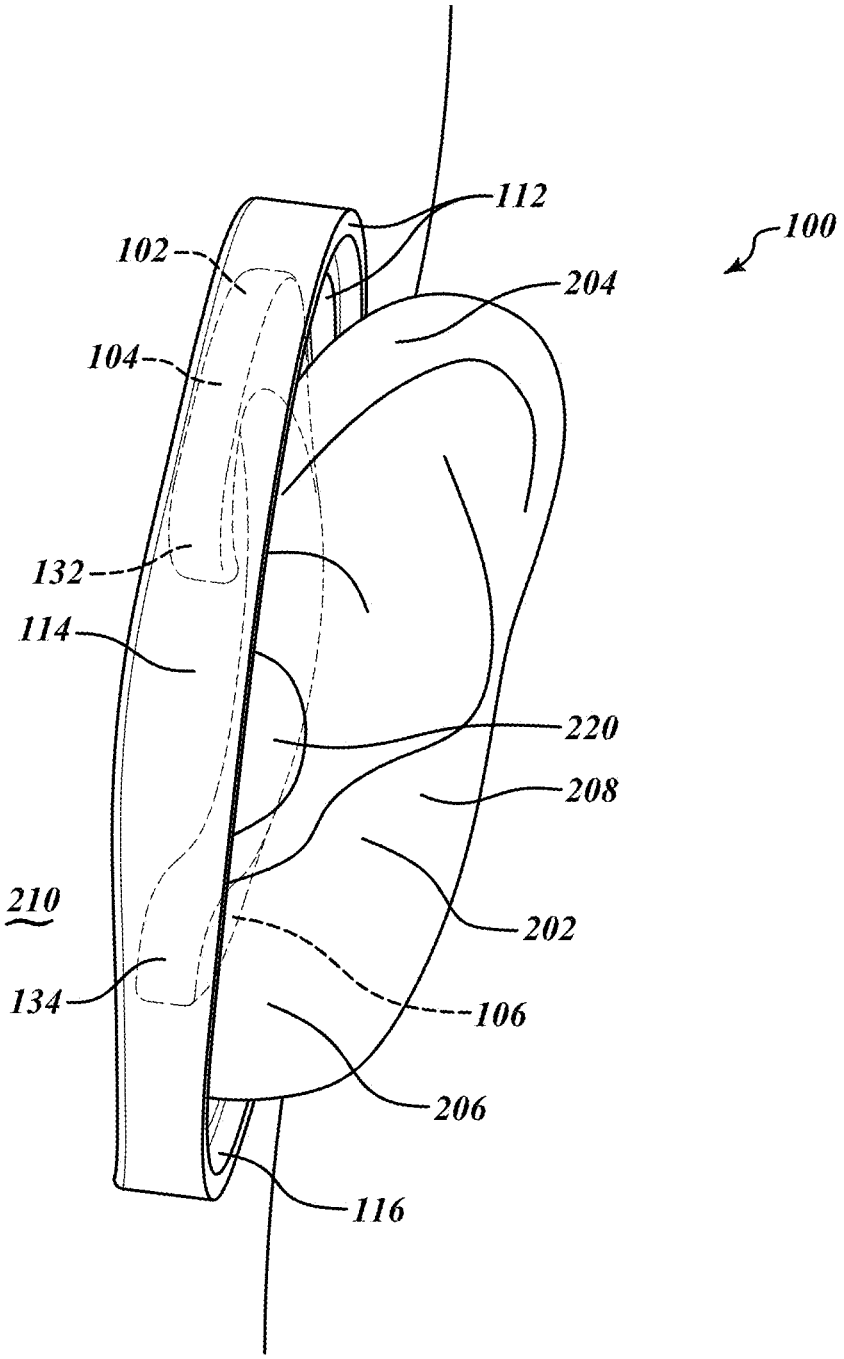

FIGS. 2A-2C illustrate views of the attachment apparatus 100 described with reference to FIGS. 1A-1D when the attachment apparatus 100 is secured to a user's ear 202, according to some embodiments. In the examples illustrated in FIGS. 2A-2C, the user's ear 202 may include a posterior portion 208, an upper portion 204, a lower portion 206, and an anterior portion 220, as generally described herein.

FIG. 2A illustrates an exterior view of a front side of the attachment apparatus 100 while secured to the ear 202 of the user and configured in an open configuration, according to some embodiments. The attachment body 102 may be secured to the ear 202 of the user by hooking, hanging, or otherwise positioning the first attachment portion 104 along the root of the upper portion 204 of the ear 202 and by rotating the attachment body 102 until at least part of the upper portion 204 and posterior portion 208 of the ear 202 passes through the opening 126 and the second attachment portion 106 (illustrated in FIGS. 2A and 2B by hidden lines) comes into physical contact with a surface of the root of the posterior portion 208 of the ear 202. In such embodiments, the shape or curvature of the first attachment portion 104 (e.g., a hooked shape) may cause the first attachment portion 104 to remain engaged with the root of the upper portion 204 of the ear 202, for example, by hanging on the root of the upper portion 204 of the ear 202.

The second attachment portion 106 may generally accommodate the anatomical features of the posterior portion 208 of the ear 202. For example, a surface of at least a root portion of the posterior portion 208 of the ear 202 may rest against a surface of the second attachment portion 106 that is configuration to receive the surface of the posterior portion 208 of the ear 202. In some embodiments, the second attachment portion 106 may be configured to function to stabilize or to counterbalance the first attachment portion 104, thereby further securing the attachment body 102 to the ear 202.

In some embodiments, the attachment body 102 may be at least partially made from a viscoelastic material. A deforming force (e.g., a tensile force) may be applied to the attachment body 102 in order to transition the attachment body 102 from an initial or resting configuration to a deformed configuration. Specifically, a squeezing or stretching force applied to the first attachment portion 104 and the second attachment portion 106 may cause the opening 126 (e.g., as described with reference to FIGS. 1A and 1B) between the end 132 of the first attachment portion 104 and the end 134 of the second attachment portion 106 (positioned behind the ear 202 in FIGS. 2A-2C) to enlarge or change shape to better accommodate receiving the ear 202 through the opening 126. The attachment body 102 may be further configured to revert to the initial configuration when the deforming force applied to the attachment body 102 is removed. In some embodiments, the attachment body 102 (or one or more portions thereof) may be configured to revert to the initial configuration from the deformed configuration over a short period of time (e.g., three to five seconds) when the force applied to the attachment body 102 is removed. For example, a user may apply a pulling force on the attachment body 102 that causes the attachment body 102 to transition to a deformed configuration that better accommodates the ear 202. The user may remove the pulling force from the attachment body 102, which may cause the attachment body 102 to begin returning to the resting configuration slowly. Before the attachment body 102 returns to the resting configuration, the user may place a portion of the ear 202 through the opening 126 formed between the respective ends 132, 134 of the first attachment portion 104 and the second attachment portion 106. Once the attachment body 102 is secured to the user's ear 202, the attachment body 102 may continue transitioning back to the initial configuration, which may also cause the size of at least one dimension of the opening 126 to decrease. As such, once the attachment body 102 fully returns to the resting configuration, the opening 126 may have reduced in size, thereby securely attaching the attachment body 102 to the user. In some embodiments, the attachment body 102 may form at least a partial acoustic seal around the user's ear 202 once the attachment body 102 returns to the initial configuration around the user's ear 202. For example, the sealing material 122 (e.g., as described with reference to FIGS. 1C-1D) of the attachment body 102 may physically contact a portion of the user's body around the ear 202 and may, as a result, form at least a partial acoustic seal against the user.

Additionally (or alternatively), the attachment body 102 may be configured to exert a compressive force of the user's ear 202, such as when a size of the opening 126 is smaller than a cross-sectional area of the root of the user's ear 202. In such embodiments, the root of the ear 202 may prevent the attachment body 102 from returning completely to the initial configuration when the attachment apparatus 100 is coupled to the ear 202. As such, the attachment body 102 may continuously apply a compressive force to the root of the ear 202 while the attachment apparatus 100 is coupled to the ear 202. This compressive force may generally be applied between the ends 132, 134 and may further secure the attachment apparatus 100 to the ear 202.

Once the attachment body 102 is secured to the ear 202 of the user, the shape of the first attachment portion 104 may prevent or reduce clockwise rotation of the attachment apparatus 100 around the ear 202 (e.g., a left ear) as illustrated in FIGS. 2A and 2B. Specifically, at least a portion of the upper portion 204 and/or anterior portion 220 of the user's ear 202 may be in physical contact with the first attachment portion 104. Thus, in response to receiving a clockwise rotational force on the attachment body 102 of the example left ear device, the upper portion 204 and/or the anterior portion 220 of the user's left ear 202 may engage the first attachment portion 104, which may prevent the attachment body 102 from beginning or continuing clockwise rotation. Thus, the configuration of the attachment body 102 of the example left ear device may prevent or substantially reduce clockwise-rotational movement of the attachment apparatus 100 around the user's left ear 202. In a similar manner, a mirror-image version of the attachment apparatus 100 (not shown) may be configured to attach to a right ear, and the attachment body of such mirror-image attachment apparatus may similarly be configured to prevent or substantially reduce counterclockwise rotational movement of the mirror-image attachment apparatus around the user's right ear.

FIGS. 2B and 2C illustrate alternative views of the attachment apparatus 100 while the attachment body 102 has been secured to the ear 202 and while the attachment apparatus 100 is in a closed configuration. While secured to the attachment body 102, a portion of the ear 202 may reside, substantially or entirely, in the opening 126 formed from the attachment body 102, regardless of whether the attachment apparatus 100 is in an open configuration (e.g., as illustrated in FIG. 2A) or in a closed configuration (e.g., as illustrated in FIGS. 2B and 2C). From an open configuration, the sealing body 112 may be moved towards the attachment body 102 until the attachment apparatus 100 transitions to a closed configuration, such as when the sealing body 112 and the attachment body 102 engage one another via the coupling devices 108*a*, 108*b*, 110*a*, 110*b* (as described with reference to FIGS. 1A and 1B). As the sealing body 112 is moved towards the attachment body 102, a majority of the outer portion of the user's ear 202 may pass through the opening 124 formed by the sealing frame 116. Once the attachment apparatus 100 is in a closed configuration, the sealing body 112 may at least substantially surround the root of the ear 202 to form at least a partial acoustic seal against the area of the user's body around the root of the ear 202. For example, as shown in the examples illustrated in FIGS. 2B and 2C, a portion of the sealing body 112 (e.g., the sealing material 114) may physically engage the face 210 to form at least a partial acoustic seal against the user's body.

In some embodiments, while the attachment apparatus 100 is in a closed configuration and secured to the ear 202 (e.g., a left ear), the sealing body 112 may prevent or reduce counterclockwise rotation of the attachment apparatus 100 around the ear 202. Specifically, at least a portion of the lower portion 206 and/or the anterior portion 220 of the user's left ear 202 may be in physical contact with the sealing body 112. In response to receiving a counterclockwise rotational force on the attachment apparatus 100, the lower portion 206 and/or the anterior portion 220 of the user's ear 202 may physically engage or press against the sealing body 112, which may prevent the attachment apparatus 100 from beginning or continuing counterclockwise rotation or may substantially reduce counterclockwise-rotational movement of the attachment apparatus 100 around the user's left ear 202. In a similar manner, a mirror-image version of the attachment apparatus 100 may be configured to attach to a user's right ear (not shown) and to prevent or substantially reduce clockwise rotational movement of the mirrored-image attachment apparatus around the user's right ear.

In some embodiments (e.g., as described above), the sealing body 112 may be configured to reduce rotation of the attachment apparatus 100 around the user's ear 202 in a rotational direction opposite of the direction of the rotational movement prevented or reduced by the attachment body 102. Accordingly, in some embodiments, the attachment body 102 and the sealing body 112 may be configured, jointly, to prevent or limit both counterclockwise and clockwise rotation of the attachment apparatus 100 around the ear 202 of the user. As a result, the attachment body 102 and the sealing body 112 may collectively provide a strong attachment between the attachment apparatus 100 and the ear 202 with limited or no rotational movement.

As described (e.g., with reference to FIGS. 1A and 1B), while the attachment apparatus 100 is configured in a closed configuration, the attachment body 102 may sit within the groove 118 of the sealing body 112. In some embodiments, the groove 118 may at least substantially accommodate the attachment body 102. Thus, as depicted in the example illustrated in FIG. 2C, the sealing body 112 and the attachment body 102 (obscured by the sealing body 112) may sit substantially flush against the anatomy of the user, and the sealing body 112 may physically contact and form at least a partial acoustic seal surrounding the ear 202 of the user. In some alternative embodiments, the groove 118 may be configured to cause the attachment body 102 to be recessed within the groove 118 so that the attachment body 102 does not sit flush against the user's body in relation to the median plane of the user. In such embodiments, a surface of the sealing material 114 proximal to the median plane of the user may engage the body of the user to form at least a partial acoustic seal around the ear 202 while the attachment body 102 ensures that the attachment apparatus 100 remains secured to the ear 202. In some embodiments, the joint 120 may be configured such that, when the attachment apparatus 100 is in a closed configuration, the attachment body 102 is held entirely within the opening 124 defined by the sealing body 122, and the sealing body 112 and the attachment body 102 may sit substantially flush against the anatomy of the user. In such embodiments, the joint 120 may include a mechanism or other device or coupling arrangement for holding the attachment apparatus in a closed configuration, and the coupling devices 108*a*, 108*b*, 110*a*, 110*b* may be omitted. In addition, the joint 120 may be provided with a biasing member to urge the attachment apparatus into an open configuration, or alternatively, into a closed configuration.

Various descriptions of the attachment apparatus 100 refer to the attachment body 102 being configured to include the first attachment portion 104 and the second attachment portion 106. These descriptions are merely for ease of description and do not require or imply that the first attachment portion 104 and the second attachment portion 106 of the attachment body 102 are separate components. Instead, in some embodiments, the attachment body 102 may be configured as a single, continuous structure. However, in alternative embodiments, the first attachment portion 104 and the second attachment portion 106 of the attachment body 102 may be individual components that are joined together to form the attachment body 102.

Figure 3A:
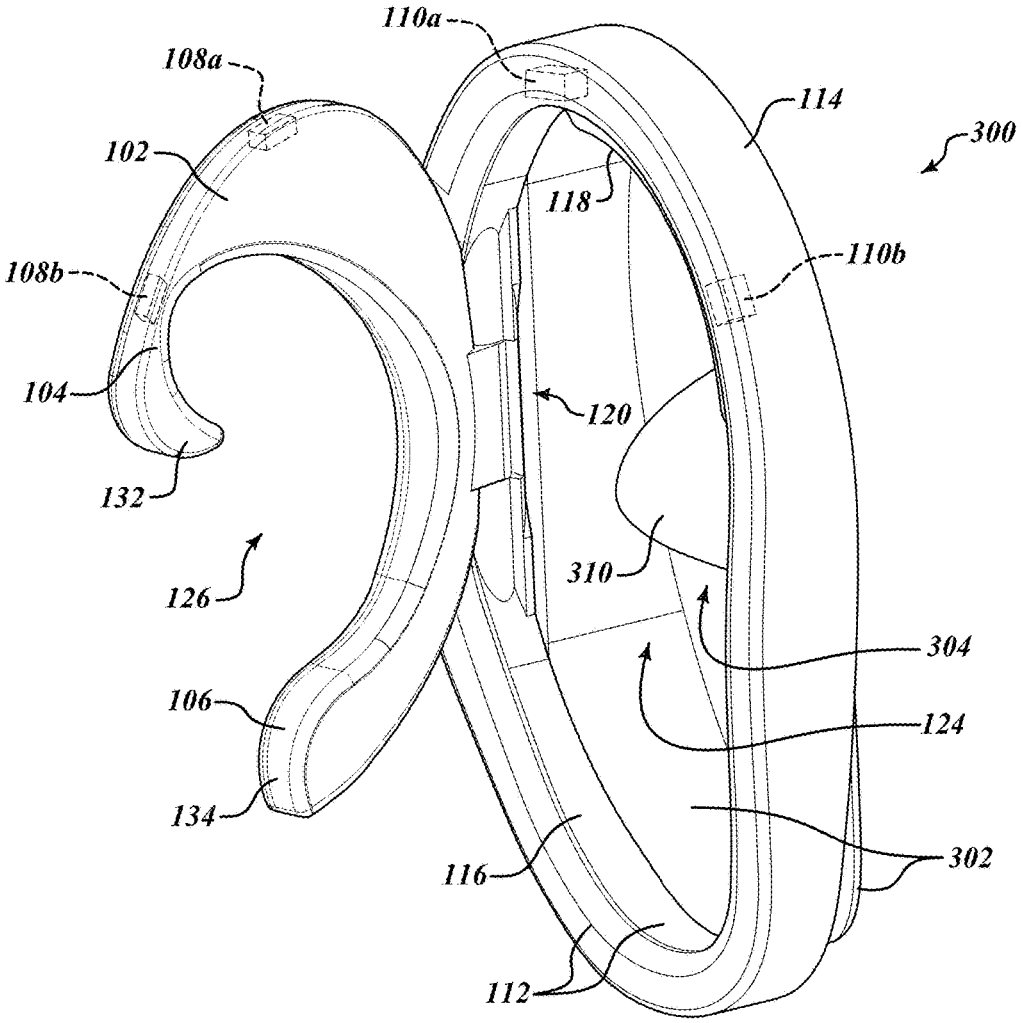
FIGS. 3A-3D are exterior views of another attachment apparatus, according to some embodiments.
Figure 3B:
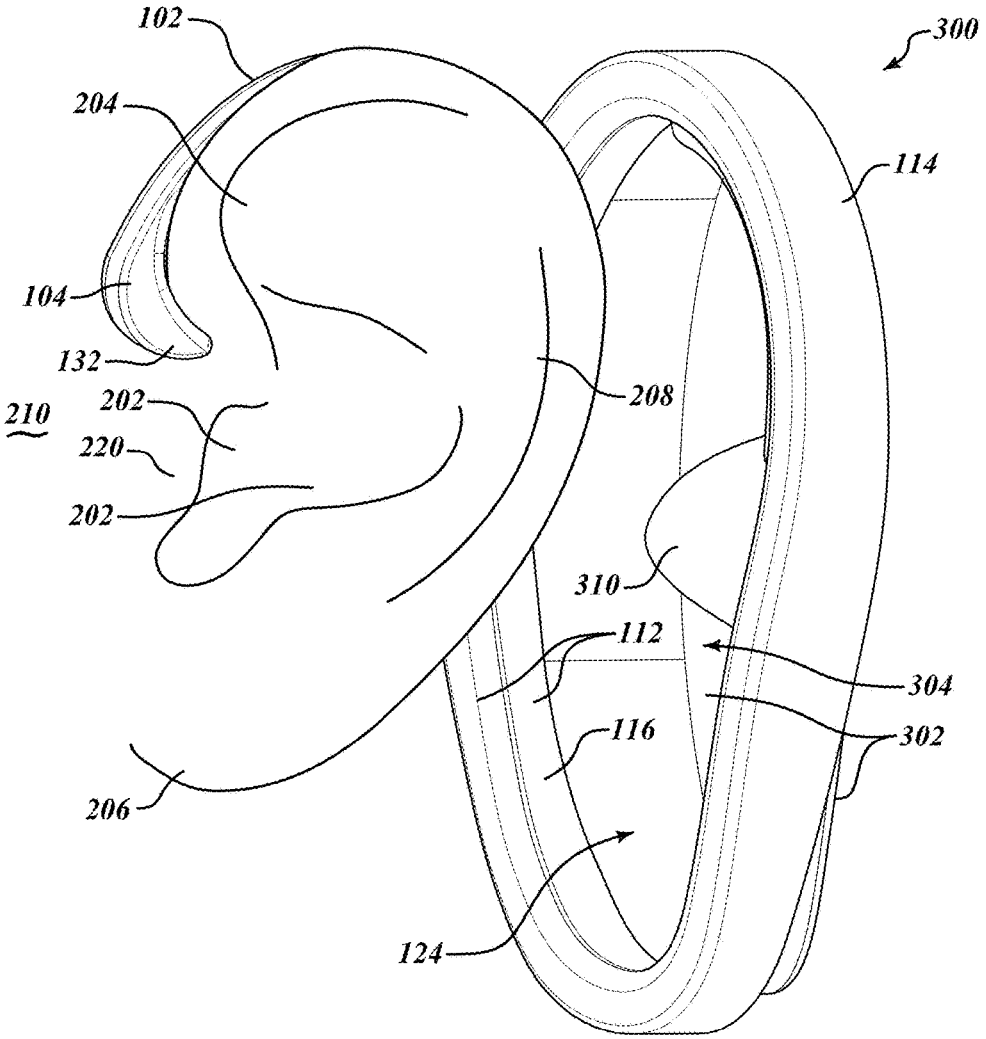
Figure 3C:
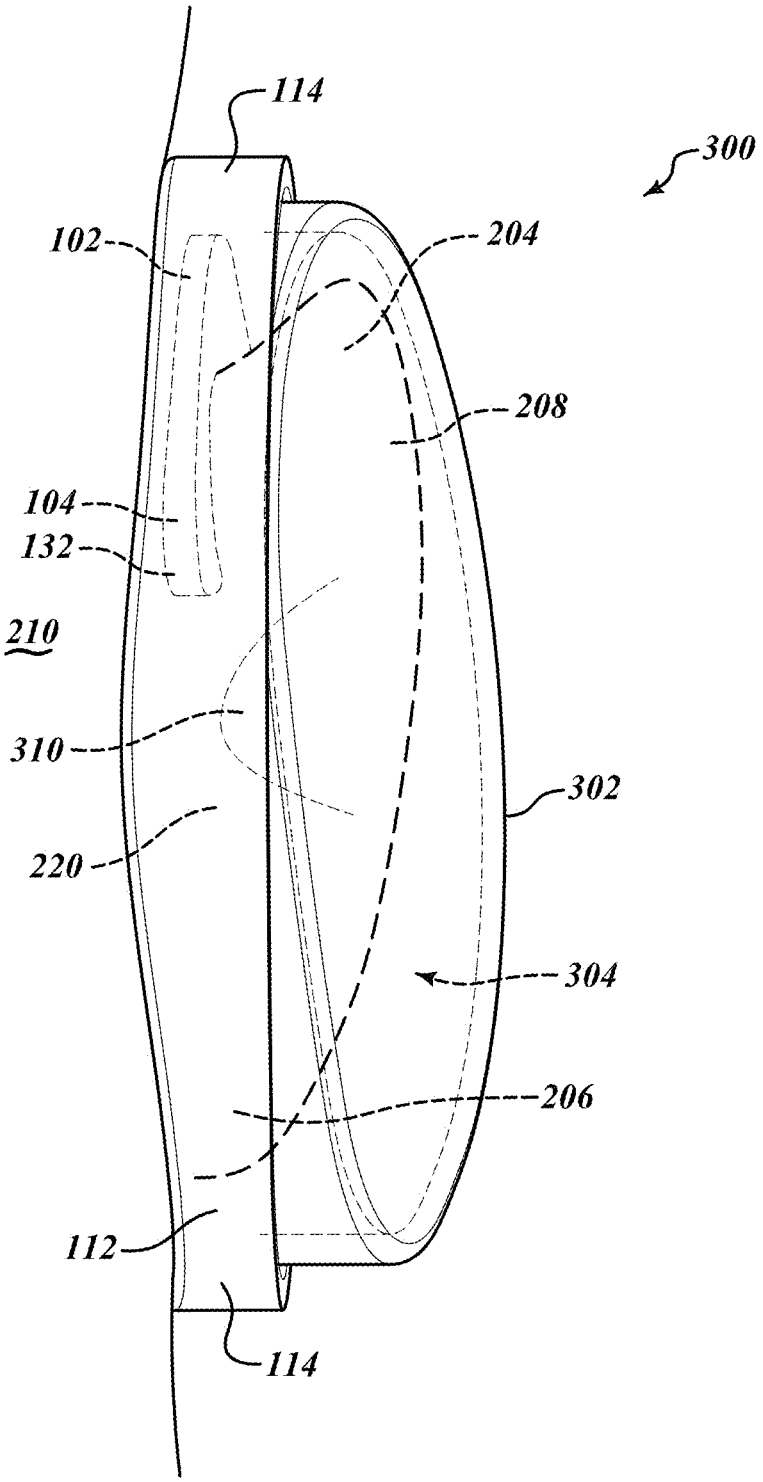

FIGS. 3A-3C illustrate exterior views of an alternative attachment apparatus 300, according to some embodiments. The attachment apparatus 300 may include one or more structural features that are similar to the structural features described with reference to the attachment apparatus 100 (e.g., as described with reference to FIGS. 1A-2C). Specifically, in some embodiments, the attachment apparatus 300 may include, but is not limited to including, the attachment body 102, the first attachment portion 104 of the attachment body 102, the end 132 of the first attachment portion 104, the second attachment portion 106 of the attachment body 102, the end 134 of the second attachment portion 106, the sealing body 112, the sealing material 114 of the sealing body 112, the sealing frame 116 and groove 118 of the sealing body 112, the joint 120, the opening 126 formed at least in part by the attachment body 102, the opening 124 formed at least in part by the sealing body 112, and the coupling devices 108*a*, 108*b*, 110*a*, and 110*b*. Some of the structural features of the attachment apparatus 300 may be analogous to structural features described above, for example, with reference to the attachment apparatuses 100 described with reference to FIGS. 1A-2C. For clarity and simplicity of description, duplicative descriptions of such structural features of the attachment apparatus 300 may not be repeated in the following descriptions.

FIG. 3A illustrates an exterior perspective view of a front side of the attachment apparatus 300 while the attachment apparatus 300 is in an open configuration. In some embodiments, the attachment apparatus 300 may include a cover body 302. The cover body 302 may be made from one or more materials, including hard or soft plastic, ceramic, metal, rubber, or various other materials or combinations thereof. The cover body 302 may be configured to have a shape or perimeter that substantially conforms to a shape or perimeter of the sealing body 112. In such embodiments, the cover body 302 may be aligned with and coupled to the sealing frame 116 via one or more attachment methods. For example, the cover body 302 may be bonded to a surface of the sealing frame 116 via adhesives or may be fastened to the sealing frame 116 via one or more interlocking members (not shown) or other fastening devices or techniques. However, in some embodiments, the cover 302 and the sealing body 112 may be formed as a single structural component, and as such, there may not be a requirement for a separate cover 302 and a separate sealing body 112.

In some embodiments, the sealing body 112 and the cover body 302 may be joined (or formed together) to form a chamber 304 between the sealing body 112 and the cover body 302 and at least partly defined by the opening 124 of the sealing frame 116 (e.g., as described with reference to FIGS. 1A and 1B). In some embodiments, the cover body 302 may include a mid-ear portion 310. The mid-ear portion 310 of the cover body 302 may be a portion of the cover body 302 that protrudes into the chamber 304. As described further herein (e.g., with reference to FIG. 3C), the mid-ear portion 310 may be configured to engage an interior portion of a user's ear to improve the attachment of the attachment apparatus 300 to the user's ear.

FIG. 3B illustrates a perspective view of the attachment apparatus 300 while the attachment apparatus 300 is attached to the user's ear 202 and is in an open configuration, according to some embodiments. In the example illustrated in FIG. 3B, and as described above, the attachment body 102 may be secured to the ear 202 via engagement of a root of the upper portion 204 and/or anterior portion 220 of the user's ear 202 by the first attachment portion 104 and via engagement of a root of the posterior portion 208 of the ear by the second attachment portion 106 (obscured in FIG. 3B by the ear 202). In some embodiments, the chamber 304 formed from the sealing body 112, the opening 124, and the cover 302 may be configured to have dimensions suitable for accommodating or housing a majority or all of the outer portion of the ear 202.

FIG. 3C illustrates a semi-transparent view of the left side of the attachment apparatus 300 while the attachment apparatus 300 is attached to the user's ear 202 and in a closed configuration, according to some embodiments. In the example illustrated in FIG. 3C, the sealing body 112 may have engaged the attachment body 102. For example, from an open configuration (e.g., as illustrated in FIG. 3B), the sealing body 112 may be moved toward the attachment body 102 until the attachment apparatus 300 transitions to a closed configuration, which may occur when the coupling devices 108*a*, 108*b* of the attachment body 102 interlock or otherwise physically engage with coupling devices 110*a*, 110*b* of the sealing body 112.

In some embodiments, while the attachment apparatus 300 is configured in a closed configuration, the sealing material 114 of the sealing body 112 (and, in some embodiments, the attachment body 102) may press against or otherwise engage the user (e.g., the user's face 210) to form at least a partial acoustic seal around the user's ear 202. In addition to the at least partial acoustic seal formed between the sealing body 112 and the user, the cover body 302 and the sealing body 112 may collectively be configured to encapsulate the ear 202, either substantially or entirely, within the chamber 304. In some embodiments, the chamber 304 may be substantially or completely isolated acoustically from noise or ambient sound originating outside of the chamber. Thus, the at least partial acoustic seal formed by the sealing body 112 around the user's ear 202 (e.g., against the user's face 210) and the chamber 302 formed from the sealing body 112 and the cover 302 may be configured to jointly reduce or block outside sound from reaching the user's ear 202 while the attachment apparatus 300 is secured to the user's ear and in a closed configuration.

The mid-ear portion 310 may be configured to be inserted into at least a portion of the user's ear 202—such as at least a part of the anterior portion 220 or interior portion of the user's ear 202—to facilitate a more stable attachment of the attachment apparatus 300 to the ear 202 of the user. Accordingly, the mid-ear portion 310 of the cover may be oriented and positioned on or within the cover 302 to ensure that the mid-ear portion 310 engages the anterior portion 220 (or interior portion) of the user's ear 202 when the attachment apparatus 300 is in a closed configuration. In some embodiments, the mid-ear portion 310 may be configured to have a shape that is complementary to the shape of the concha of the ear 202 so that the mid-ear portion 310 may be wedged in and/or around the concha of the ear 202 when the attachment apparatus 300 transitions to a closed configuration. Once inserted into and/or around a part of the anterior portion 220 of the ear, the mid-ear portion 310 may prevent or otherwise limit rotational movement of the attachment apparatus 300 around the ear of the user. By way of a non-limiting example, while the attachment apparatus 300 is in a closed configuration, the mid-ear portion 310 of the cover 302 may physically engage the concha area of the ear 202, thereby increasing friction between the attachment apparatus 300 and the user's ear 202 or otherwise functioning as a physical obstacle that prevents or limits rotational movement of the attachment apparatus 300 around the ear 202. In some alternative (or additional) embodiments in which the attachment apparatus 300 is configured as a wearable audio system (e.g., as described with reference to FIGS. 4A and 4B), the mid-ear portion 310 may include one or more speaker elements that may be positioned in close proximity to the ear canal of the user in order to facilitate direction of sound into the ear canal.

Figure 3D:
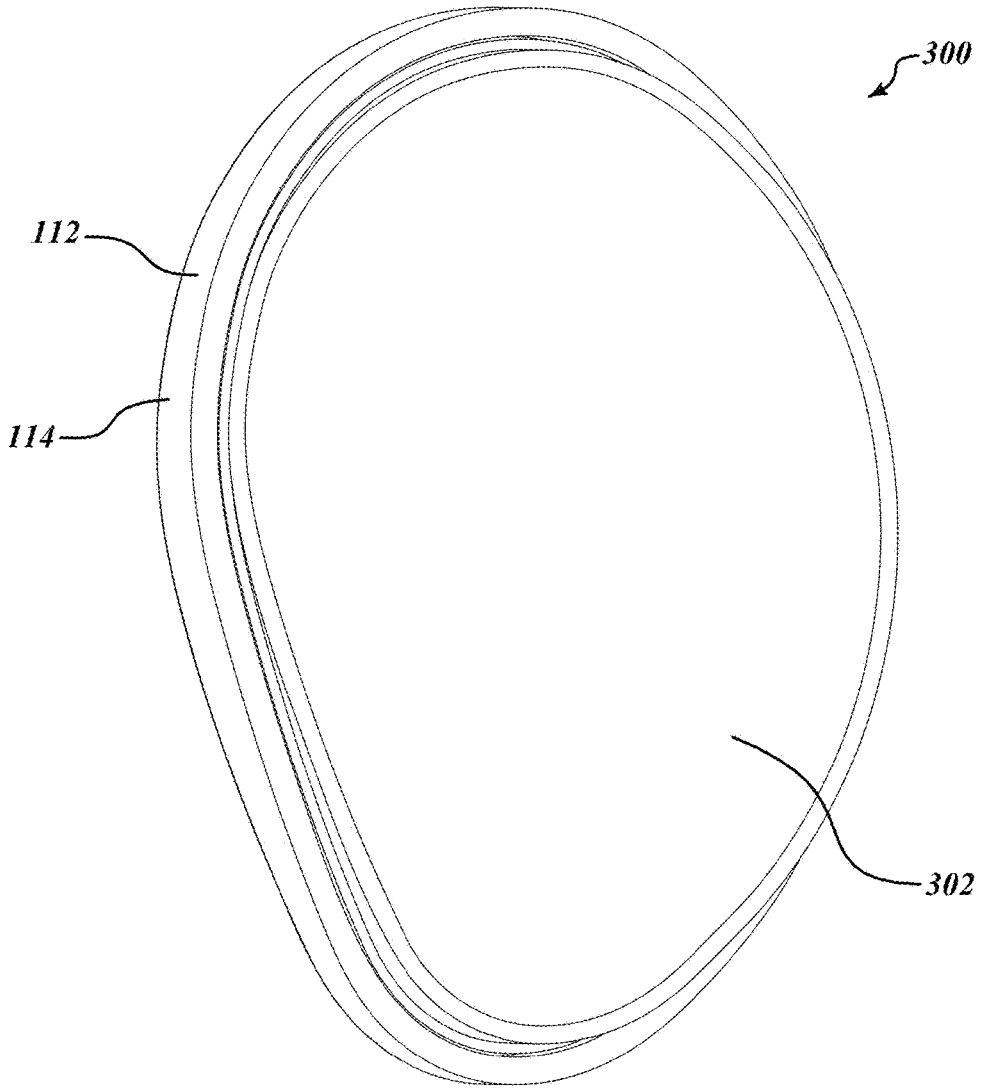

FIG. 3D illustrates an exterior view of a front side of the attachment apparatus 300 while the attachment apparatus 300 is secured to an ear of a user and while the attachment apparatus 300 is in a closed configuration, according to some embodiments. As depicted in the example illustrated in FIG. 3D, the sealing material 114 of the sealing body 112 may form at least a partial acoustic seal around the entirety of the user's ear 202. Further, as described, the cover body 302 may be configured to encapsulate all or substantially all of the user's ear 202 in the chamber 304 (not shown), thereby isolating or substantially isolating the ear 202 from ambient sound.

Figure 4A:
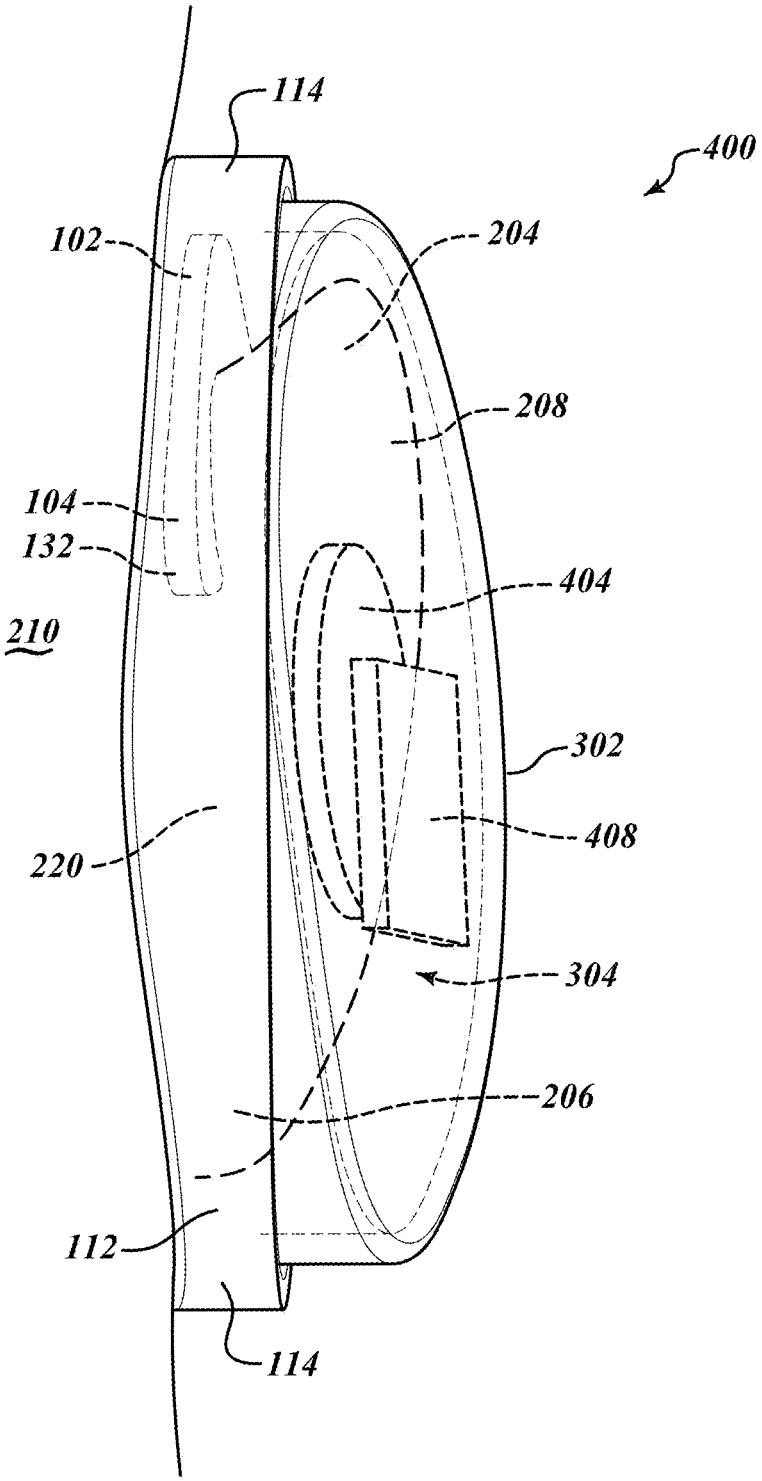
FIGS. 4A-4B are semi-transparent, exterior views of another attachment apparatus configured as a wearable audio system, according to some embodiments.
Figure 4B:
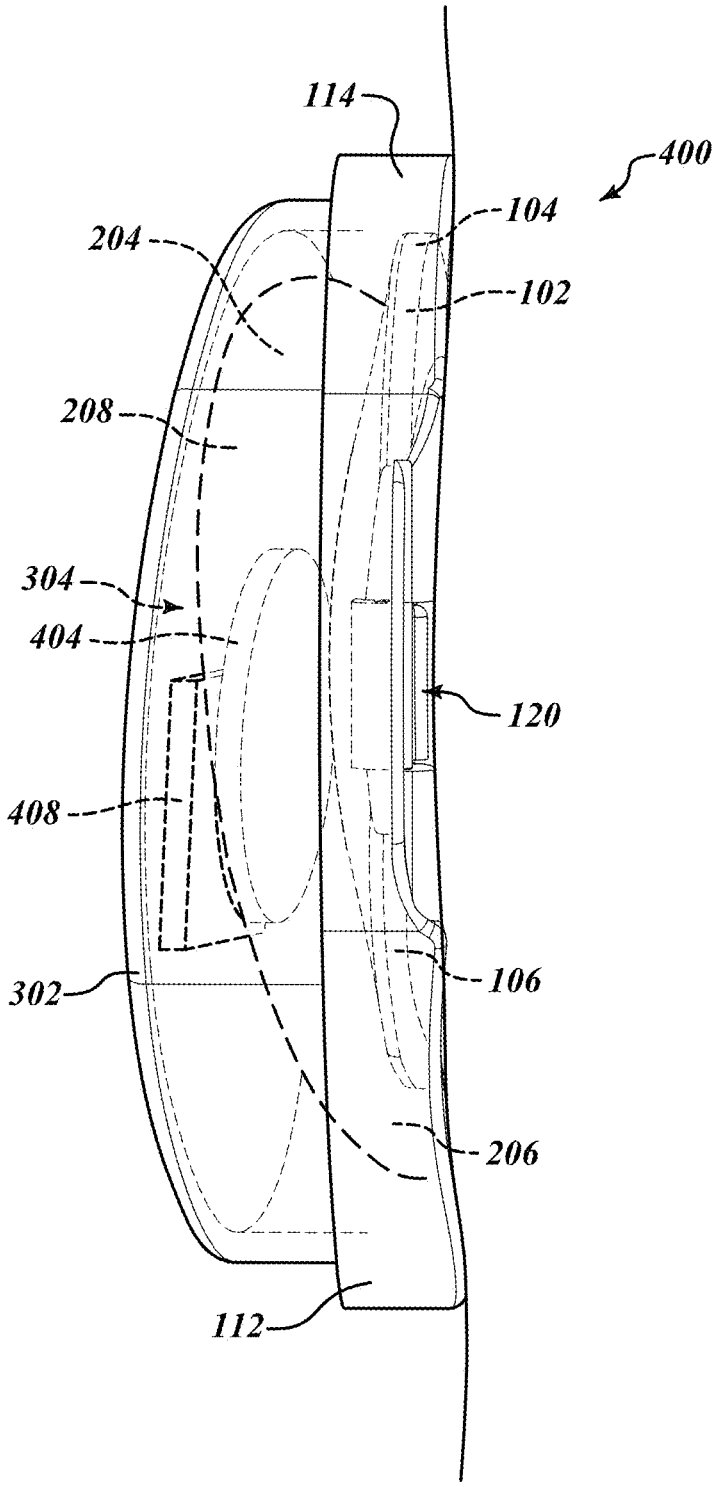

FIGS. 4A-4B illustrate alternative views of an attachment apparatus 400 configured as a wearable audio system, according to some embodiments. As shown in the examples of the attachment apparatus 400 illustrated in FIGS. 4A-4B, the attachment apparatus 400 may include one or more structural features that are similar to the structural features described above (e.g., with reference to the attachment apparatuses 100 and/or 300 described with reference to in FIGS. 1A-3D). Specifically, in some embodiments, the attachment apparatus 400 may include, but is not limited to including, the attachment body 102, the first attachment portion 104 of the attachment body 102, the second attachment portion 106 of the attachment body 102, the sealing body 112, the sealing material 114 of the sealing body 112, the sealing frame 116 of the sealing body 112, the joint 120, the cover body 302, and the chamber 304 formed within the cover body 302. Some of the structural features of the attachment apparatus 400 may be analogous to structural features described above, for example, with reference to the attachment apparatuses 100 and/or 300. For clarity and simplicity of description, duplicative descriptions of such structural features of the attachment apparatus 400 may not be repeated in the following descriptions.

FIG. 4A illustrates a semi-transparent, exterior view of a left side of the attachment apparatus 400. In some embodiments, the cover body 302 may incorporate or otherwise include one or more audio components 408 that may enable the attachment apparatus 400 to function as a wearable audio system. The one or more audio components 408 may include, without limitation, a flexible circuit or printed circuit board, memory, a power source (e.g., a battery), a transceiver for receiving audio signals from an exterior computing device (e.g., a smart phone), a processing unit, a signal processor, an amplifier, or the like. Further, the cover body 302 may include a speaker system 404 that may be configured to play audio into the chamber 304 formed by at least the cover body 302. In some embodiments (not shown), the cover body 302 may include an input device, such as a capacitance touch screen, a physical button, a scroll wheel or the like. For example, the cover body 302 may be configured to receive a touch input from a user, and the touch input may be provided to one or more processing components included in the cover body 302 (e.g., a processing unit or the like). For example, the cover body 302 may receive a touch input that causes the processing unit to stop, start, or change audio that is played out through a speaker included in the cover body 302.

In the example illustrated in FIG. 4A, the audio components 408 and/or the speaker system 404 may be positioned within a portion of the chamber 304 in proximity to the ear 202 of the user. For example, when the attachment apparatus 400 is secured to the user's ear 202, the speaker system 404 may be positioned so that audio played through the speaker system 404 is directed towards the ear canal of the ear 202. In such embodiments, the speaker system 404 may be positioned at an angle in order to direct sound into the ear canal of the ear 202. In some embodiments (not shown), the speaker system 404 may be positioned on or within the mid-ear portion 310 (not shown) of the cover body 302. In such embodiments, the speaker system 404 may extend towards the ear 202, such as by extending into the interior portion of the ear 202 or into, on, or inside of the opening of the ear canal (not shown).

FIG. 4B illustrates a semi-transparent, exterior view of a right side of the attachment apparatus 400, according to some embodiments. In the example illustrated in FIG. 4B, the attachment body 102 may secure the attachment apparatus 400 to the root of the posterior portion 208 of the user's ear 202 and to at least the root of the upper portion 206 of the ear 202. The attachment body 102 may be coupled to the sealing body 112 via the joint 120 (e.g., as described with reference to FIGS. 1A and 1B). When the attachment apparatus 400 is secured to the ear 202, the ear 202 may be encapsulated in the chamber 304 formed by at least the cover body 302. As further illustrated in this example, the cover body 302 may be configured to include the one or more audio components 408 and the speaker system 404. As shown, the speaker system 404 may be positioned relative to the ear 202 such that the speaker system 404 is capable of outputting audio that is directed to the ear canal of the ear 202.

Figure 5:
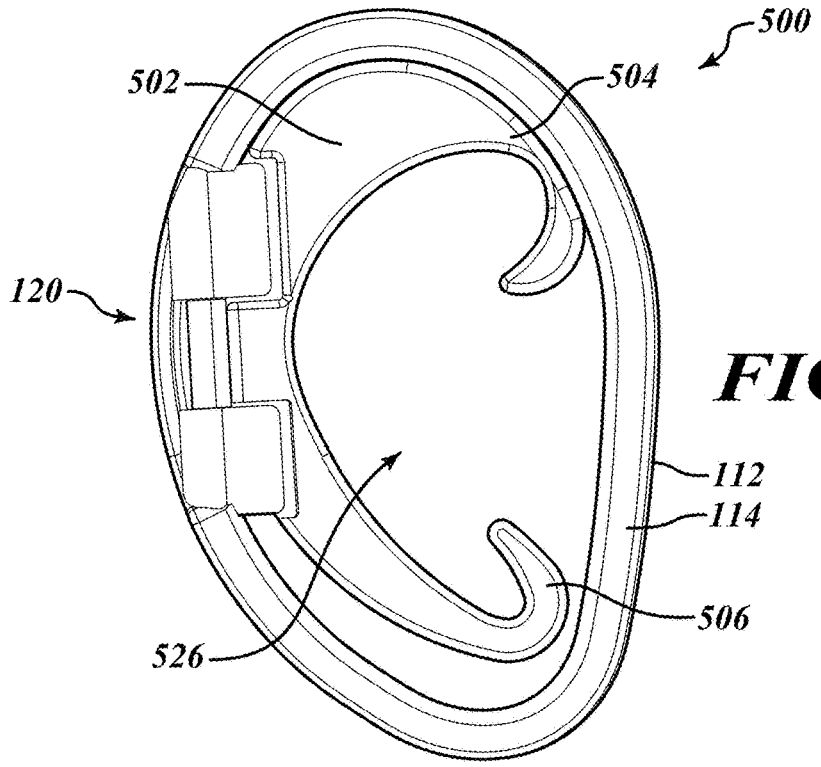
FIG. 5 is an exterior view of a back side of another attachment apparatus that includes an attachment body having an alternative design, according to some embodiments.

FIG. 5 illustrates an exterior view of a back side of an attachment apparatus 500, according to some alternative embodiments. The attachment apparatus 500 may include one or more structural features that are similar to the structural features described above (e.g., with reference to the attachment apparatuses 100, 300, and/or 400 illustrated in FIGS. 1A-4B). Specifically, in some embodiments, the attachment apparatus 500 may include, but is not limited to including, the sealing body 112, the sealing material 114 of the sealing body 112, the sealing frame 116 of the sealing body 112, and the joint 120. Some of the structural features of the attachment apparatus 500 may be analogous to structural features described above, for example, with reference to the attachment apparatuses 100, 300, and/or 400. For clarity and simplicity of description, duplicative descriptions of such structural features of the attachment apparatus 500 may not be repeated in the following descriptions.

As illustrated in FIG. 5, the attachment apparatus 500 may include an attachment body 502. The attachment body 502 may be made from various elastic or non-elastic materials or combinations thereof. The attachment body 502 may include a first attachment portion 504 and a second attachment portion 506. In some embodiments, when a stretching, tensile or other deforming force is applied to the attachment body 502 (e.g., by pulling the first attachment portion 504 and the second attachment portion 506 in opposite directions, the attachment body 502 may transition from an initial, resting configuration to a deformed configuration in which the attachment body 502 is stretched out. While the attachment body 502 is in a deformed configuration (e.g., while stretched or expanded), an opening 526 formed between respective the first attachment portion 504 and the second attachment portion 506 may be larger in at least one dimension, thereby enabling a user to secure the attachment body 502 to the user's ear more easily. When the deforming force is removed from the attachment body 502, the attachment body 502 may begin transitioning from a deformed configuration to an initial, resting configuration, for example, via elastic contraction. Because the attachment body returns to the resting configuration when the deforming force is removed, at least one dimension of the opening 526 may decrease. As a result of transitioning back to the resting configuration, the attachment body 502 may apply a compressive force on a user's ear that is inserted into the opening 526, thereby preventing a user's ear inserted into the opening 526 from passing back through the opening 526 easily and thus securing the attachment apparatus 500 to the user.

In some embodiments, the first attachment portion 504 may be configured similarly to the configuration of the first attachment portion 104 (e.g., as described with reference to FIGS. 1A-1B). Specifically, the first attachment portion 504 may be configured to have a shape suitable for engaging or hooking onto an upper root portion of a user's ear. The second attachment portion 506 may be configured to have a shape that is suitable for engaging or hooking onto a lower root portion of a user's ear. In some embodiments, the attachment body 502 may be secured to a user's ear by configuring the attachment apparatus 500 into an open configuration and by inserting the user's ear into the opening 526 formed at least in part by the first attachment portion 504 and the second attachment portion 506. Specifically, the user's ear may be inserted into the opening 526 such that the first attachment portion 504 engages with, hooks onto, or otherwise physically contacts the upper root portion of the ear. Similarly, the second attachment portion 506 may engage with, hook onto, or otherwise physically contact the lower root portion of the ear. As a result, the first attachment portion 504 and the second attachment portion 506 may engage both the upper root portion and lower root portion of the user's ear, thereby ensuring that the attachment body 502 is firmly secured to the user's ear.

In some embodiments, the first attachment portion 504 may be configured with a shape suitable for preventing or reducing clockwise rotation of the example attachment apparatus 500 around the user's left ear. In the example illustrated in FIG. 5, the first attachment portion 504 may be made from a non-elastic or rigid material and may be configured to hang over the upper root portion of the ear. As such, while the attachment body 502 is secured to the user's left ear, any clockwise rotation of the attachment body 502 around the user's left ear may cause a part of the first attachment portion 504 (e.g., the hooked portion as illustrated in FIG. 5) to physically engage the upper root portion of the ear. Because the first attachment portion 504 may be configured such that it cannot move through or past the upper root portion, the first attachment portion 504 may limit or prevent clockwise rotation of the attachment body 502 around the user's left ear. In a similar manner, a first attachment portion of a mirror-image of the attachment apparatus 500 may prevent or substantially reduce counterclockwise rotational movement of such a mirror-image attachment body around the user's right ear.

In some embodiments, the second attachment portion 506 of the example attachment apparatus 500 may be configured with a shape suitable for preventing or reducing counterclockwise rotation of the attachment apparatus 500 around the user's left ear. In the example illustrated in FIG. 5, the second attachment portion 504 may be made from a non-elastic or rigid material and may be configured to engage the lower root portion of the left ear. As such, while the attachment body 502 is secured to the user's left ear, any counterclockwise rotation of the attachment body 502 around the user's left ear may cause an end portion of the second attachment portion 504 (e.g., the hooked portion as illustrated in FIG. 5) to push against the lower root portion of the ear or, in some instances, the anterior portion of the user's ear. Because the first attachment portion 504 may be configured such that it cannot move through or past the lower root portion or anterior portion of the user's ear, the first attachment portion 504 may limit or prevent clockwise rotation of the attachment body 502 around the user's left ear (e.g., as described above). Accordingly, in some embodiments, the first attachment portion 504 and the second attachment portion 506 may be configured jointly to reduce or prevent both clockwise and counterclockwise rotation of the attachment apparatus 500 around the user's ear, as described above. In a similar manner, a first attachment portion of a mirror-image of the attachment apparatus 500 may prevent or substantially reduce counterclockwise rotational movement of the mirror-image attachment apparatus around a user's right ear, and a second attachment portion of the mirror-image attachment apparatus may prevent or substantially reduce clockwise rotational movement of the mirror-image attachment apparatus around the user's right ear.

Figure 6:
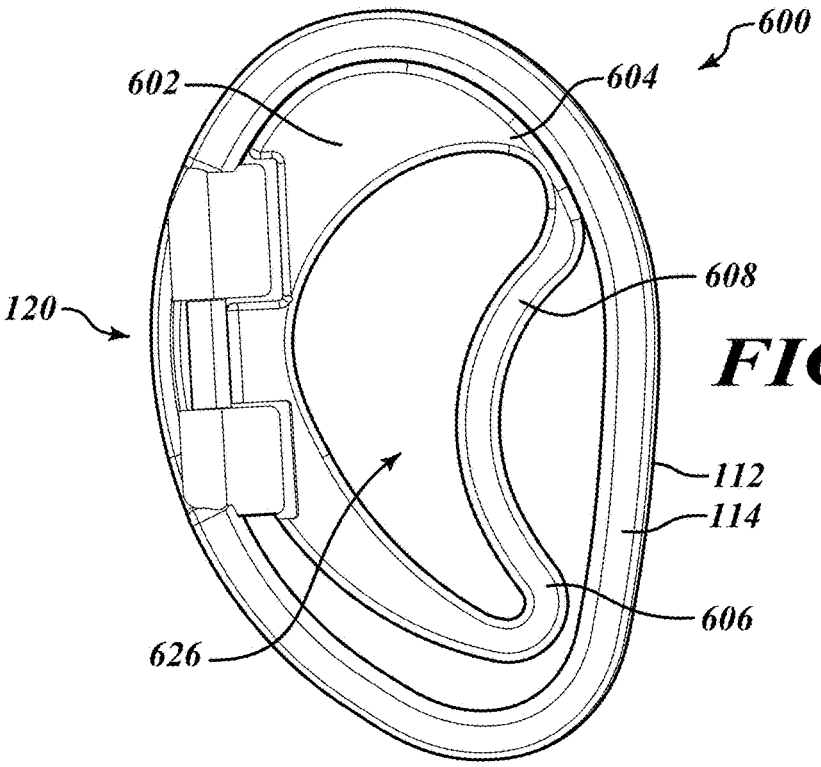
FIG. 6 is an exterior view of a back side of another attachment apparatus that includes an attachment body having another alternative design, according to some embodiments.

FIG. 6 illustrates an exterior view of a back side of an attachment apparatus 600, according to some alternative embodiments. The attachment apparatus 600 may include one or more structural features that are similar to the structural features described above (e.g., with reference to the attachment apparatuses 100, 300, 400, and/or 500 illustrated in FIGS. 1A-5). Specifically, in some embodiments, the attachment apparatus 600 may include, but is not limited to including, the sealing body 112, the sealing material 114 of the sealing body 112, the sealing frame 116 of the sealing body 112, and the joint 120. Some of the structural features of the attachment apparatus 600 may be analogous to structural features described above, for example, with reference to the attachment apparatuses 100, 300, 400, and/or 500. For clarity and simplicity of description, duplicative descriptions of such structural features of the attachment apparatus 600 may not be repeated in the following descriptions.

As illustrated in FIG. 6, the attachment apparatus 600 may include an attachment body 602. The attachment body 602 may include a first attachment portion 604, a second attachment portion 606, and a third attachment portion 608. The attachment body 602 may be made from various elastic or non-elastic materials or combinations thereof. The attachment body 602 may include a first attachment portion 604 and a second attachment portion 606. In some embodiments, the attachment body 602 may be configured to transition from an initial, resting configuration to a deformed configuration in response to receiving a tensile force (e.g., as described with reference to the attachment body 502 illustrated in FIG. 5). As such, while the attachment body 602 is in a deformed configuration (e.g., while stretched or expanded), an opening 626 formed between the first attachment portion 604 and the second attachment portion 606 may be larger in at least one dimension. Because the attachment body 602 returns to the resting configuration when the deforming force is removed, at least one dimension of the opening 626 may decrease. As a result of transitioning back to the resting configuration, the attachment body 602 may apply a compressive force on a user's ear that is inserted into the opening 626, thereby preventing a user's ear inserted into the opening 626 from passing back through the opening 626 easily and thus securing the attachment apparatus 600 to the user.

In some embodiments, the first attachment portion 604 may be configured similarly to the configuration of the first attachment portion 104 (e.g., as described with reference to FIGS. 1A-1B). Specifically, the first attachment portion 604 may be configured to have a shape suitable for engaging or hooking onto an upper root portion of a user's ear. The second attachment portion 606 may be configured to have a shape that is suitable for engaging or hooking onto a lower root portion of a user's ear. In some embodiments, the attachment body 602 may be secured to a user's ear by configuring the attachment apparatus 600 into an open configuration and by inserting the user's ear into an opening 626 formed at least in part by the first attachment portion 604 and the second attachment portion 606. Specifically, the user's ear may be inserted into the opening 626 such that the first attachment portion 604 engages with, hooks onto, or otherwise physically contacts the upper root portion of the ear. Similarly, the second attachment portion 606 may engage with, hook onto, or otherwise physically contact the lower root portion of the ear. As a result, the first attachment portion 604 and the second attachment portion 606 may engage both the upper root portion and lower root portion of the user's ear, thereby ensuring that the attachment body 602 is firmly secured to the user's ear.

In some embodiments, the third attachment portion 608 may be positioned in the attachment body 602 between the first attachment portion 604 and the second attachment portion 606 (e.g., as illustrated in FIG. 6). The third attachment portion 608 may be configured to engage or otherwise physically contact at least an anterior portion of the user's ear (not shown) while the attachment body 602 is secured to the user's ear. In such embodiments, the first attachment portion 604, the second attachment portion 606, and the third attachment portion 608 may completely define the perimeter of the opening 626 (e.g., in contrast with the opening 526 illustrated in FIG. 5 that may be partially defined by the first attachment portion 504 and the second attachment portion 506). The attachment body 602 may be firmly secured to the user's ear because each of the first attachment portion 604, second attachment portion 606, and third attachment portion 608 are collectively configured to engage the user's ear.

In some embodiments, the first attachment portion 604 of the example attachment apparatus 600 may be configured with a shape suitable for preventing or reducing clockwise rotation of the attachment apparatus 600 around the user's left ear. In the example illustrated in FIG. 6, the first attachment portion 604 may be made from a non-elastic or rigid material and may be configured to hang over the upper root portion of the ear. As such, while the attachment body 602 is secured to the user's left ear, any clockwise rotation of the attachment body 602 around the user's left ear may cause an end portion of the first attachment portion 604 (e.g., the hooked portion as illustrated in FIG. 6) to physically engage the upper root portion of the ear. Because the first attachment portion 604 may be configured such that it cannot move through or past the upper root portion, the first attachment portion 604 may limit or prevent clockwise rotation of the attachment body 602 around the user's left ear. In a similar manner, a first attachment portion of a mirror-image of the attachment apparatus 600 may prevent or substantially reduce counterclockwise rotational movement of the mirror-image attachment body around the user's right ear.

In some embodiments, the second attachment portion 606 of the example attachment apparatus 600 for the left ear may be configured with a shape suitable for preventing or reducing counterclockwise rotation of the attachment apparatus 600 around the user's ear. In the example illustrated in FIG. 6, the second attachment portion 604 may be made from a non-elastic or rigid material and may be configured to engage the lower root portion of the ear. As such, while the attachment body 602 is secured to the user's left ear, any counterclockwise rotation of the attachment body 602 around the user's left ear may cause an end portion of the second attachment portion 604 (e.g., the hooked portion as illustrated in FIG. 6) to physically engage the lower root portion of the ear or, in some instances, the anterior portion of the user's left ear. Because the first attachment portion 604 may be configured such that it cannot move through or past the lower root portion or anterior portion of the user's left ear, the first attachment portion 604 may limit or prevent counterclockwise rotation of the attachment body 602 around the user's left ear. In a similar manner, a second attachment portion of a mirror-image of the attachment apparatus 600 may prevent or substantially reduce clockwise rotational movement of the mirror-image attachment body around the user's right ear.

In some embodiments, the first attachment portion 604 and the second attachment portion 606 may be configured jointly to reduce or prevent clockwise and counterclockwise rotation of the attachment apparatus 600 around the user's ear, as described above. Further, the third attachment portion 608 may be configured to reduce or prevent clockwise and counterclockwise rotation of the attachment apparatus 600 around the user's left ear. Specifically, in response to any rotational movement, the third attachment apparatus 608 may push against or otherwise physically engage at least the anterior portion of the user's left ear, which may prevent the third attachment portion 608 (and the attachment body 602 as a whole) from moving or may reduce such movement. In a similar manner, first, second, and third attachment portions of a mirror-image of the attachment apparatus 600 may prevent or substantially reduce clockwise and counterclockwise rotational movement of the mirror-image attachment body around the user's right ear.

Figure 7A:
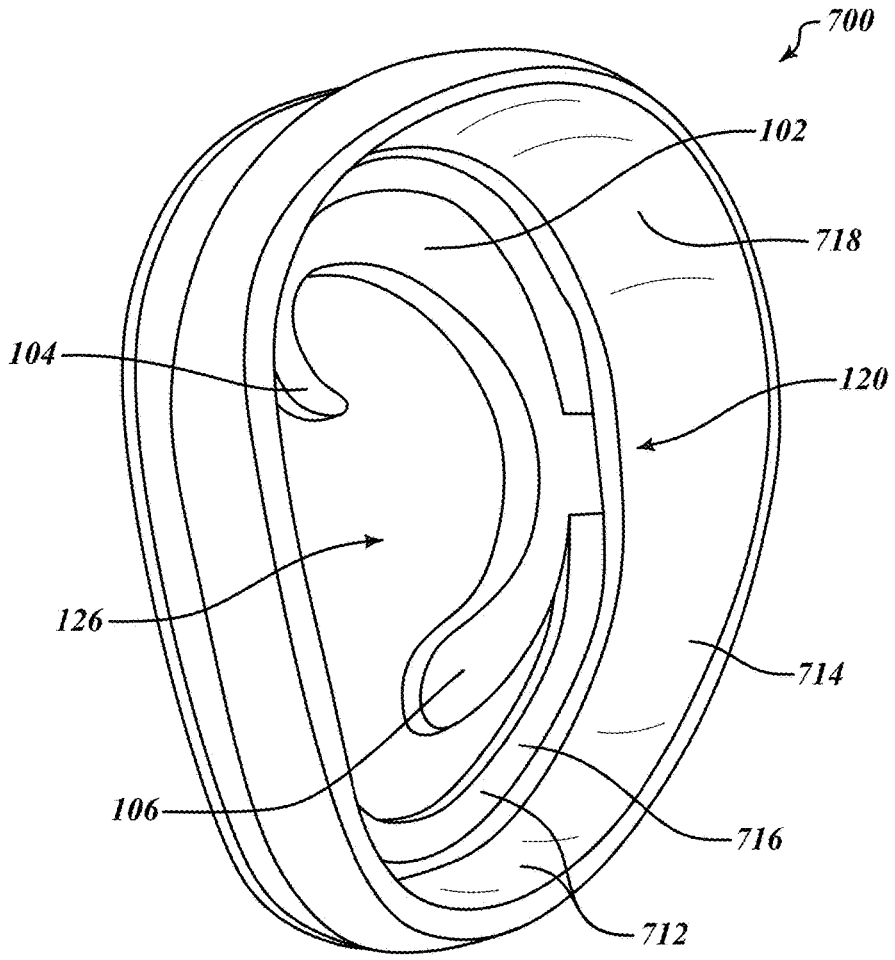
FIGS. 7A-7B are external views of another attachment apparatus in a closed configuration and having an alternative sealing body, according to some embodiments.
Figure 7B:
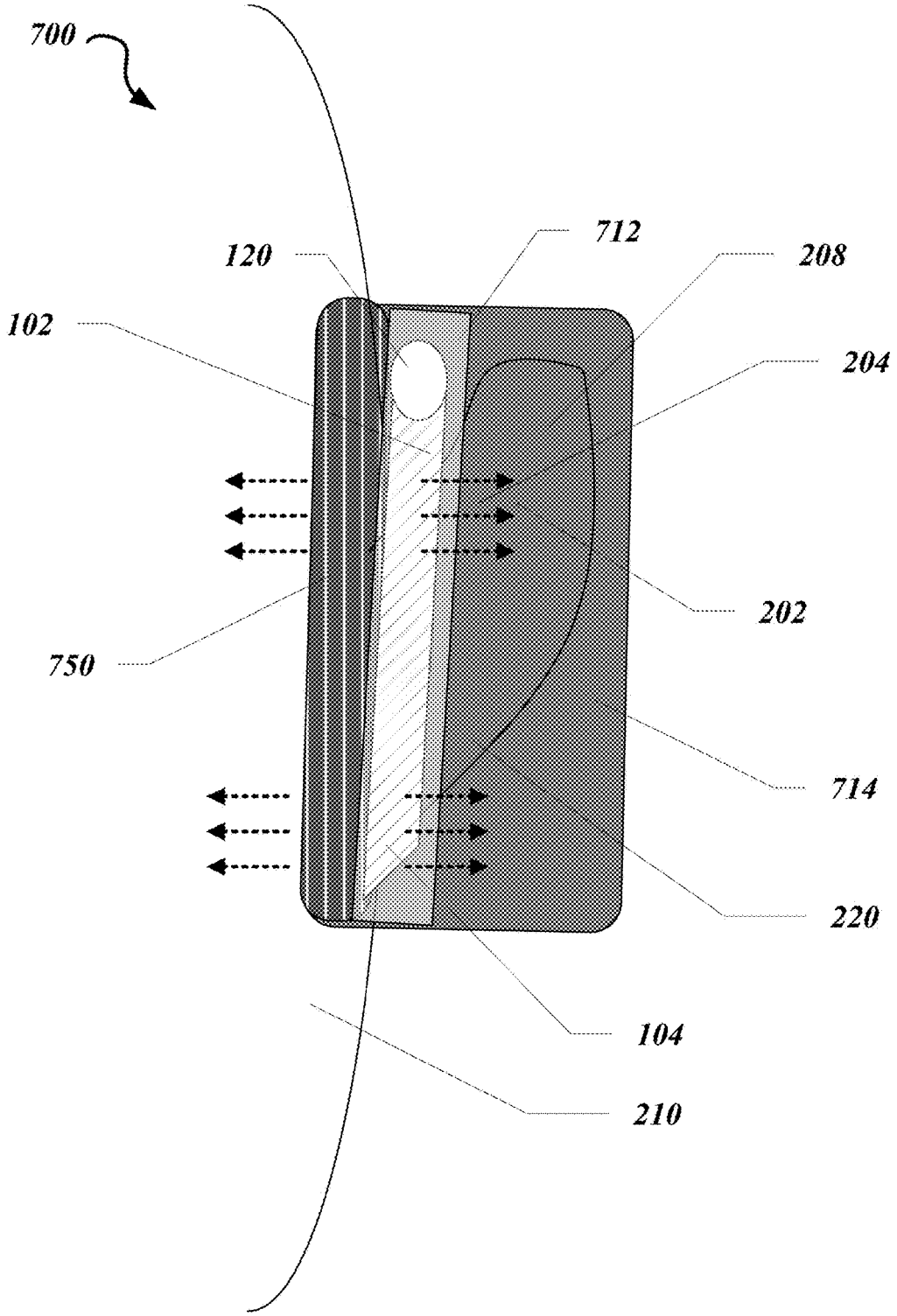

FIGS. 7A-7B illustrate alternative exterior views of an attachment apparatus 700 configured to include an alternative design, according to some embodiments. As shown in the examples of the attachment apparatus 700 illustrated in FIGS. 7A-7B, the attachment apparatus 700 may include one or more structural features that are similar to the structural features described above (e.g., with reference to the attachment apparatuses 100, 300, 400, 500, and/or 600 illustrated in FIGS. 1A-6). Specifically, in some embodiments, the attachment apparatus 700 may include, but is not limited to including, the attachment body 102, the first attachment portion 104 of the attachment body 102, the second attachment portion 106 of the attachment body 102, the joint 120, and the opening 126 defined by the first attachment portion 104 and the second attachment portion 106. Some of the structural features of the attachment apparatus 700 may be analogous to structural features described above, for example, with reference to the attachment apparatuses 100, 300, 400, 500, and/or 600. For clarity and simplicity of description, duplicative descriptions of such structural features of the attachment apparatus 700 may not be repeated in the following descriptions.

FIG. 7A illustrates an exterior view of a front side of the attachment apparatus 700, according to some embodiments. In some embodiments, the attachment body 102 of the attachment apparatus 700 may be coupled to a sealing body 712, such as via the joint 120. In some embodiments, the sealing body 712 may be made from one or more rigid or semi-rigid materials or combinations of these materials. For example, the sealing body 712 may be made from hard plastic or rubber. In some embodiments, the sealing body 712 may be made from at least partially elastic materials or combination of at least partially elastic materials. The sealing body 712 may include a sealing frame 716, which may be configured to have characteristics and/or functions similar to the characteristics and/or functions of the sealing frame 116 (e.g., as described with reference to FIGS. 1A and 1B). For example, the sealing frame 716 may be configured to be moved about the joint 120 such that the sealing frame 716 may be moved (e.g., swung or rotated) away from the attachment body 102 to configure the attachment apparatus 700 in an open configuration or may be moved toward and engage with the attachment body 102 in order to configure the attachment apparatus 700 in a closed configuration.

The sealing frame 716 may be coupled to sealing material 714. The sealing material 714 may be made from one or more elastic materials that includes, for example, plastic, rubber, or the like. In some embodiments, the sealing material 714 may be configured to include or form a curved groove or channel extending away from the sealing frame 716. In some embodiments, the curved groove or channel (e.g., a groove 718) of the sealing material 714 may be configured to accommodate at least a posterior portion of the user's ear. For example, the sealing material 714 may be configured to allow the posterior portion of the user's ear to sit within the groove 718 of the sealing material 114 so that a surface of the posterior portion of the user's ear contacts a surface of the sealing material 714 when the attachment body 102 is secured to the user's ear and when the attachment apparatus 700 is configured in a closed configuration.

FIG. 7B illustrates a semi-transparent view of the top side of the attachment apparatus 700. In the example illustrated in FIG. 7B, the attachment body 102 may be secured to the ear 202 of a user, and the attachment apparatus 700 may be in a closed configuration in which the attachment body 102 and sealing body 712 have physically engaged. In some embodiments, in attaching the attachment body 102 to the ear 202 of the user, an elastic portion 750 of the sealing material 714 may be compressed. For example, the elastic portion 750 of the sealing material 714 may be closer to the center plane of the user than the attachment body 102. Thus, while the attachment body 102 is secured to the ear 202, the elastic portion 750 may be in a compressed or deformed state. As indicated by the dotted reference lines illustrated in FIG. 7B, while in the compressed state, the elastic portion 750 may attempt to return to the resting configuration (e.g., via expansion), which may cause the elastic portion 750 to push against the head of the user while simultaneously pushing the attachment apparatus 700 away from the user's head. However, because the attachment body 102 is secured to the user's ear 202, the elastic portion 750 may be unable to displace the attachment apparatus 700 or may not be able to displace the attachment apparatus 700 to an extent that would allow the elastic portion 750 to return fully to a resting configuration. As a result, the elastic portion 750 may remain in at least a partially compressed state while the attachment body 102 is secured to the user's head, and the elastic portion 750 may form at least a partial acoustic seal against the user's head by continuously pushing against the user's head. In some embodiments, the elastic portion 750 may transition to a resting configuration when the attachment apparatus 700 transitions to an open configuration, for example, when the sealing body 712 is moved away from the attachment body 102 via the joint 120.

Figure 8A:
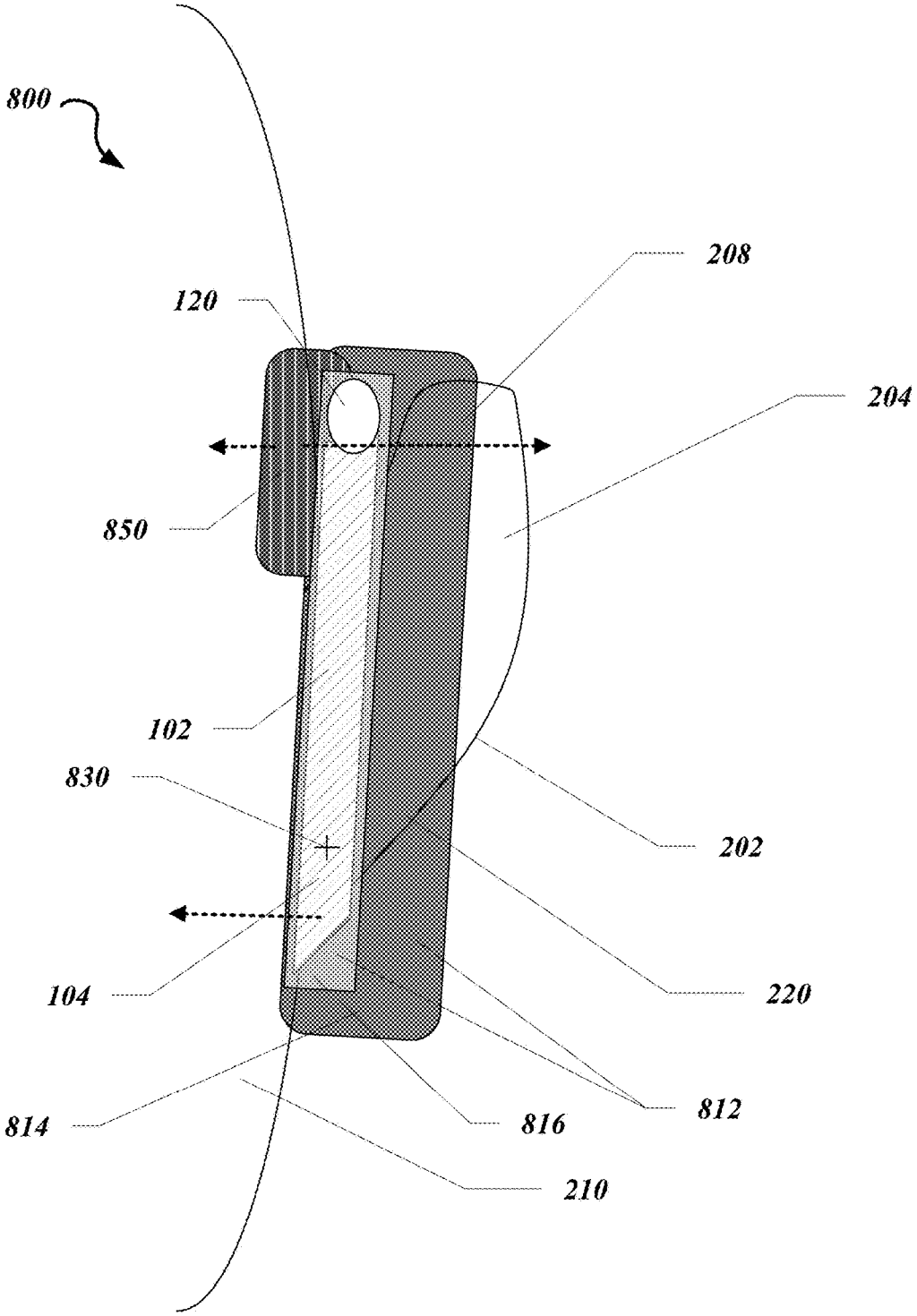
FIG. 8A is a semi-transparent, external view of a top side of another attachment apparatus while the attachment apparatus is secured to a user's ear and configured in a closed configuration, according to some embodiments.
Figure 8B:
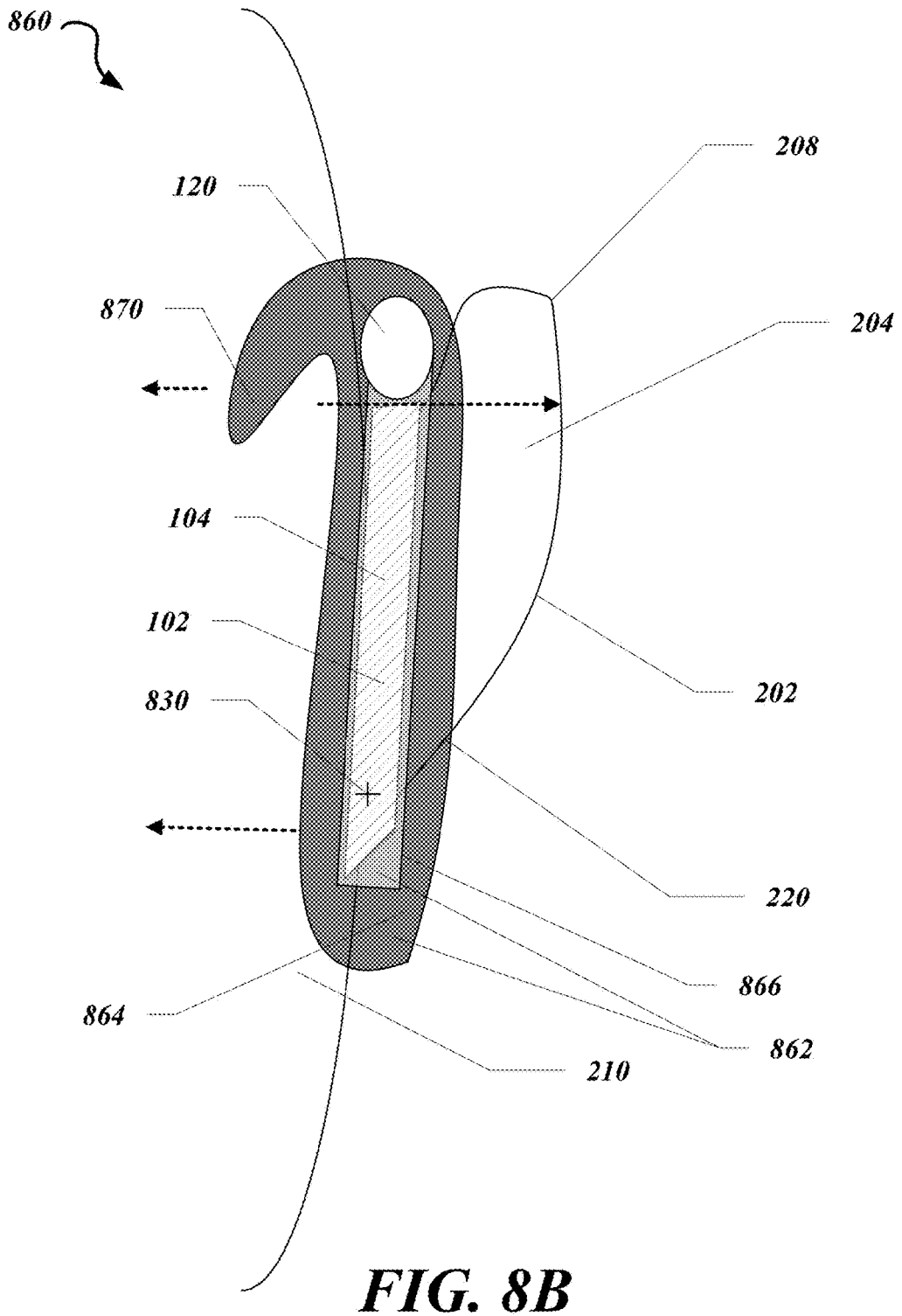
FIG. 8B is a semi-transparent, exterior view of a top side of another attachment apparatus that is secured to a user's ear and configured in a closed configuration, according to some embodiments.

FIGS. 8A-8B illustrate semi-transparent, top-down views of alternative attachment apparatuses 800, 860 configured to include alternative designs, according to some embodiments. As shown in the examples of the attachment apparatuses 800, 860 illustrated in FIGS. 8A and 8B, the attachment apparatuses 800, 860 may include one or more structural features that are similar to the structural features described above (e.g., with reference to the attachment apparatuses 100, 300, 400, 500, 600, and/or 700 illustrated in FIGS. 1A-7B). Specifically, in some embodiments, the attachment apparatuses 800, 860 may include, but are not limited to including, the attachment body 102, the first attachment portion 104, the second attachment portion 106, and the joint 120. Some of the structural features of the attachment apparatuses 800, 860 may be analogous to structural features described above, for example, with reference to the attachment apparatuses 100, 300, 400, 500, 600, and/or 700. For clarity and simplicity of description, duplicative descriptions of such structural features of the attachment apparatuses 800, 860 may not be repeated in the following descriptions.

With reference to the example illustrated in FIG. 8A, the attachment apparatus 800 may be attached to the user's ear 202 and may be configured in a closed configuration (e.g., as described with reference to FIGS. 1A-1D). Specifically, the attachment body 102 may be secured to the user's ear 202 and may be coupled to a sealing body 812, such as via the joint 120. In some embodiments, the sealing body 812 may include sealing material 814 that is coupled to, molded on top of, or otherwise affixed to a sealing frame 816. While the attachment body 102 is secured to the user's ear 202, the sealing frame 816 may be moved from an open configuration towards the attachment body 102 until the sealing frame 816 is positioned in close proximity to the user. For example, the sealing frame 816 may be moved toward the attachment body 102 via the joint 120 until the outer portion 208 of the user's ear 202 passes through an opening in the sealing frame 816 and the outer portion 208 comes into proximity to the user, for example, by surrounding the ear 202 (e.g., as described with reference to the sealing frame 116 illustrated in FIGS. 1A-1B). In some embodiments (not shown), the attachment apparatus 102 and the sealing body 812 may be coupled together using one or more coupling devices (e.g., the coupling devices 108*a*, 108*b*, 110*a*, 110*b* as described with reference to FIGS. 1A-1B).

The sealing material 814 may be coupled to the sealing frame 816 such that at least the sealing material 814 forms at least a partial acoustic seal around the ear 202 of the user while the attachment body 102 is secured to the user's ear and while the attachment apparatus 800 is configured in a closed configuration. In some embodiments, the sealing material 814 may include a biasing portion 850. The biasing portion 850 may be configured as a protrusion of a part of the sealing material 814 proximal to the root of the posterior portion 208 of the ear 202. The biasing portion 850 (and, optionally, some or all of the sealing material 814) may be made from elastic or semi-elastic materials or a combination of materials, including but not limited to rubber, plastic, or the like. In such embodiments, the biasing portion 850 may be configured according to one or more configurations to function as a spring or spring-like mechanism that may urge at least a portion of the sealing body 812 away from the median plane of the user's body while the attachment apparatus 800 is secured to the user's ear 202 and in a closed configuration.

In the example illustrated in FIG. 8A, the biasing portion 850 may be a relatively larger amount of the sealing material 814 that is coupled to a portion of the sealing frame 816 that is proximal to the root portion of the posterior portion 208 of the ear 202. In some embodiments, while the attachment apparatus 800 is in an open configuration, the biasing portion 850 may be in an uncompressed configuration in which the biasing portion 850 may not be compressed or may experience only slight compression. During transition of the attachment apparatus 800 from an open configuration to a closed configuration, the biasing portion 850 may come into physical contact with the body of the user and may transition from the uncompressed configuration to a compressed or partially compressed configuration. While the attachment apparatus 800 is in a closed configuration, the attachment body 102 may be firmly secured to the ear 202 such that the attachment body 102 and the sealing body 812 are fixed or substantially fixed to the ear 202 and the biasing portion 850 may remain in the compressed or partially compressed configuration.

While in the compressed configuration, the biasing portion 850 may attempt to transition from the compressed configuration to an uncompressed configuration, such as through expansion, a springing action, or the like. As a result, the biasing portion 850 may push against the head of the user in proximity to the root of the posterior portion 208 of the ear 202 and may displace the sealing frame 816 away from the median plane of the user's body (e.g., as illustrated in FIG. 8A by the dotted arrows). However, as described, the sealing frame 816 may be coupled to the attachment body 102 and thus secured to the ear 202, thereby causing the expansion or springing action of the biasing portion 850 to cause the sealing body 812 (and, in some embodiments, the attachment body 102) to pivot about an axis of rotation that is at least substantially parallel to a vertical central line of the user's body (e.g., represented in FIG. 8A by axis 830). As a result, the expansion or springing action of the biasing portion 850 may also cause at least one portion of the sealing body 812 and/or the attachment body 102 located in proximity to the anterior portion 220 of the ear to be urged towards the median plane of the user and into contact with the face 210 of the user. Accordingly, in some embodiments, the biasing portion 850 may cause the portions of the sealing body 812 and attachment body 102 in proximity to the anterior portion 220 of the ear 202 to form at least a partial acoustic seal or to improve such a seal formed around the ear 202 in proximity to the face 210 of the user.

FIG. 8B illustrates the attachment apparatus 860 that may be configured to include an alternative sealing body 862. Specifically, in the example illustrated in FIG. 8B, the sealing body 862 may include sealing material 864 coupled to the sealing frame 866. In some embodiments, the sealing material 864 may include a biasing portion 870 that be made from an elastic or semi-elastic material or combination of materials and may be configured to function as a spring-like mechanism. As illustrated, the biasing portion 870 may be configured to include a tail-like portion. In particular, while the attachment apparatus 860 is secured to the user's ear 202 and in a closed configuration, the biasing portion 870 may be in a compressed or partially compressed configuration and may bias a portion of the sealing frame 866 (and, in some embodiments, the attachment body 102 proximal to the root of the posterior portion 208 of the ear 202) away from the median plane of the user's body. As a result of this biasing, the attachment body 102 and/or the sealing body 862 may pivot about a rotational axis that is at least substantially parallel to a vertical center line of the user's body (e.g., represented in FIG. 8A by the axis 830), which may cause another portion of the sealing frame 866 and/or the attachment body 102 to be urged towards the user's face 210, thereby creating or improving at least a partial acoustic seal formed against the user's face 210.

Figure 9:
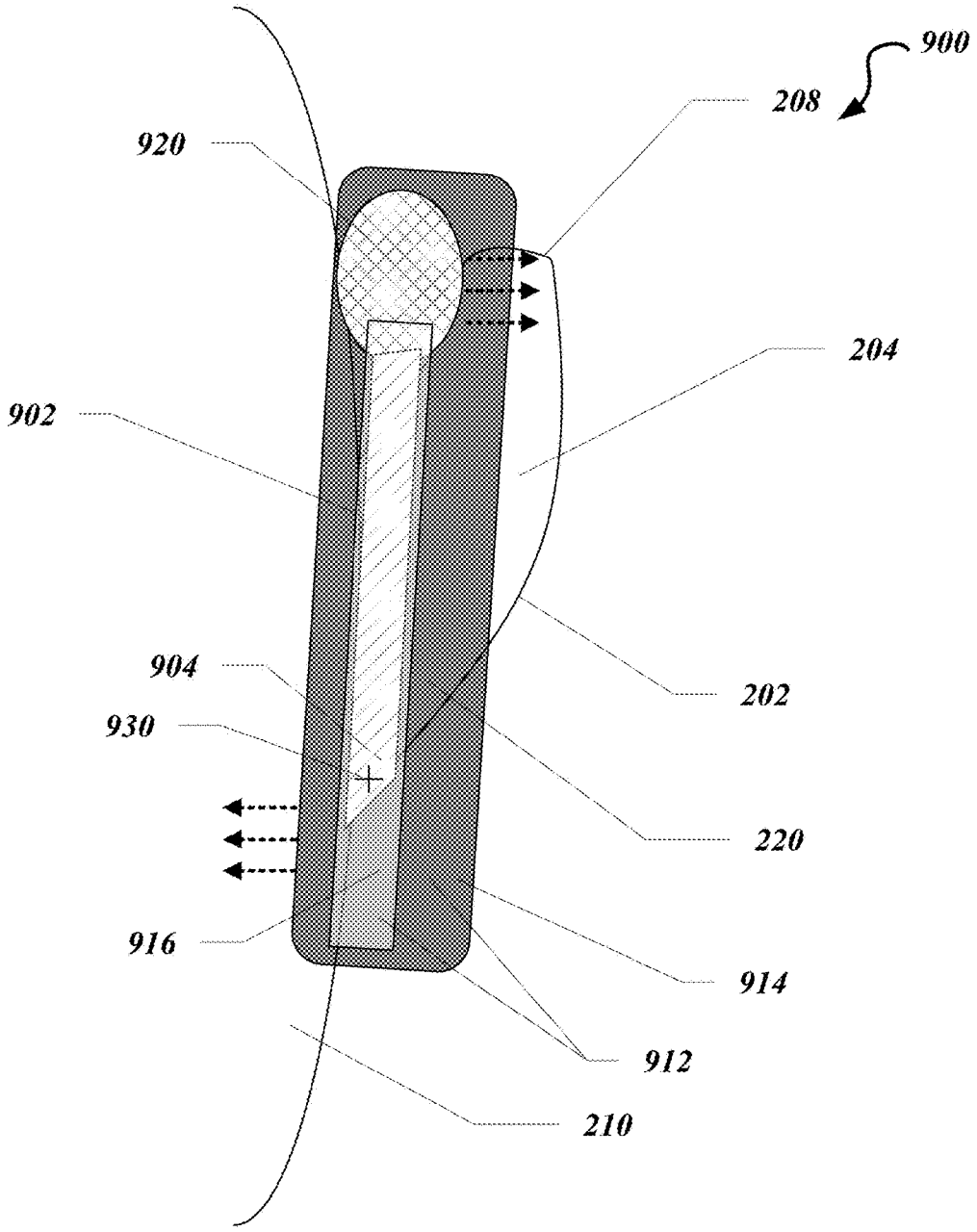
FIG. 9 is a semi-transparent, exterior view of a top side of another attachment apparatus configured in a closed configuration, according to some embodiments.

FIG. 9 illustrates a semi-transparent, top-down view of an alternative attachment apparatus 900 configured to include an alternative design, according to some embodiments. As shown in the example of the attachment apparatus 900 illustrated in FIG. 9, the attachment apparatus 900 may include one or more structural features that may at least be somewhat analogous to structural features described above (e.g., with reference to the attachment apparatuses 100, 300, 400, 500, 600, 700, 800, and/or 860 illustrated in FIGS. 1A-8B). For example, the attachment apparatus 900 may include an attachment body 902, a first attachment portion 904 of the attachment body, a second attachment portion of the attachment body 906 (not shown), a joint (not shown), a sealing body 912, a sealing frame 916 of the sealing body, and sealing material 914 of the sealing body 912. For clarity and simplicity of description, duplicative descriptions of such structural features of the attachment apparatus 900 may not be repeated in the following descriptions.

In some embodiments, the attachment body 902 may include a displacement portion 920. In such embodiments, the displacement portion 920 may be configured to have a width that is larger than other portions of the attachment body 902. For example, the displacement portion 920 may bulge out or protrude from the attachment body 902, as depicted in the example illustrated in FIG. 9. In some alternative embodiments (not shown), the displacement portion 920 may be configured to curve away from the head of the user and to curve towards a back surface of the posterior portion 208 of the ear 202. According to one or more of these configurations, the displacement portion 920 may displace the posterior portion 208 of the ear 202 in a direction that is away from a median plane of the user while the attachment apparatus 900 is secured to the user's ear 202. The interaction of the posterior portion 208 of the ear 202 and the displacement portion 920 may bias at least a portion of the sealing body 912 proximal to the face 210 of the user towards the median plane of the user as a result of pivoting about an axis of rotation that is at least substantially parallel to a vertical central line of the user's body (e.g., represented in FIG. 9 by axis 930). Because the sealing body 912 is coupled to the attachment body 102, the biasing of the sealing body 912 may similarly bias the first attachment portion 104 of the attachment body 102 in a direction that causes the first attachment portion 104 of the attachment body 102 to engage with the user. For example, the first attachment portion 104 may press against the face of the user 210, thereby forming or contributing to the formation of at least a partial acoustic seal against the user's face.

In some embodiments, a joint of an attachment apparatus is described above and illustrated in the accompanying drawings as being positioned near the posterior portion of the user's ear. However, in some embodiments, the joint may be positioned in various other locations on the attachment body and/or the sealing body of the attachment apparatus without changing (or without substantially changing) the functionality or characteristics of the attachment apparatus (e.g., as described above). As such, unless otherwise limited by the claims, the description or illustration of a joint positioned near a posterior portion of the user's ear is merely for ease of description and does not prohibit the joint from being positioned elsewhere on the attachment body and/or sealing body.

Some embodiments of an attachment apparatus are described above as including an attachment body coupled to a sealing body via a joint. In some alternative embodiments, the attachment body and the sealing body may be formed as one structural feature of the attachment apparatus. Accordingly, in such embodiments, the attachment body may be configured to secure the attachment apparatus to a user's ear while forming at least a partial acoustic seal around the user's ear without requiring a separate sealing body. Some embodiments of attachment apparatuses having an attachment body that forms at least a partial acoustic seal without a separate sealing body are described herein at least with reference to FIGS. 10A-12B.

FIGS. 10A-10E illustrate exterior views of an alternative attachment apparatus 1000, according to some embodiments. The attachment apparatus 1000 may include a plurality of features, including: an attachment body 1002, a coupling edge 1012, a front portion 1004, a back portion 1006, a groove 1010 of the back portion 1006, a biasing body 1020, an interior surface 1024 of the biasing body 1020, a first portion 1022 of the biasing body 1020 and a second portion 1028 of the biasing body 1020. The attachment apparatus 1000 may also include an opening 1008 defined by the attachment body 1002. The various features of the attachment apparatus 1000 are further described as follows.

Figure 10A:
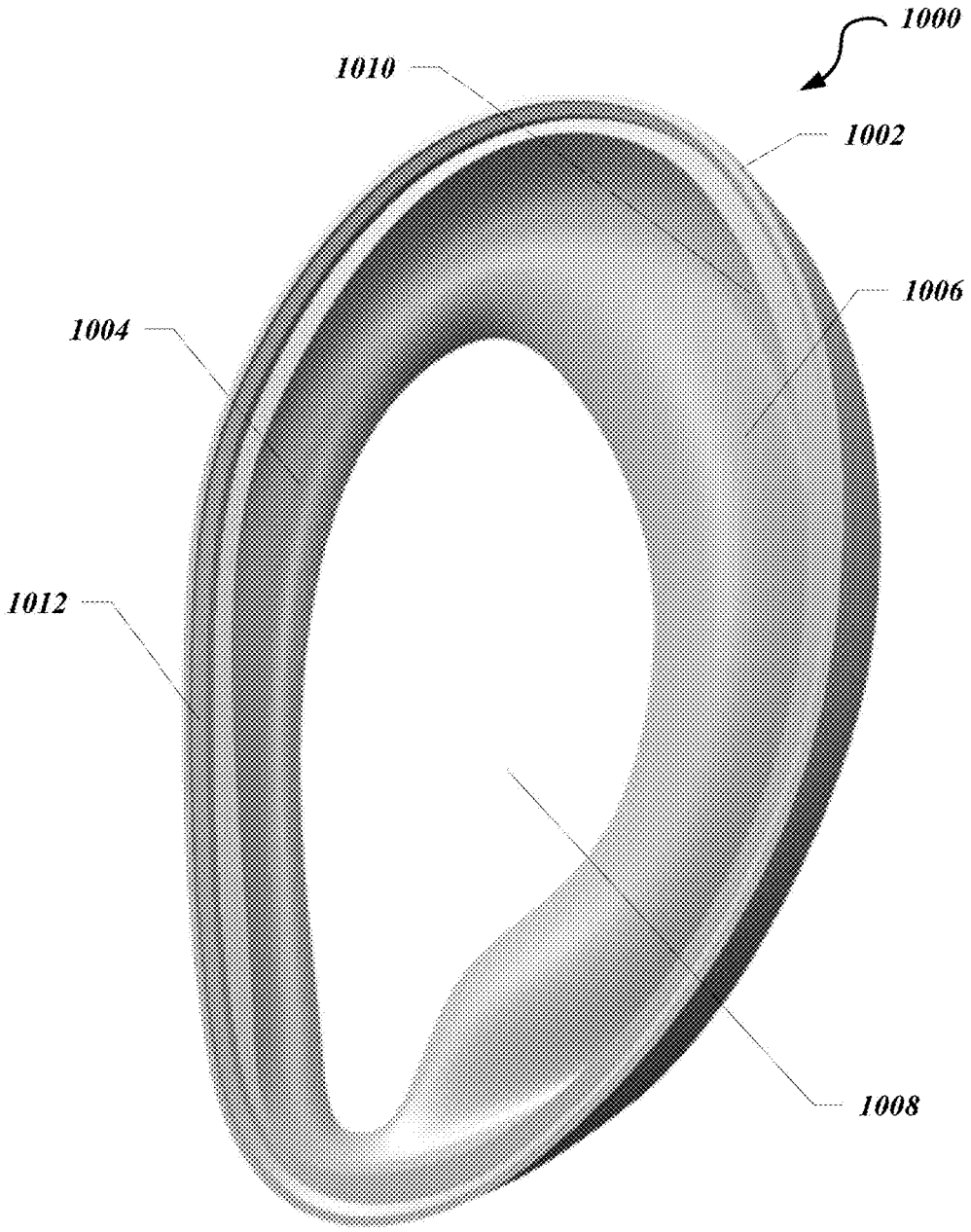
FIGS. 10A-E are different views of an attachment apparatus having an alternative design, according to some embodiments.

FIG. 10A illustrates an exterior view of a front side of the attachment apparatus 1000. In some embodiments, the front portion 1004 and the back portion 1006 may be configured to define the opening 1008, which is substantially positioned at a center of the attachment body 1002. In some embodiments, the attachment body 1002 may be configured such that the opening 1008 has a shape that approximates a profile of a root of a human ear. The size and shape of the opening 1008 may enable a majority of a human ear to pass through the opening 1008. The size and shape of the attachment body 1002 may also enable the majority of the ear to come into physical contact with one or more surfaces of the attachment body 1002. Once the attachment apparatus 1000 is secured to the ear of the user, the shape of the opening 1008 may prevent or reduce rotation of the attachment apparatus 1000 around the user's ear.

The back portion 1006 of the attachment body 1002 may be configured to form a curved groove or channel (e.g., the groove 1010) between the opening 1008 and the coupling edge 1012. In some embodiments, the groove 1010 of the back portion 1006 may be configured to accommodate a posterior portion of the user's ear. For example, the back portion 1006 may allow the posterior portion of the user's ear to sit within the groove 1010 of the back portion 1006. Additionally, a surface of the posterior portion of the user's ear may be in physical contact with the back portion 1006 while the attachment apparatus 1000 is secured to the user.

In some embodiments, the front portion 1004 and the back portion 1006 may be configured such that the opening 1008 is asymmetrical. In some embodiments, the opening 1008 may be configured to approximate the asymmetry of the profile of a human ear. In such embodiments, the opening 1008 may accommodate the asymmetry of the profile of a human ear and, thus, may enable the user's ear to pass through the opening 1008 easily. In some alternative embodiments (not shown), the front portion 1004 and the back portion 1006 may be configured so that the opening 1008 is at least substantially symmetrical.

The coupling edge 1012 may be configured to couple the attachment body 1002 to a cover body (e.g., as generally described with reference to FIGS. 12A-12B). The coupling edge 1012 may be configured to run along an edge of the attachment body 1002. The perimeter of the coupling edge 1012 may be larger than the size or perimeter of the opening 1008. As a result, the portion of the user's ear that passes through the opening 1008 may not contact the coupling edge 1012.

Figure 10B:
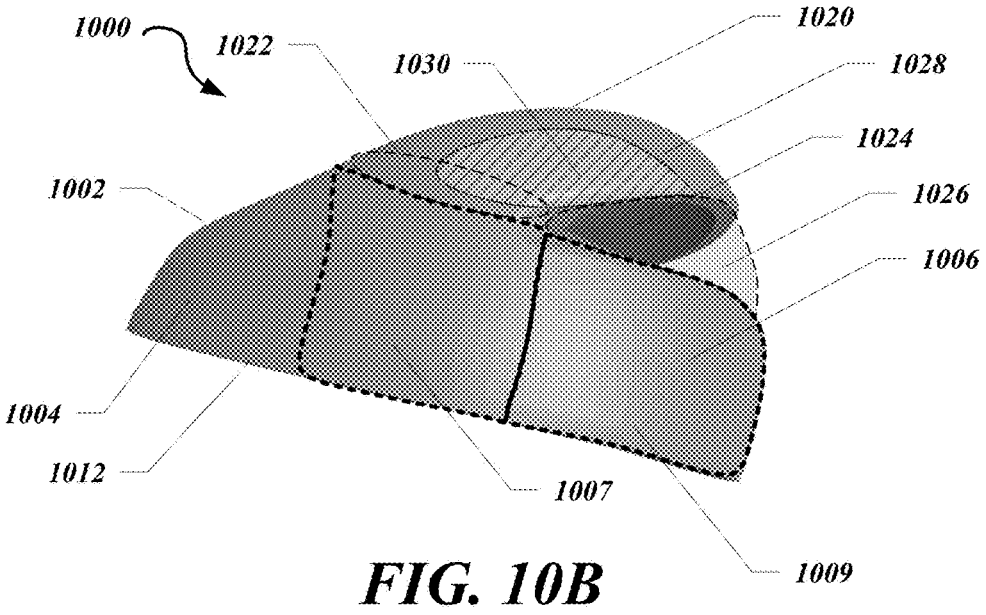
Figure 10C:
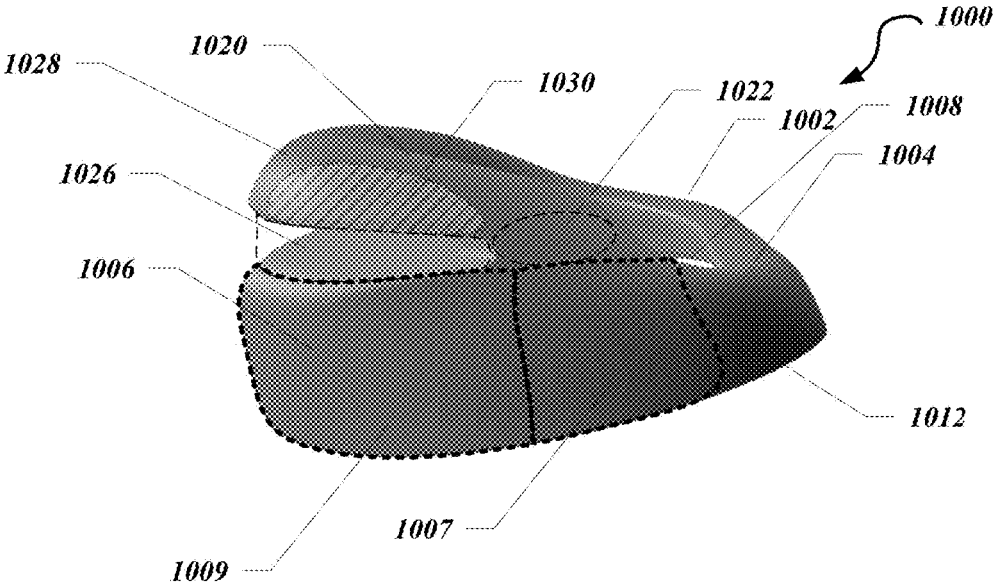

FIGS. 10B-10C illustrates exterior views of a top side and a bottom side, respectively, of the attachment apparatus 1000 described with reference to FIG. 10A, according to some embodiments. With reference to the examples illustrated in FIGS. 10B-10C, the biasing body 1020 may be configured as a protrusion of a part of the attachment body 1002, such as by protruding from a back surface of the back portion 1006 of the attachment body 1002 in a direction extending away from the coupling edge 1012. In some embodiments (e.g., as illustrated in FIGS. 10A-10E), the biasing body 1020 may be formed as part of the attachment body 1002. In some alternative embodiments, the biasing body 1020 may be configured as a separate structure that is joined to or coupled to the back portion 1006 of the attachment body 1002, such as through welding, adhesives, coupling devices, or the like. The biasing body 1020 may be made from elastic or semi-elastic materials or a combination of materials, including but not limited to rubber, plastic, or the like. In such embodiments, the biasing body 1020 may be configured according to one or more configurations to function as a spring or spring-like mechanism, for example, as further described herein.

The biasing body 1020 may include a first portion 1022 and a second portion 1028. In some embodiments in which the biasing body 1020 is formed as part of the attachment body 1002, the first portion 1022 of the biasing body 1020 may be proximal to a first portion 1007 of the back portion 1006 of the attachment body 1002. In some optional embodiments in which the biasing body 1020 is initially formed as a separate structure from the attachment body 1002, the first portion 1022 of the biasing body 1020 may be coupled to the first portion 1007 of the back portion 1006 of the attachment body 1002, such as through welding, adhesives, fasteners, molding, or the like. In some embodiments, the second portion 1028 of the biasing body 1020 and a second portion 1009 of the back portion 1006 of the attachment body 1002 may form a gap 1026. In some embodiments, the biasing body 1020 may be configured to be able to transition between a resting configuration and a deformed configuration. While the biasing body 1020 is in a deformed configuration, a size of at least one dimension of the gap 1026 may be less than a size of that at least one dimension while the biasing body 1020 is configured in a resting configuration.

In some embodiments, while the biasing body 1020 is in the resting configuration, the biasing body 1020 may receive an external force (e.g., a compressive or pushing force) that may cause the biasing body 1020 to transition to a biased configuration by biasing the biasing body 1020 in a direction towards the second portion 1009 of the back portion 1006 of the attachment body 1002. In some embodiments, the second portion 1028 of the biasing body 1020 may be biased towards the second portion 1009 of the back portion 1006 of the attachment body 1002 at least until the gap 1026 is entirely or substantially closed. For example, the biasing body 1020 may receive a compressive force that causes the second portion 1028 of the biasing body 1020 to move or to biased towards the second portion 1009 of the back portion 1006 of the attachment 1002, and the biasing body 1020 may continue biasing or moving towards the second portion 1028 until the compressive force is removed and/or until the gap 1026 between the second portion 1028 of the biasing body 1020 and the second portion 1009 of the back portion 1006 of the attachment body 1002 is closed.

In some embodiments, the biasing body 1020 may be made from one or more elastic materials or may otherwise have elastic properties that may enable the biasing body 1020 to transition from a biased or deformed configuration back to a resting configuration when the compressive force is removed from the biasing body 1020. Accordingly, while the biasing body 1020 is in a biased or deformed configuration, the first portion 1022 of the biasing body 1020 may exert a force that urges, biases, or moves the attachment body 1002 in a direction that is away from the biasing body 1020 (or vice versa). For example, such force may be transferred from the first portion 1022 of the biasing body 1020 to the first portion 1007 of the back portion 1006 of the attachment body 1006, which may cause the attachment body 1006 to bias, move, or deflect away from the biasing body 1020. In some embodiments, the first portion 1022 of the biasing body 1020 may be configured to function as a pivot or fulcrum to transfer force from the biasing body 1020 to the attachment body 1002 while the biasing body 1020 is configured in a deformed configuration, and this force may urge, bias, or move at least a portion of the attachment body 1002 in a direction that is away from the biasing body 1020. In some additional (or alternative) embodiments, the first portion 1022 of the biasing body 1020 may cause the biasing body 1020 to bias, move, or deflect away from the attachment body 1002 when the biasing body 1020 transitions from a biased or deformed configuration to a resting configuration (e.g., when an external force is removed from the biasing body 1020).

In some embodiments, the biasing body 1020 may include an at least partially hollow chamber 1030 within the biasing body 1020. The chamber 1030 may be configured to increase or facilitate the overall elasticity or elastic responsiveness of the biasing body 1020. Specifically, an interior surface 1024 of the biasing body 1020 proximate to the chamber 1030 may form a curved groove or channel (e.g., a bowl-shaped formation). In some embodiments, by configuring the interior surface 1024 to have a curved or bowl shape, the biasing body 1020 may increase the springing or counter force generated by the biasing body 1020 in response to receiving a compressive force. In such embodiments, this relatively increased counter force may be transferred from the biasing body 1020 to the attachment body 1002 while the biasing body 1020 is in a biased or deformed configuration, thereby causing the attachment body 1002 to be biased, moved, or deflected in a direction away from the biasing body 1020 with a relatively larger amount of force and/or to a relatively greater degree than if the biasing body 1020 were a solid structure. However, in some alternative embodiments, the biasing body 1020 may not include the chamber 1030 or the internal surface 1024, and instead, the biasing body 1020 may be configured as an at least substantially solid structure.

In some embodiments, the biasing body 1020 and the attachment body 1002 may be configured so that the gap 1026 is not formed between the biasing body 1020 and the attachment body 1002. In such embodiments, the gap 1026 (e.g., as illustrated in FIGS. 10B-10C) may instead be filled with material that is more compliant than the materials from which the attachment body 1002 and/or the biasing body 1020 are made. For example, the gap 1026 may be filled with a foam or another soft material that may compress while the biasing body 1020 is in a deformed configuration and that may decompress while the biasing body 1020 is in the resting configuration.

Figure 10D:
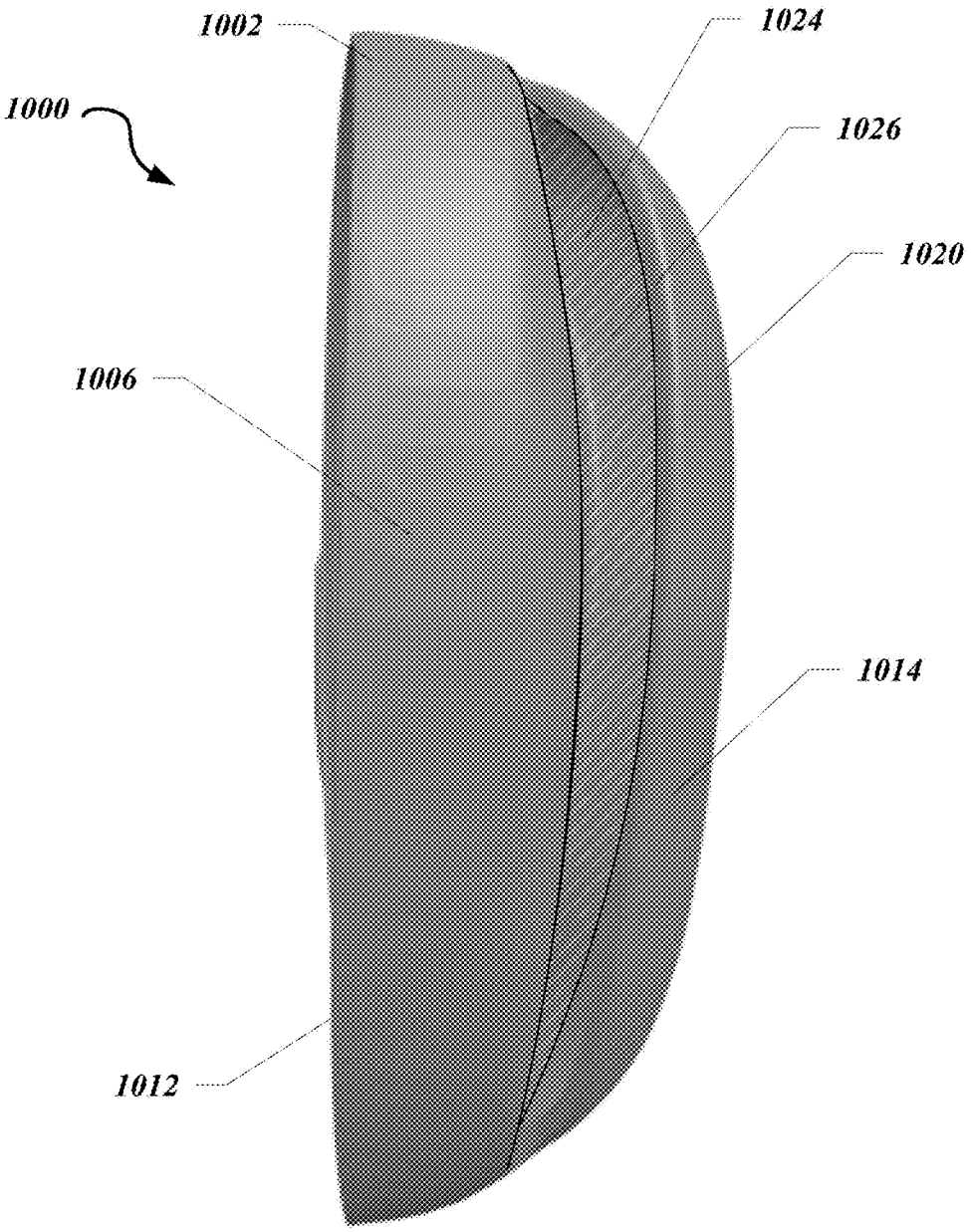
Figure 10E:
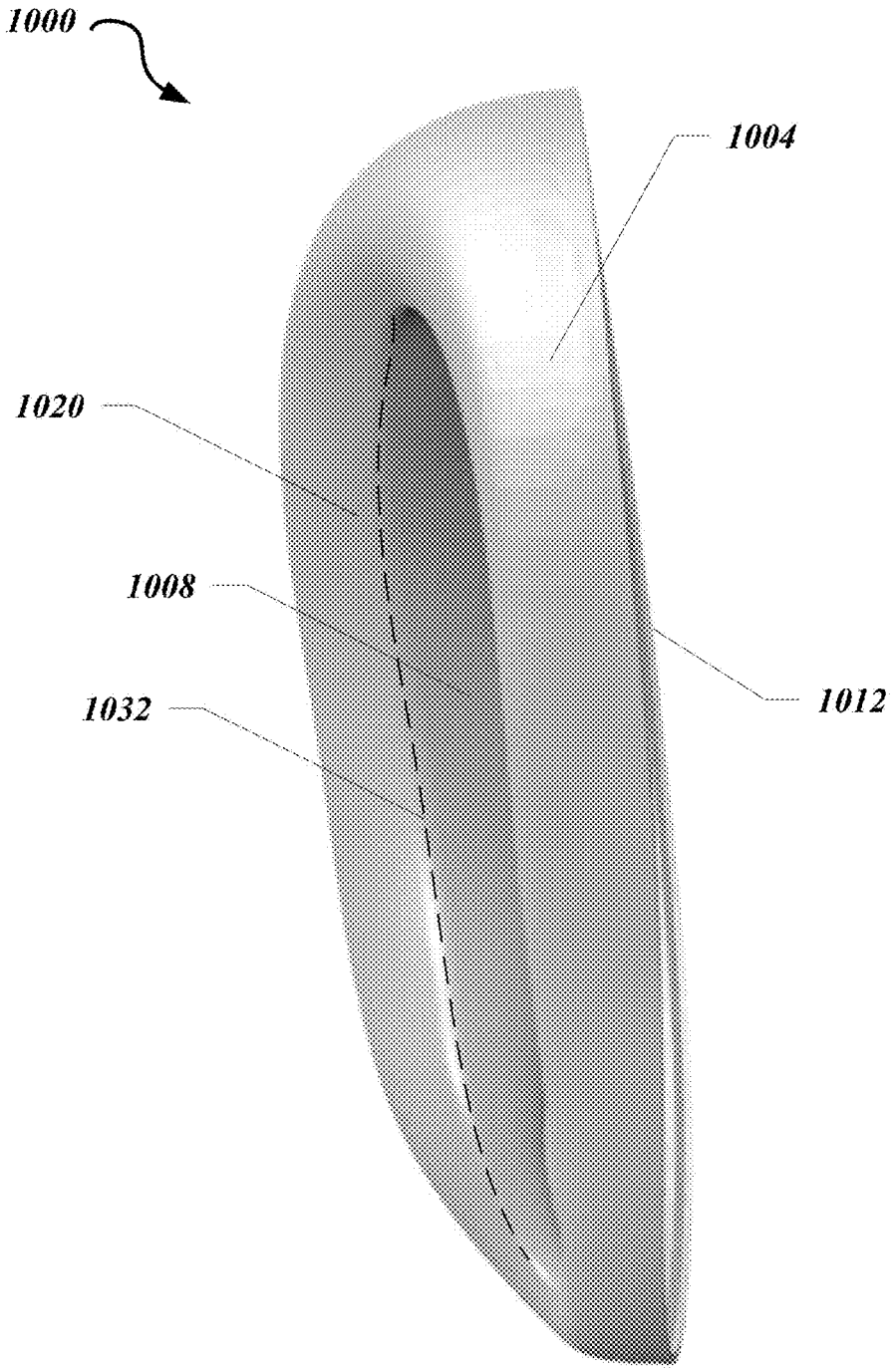

FIG. 10D illustrates an exterior view of a left side of the attachment apparatus 1000. In some embodiments, the gap 1026 between the biasing body 1020 and the attachment body 1002 may extend or substantially extend along a vertical profile of the attachment apparatus 1000. FIG. 10E illustrates an exterior view of a right side of the attachment apparatus 1000. In some embodiments, in transitioning between a resting configuration and a deformed configuration (or vice versa), the biasing body 1020 may be configured to flex or bend along a referential line 1032, which for ease of description, illustrates a division between the biasing body 1020 and the attachment body 1002 (e.g., as described above).

In the corresponding drawings illustrating FIGS. 10B, 10C, and 10E, dotted referential lines are illustrated to indicate general locations or positions of features and/or to describe such features depicted in the examples illustrated in FIGS. 10B, 10C, and 10E above. The placement and extent of these dotted referential lines are included in the drawings corresponding to FIGS. 10B, 10C, 10E merely for ease of reference and description and are not meant to limit the extent or position of the portions of the attachment apparatus 1000 described in light of these dotted referential lines. As such, unless otherwise limited in the claims, the positions of various features of the attachment apparatus 1000 may have the same or different configurations and/or positions with respect to the attachment apparatus 1000 without loss of generality.

Figure 11A:
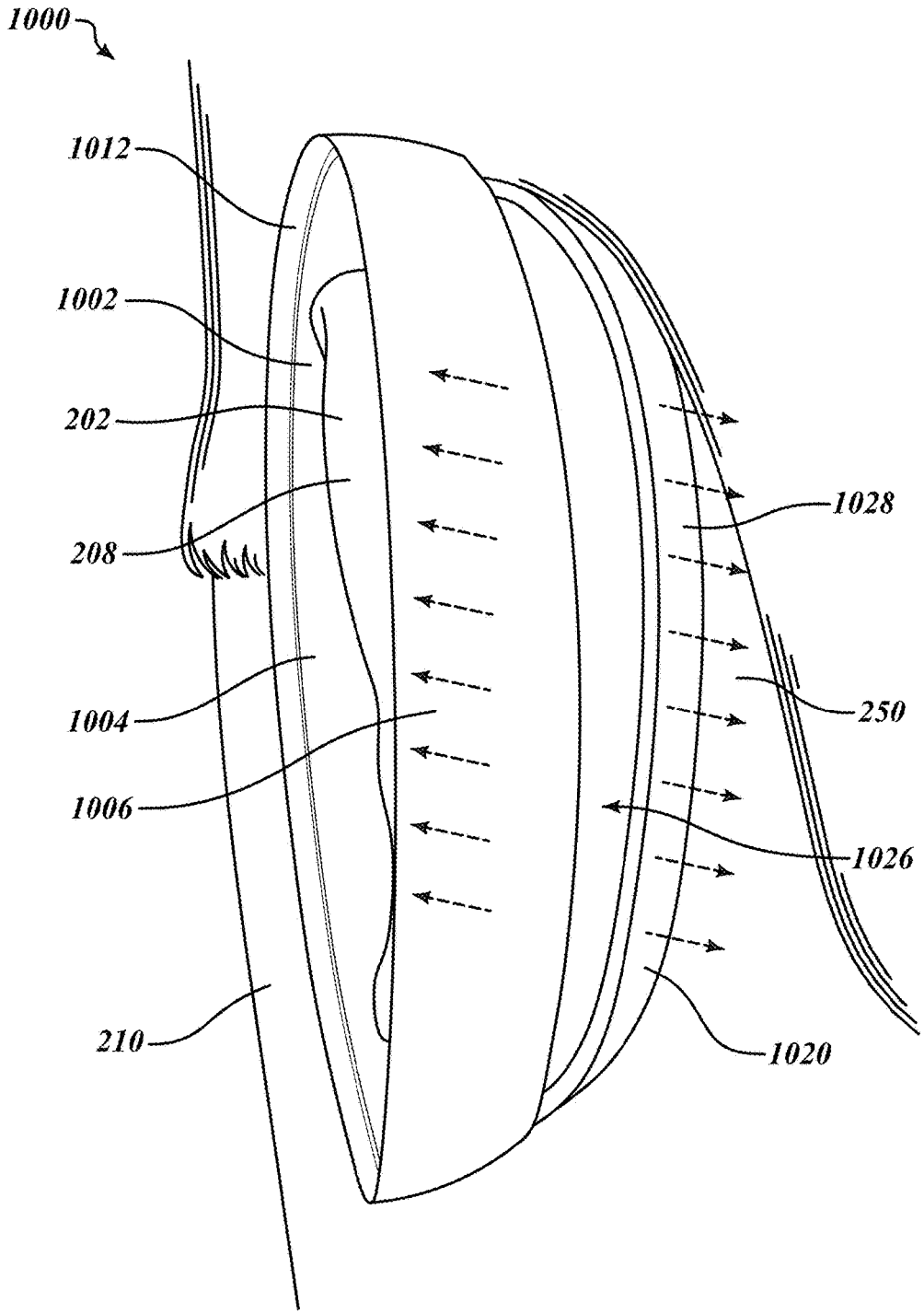
FIGS. 11A-B are different views of the attachment apparatus depicted in FIGS. 10A-10E while secured to a user's ear, according to some embodiments.
Figure 11B:
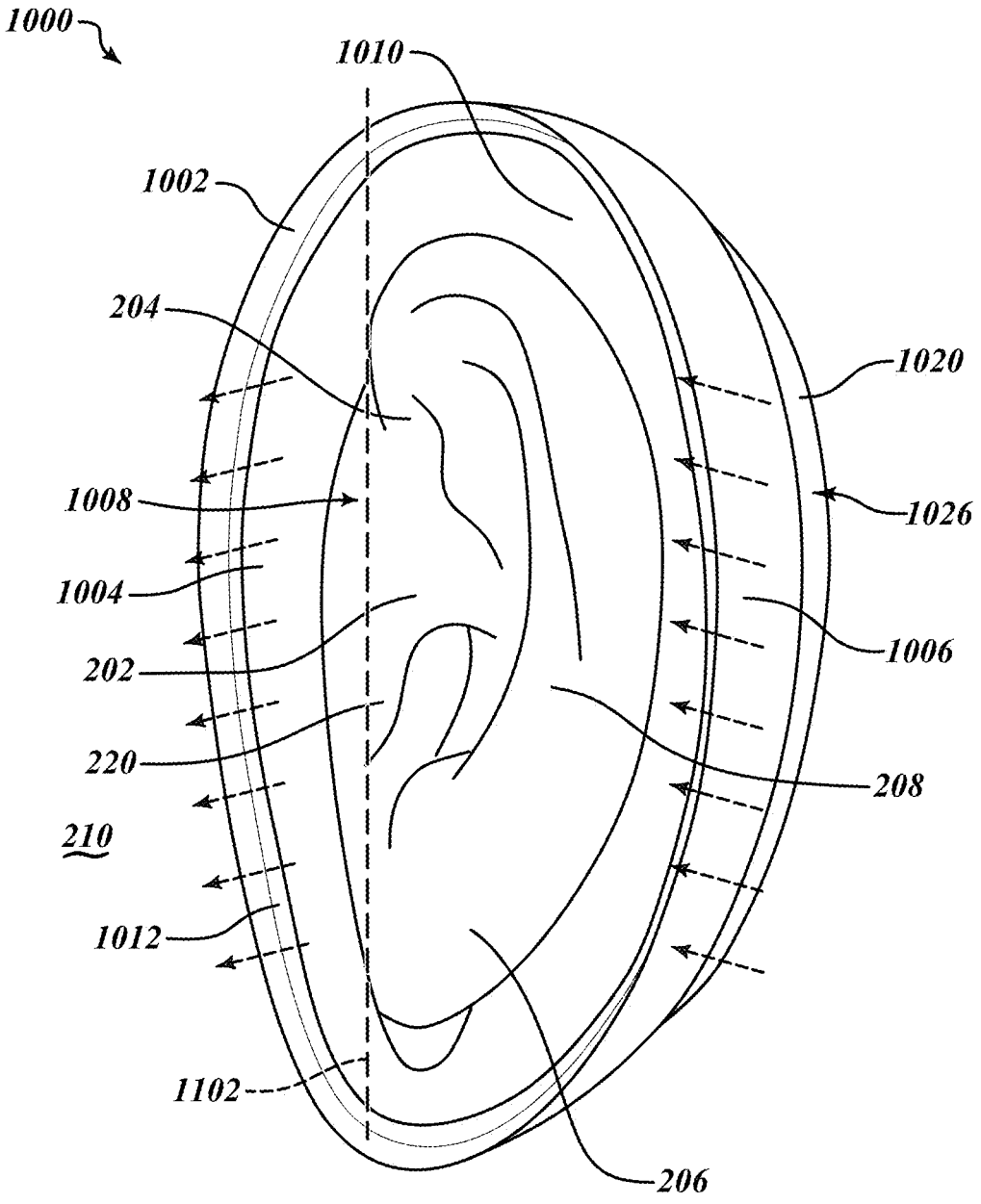

FIGS. 11A-11B are different exterior views of the attachment apparatus depicted in FIGS. 10A-10E while the attachment apparatus is secured to an ear of a user, according to some embodiments. Specifically, FIG. 11A is an exterior perspective view of the right side of the attachment apparatus 1000 while secured to a user's ear 202, according to some embodiments. FIG. 11B is an exterior perspective view of a front side of the attachment apparatus 1000 while secured to the user's ear 202. The attachment apparatus 1000 may include one or more structural features that are similar to the structural features described above (e.g., with reference to FIGS. 10A-10E). For clarity and simplicity of description, duplicative descriptions of such structural features of the attachment apparatus 1000 may not be repeated in the following descriptions.

In the examples illustrated in FIGS. 11A and 11B, a majority of the user's ear 202 may have been inserted through the opening 1008 (e.g., as generally described with reference to FIG. 10A). Once coupled to the attachment apparatus 1000, the posterior portion 208 of the ear 202 may be received or engaged by the back portion 1006 of the attachment body 1002. For example, a surface of the posterior portion 208 of the ear 202 may lay flush against the groove 1010 formed from the back portion 1006 of the attachment body 1002. As described, the back portion 1006 may be configured to contour to the general anatomical features of the posterior portion 208 of the ear 202 to enable the posterior portion 208 to fit comfortable with the attachment body 1002. The root of the lower portion 206 of the ear 202 may be received within at least the front portion 1004 of the attachment body 1002. Similarly, the root of the upper portion 204 of the ear 202 may be received by the front portion 104 of the attachment body 1002. Once secured to the attachment apparatus 1000, a majority of the ear 202 may reside, substantially or entirely, in a partial chamber formed from the front portion 1004 and back portion 1006 of the attachment body 1002. In some embodiments, the front portion 1004 and the back portion 1006 may be configured such that the back portion 1006 extends in a direction away from the median plane of the user farther than the extent to which the front portion 1004 extends away from the median plane of the user. As such, the anterior portion 220 of the ear 202 may not be visible or may only be partially visible when viewed from the right side of the attachment apparatus 1000 (e.g., as illustrated in FIG. 11A). In contrast, the posterior portion 208 may be at least partially visible from the left side of the attachment apparatus 1000 because the front portion 1004 may not extend as far away from the median plane of the user as the back portion 1006.

With specific reference to the example illustrated in FIG. 11A, while the attachment apparatus 1000 is secured to the ear 202, the attachment body 1002 and the biasing body 1020 may be fixed or substantially fixed to the root of the ear 202 (e.g., as generally described above), and the biasing body 1020 may be configuration remain in the deformed or partially deformed configuration so long as the attachment apparatus 1000 is secured to the ear 202. Specifically, while the attachment apparatus 1000 is secured to the user's ear, the back portion 1006 of the attachment body 1002 and the biasing body 1020 may at least partially occupy a space between the posterior portion 208 of the ear and a surface 250 of the head of the user in proximity to the posterior portion 208 of the ear 202. In some embodiments, a combined width of the back portion 1006 of the attachment body 1002, the biasing body 1020, and the gap 1026 between the back portion 1006 and the biasing body 1020 may be greater than at least one dimension of that space between the posterior portion 208 of the ear and the surface 250 of the head. Thus, in such embodiments, while the attachment apparatus 1000 is secured to the user's ear 202, the biasing body 1020 and the back portion 1006 of the attachment body 1002 may be compressed between the posterior portion 208 of the ear 202 and the surface 250 of the head. As a result, the biasing body 1020 may be displaced or biased in a direction toward the back portion 1006 of the attachment body 1002, thereby causing at least one dimension of the gap 1026 to be reduced. As described (e.g., with reference to FIGS. 10A-10E), while the biasing body 1020 is in a deformed configuration between the posterior portion 208 of the ear 202 and the surface 250 of the user's head, the biasing body 1020 may attempt to revert to a resting configuration through a spring-like action, such as by pressing against the surface 250 and displacing, moving, or biasing the back portion 1006 of the attachment body 1002 in a direction that is away from the biasing body 1020 (e.g., as indicated by the dotted force lines illustrated in FIG. 11A and as generally described with reference to FIGS. 10B-10C). Because of this springing action of the biasing body 1020, the biasing body 1020 may firmly engage the surface 250 of the user's head, thereby forming at least a partial acoustic seal between the biasing body 1020 and the surface 250.

With reference to the example illustrated in FIG. 11B, while the attachment apparatus 1000 is secured to the ear 202 and thus while the biasing body 1020 is in the deformed configuration, the biasing body 1020 may attempt to transition from a deformed configuration to a resting configuration, such as through expansion, a springing action, or the like. As a result, the biasing body 1020 may push against the surface 250 of the head of the user in proximity to the root of the posterior portion 208 of the ear 202 and may displace the attachment body 1002 away from the median plane of the user's body (e.g., as illustrated in FIG. 11B by the dotted arrows). However, as described, the root of the ear 202 may be received by and thus secured by at least the front portion 1004 of the attachment body 1002, thereby causing the expansion or springing action of the biasing body 1020 to cause the attachment body 1002 to pivot about an axis of rotation that is at least substantially parallel to a vertical central line of the user's body (e.g., represented in FIG. 11B by the dotted referential line 1102). As a result, the expansion or springing action of the biasing body 1020 may also cause at least one portion of the front portion 1004 of the attachment body 1002 located in proximity to the anterior portion 220 of the ear to be urged towards the median plane of the user and into contact with the face 210 of the user. Accordingly, in some embodiments, the biasing body 1020 may cause the portions of the sealing body 812 and attachment body 102 in proximity to the anterior portion 220 of the ear 202 to form at least a partial acoustic seal or to improve such a seal formed around the ear 202 in proximity to the face 210 of the user.

Figure 12A:
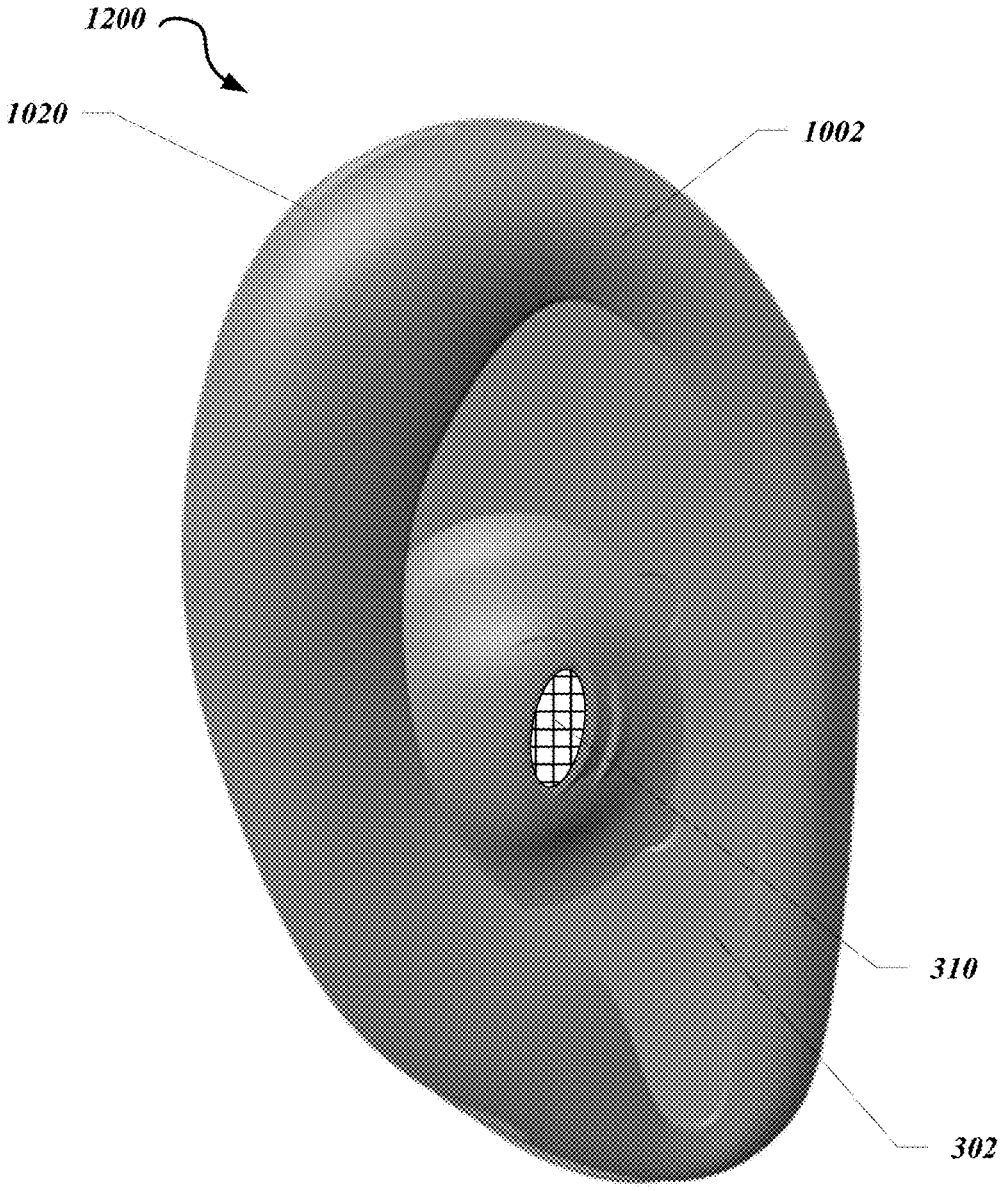
FIGS. 12A-12B are exterior views of an attachment apparatus having an alternative design, according to some embodiments.
Figure 12B:
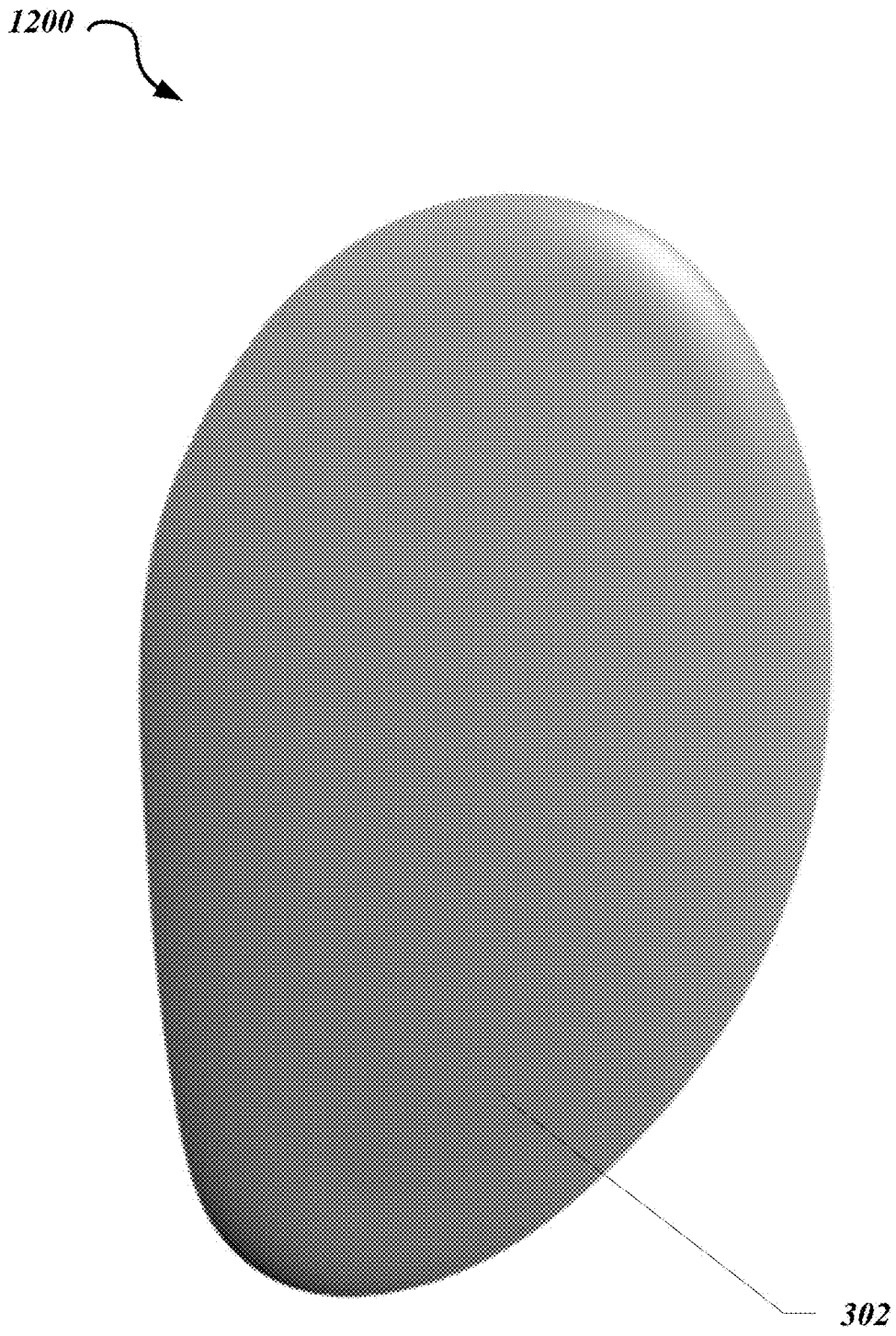

FIGS. 12A-12B illustrate exterior views of an alternative attachment apparatus 1200, according to some embodiments. Specifically, FIG. 12A illustrates an exterior view of a back side of the attachment apparatus 1200, and FIG. 12B illustrates an exterior view of a front side of the attachment apparatus 1200. The attachment apparatus 1200 may include one or more structural features that are similar to the structural features described with reference to one or more of the apparatuses 100, 300, 400, 500, 600, 700, 800, 860, 900, 1000 (e.g., as described with reference to FIGS. 1A-11B). Specifically, in some embodiments, the attachment apparatus 1200 may include, but is not limited to including, the attachment body 1002, the mid-ear portion 310, and the cover body 302 coupled to the attachment body 1002 via the coupling edge 1012 (not shown). For clarity and simplicity of description, duplicative descriptions of such structural features of the attachment apparatus 1200 may not be repeated to satisfy enablement.

In some embodiments (shown or not shown), one or more of the apparatuses 100, 300, 400, 500, 600, 700, 800, 860, 900, 1000, 1200 (e.g., as described above with reference to and illustrated in FIGS. 1A-12) may be configured to encapsulate or substantially encapsulate the user's ear. In such embodiments, one or more of the apparatuses 100, 300, 400, 500, 600, 700, 800, 860, 900, 1000, 1200 may include a cover body (e.g., the cover body 302) that may be coupled to an attachment body and/or a sealing body to form an acoustically isolated (or substantially isolated) environment in which the ear 202 resides while the one or more of the apparatuses 100, 300, 400, 500, 600, 700, 800, 860, 900, 1000, 1200 are secured to the ear 202. Further, in some embodiments, one or more of the apparatuses 100, 300, 400, 500, 600, 700, 800, 860, 900, 1000, 1200 may be configured to include a cover body that houses one or more audio components, speaker systems, or the like, for example as generally described above with reference to the attachment apparatus 400 (see, for example, FIGS. 4A and 4B).

Some embodiments of an attachment apparatus are described above as including an attachment body having a rigid C-shape (or a similar rigid, hooked shape). However, in some alternative embodiments, an attachment apparatus may include an attachment body that is coupled to a deformable hooking body. According to such embodiments, the attachment body may include a bridging member and a plate member. The bridging member may be configured to couple the hooking body to a plate member of the attachment body such that a space suitable for receiving a portion of the user's ear is formed between the hooking body and the plate member. The hooking body may be positioned on the user's ear so that the hooking body engages at least a root of a posterior portion of the user's ear and the bridging member engages a root of an upper portion of the user's ear. The hooking body may be deformed to conform to the root of the posterior portion of the user's ear to secure or further secure the attachment apparatus to the user's ear. In some embodiments, the plate member of the attachment body may be configured such that one or more speakers, earpads, electronic components, and/or various other physical bodies/systems can be mounted on or to the plate member. For example, a speaker system may be mounted to the plate member so that the speaker system is near the user's ear canal while the attachment apparatus is secured to the user's ear. In some embodiments, a sealing body may be directly or indirectly coupled to the plate member of the attachment body, and the sealing body may form at least a partial acoustic seal around the user's ear while the attachment apparatus is secured to the user's ear via the hooking body. Some embodiments of attachment apparatuses having at least a hooking body and an attachment body are further described herein at least with reference to FIGS. 13A-30.

FIGS. 13A-E illustrate different exterior views of an alternative attachment apparatus 1300, according to some embodiments. The attachment apparatus 1300 may include a plurality of features, including—without limitation—an attachment body 1302 and a hooking body 1322. In some embodiments, the attachment body 1302 may include a bridging member 1312 and a plate member 1306 that optionally includes a mid-ear portion 1304. The various features of the attachment apparatus 1300 are further described as follows.

Figure 13A:
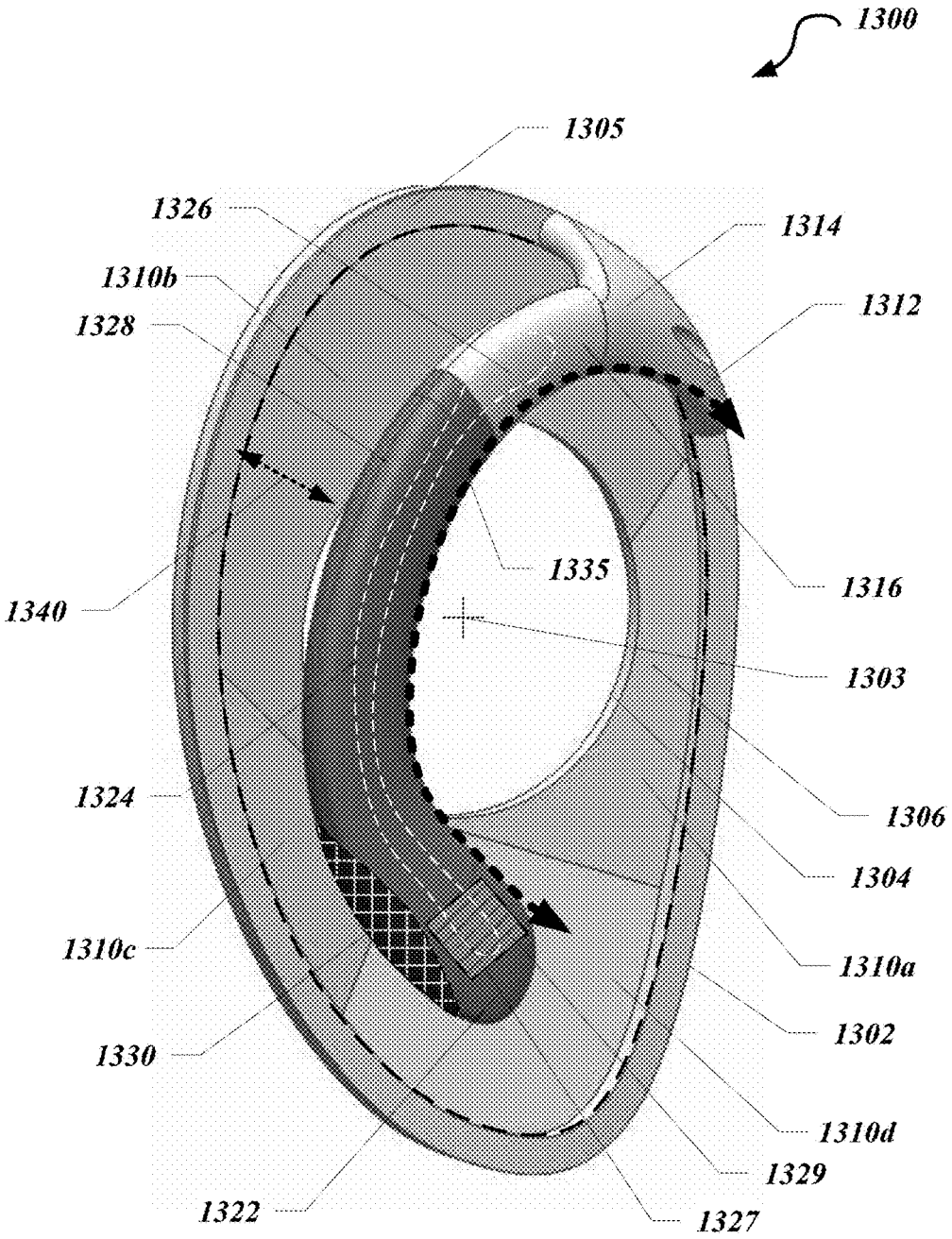
FIGS. 13A-13E are views of an attachment apparatus having an alternative design, according to some embodiments.

With reference to FIG. 13A, the hooking body 1322 may include a deformable core 1324 and a cushioning portion 1328. The deformable core 1324 may be made of one or more materials (or combinations of such materials) that are flexible and non-resilient, such as aluminum, non-springing steel, or the like. In some embodiments, a first end portion 1326 of the deformable core 1324 may be coupled to or embedded within the bridging member 1312 of the attachment body 1302. In the example illustrated in FIG. 13A, the first end portion 1326 of the deformable core 1324 may be embedded within or otherwise anchored to a second portion 1316 of the bridging member 1312. Accordingly, the first end portion 1326 of the deformable core 1324 may not be moved (or at least not easily moved) in relation to the attachment body 1302. A second end portion 1327 of the deformable core 1324 may not be coupled, anchored, or otherwise attached to the attachment body 1302 and thus may be moved freely in relation to the attachment body 1302.

The hooking body 1322 may include a cushioning portion 1328 that may be made from one or more materials suitable for physically engaging a user's ear comfortably. For example, the cushioning portion 1328 may be made from one or more of (or a combination of) soft plastics, leathers, rubbers, silicone, or the like. In some embodiments, a portion of the cushioning portion 1328 of the hooking body 1322 may be coupled to the bridging member 1312 of the attachment body 1302 via adhesives, welding, overmolding, complementary male/female connections, and/or one or more of fasteners of various known types. As depicted in the example illustrated in FIG. 13A, a portion of the cushioning portion 1328 in proximity to the first end 1326 of the deformable core 1324 may be affixed to the second portion 1316 of the bridging member 1312.

In some embodiments, the cushioning portion 1328 may be configured to include an optional cutout 1330. The cutout 1330 of the cushioning portion 1328 may be configured to accommodate a user's finger such that a force received on the hooking body 1322 from the user's finger is directed along a predefined directional plane. For example, the cutout 1330 of the cushioning portion 1328 may be configured to guide a user to press against the hooking body 1322 along a directional plane that is substantially parallel to the plane of a surface of the plate member 1306 that is proximate to the hooking body 1322.

In some embodiments and as further described herein (e.g., with reference to FIGS. 13D-13E), the hooking body 1322 may be configured to have a shape that generally conforms to at least a portion of a root of a posterior portion of a user's ear. The configuration of the hooking body 1322 may enable a portion of a root of the posterior portion of the user's ear to come into physical contact with one or more surfaces of the cushioning portion 1328. For example, as illustrated in FIG. 13A, the hooking body 1322 may have a substantially curved, C-shape that approximates the profile shape of a root of a posterior portion of a user's ear.

In some embodiments, the bridging member 1312 may be configured to have a shape such that at least a portion of each of the hooking body 1322 and the bridging member 1312 collectively form a curved shape that approximates the shape of a root of a posterior portion of a user's ear. In the example illustrated in FIG. 13A, the hooking body 1322 and the bridging member 1312 may each be configured such that, when the hooking body 1322 and the bridging member 1312 are coupled or otherwise secured together, the hooking body 1322 and the bridging member 1312 form a curved shape (e.g., as indicated by dotted reference line 1335) that corresponds and is complementary to (at least substantially) a curved shape of a root of a posterior portion of a user's ear. Accordingly, in such embodiments, the hooking body 1322 and the bridging member 1312 may collectively be configured to accommodate a portion of a user's ear at least by receiving a surface of a root of the posterior portion of the user's ear.

In some embodiments, the deformable core 1324 may be configured to receive a deforming force that causes at least the second end portion 1327 of the deformable core 1324 to move in the direction of the force that is received. Thus, because the first end portion 1326 is coupled to, anchored to, or embedded in the bridging member 1312, the force received on the deformable core 1324 may not move (or may only minimally move) the first end portion 1326 of the deformable core 1324 in relation to the attachment body 1302. In some embodiments, the deformable core 1324 may be configured such that the deformable core 1324 is capable of being moved within a limited range of movement. For example, the deformable core 1324 may be configured to move only in response to receiving a force that would move the deformable core 1324 along a plane that is substantially parallel to a plane of the plate member 1306 of the attachment body 1302. In some embodiments (not shown), the hooking body 1322 and/or the attachment body 1302 may include one or more physical structures that physically prevent or obstruct the deformable core 1324 from moving in one or more directions and/or from moving beyond a predetermined extent.

In some alternative (or additional) embodiments, the hooking body 1322 may include an end piece 1329. In such embodiments, the second end 1327 of the deformable core 1324 may be coupled to the end piece 1329 such that the second end 1327 of the deformable core 1324 is embedded in the end piece 1329. Specifically, the end piece 1329 may be coupled to or embedded in the cushioning portion 1328 of the hooking body 1322 and may be configured to anchor the second end 1327 of the deformable core 1324 to the cushioning portion 1328. As a result, the end piece 1329 may physically obstruct movement of the second end 1327 of the deformable core 1324 in relation to the cushioning portion 1328, thereby decreasing (or eliminating) the likelihood that the second end 1327 of the deformable core 1324 will puncture the cushioning portion 1328 as the hooking body 1322 is deformed/moved.

In some embodiments, the bridging portion 1312 may be coupled to or may be an extension of the plate member 1306. In the example illustrated in FIG. 13A, a first portion 1314 of the bridging member 1312 may be coupled to (or may extrude from) the plate member 1306. In some embodiments, the bridging member 1312 may be coupled to the plate member 1306 along a coupling edge 1305 that extends along at least a portion of the perimeter of the plate member 1306. In some embodiments, the bridging member 1312 may be coupled to the plate member 1306 at a position on the plate member 1306 other than along the coupling edge 1305, such as at a position that is closer to the center of the plate member 1306 (e.g., as represented by a center position 1303 depicted in FIG. 13A). In some alternative embodiments, the bridging member 1312 may be indirectly coupled to the attachment body 1302 by way of a separate hook coupling body (not shown). Specifically, in such embodiments, the first portion 1314 of the bridging member 1312 may be coupled to the hook coupling body, and the hook coupling body may, in turn, be coupled to the plate member 1306 of the attachment body 1302 (e.g., via the coupling edge 1305).

Figure 13C:
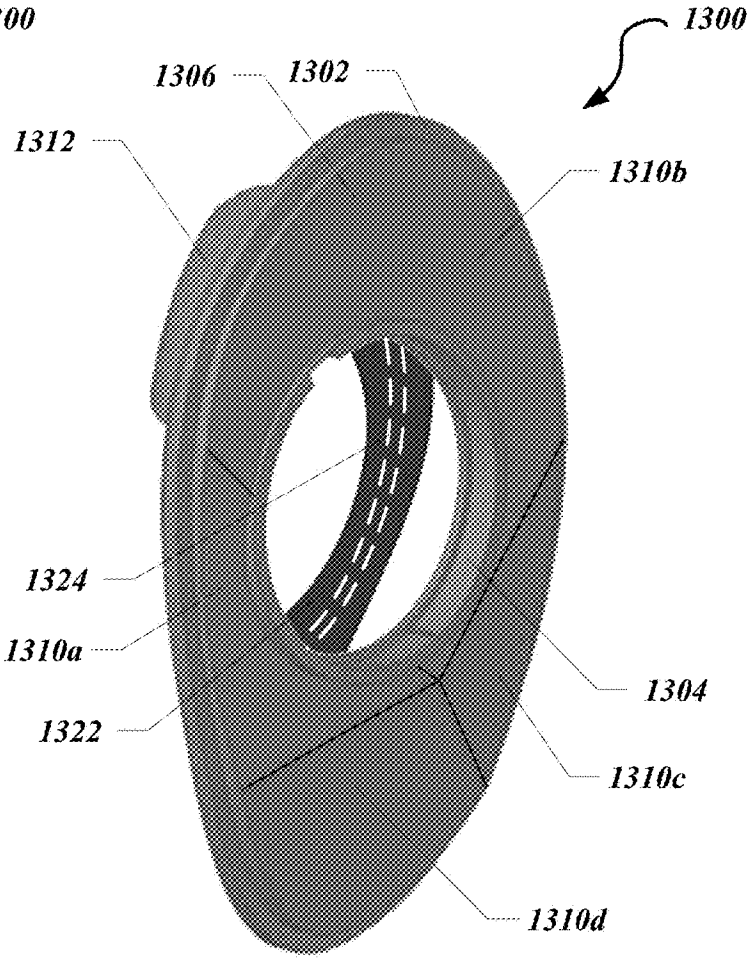

The bridging member 1312 may be coupled to the hooking body 1322 via the second portion 1316 of the bridging member 1312. Because the bridging member 1312 is coupled to the hooking body 1322 via the second portion 1316 of the bridging member 1312 and coupled to (or extruding from) the plate member 1306 via the first portion 1316 of the bridging member 1312, the bridging member 1312 may couple the hooking body 1322 to the plate member 1306 of the attachment body 1302. In some embodiments, the bridging member 1312 may be configured to hang on a root of an upper portion of a user's ear (e.g., as illustrated in FIGS. 13D-13E). In such embodiments, the bridging member 1312 may be coupled to the hooking body 1322 and the plate member 1306 in a way that creates a space 1340 between the hooking body 1322 and the plate member 1306. In such embodiments, the space 1340 may be suitable to receive or accommodate at least a posterior portion of a user's ear (e.g., as further described with reference to at least FIG. 13D).

The plate member 1306 may be configured to have a shape that approximates the profile of an outer portion of a human ear, and as such, the plate member 1306 may be elliptical or roughly elliptical in shape. In some embodiments, the plate member 1306 may include, be coupled to, or define a mid-ear portion 1304. The mid-ear portion 1304 may (but is not required to be) positioned at a center or approximate center (e.g., the center position 1303) of the plate member 1306. In some embodiments, the mid-ear portion 1304 may be configured to be suitable for receiving, coupling to, or otherwise accommodating a speaker system that may be mounted to the mid-ear portion 1304. For example, the mid-ear portion 1304 may include one or more fasteners or mounting systems (not shown) that may be configured to couple to corresponding fasteners or mounting systems on a speaker system (not shown). In some embodiments, the mid-ear portion 1304 may define an opening in the plate member 1306 that has a shape suitable for receiving or otherwise accommodating at least a portion of a speaker system. While the opening defined by the mid-ear portion 1304 is illustrated in various corresponding drawings as having a substantially circular shape, in some embodiments, the mid-ear portion 1304 may be configured to define opening having various shapes, including but not limited to, circular, rectangular, elliptical, or various other shapes. In some embodiments, the mid-ear portion 1304 may be a separate structure that is coupled to the plate member 1306.

In some embodiments, the plate member 1306 may include two or more facets 1310*a*-1310*d* having flat or substantially flat surfaces. The plate member 1306 may be configured such that the facets 1310*a*-1310*d* are arranged/positioned around the mid-ear portion 1304, for example, as illustrated in FIG. 13A. In some embodiments (not shown), the facets 1310*a*-1310*d* may enable the overall shape of the plate member 1306 to be or appear to be curved while maintaining two or more flat surfaces that enable various components (e.g., electronic components) to be coupled or mounted to the facets 1310*a*-1310*d*. By way of a non-limiting example, the facets 1310*a*-1310*d* may be configured to enable a battery, printed circuit board, speaker system, and/or various other electronic components to be mounted to surfaces of the plate member 1306 distal from the hooking body 1322.

Figure 13B:
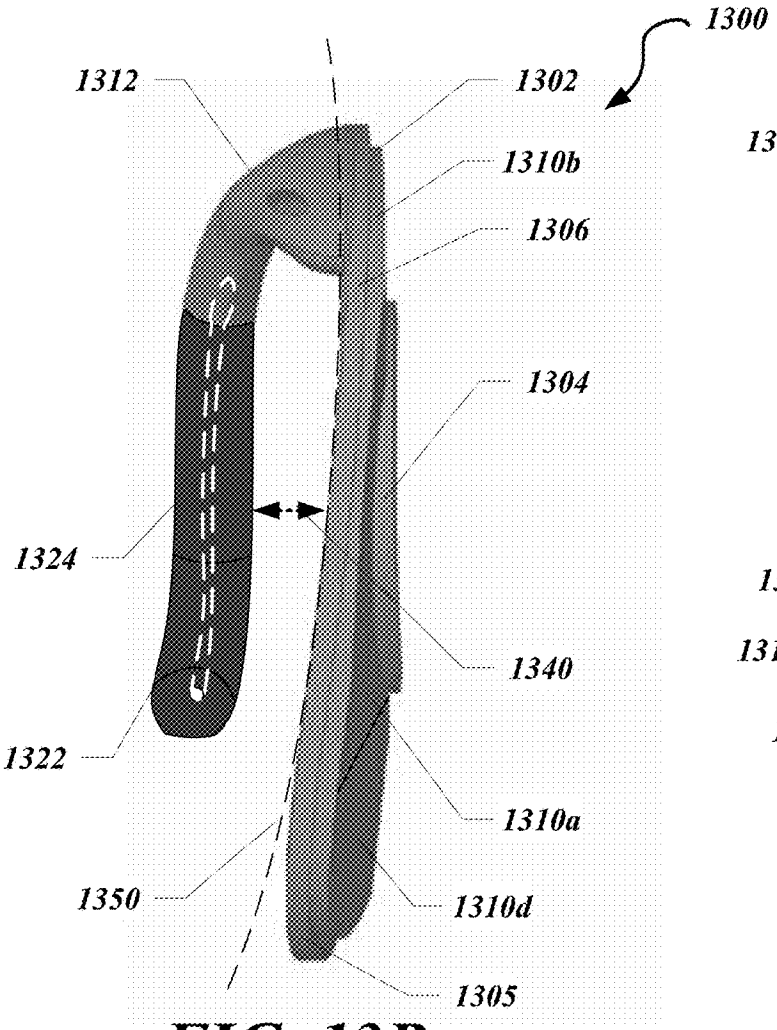
Figure 13D:
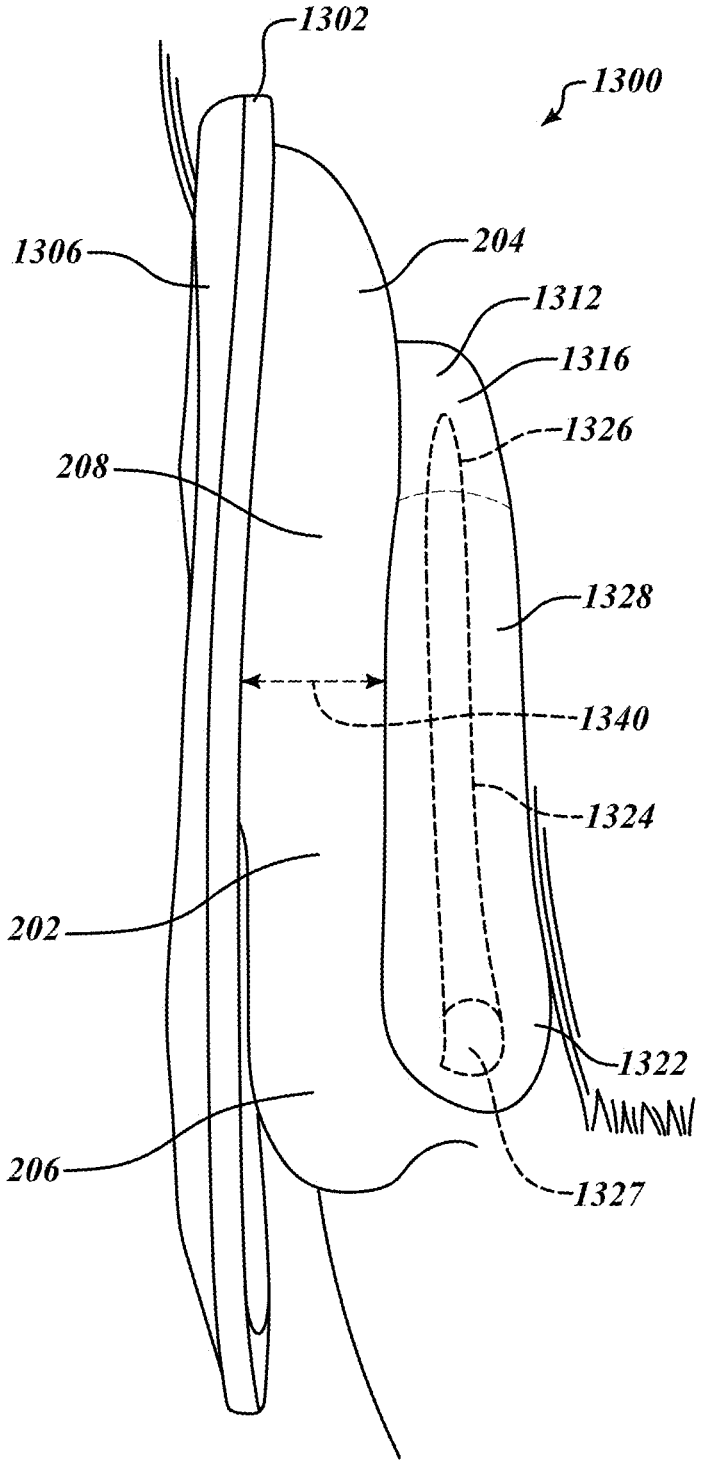
Figure 13E:
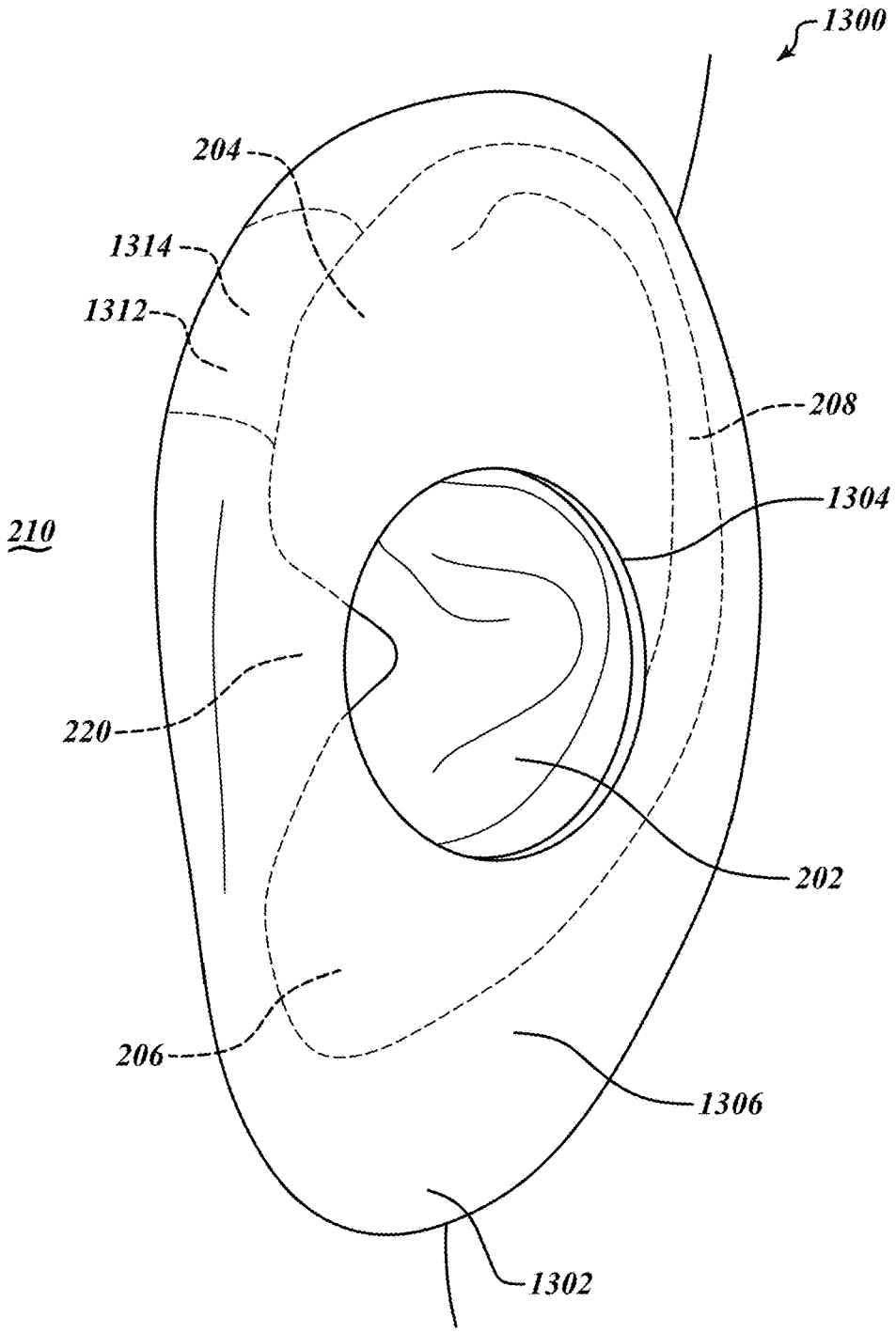

FIG. 13B illustrates an exterior profile view of a left side of the attachment apparatus 1300 depicted in FIG. 13A. FIG. 13C illustrates an exterior perspective view of a front side of the attachment apparatus 1300. With reference to the examples illustrated in FIGS. 13B-13C, the plate member 1306 may be configured to have a concave, curved shape (e.g., as indicated by a reference line 1350) that at least approximates a shape of a profile of a human head. Specifically, in relation to the reference line 1350, the plate member 1306 may be configured to generally curve in a direction away from the hooking body 1322. In such embodiments, the plate member 1306 may be configured to contour, at least partially, to the shape of the profile of a human head (e.g., as illustrated in and described with reference to FIG. 13E).

As described, the plate member 1306 may be configured to include one or more facets 1310*a*-1310*d* that are at least substantially flat. In some embodiments, the flat surfaces formed by the facets 1310*a*-1310*d* may be suitable for use in mounting various components to the front side of the plate member 1306 (e.g., as illustrated with reference to FIG. 15A). In such embodiments, the flat surfaces of the facets 1310*a*-1310*d* may enable one or more components having at least substantially flat surfaces (e.g., printed circuit boards, batteries, or the like) to the plate member 1306 even though, in some embodiments, the plate member 1306 may be configured to have a substantially curved shape that otherwise may not be suitable (or as suitable) for mounting components having at least substantially flat surfaces. Accordingly, in such embodiments, the facets 1310*a*-1310*d* may enable the overall plate member 1306 to be configured to have a curved shape that at least partially conforms to a shape of a profile of a human head while facilitating the mounting or attachment of various components to one or more flat surfaces on the plate member 1306.

FIG. 13D illustrates an exterior view of a right side of the attachment apparatus 1300 while the attachment apparatus 1300 is secured to a user's ear. FIG. 13E illustrates an exterior perspective view of a front side of the attachment apparatus 1300 while the attachment apparatus 1300 is secured to a user's ear. With reference to the examples illustrated in FIGS. 13D-13E, the hooking body 1322 and the attachment body 1302 may be collectively configured to secure the attachment apparatus 1300 to the user's ear 202, as further described herein.

In some embodiments, the hooking body 1322 may be coupled to the bridging member 1312 of the attachment body 1302 in a way that forms the space 1340. As depicted in the examples illustrated in FIGS. 13D-13E, at least a part of the posterior portion 208 of a user's ear 202 may be inserted into the space 1340, thereby positioning at least that part of the posterior portion 208 of the user's ear 202 between the hooking body 1322 and the plate member 1306. Accordingly, the hooking body 1322 may be positioned behind the ear 202 such that at least one surface of the hooking body 1322 physically contacts a surface of the root of the posterior portion 208. Further, the bridging member 1312 may be configured to have a shape that at least partially conforms to the root of the upper portion 204 the ear 202. Specifically, a surface of at least the first portion 1314 of the bridging member 1312 may engage a surface of the upper portion 204 of the ear 202 (e.g., along the root of the upper portion 204 of the ear 202 towards the user's face). Thus, in some embodiments, while the hooking body 1322 is secured to the user's ear, the attachment body 1302 may hang on the user's ear 202 from the bridging member 1312.

In some embodiments, at least one surface of the plate member 1306 facing the hooking body 1322 may physically engage at least one surface of the ear 202 while the hooking body 1322 is secured to the ear 202. In some embodiments in which the attachment body 1302 is configured to have a shape that at least partially contours to the shape of a human head (e.g., as described in reference to the reference line 1350 illustrated in FIG. 13B), at least a front portion of the plate member 1306 proximate to the front of the user's body may engage the user's face 210 while the hooking body 1322 is secured to the user's ear 202. In such embodiments, the plate member 1306 may form at least a partial seal against the user's face 210.

In some embodiments (e.g., as described above), the hooking body 1322 may be configured to respond to a force received by the user by moving or deforming in a direction of the applied force. For example, the hooking body 1322 may receive a force from the user that moves the second end 1327 of the hooking body 1322 in a direction of the force. By way of a non-limiting example, the user may apply a force to the hooking body 1322 in a direction that is towards the user's ear 202. While the user's ear 202 in at least partially inserted into the space 1340 and while the upper portion 204 of the user's ear 202 is secured to the bridging member 1312, the hooking body 1322 may move in the direction of the applied force. As the distance between the deformable core 1324 and the back surface of the posterior portion 208 of the ear 202 decreases, the hooking body 1322 may become increasingly secured to the user's ear 202. Specifically, because the hooking body 1322 is not resilient (or is only minimally resilient), when the force received on the hooking body 1322 that moves the hooking body 1322 into a first position is removed from the hooking body 1322, the hooking body 1322 may remain in that first position until the hooking body 1322 receives another force (e.g., further adjusts form the user), which may cause the hooking body 1322 to transition to a second position and remain at that second position. In some embodiments, a counter force that the ear applied to the hooking body 1322 may be insufficient to move the hooking body 1322 or may move the hooking body 1322 only slightly.

Various descriptions of the attachment apparatus 1300 refer to the attachment body 1302 including the plate member 1306 and the bridging member 1312. These descriptions are merely for ease of description and do not require or imply that the plate member 1306 and the bridging member 1312 of the attachment body 1302 are separate components. Instead, in some embodiments, the attachment body 1302 may be configured as a single, continuous structure. However, in alternative embodiments, the plate member 1306 and the bridging member 1312 of the attachment body 1302 may be individual components that are joined together to form the attachment body 1302.

Further, various descriptions of the attachment apparatus 1300 refer to the bridging member 1312 being configured to include the first portion 1314 and the second portion 1316. These descriptions are merely for ease of description and do not require or imply that the first portion 1314 and the second portion 1316 of the bridging member 102 are separate components. Instead, in some embodiments, the bridging body 1312 may be configured as a single, continuous structure. However, in alternative embodiments, the first portion 1314 and the second portion 1316 of the bridging member 1312 may be individual components that are joined together to form the bridging member 1312.

Figure 14:
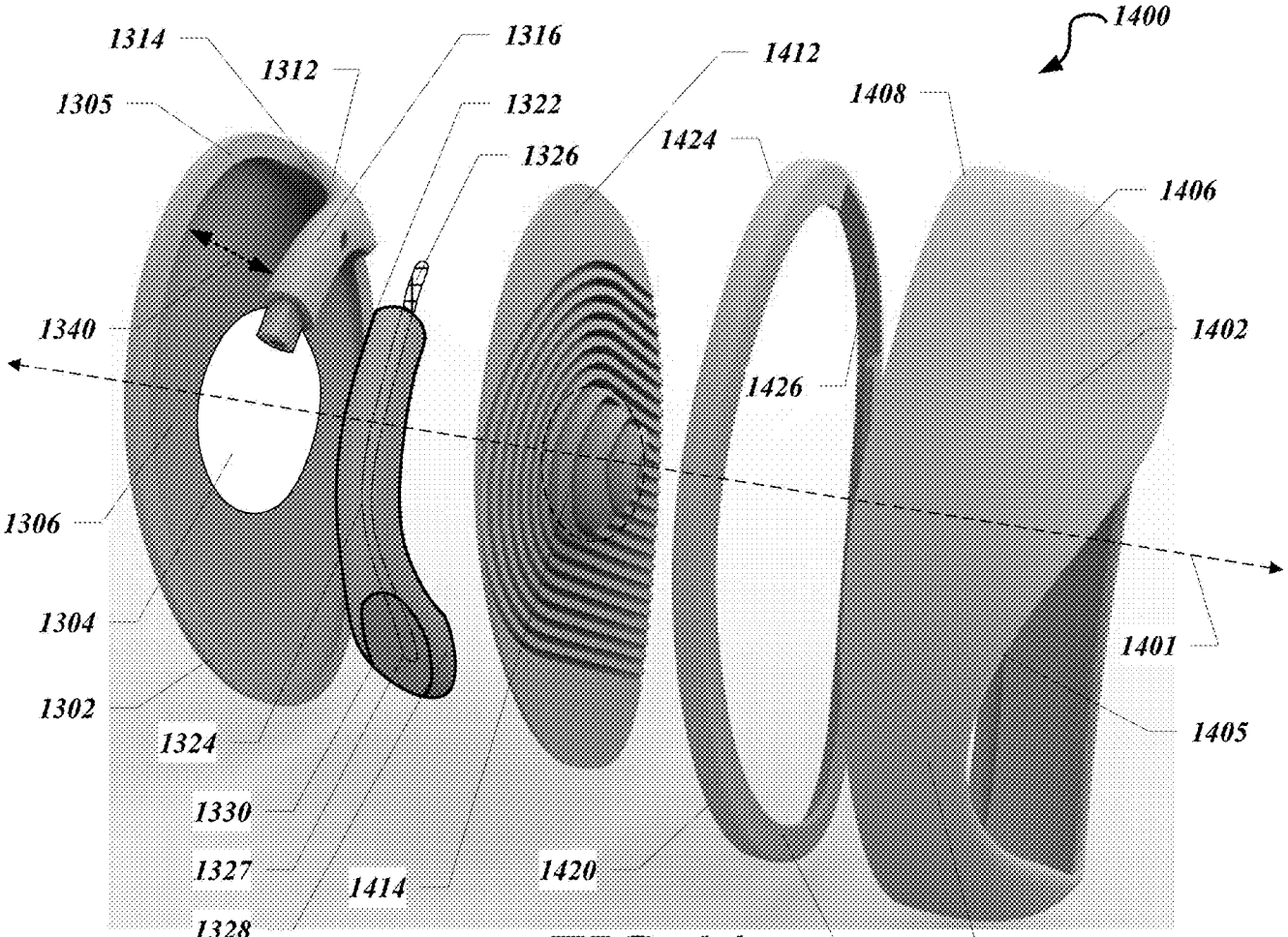
FIG. 14 is an exploded view of an alternative attachment apparatus, according to some embodiments.

FIG. 14 illustrates an exploded, exterior perspective view of a back side of an alternative attachment apparatus 1400, according to some embodiments. The attachment apparatus 1400 may include one or more structural features that are similar to the structural features described with reference to the attachment apparatus 1300 (e.g., as described with reference to FIGS. 13A-13E). Specifically, in some embodiments, the attachment apparatus 1400 may include, but is not limited to including, the attachment body 1302, the bridging member 1312, the plate member 1306, the hooking body 1322, and the space 1340 formed or defined at least in part by the bridging member 1312 and the plate member 1306. The plate member 1306 may include the mid-ear portion 1304. The hooking body 1322 may include, but is not limited to including, the deformable core 1324, the cushioning portion 1328, and the cutout 1330. The deformable core 1324 may include the first end 1326. The deformable core 1324 may also include a second end 1327 that may be freely moved in the presence of an external force from a first configuration (e.g., an initial configuration) into a second configuration (e.g., a deformed configuration) in response to receiving a force. Some of the structural features of the attachment apparatus 1400 may be analogous to structural features described above, for example, with reference to the attachment apparatus 1300 described with reference to FIGS. 13A-13E. For clarity and simplicity of description, duplicative descriptions of such structural features of the attachment apparatus 1400 may not be repeated in the following descriptions.

In the example illustrated in FIG. 14, the attachment apparatus 1400 may include one or more of the structures/components described above, and these structures/components may, generally, be coupled together and/or assembled along referential line 1401. In some embodiments, the attachment apparatus 1400 may include a sealing body 1402. The sealing body 1402 may include a first sealing portion 1404, a second sealing portion 1406, and a coupling edge 1408. The sealing body 1402 may be configured—in conjunction with at least the attachment body 1302 and the hooking body 1322—to ensure that the attachment apparatus 1400 is comfortably and securely attached to the user's ear.

In some embodiments, the coupling edge 1408 of the sealing body 1402 may be coupled to the coupling edge 1305 of the plate member 1306 to create a cavity that at least partially surrounds the bridging member 1312 and the hooking body 1322. In such embodiments, the first sealing portion 1404 and the second sealing portion 1406 of the sealing body 1402 may define or form an opening suitable for receiving a human ear. Specifically, while coupled to the attachment body 1302, the opening formed by the sealing body 1402 may enable a portion of the ear to be received in the cavity and to be positioned within the space 1340 between the hooking body 1322/bridging member 1312 and the plate member 1306 (e.g., as described above). In some embodiments, the sealing body 1402 may be configured to engage an area of the user's anatomy around the user's ear to form an acoustic seal (e.g., as further described with reference to at least FIGS. 16A-16B).

In some embodiments, the first sealing portion 1404 of the sealing body 1402 may be configured to provide the user with access to the hooking body 1322 in the cavity formed by the sealing body 1402 while the attachment apparatus 1400 is secured to the user's ear. Specifically, the first sealing portion 1404 may feature a cutout portion 1405 that enables the user to access the hooking body 1322. The cutout portion 1405 of the first sealing portion 1404 may enable the user to deliver a force (e.g., via a finger) to the hooking body 1322, such as by pressing against the hooking body 1322 until the hooking body 1322 moves against a back surface of the user's ear, thereby securing the hooking body 1322 to the user's ear. In such configurations, the sealing body 1402 and the back surface of the user's ear in proximity to the first sealing portion 1404 (e.g., a part of the posterior portion of the ear) may form at least a partial acoustic seal from ambient sound around the ear canal of the user's ear.

In some embodiments, a surface of the sealing body 1402 may be coupled to a surface of the hooking body 1322 (e.g., a surface of the hooking body 1322 distal from the plate member 1306). In such embodiments, the sealing body 1402 may be caused to deform or move in response to receiving a force on the hooking body 1322. Accordingly, in such embodiments, the cavity formed at least in part by the sealing body 1402 and that encapsulates the user's ear may change in shape based on the position of the hooking body 1322, such as by increasing in size of at least one dimension when the hooking body 1322 is biased away from a user's ear or by decreasing in size of at least one dimension when the hooking body 1322 is biased towards a user's ear.

In some alternative embodiments, the sealing body 1402 may not be coupled to the hooking body 1322. In such embodiments, the hooking body 1322 may be movable independently of the sealing body 1402. So long as the hooking body 1322 does not physically engage the sealing body 1402, the hooking body 1322 may be moved in a direction of a force received from a user without moving or otherwise deforming the sealing body 1402. However, in such embodiments, a force received on the hooking body 1322 may indirectly cause the sealing body 1402 to move or flex if the force causes the hooking body 1322 to physically engage (e.g., push against) a portion of the sealing body 1402.

In some embodiments, the attachment apparatus 1400 may include an optional earpad 1412 that may be coupled (or otherwise attached) to a side of the plate member 1306 proximate to the hooking body 1322. The earpad 1412 may include a protruding portion 1414 that is made from elastic or semi-elastic materials or combinations of such materials. In such embodiments, the earpad 1412 may be configured to engage the interior portion of the user's ear (e.g., the concha portion of the ear) when the attachment apparatus 1400 is secured to the user's ear. Specifically, while the attachment apparatus 1400 is secured the user's ear, the protruding portion 1414 of the earpad 1412 may be elastically compressed against the user's ear. While compressed, the protruding portion 1414 of the earpad 1412 may exert a force against the user's ear in a direction toward the median plane of the user's body and thereby establish a counterforce from the ear that urges the attachment apparatus 1400 in a direction away from the median plane of the user. Because the bridge member 1312 and/or the hooking body 1322 is secured to the ear while the protruding portion 1414 is urging the attachment apparatus 1400 in a direction away from the median plane of the user, the protruding portion 1414 may cause the unit to pivot about the bridging member 1312, which may function as a fulcrum. Accordingly, the lever action of the protruding portion 1414 may urge an anterior portion of the attachment apparatus 1400 in a direction into the face of the user, thereby enabling (or further enabling) the sealing body 1402 to form at least a partial acoustic seal against the user's anatomy (e.g., the user's face). Further, at least the protruding portion 1414 of the earpad 1412 may be configured to allow sound to pass from a speaker mounted, directly or indirectly, to the mid-ear portion 1304 of the attachment body 1302 to the user's inner ear, such as by including sound-transparent features in the protruding portion 1414.

In some embodiments, the attachment apparatus 1400 may include an optional coupling ring 1420. The coupling ring 1420 may be configured to function as an intermediary coupling device between the sealing body 1402 and the attachment body 1302. The coupling ring 1420 may include a first surface 1424 that may be configured to couple to the attachment body 1302, for example, along a surface of the coupling edge 1305 proximate to the hooking body 1322. The coupling ring 1420 may also include a second surface 1422 that may be configured to couple to the sealing body 1402, for example, along a surface of the coupling edge 1408. In some embodiments, the attachment body 1302 and/or the sealing body 1402 may be coupled to the coupling ring 1420 via adhesives, reciprocal fasteners, welding, or through various other coupling techniques. The coupling ring 1420 may include a recessed portion 1426. In some embodiments, the recessed portion 1426 may be configured as a notched portion of the coupling ring 1420 that enables at least a portion of the bridging member 1312 to pass through the coupling ring 1420. In some alternative embodiments, the bridging member 1312 may be coupled to the recessed portion 1426 (or otherwise formed as a part of the coupling ring 1420) instead of being coupled to or formed as part of the attachment body 1302.

Figure 15A:
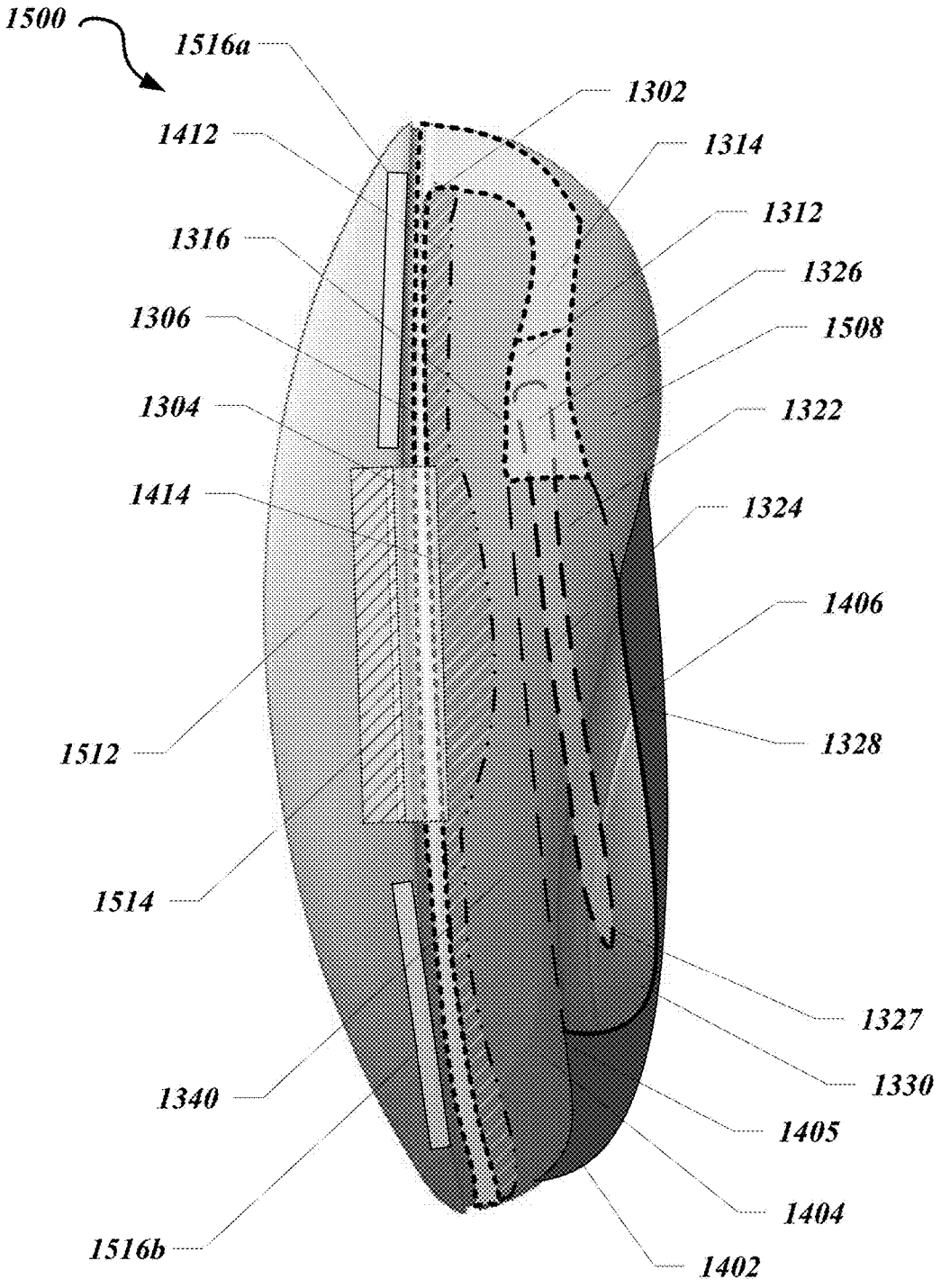
FIGS. 15A-15B are exterior views of an alternative attachment apparatus, according to some embodiments.
Figure 15B:
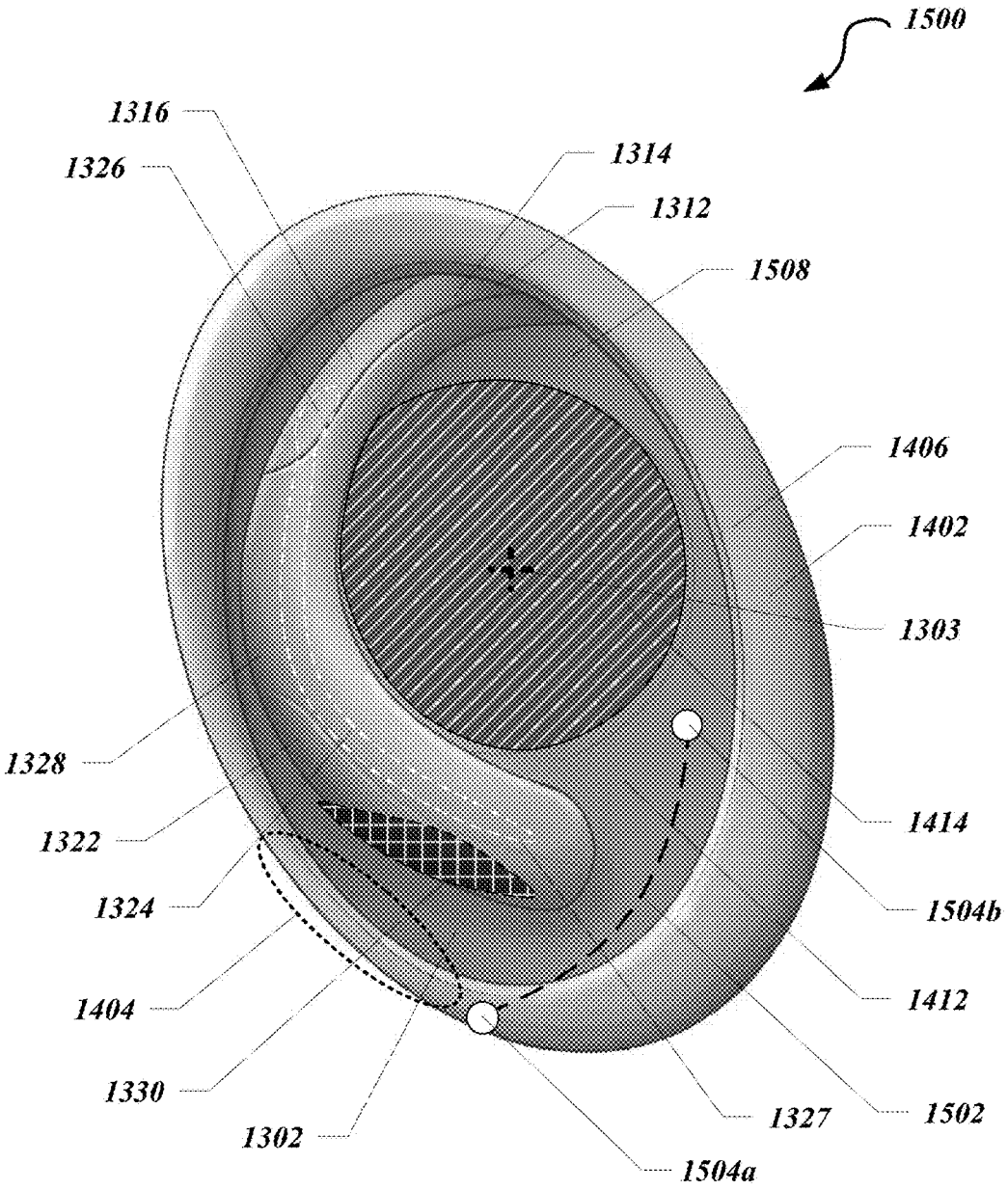

FIGS. 15A-15B illustrate exterior views of an alternative attachment apparatus 1500, according to some embodiments. The attachment apparatus 1500 may include one or more structural features that are similar to the structural features described with reference to the attachment apparatuses 1300 and 1400 (e.g., as described with reference to FIGS. 13A-14). Specifically, in some embodiments, the attachment apparatus 1500 may include, but is not limited to including, the sealing body 1402 having the first portion 1404 and the second portion 1406; the attachment body 1302 having the bridging member 1312 and the plate member 1306; the hooking body 1322; the space 1340 formed or defined at least in part by the hooking body 1322 and the plate member 1306; and the ear-pad 1412 having the protruding portion 1414. The plate member 1306 may include the mid-ear portion 1304. The hooking body 1322 may include the deformable core 1324 and the cushioning portion 1328. The deformable core 1324 may include the first end 1326, which may be coupled or embedded in the first portion 1314 of the bridging portion 1312. The deformable core 1324 may also include the second end 1327 that is not coupled to the bridging member 1312 and that is freely movable in response to receiving one or more forces. For clarity and simplicity of description, duplicative descriptions of such structural features of the attachment apparatus 1500 may not be repeated in the following descriptions.

Regarding the examples illustrated in FIGS. 15A-15B, the attachment apparatus 1500 may include a cover body 1512. In some embodiments, the cover body 1512 may include one or more audio components 1514, including, but not limited to, a speaker system for playing out sound. In some embodiments, the audio components 1514 may be mounted to or otherwise coupled to the mid-ear portion 1304 of the attachment body 1302. The cover body 1512 may be coupled to the attachment body 1306 so that the audio components 1514 are positioned at or in proximity to the center of the plate member 1306. Thus, when the attachment apparatus 1500 is secured to a user's ear, sound emitted from the audio components 1514 may pass through the mid-ear portion 1304 of the attachment body 1302 in a direction towards the user's inner ear. In some embodiments in which the optional earpad 1412 is included in the attachment apparatus 1500, the sound from the audio components 1514 may also pass through an opening in the earpad 1412 or the protruding portion 1414 of the earpad 1412 before reaching the user's ear. In some embodiments, the sealing body 1402 may form at least a partial acoustic seal around the user's ear while the attachment apparatus 1500 is secured to the user's ear. Accordingly, in such embodiments, the audio components 1514 included in the cover body 1512 may produce high-quality sound because external noise is blocked or reduced.

In some embodiments, the cover body 1512 may include one or more of various other electronic components 1516*a* and 1516*b*. For example, the electronic components 1516*a* and 1516*b* may include, but not limited to, memory, a processing unit (e.g., a digital signal processor or central processing unit), a transceiver configured to receive audio data from external computing devices, or the like. In some embodiments, the electronic components 1516*a*, 1516*b* may be mounted to or coupled to one or more facets (not shown) of the plate member 1306 of the attachment body 1302 (e.g., the facets 1310*a*-1310*d* as described with reference to FIGS. 13A-13C).

While coupled to the plate member 1306 or the earpad 1412, the sealing body 1402 and at least one of the earpad 1412 and the plate member 1306 of the attachment body 1302 may define, at least partly, a cavity 1508. In the examples depicted in FIGS. 15A-15B, the hooking body 1322 and/or the bridging member 1312 may be at least partially positioned or located within the cavity 1508. In some embodiments, the cavity 1508 may be formed between the first sealing portion 1404 and the second sealing portion 1406. The cutout portion 1405 of the sealing body 1402 (e.g., as described with reference to FIG. 14) may be configured to enable the user to access the hooking body 1322 within the cavity 1508. Thus, as shown in the example illustrated in FIG. 15A, a portion of the hooking body 1322 (e.g., the cutout 1330) may extend outside of the cavity 1508 and thus may be accessible by a user while the attachment apparatus 1500 is secured to the user's ear (e.g., as further described with reference to FIGS. 16A-16B). In some embodiments, the hooking body 1322 may have a range of movement 1502 within the cavity 1508, such as between a first movement position 1504*a* and a second movement limit 1504*b*.

In some embodiments, the earpad 1412 may be coupled to the plate member 1306 of the attachment body 1302 such that the protruding portion 1414 of the earpad 1412 is positioned at or near the center of the plate member 1306. The hooking body 1322 may be coupled to the bridging member 1312, which may in turn be coupled to (or formed as part of) the plate member 1306. The sealing body 1402 may be coupled to the plate member 1306 and/or the earpad 1412. In some embodiments, the earpad 1412 may not be included in the attachment apparatus 1500, and the sealing body 1402 may be directly coupled to the plate member 1306 of the attachment body 1302. In some alternative (or additional) embodiments, the sealing body 1402 may be indirectly coupled to the plate member 1306 of the attachment body 1302 via a coupling ring (e.g., the coupling ring 1420 as described with reference to FIG. 14).

Figure 16A:
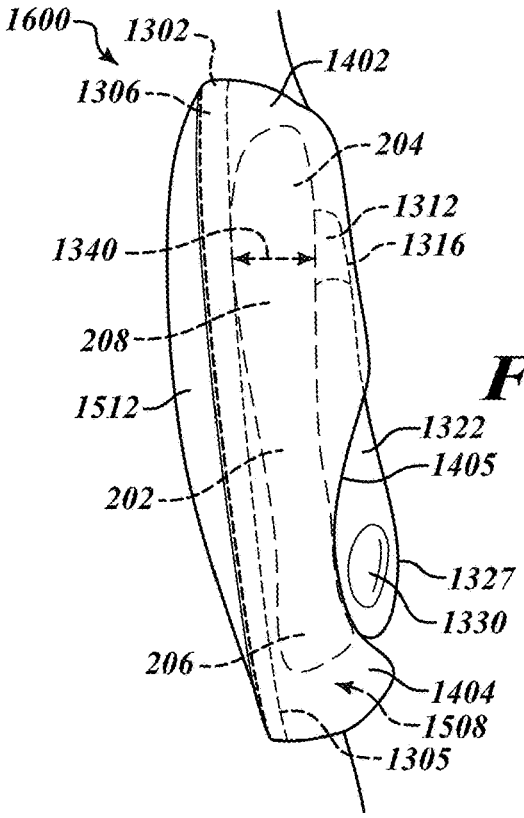
FIGS. 16A-16B are exterior views of an alternative attachment apparatus, according to some embodiments.
Figure 16B:
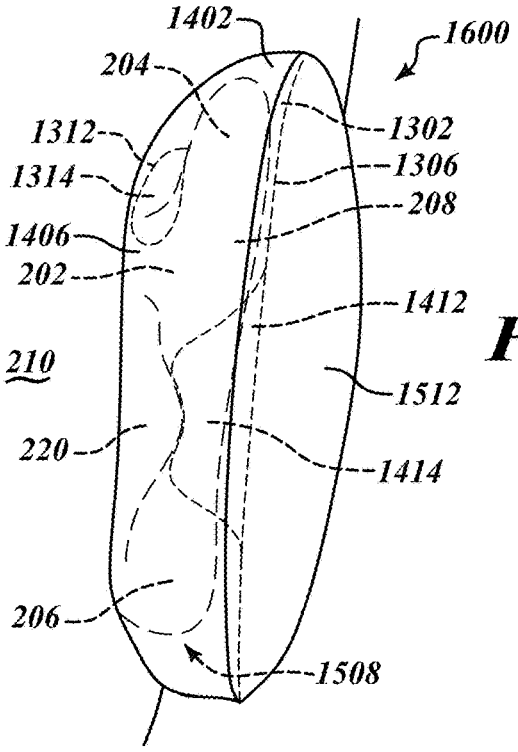

FIGS. 16A-16B illustrate exterior, semi-transparent views of an alternative attachment apparatus 1600 that is secured to a user's ear, according to some embodiments. The attachment apparatus 1600 may include one or more structural features that are similar to the structural features described with reference to the attachment apparatuses 1300, 1400, 1500 (e.g., as described with reference to FIGS. 13A-15B). Specifically, in some embodiments, the attachment apparatus 1600 may include, but is not limited to including, the sealing body 1402 having the first sealing portion 1404 and the second sealing portion 1406; the attachment body 1302 having the bridging member 1312 (having the first portion 1314 and the second portion 1316) and the plate member 1306; the hooking body 1322; the space 1340 formed or defined at least in part by the hooking body 1322 and the plate member 1306; the cover body 1512; and the ear-pad 1412 having the protruding portion 1414. Some of the structural features of the attachment apparatus 1600 may be analogous to structural features described above, for example, with reference to the attachment apparatuses 1300, 1400, and 1500 described with reference to FIGS. 13A-15B. For clarity and simplicity of description, duplicative descriptions of such structural features of the attachment apparatus 1600 may not be repeated in the following descriptions.

With reference to the example illustrated in FIGS. 16A-16B, the attachment apparatus 1600 may be configured, at least substantially, to encapsulate the user's ear 202. In some embodiments, the hooking body 1322 may be secured to the posterior portion 208 of the user's ear 202, such as along the root of the posterior portion 208 of the user's ear 202. The bridging member 1312 (and, in some embodiments, the hooking body 1322) may be secured to the root of the upper portion 204 of the user's ear 202. At least a portion of the user's ear 202 (e.g., at least a part of the posterior portion 208 of the ear 202) may reside in the space 1340 between the plate member 1306 and the hooking body 1322. While the hooking body 1322 and the attachment body 1302 are secure to the ear 202, the ear 202 may be that at least partially encapsulated in the cavity 1508 formed by the sealing body 1402.

In some embodiments, the first sealing portion 1404 of the sealing body 1402 may be configured to provide the user with access to the hooking body 1322. In the examples illustrated in FIGS. 16A-16B, a portion of the hooking body 1322 that includes the cutout 1330 may be visible and accessible to a user. In some embodiments, the first portion 1404 of the sealing body 1402 may enable a user to insert a finger or a similarly sized object into the cavity 1508 in order to deform, flex, bend, move, or otherwise manipulate the hooking body 1322 into another position. For example, while the attachment apparatus 1600 is secured to the user's ear 202, the first sealing portion 1404 may enable the user to use a finger to exert a force in a direction that is parallel to the sagittal plane of the user's body to urge the hooking body 1322 towards the user's ear 202, thereby further securing the attachment apparatus 1600 to the user's ear 202. In another example, the first sealing portion 1404 may be configured to enable the user to use a finger to urge the hooking body 1322 away from the user's ear, such as by pulling the hooking body 1322 away from the ear (e.g., via the cutout portion 1405). In yet another example, the first sealing portion 1404 may, additionally or alternatively, be configured to enable the user to exert a force on the hooking body 1322 that causes the hooking body 1322 to move in a direction that is towards or away from the median plane of the user's body. In this example, moving the hooking body 1322 towards the median plane of the user's body may cause the hooking body 1322 to protrude outside of the cavity 1508 to a greater extent than when the hooking body 1322 is moved away from the median plane of the user's body.

In some embodiments, while the attachment apparatus 1600 is secured to the user's ear 202, the earpad 1412 may at least partially engage the interior portion of the ear 202. In some embodiments in which the earpad 1412 includes a protruding portion 1414, the protruding portion 1414 of the earpad 1412 may engage the interior portion of the user's ear 202 outside of the ear canal. Because the hooking body 1322 is secured to the user's ear 202, the protruding portion 1414 may urge the attachment apparatus 1600 away from the median plane of the user's body, thereby causing an anterior portion of the attachment apparatus 1600 to pivot towards and to engage the user's face 210 (e.g., as described with reference to FIG. 14).

Figure 17:
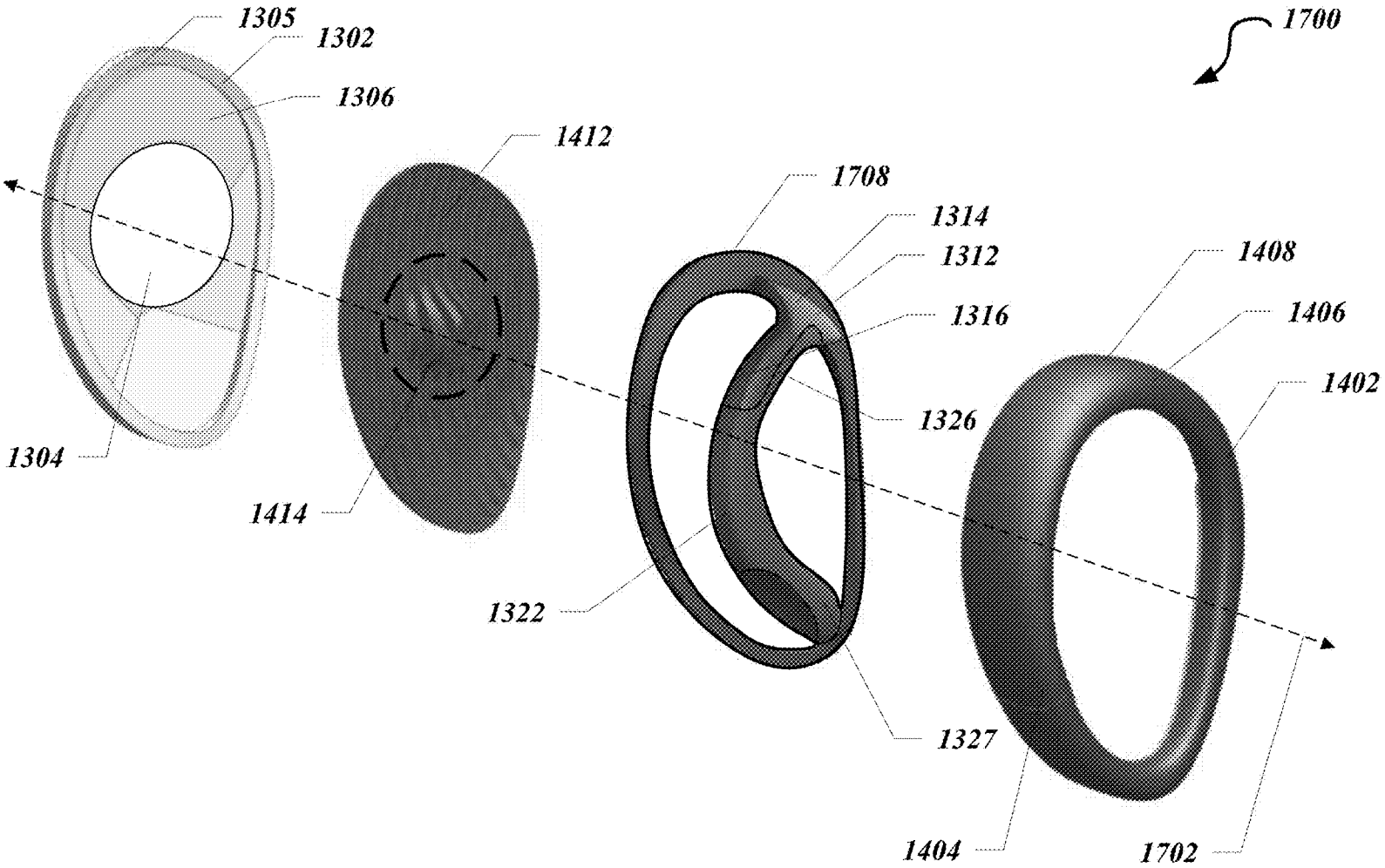
FIG. 17 is an exploded view of an alternative attachment apparatus, according to some embodiments.

FIG. 17 illustrates an exploded, exterior perspective view of a back side of an alternative attachment apparatus 1700, according to some embodiments. The attachment apparatus 1700 may include one or more structural features that are similar to the structural features described with reference to the attachment apparatus 1300, 1400, 1500, 1600 (e.g., as described with reference to FIGS. 13A-16B). In some embodiments, the attachment apparatus 1700 may include, but is not limited to including: the attachment body 1302 that includes the plate member 1306 and the optional mid-ear portion 1304; the optional earpad 1412 that may include the protruding portion 1414; the sealing body 1402 having the first sealing portion 1404, the second sealing portion 1406, and the coupling edge 1408; and the hooking body 1322. For clarity and simplicity of description, duplicative descriptions of such structural features of the attachment apparatus 1700 may not be repeated in the following descriptions.

In the example illustrated in FIG. 17, the attachment apparatus 1700 may include one or more of the structures/components described above, and these structures/components may, generally, be coupled together and/or assembled along referential line 1702. In some embodiments, the optional earpad 1412 may be coupled to the plate member 1306 of the attachment body 1302 so that the protruding portion 1414 of the earpad 1412 overlays (at least in part) the mid-ear portion 1304. As described, the protruding portion 1414 of the earpad 1412 may be configured to allow sound generated from a speaker system (not shown) mounted to the mid-ear portion 1304 to pass through the protruding portion 1414 of the earpad 1412.

In some embodiments, the attachment apparatus 1700 may include an alternative coupling ring 1708. The coupling ring 1708 may be a rigid or semi-rigid structure that is roughly ellipsoid in shape. In the example illustrated in FIG. 17, the sealing body 1402 may be formed around (or coupled to) a surface of the coupling ring 1708 such that the sealing body 1402 is formed around all or substantially all of the perimeter of the coupling ring 1708. In some embodiments, the sealing body 1402 may define at least a portion of an opening that may be suitable for allowing at least a portion of a user's ear to pass through the opening (e.g., as described regarding the sealing body 1402 depicted in FIG. 14).

In some embodiments, the bridging member 1312 may be coupled to or formed as part of the coupling ring 1708, for example, rather than being coupled to or formed as part of an attachment body 1302 (e.g., as described with reference to FIGS. 13A-14). The hooking body 1322 may be coupled to, embedded in, or otherwise anchored to the bridging member 1312, thereby securing the hooking body 1322 to the coupling ring 1708. By way of an example, the first end 1326 of the hooking body 1322 may be embedded in, anchored to, or otherwise coupled to the second portion 1316 of the bridging member 1312. However, as illustrated in the example depicted in FIG. 17, the second end 1327 of the hooking body 1322 may not be attached or secured to the bridging member 1312 or the coupling ring 1708. Accordingly, the second end 1327 of the hooking body 1322 may be able to be freely moved in response to receiving a force on the hooking body 1322, whereas the first end 1326 of the hooking body 1322 may not be moved in relation to the bridging member 1312 (or may only be moved slightly) in response to receiving such force (e.g., as described with reference to FIG. 13A).

In some embodiments, the shape of the coupling ring 1708 may correspond to a shape of the coupling edge 1305 of the plate member 1306 of the attachment body 1302. In the example illustrated in FIG. 17, the shape of the coupling ring 1708 may be substantially ellipsoid, which may correspond to the substantially elliptical shape of the coupling edge 1305 of the attachment body 1302. In such embodiments, a surface of the coupling ring 1708 may be coupled directly to the surface of the coupling edge 1305. Alternatively, in some embodiments in which the optional earpad 1412 is coupled to the coupling edge 1305, a surface of the coupling ring 1708 may be coupled indirectly to the attachment body 1302 by coupling the coupling ring 1708 to the earpad 1412, which may, in turn, be coupled to the coupling edge 1305 and/or the plate member 1306 generally.

When the attachment body 1302, the coupling ring 1708, the earpad 1412, and the sealing body 1702 are coupled together, the plate member 1306, the sealing body 1402, and (optionally) the earpad 1412 may form a chamber (e.g., similar to the chamber 1508 described with reference to FIG. 15A-15B) that encapsulates at least a portion of the hooking body 1322 and/or at least a portion of the bridging member 1312. In such embodiments, a user may insert the user's ear into the chamber through the opening, hang the bridging member 1312 on the root of the upper portion of the user's ear, and position the hooking body 1322 along the root of the posterior portion of the user's ear (not shown). The user may then deform the hooking body 1322 until the hooking body 1322 is comfortably secured to the root of the posterior portion of the user's ear.

While the user's ear is secured to the hooking body 1322, the user's ear may be positioned within and at least partially encapsulated by the chamber formed by the sealing body 1402, the plate member 1306, and (optionally) the earpad 1412. While the user's ear is encapsulated, the sealing body 1402, the attachment body 1302, and/or the earpad 1402 may form at least a partial acoustic seal that at least partially isolates the user's ear canal from ambient sounds. In some optional embodiments in which the attachment body 1302 includes a speaker system (not shown) mounted to the mid-ear portion 1304 of the plate member 1306, the sound generated by the speaker system may be directed to the user's ear canal and at least partially isolated from ambient sound.

Figure 18A:
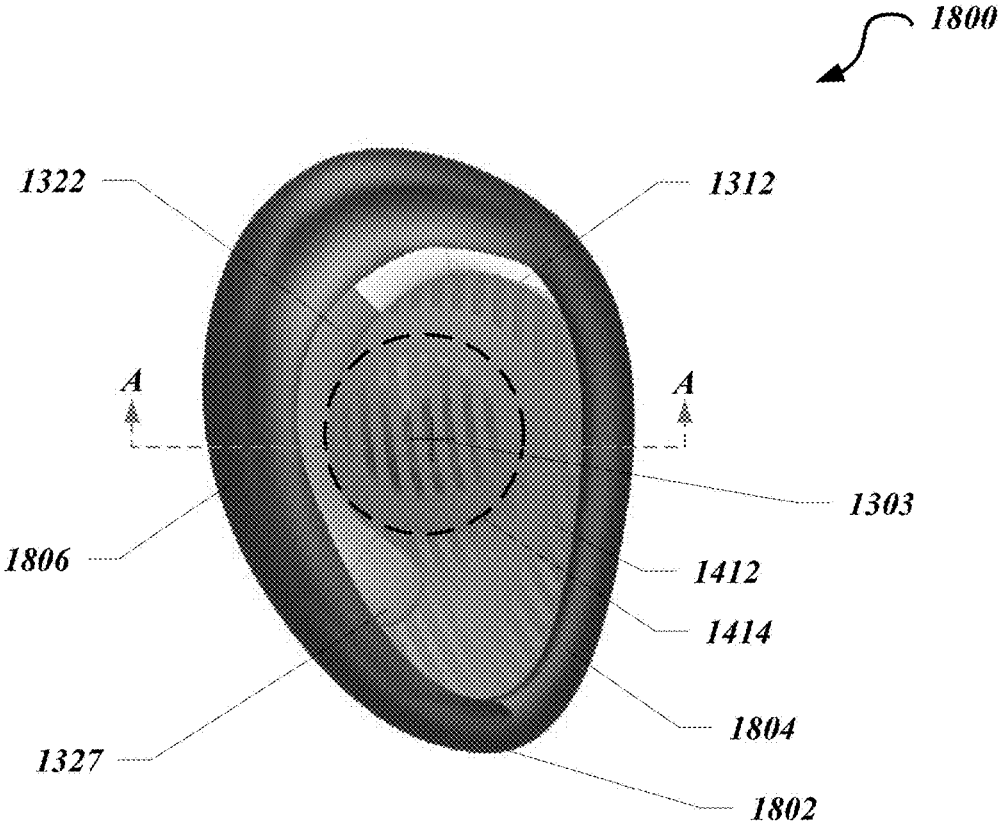
FIGS. 18A-18B are exterior views of an alternative attachment apparatus, according to some embodiments.
Figure 18B:
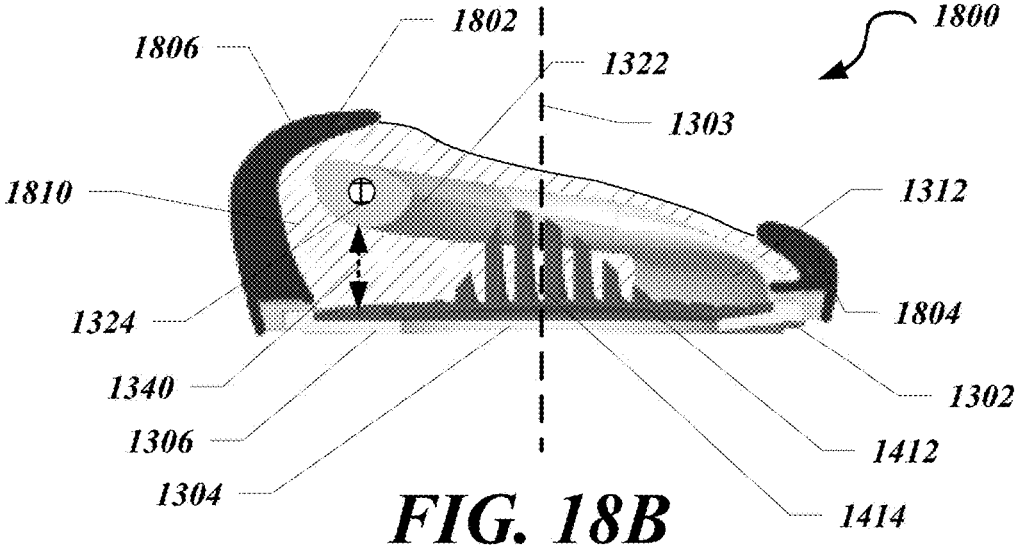

FIG. 18A illustrates an exterior view of a back side of an alternative attachment apparatus 1800, according to some embodiments. FIG. 18B illustrates a semi-transparent cross-sectional view of the attachment apparatus 1800 taken along referential line A depicted in FIG. 18A. The attachment apparatus 1800 may include one or more structural features that are similar to the structural features described with reference to the attachment apparatus 1300, 1400, 1500, 1600, 1700 described herein (e.g., with reference to FIGS. 13A-17). In some embodiments, the attachment apparatus 1800 may include, but is not limited to including: the attachment body 1302, which may include the plate member 1306, the bridging member 1312, and the optional mid-ear portion 1304; the optional earpad 1412 that may include a protruding portion 1414; and the hooking body 1322 that may include the deformable core 1324. For clarity and simplicity of description, duplicative descriptions of such structural features of the attachment apparatus 1800 may not be repeated in the following descriptions.

With reference to FIGS. 18A-18B, the attachment apparatus 1800 may include a sealing body 1802. In some embodiments, the sealing body 1802 may be made from or may include, at least partially, one or more pliable or elastomeric materials, such as plastic, foam, rubber, silicone, or the like or combinations of any of the foregoing. The sealing body 1802 may define or form an opening configured to be suitable for enabling a user's ear to pass through the opening (e.g., as described with reference to the sealing body 1402 illustrated in FIG. 14). For example, the sealing body 1802 may define an opening having a shape that approximates the shape of a profile of a user's ear or, in another example, having a roughly elliptical shape.

The sealing body 1802 may be coupled to the attachment body 1302 (e.g., along the coupling edge 1305 of the attachment body 1302—not shown) so that the sealing body 1802 at least partially defines or forms a chamber 1810. The hooking body 1322 and the bridging member 1312 may be encapsulated, at least substantially, within the chamber 1810. In some embodiments, when a user's ear is secured to the hooking body 1322 (e.g., as described with reference to FIG. 13A-13E), at least a portion of the user's ear may have passed through the opening into the chamber 1810, and at least a posterior portion of the user's ear may be positioned within the space 1340 in the chamber 1810 between the hooking body 1322 and the attachment body 1302 or, optionally, the earpad 1412 (e.g., as illustrated in the examples depicted in FIGS. 16A-16B).

In some embodiments, the sealing body 1802 may be configured to encapsulate, at least substantially, the user's ear within the chamber 1810 while the attachment apparatus 1800 is secured to the user's ear via the hooking body 1322. The sealing body 1802 may be further configured to engage an area of the user's anatomy around the user's ear to form at least a partial acoustic seal against the user's anatomy. Accordingly, while the attachment apparatus 1800 is secured to the user's ear via the hooking body 1322, the sealing body 1802 may at least substantially encapsulate the user's ear in the chamber 1810 and/or form at least a partial acoustic seal around the user's ear, thereby reducing or blocking ambient sounds from reaching the user's ear canal.

In some embodiments, a shape of a cross section of the sealing body 1802 may be curved so that portions of the sealing body 1802 proximate to the opening engage an area around a user's ear when the user's ear is inserted through the opening. In such embodiments, the portions of the sealing body 1802 proximate to the opening may form at least a partial acoustic seal around the user's ear while the attachment apparatus 1800 is secured to the user's ear. By way of a non-limiting example (e.g., as illustrated in FIG. 18B), the sealing body 1802 may be configured so that the sealing body 1802 curves towards (at least partially) the center position 1303 of the attachment body 1302.

The sealing body 1802 may include a first sealing portion 1804 and a second sealing portion 1806. When the attachment apparatus 1800 is secured to the user via the hooking body 1322, the first sealing portion 1804 may be proximate to a front side of the user's body (e.g., closer to the face of the user), whereas the second sealing portion 1806 may be proximate to a back side of the user's body (e.g., closer to the back of the user's head). In some embodiments, at least a portion of the first sealing portion 1804 and at least a portion of the second sealing portion 1806 may engage and be biased by a user's anatomy while the attachment apparatus 1800 is secured to or is being secured to the user's ear. For example, as the user inserts the user's ear into the portion of the chamber 1810 between the hooking body 1322 and the attachment body 1302 (or optionally the earpad 1412), at least some part of the first sealing portion 1804 and the second sealing portion 1806 (e.g., portions proximate to the opening and distal to the attachment body) may physically engage and be biased in a direction towards the attachment body 1302 (and away from the median plane of the user's body) by the user's ear and/or by anatomical features surrounding the user's ear. Accordingly, while the attachment apparatus 1800 is secured to the user's ear, at least some part of the first sealing portion 1804 and the second sealing portion 1806 may transition from an uncompressed, non-deformed configuration to a compressed, deformed configuration in which at least some part of the first sealing portion 1804 and the second sealing portion 1806 form at least a partial acoustic seal against the user's anatomy surrounding the user's ear. When the attachment apparatus 1800 is removed or decoupled from the user's ear, the first and second sealing portions 1804, 1806 may transition from the compressed, deformed configuration back to the uncompressed, non-deformed configuration. By way of a non-limiting example, as the user's ear is removed from the attachment apparatus 1800, the first and second sealing portions 1804, 1806 may elastically return to the uncompressed, non-deformed configuration illustrated in FIGS. 18A-18B by moving in a direction away from the attachment body 1302.

In some embodiments (e.g., as illustrated in FIG. 18B), while the sealing body 1802 is coupled—directly or indirectly—to the attachment body 1302, the first sealing portion 1804 of the sealing body 1802 may extend or protrude from the attachment body 1302 to a lesser extent than the extent to which the second sealing portion 1806 extends or protrudes from the attachment body 1302. The extent to which the first sealing portion 1804 and the second sealing portion 1806 protrudes from the attachment body 1302 may correspond, at least in part, with a general contour of a human head. As such, while the hooking body 1322 is secured to the user's ear, the attachment body 1302 may be rotated or angled on the user's head towards the user's face due to the difference in the extents to which the first sealing portion 1804 and the second sealing portion 1806 protrude from the attachment body 1302. In some embodiments, by causing the attachment body 1302 to rotate toward the user's face when the attachment apparatus 1800 is secured to the user's ear, the sealing body 1802 may cause the mid-ear portion 1304 of the attachment body 1302 to be positioned near and/or oriented in the direction of the ear canal of the user's ear. In such embodiments, a speaker system (not shown) mounted to the mid-ear portion 1304 of the attachment body 1302 may play sound that is directed towards the user's ear canal. As such, the configurations of the first sealing portion 1804 and the second sealing portion 1806 may cause such speaker system to provide the user with a relatively high-quality audio experience as the sound generated by the speaker system is directed to the user's ear canal. Further, because the sealing body 1802 generally forms at least a partial acoustic seal around the user's ear, the sealing body 1802 may also reduce or prevent ambient noise from interfering with the sound generated by such a speaker system, thereby further improving the user's audio experience. In some alternative embodiments, the extent to which the first sealing portion 1804 and second sealing portion 1806 extend away from the attachment body 1302 may be the same or substantially the same, and in such embodiments, the attachment apparatus 1800 may not be rotated or may only be slightly rotated towards the user's face when the attachment apparatus 1800 is secured to the user's ear.

Figure 19A:
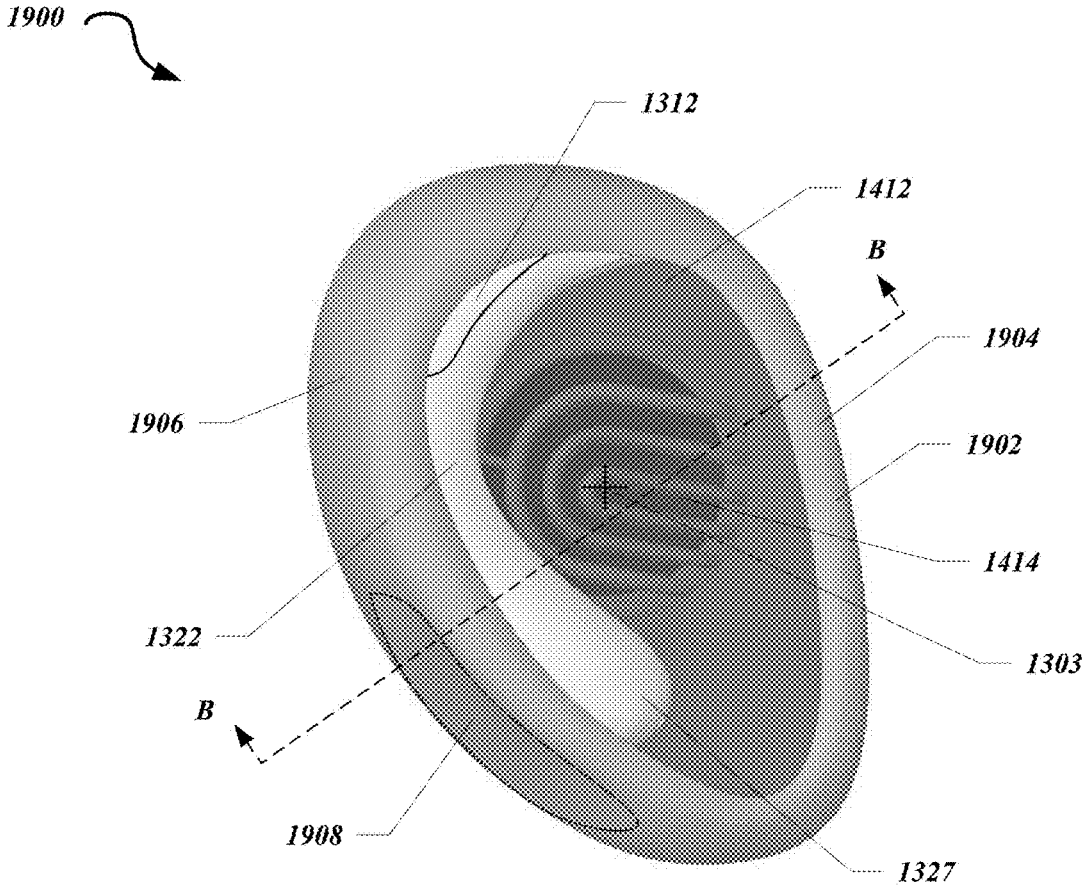
FIGS. 19A-19B are exterior views of an alternative attachment apparatus, according to some embodiments.
Figure 19B:
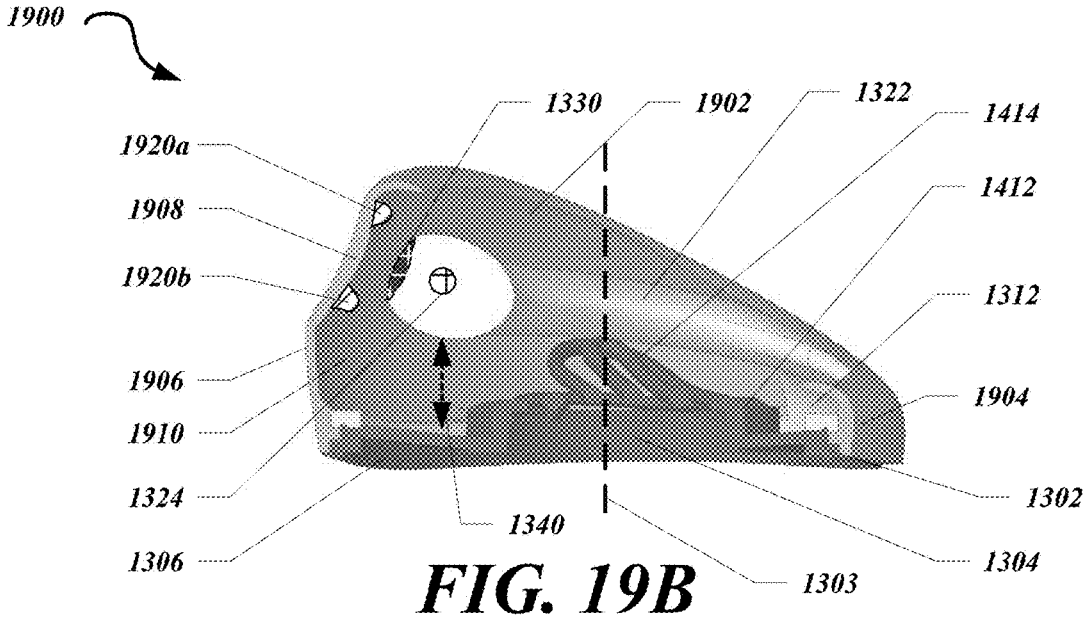

FIG. 19A illustrates an exterior view of a back side of an alternative attachment apparatus 1900, according to some embodiments. FIG. 19B illustrates a semi-transparent cross-sectional view of the attachment apparatus 1900 taken along referential line B depicted in FIG. 19A. In some embodiments, the attachment apparatus 1900 may include, but is not limited to including: the attachment body 1302, which may include the plate member 1306, the bridging member 1312, and the optional mid-ear portion 1304; the optional earpad 1412 that may include a protruding portion 1414; and the hooking body 1322 that may include the deformable core 1324 and optional cutout 1330. Some of the structural features of the attachment apparatus 1900 may be analogous to structural features described above, for example, with reference to the attachment apparatuses 1300, 1400, 1500, 1600, 1700, 1800 described with reference to FIGS. 13A-18B. For clarity and simplicity of description, duplicative descriptions of such structural features of the attachment apparatus 1900 may not be repeated in the following descriptions.

With reference to FIGS. 19A-19B, the attachment apparatus 1900 may include a sealing body 1902. In some embodiments, the sealing body 1902 may be made from or may include, at least partially, one or more pliable or elastomeric materials, such as plastic, foam, rubber, silicone, or the like or combinations of any of the foregoing. The sealing body 1902 may define or form an opening configured to be suitable for enabling a user's ear to pass through the opening (e.g., as described with reference to the sealing body 1402 illustrated in FIG. 14). For example, the sealing body 1902 may define an opening having a shape that approximates the shape of a profile of a user's ear or, in another example, having a roughly elliptical shape.

The sealing body 1902 may be coupled to the attachment body 1302 (e.g., along the coupling edge 1305 of the attachment body 1302—not shown) so that the sealing body 1902 at least partially defines or forms a chamber 1910. The hooking body 1322 and the bridging member 1312 may be encapsulated, at least substantially, within the chamber 1910. In some embodiments, when a user's ear is secured to the hooking body 1322 (e.g., as described with reference to FIG. 13A-13E), at least a portion of the user's ear may have passed through the opening into the chamber 1910, and at least a posterior portion of the user's ear may be positioned within the space 1340 in the chamber 1910 between the hooking body 1322 and the attachment body 1302 or, optionally, the earpad 1412 (e.g., as illustrated in the examples depicted in FIGS. 16A-16B).

In some embodiments, the sealing body 1902 may be configured to encapsulate, at least substantially, the user's ear within the chamber 1910 while the attachment apparatus 1900 is secured to the user's ear via the hooking body 1322. The sealing body 1902 may be further configured to engage an area of the user's anatomy around the user's ear to form at least a partial acoustic seal against the user's anatomy. Accordingly, while the attachment apparatus 1900 is secured to the user's ear via the hooking body 1322, the sealing body 1902 may at least substantially encapsulate the user's ear in the chamber 1910 and/or form at least a partial acoustic seal around the user's ear, thereby reducing or blocking ambient sounds from reaching the user's ear canal.

In some embodiments, the sealing body 1902 may be configured similarly to one or more other sealing bodies described herein (e.g., with reference to the sealing body 1802 described with reference to FIGS. 18A-18B). For example, the sealing body 1902 may be configured to have a curved cross section so that portions of the sealing body 1902 proximate to the opening engage an area around a user's ear when the user's ear is inserted through the opening. In another example, the sealing body 1902 may include a first sealing portion 1904 and a second sealing portion 1906 that are collectively configured to engage and be biased by a user's anatomy while the attachment apparatus 1900 is secured to or is being secured to the user's ear in order to form at least a partial acoustic seal against the user's anatomy. In yet another example (e.g., as illustrated in FIG. 19B), while the sealing body 1902 is coupled—directly or indirectly—to the attachment body 1302, the first sealing portion 1904 of the sealing body 1902 may extend or protrude from the attachment body 1302 to a lesser extent to the extent to which the second sealing portion 1906 extends or protrudes from the attachment body 1302 in order to cause the attachment apparatus 1900 to be rotated or angled on the user's head towards the user's face due to the difference in the extents to which the first sealing portion 1904 and the second sealing portion 1906 protrude from the attachment body 1302.

In some embodiments, when the attachment apparatus 1900 is secured to the user's ear, the second end 1327 of the hooking body 1322 may be moved/adjusted towards or away from the posterior portion of the user's ear in order to achieve a more or less secure fit to the individual physical features of the user's ear. However, as described, the sealing body 1902 may at least partially encapsulate the user's ear while the user's ear is secured to the hooking body 1322. In order to facilitate the user's ability to move or deform the hooking body 1322 to achieve a desired fit, the second sealing portion 1906 may be configured to include an indented portion 1908. The indented portion 1908 may be configured to improve or to facilitate the user's access to the hooking body 1322. Particularly, in some embodiments, the indented portion 1908 of the second sealing portion 1906 may be configured as a curved indentation that protrudes into the chamber 1910 towards the second end 1327 of the hooking body 1322 (e.g., as illustrated in FIG. 19B). Accordingly, in some embodiments, the indented portion 1908 may be positioned and/or oriented on or in the second sealing portion 1906 to be in proximity to the second end 1327 of the hooking body 1322. While, the cross section of the indented portion 1908 is illustrated in FIG. 19B as being curved, the cross section of the indented portion 1908 may be various other shapes that protrude into the chamber 1910, including but not limited to rectangular, triangular, or various other shapes.

In some embodiments, the indented portion 1908 may be configured to receive a force from a user that is directed toward the second end 1327 of the hooking body 1322. In response to receiving the force, the indented portion 1908 may move toward the second end 1327 of the hooking body 1322 until the indented portion 1908 physically engages the second end 1327, at which point the force that is applied to the indented portion 1908 may be transferred through the indented portion 1908 to the second end 1327 of the hooking body 1322, thereby causing both the indented portion 1908 and the second end 1327 of the hooking body 1322 to deform/move in the direction of the force.

In some embodiments, the indented portion 1908 may be made from or include one or more known elastic materials. As such, the indented portion 1908 may be configured to transition from a resting configuration (e.g., an initial or non-deformed configuration) to a deformed configuration in response to receiving a force. Specifically, the indented portion 1908 may remain in a resting configuration when no force is applied to the indented portion 1908 regardless of whether the attachment apparatus 1900 is secured to a user's ear. Upon receiving a force that is applied to the indented portion 1908, the indented portion 1908 may transition to a deformed configuration by deforming or moving in the direction that the force is applied (e.g., as previously described). In such embodiments, the indented portion 1908 may then return to the resting configuration when such force is removed from the indented portion 1908. By way of a non-limiting example, the attachment apparatus 1900 may be secured to a user's ear via the hooking body 1322. The user may use a finger or other object to push against the indented portion 1908, which may cause the indented portion 1908 to move toward the second end of the hooking body 1322 until the indented portion 1908 engages the second end 1327 of the hooking body 1322. If the force applied to the indented portion 1908 is sufficient to move/deform the deformable core 1324, both the indented portion 1908 and the second end of the hooking body 1322 may be moved along the direction of force. When the force is removed from the indented portion 1908, the indented portion 1908 may transition back to the resting configuration of the indented portion 1908 due to the elastic characteristics of the indented portion 1908. In this example, the second end 1327 of the hooking body 1322 may not elastically return to its initial configuration (i.e., its configuration prior to being moved by the force) and, instead, may remain in its new, deformed configuration. In some alternative embodiments, the indented portion 1908 may not be elastic and thus may remain in a deformed configuration after a force is removed from the indented portion 1908.

In some embodiments, an elasticity of the indented portion 1908 may be relatively higher than an elasticity of the remainder of the second sealing portion 1906 (and/or the remainder of the sealing body 1902 as a whole). In such embodiments, the indented portion 1908 may be configured to be particularly suitable for receiving a deforming force that enables a user to apply a force to the hooking body 1322 via the indented portion 1908 (e.g., as described above). In such embodiments, applying a force to the indented portion 1908 may deform the indented portion 1908 without any or substantial deformation of other portions of the sealing body 1902. The relatively higher elasticity of the indented portion 1908 may be a result of using one or more materials to form the indented portion 1908 that are different than the one or more materials used to form the remainder of the sealing body 1908. In some alternative (or additional) embodiments, the indented portion 1908 may be comparatively thinner than the thickness of the remainder of the sealing body 1902, and the relatively higher elasticity of the indented portion 1908 may be a result of the comparatively lower thickness of the indented portion 1908 in relation to the remainder of the sealing body 1902.

In some embodiments, the indented portion 1908 may include one or more guiding protrusions 1920*a*, 1920*b* that may function as physical barriers that cause the hooking body 1322 to maintain a relatively consistent position relative to the indented portion 1908 of the sealing body 1902 when a force is applied to the hooking body 1322 through the indented portion 1908. For example, when a force is applied to the indented portion 1908 in the direction of the hooking body 1322, the indented portion 1908 may move towards the cutout 1330 of the hooking body 1322 until the hooking body 1322 is positioned (at least partially) between the guiding protrusions 1920*a*, 1920*b*. In such embodiments, the one or more guiding protrusions 1920*a*, 1920*b* may enable a user to guide the hooking body 1322 in a desired direction and to a desired position through the sealing body 1902 without directly engaging the hooking body 1322. In some embodiments, the guiding protrusions 1920*a*, 1920*b* may be positioned on the second sealing portion 1906 so that the guiding protrusions 1920*a*, 1920*b* are substantially parallel. In such embodiments, the distance between the guiding protrusions 1920*a*, 1920*b* may be substantially the same along the length of the guiding protrusions 1920*a*, 1920*b*. In some embodiments, distance between the guiding protrusions 1920*a*, 1920*b* along at least one dimension may be less than at least one dimension of a cross section of the hooking body 1322 (e.g., a longitudinal length of the cross section of the hooking body 1322 and/or a latitudinal length of the cross section of the hooking body 1322). In some optional embodiments, the guiding protrusions 1920*a*, 1920*b* may be positioned on the second sealing portion 1906 to run along at least a portion of the indented portion 1908 of the second sealing portion 1906. In some alternative (or additional) embodiments, the guiding protrusions 1920*a*, 1920*b* may be positioned to run along at least a portion of the indented portions 1908 of the second sealing portion 1906 and at least a portion of an un-indented portion of the second sealing portion 1906.

Figure 20A:
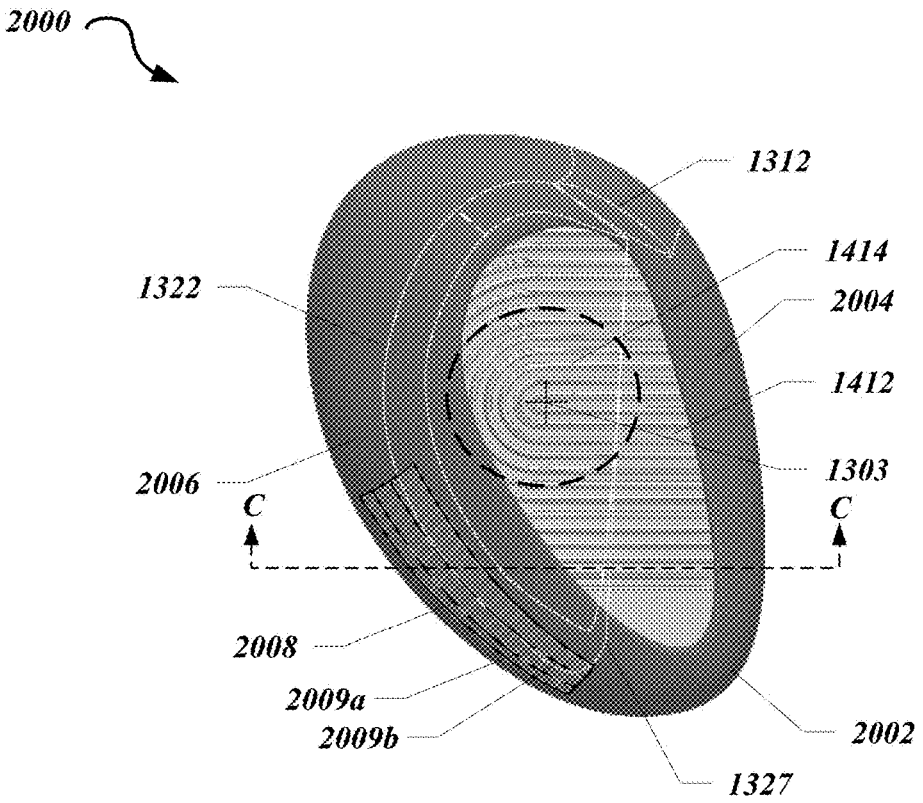
FIGS. 20A-20B are exterior views of an alternative attachment apparatus, according to some embodiments.
Figure 20B:
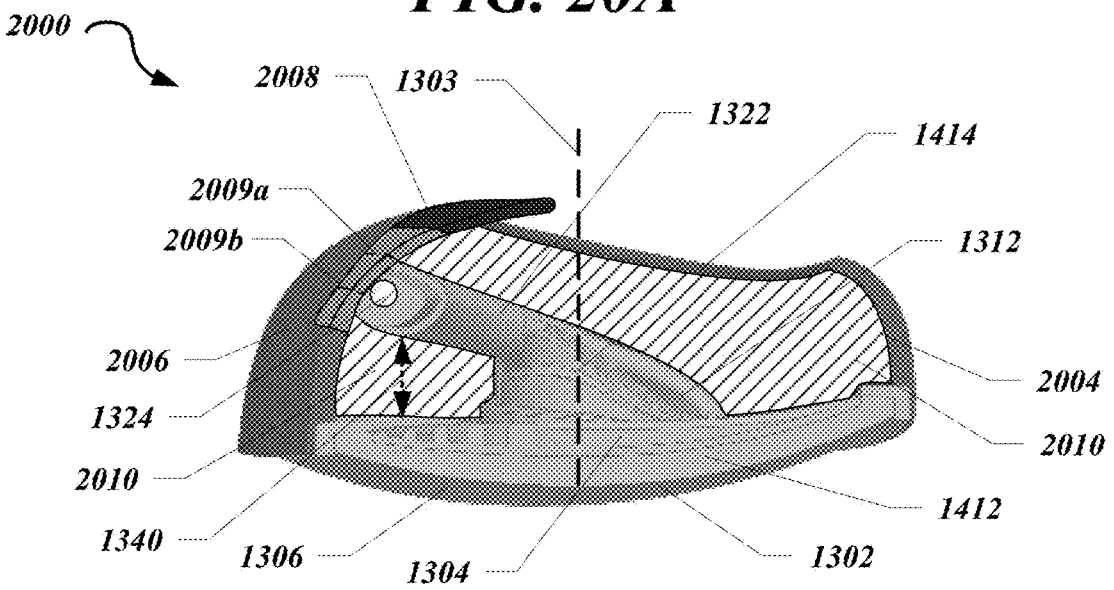

FIG. 20A illustrates an exterior view of a back side of an alternative attachment apparatus 2000, according to some embodiments. FIG. 20B illustrates a semi-transparent cross-sectional view of the attachment apparatus 2000 taken along referential line C depicted in FIG. 20A. The attachment apparatus 2000 may include one or more structural features that are similar to the structural features described with reference to the attachment apparatus 1300, 1400, 1500, 1600, 1700, 1800, 1900 (e.g., as described with reference to FIGS. 13A-19B). In some embodiments, the attachment apparatus 2000 may include, but is not limited to including: the attachment body 1302, which may include the plate member 1306, the bridging member 1312, and the optional mid-ear portion 1304; the optional earpad 1412 that may include a protruding portion 1414; and the hooking body 1322 that may include the deformable core 1324 and optional cutout 1330. For clarity and simplicity of description, duplicative descriptions of such structural features of the attachment apparatus 2000 may not be repeated in the following descriptions.

With reference to FIGS. 20A-20B, the attachment apparatus 2000 may include a sealing body 2002. In some embodiments, the sealing body 2002 may be made from or may include, at least partially, one or more pliable or elastomeric materials, such as plastic, foam, rubber, silicone, or the like or combinations of any of the foregoing. The sealing body 2002 may define or form an opening configured to be suitable for enabling a user's ear to pass through the opening (e.g., as described with reference to the sealing body 1402 illustrated in FIG. 14). For example, the sealing body 2002 may define an opening having a shape that approximates the shape of a profile of a user's ear or, in another example, having a roughly elliptical shape.

The sealing body 2002 may be coupled to the attachment body 1302 (e.g., along the coupling edge 1305 of the attachment body 1302—not shown) so that the sealing body 2002 at least partially defines or forms a chamber 2010. The hooking body 1322 and the bridging member 1312 may be encapsulated, at least substantially, within the chamber 2010. In some embodiments, when a user's ear is secured to the hooking body 1322 (e.g., as described with reference to FIG. 13A-13E), at least a portion of the user's ear may have passed through the opening into the chamber 2010, and at least a posterior portion of the user's ear may be positioned within the space 1340 in the chamber 2010 between the hooking body 1322 and the attachment body 1302 or, optionally, the earpad 1412 (e.g., as illustrated in the examples depicted in FIGS. 16A-16B).

In some embodiments, the sealing body 2002 may be configured to encapsulate, at least substantially, the user's ear within the chamber 2010 while the attachment apparatus 2000 is secured to the user's ear via the hooking body 1322. The sealing body 2002 may be further configured to engage an area of the user's anatomy around the user's ear to form at least a partial acoustic seal against the user's anatomy. Accordingly, while the attachment apparatus 2000 is secured to the user's ear via the hooking body 1322, the sealing body 2002 may at least substantially encapsulate the user's ear in the chamber 2010 and/or form at least a partial acoustic seal around the user's ear, thereby reducing or blocking ambient sounds from reaching the user's ear canal.

In some embodiments, the sealing body 2002 may be configured similarly to one or more other sealing bodies described herein (e.g., with reference to the sealing body 1802 described with reference to FIGS. 18A-18B). For example, the sealing body 2002 may be configured to have a curved cross section so that portions of the sealing body 2002 proximate to the opening engage an area around a user's ear when the user's ear is inserted through the opening. In another example, the sealing body 2002 may include a first sealing portion 2004 and a second sealing portion 2006 that are collectively configured to engage and be biased by a user's anatomy while the attachment apparatus 2000 is secured to or is being secured to the user's ear in order to form at least a partial acoustic seal against the user's anatomy. In yet another example (e.g., as illustrated in FIG. 20B), while the sealing body 2002 is coupled—directly or indirectly—to the attachment body 1302, the first sealing portion 2004 of the sealing body 2002 may extend or protrude from the attachment body 1302 to a lesser extent to the extent to which the second sealing portion 2006 extends or protrudes from the attachment body 1302 in order to cause the attachment apparatus 2000 to be rotated or angled on the user's head towards the user's face due to the difference in the extents to which the first sealing portion 2004 and the second sealing portion 2006 protrude from the attachment body 1302.

As similarly described above (e.g., with reference to the sealing body 1902 depicted in FIGS. 19A-19B), the sealing body 2002 may at least partially encapsulate the user's ear while the user's ear is secured to the hooking body 1322. In order to facilitate the user's ability to adjust or deform the hooking body 1322 to achieve a desired fit, the second sealing portion 2006 may be configured to include an incised portion 2008 that enables or improves the user's access to the hooking body 1322. Particularly, in some embodiments, the incised portion 2008 of the second sealing portion 2006 may be a portion of the second sealing portion 2002 featuring one or more incisions or slits, such as the one or more incisions 2009*a*, 2009*b*.

In some embodiments, the incised portion 2008 may be positioned and/or oriented on or in the second sealing portion 2006 to be in proximity to the second end 1327 of the hooking body 1322. In some embodiments, the incised portion 2008 may be made from or include one or more known elastic materials. As such, the incised portion 2008 may be configured to transition from a resting configuration (e.g., an initial or non-deformed configuration) to a deformed configuration in response to receiving a force. Specifically, the incised portion 2008 may remain in a resting configuration when no force is applied to the incised portion 2008 regardless of whether the attachment apparatus 2000 is secured to a user's ear. Upon receiving a force that is applied to the incised portion 2008, the incised portion 2008 may transition to a deformed configuration by deforming or moving in the direction that the force is applied. In such embodiments, the incised portion 2008 may then return to the resting configuration when such force is removed from the incised portion 2008.

In some embodiments, in response to receiving a force (e.g., from a user's finger), causes the incised portion 2008 may move into the chamber 2010 towards the second end 1327 of the hooking body 1322 until the incised portion 2008 physically engages the second end 1327. The force that is applied to the incised portion 2008 may be transferred through the incised portion 2008 to the second end 1327 of the hooking body 1322, thereby causing both the incised portion 2008 and the second end 1327 of the hooking body 1322 to deform/move in the direction of the force. Accordingly, when the attachment apparatus 2000 is secured to a user's ear via the hooking body 1322, the user may use a finger or other object to push against the incised portion 2008 until the incised portion 2008 engages the second end 1327 of the hooking body 1322 and until the hooking body 1322 engages the user's ear. When the force is removed from the incised portion 2008, the incised portion 2008 may transition back to the resting configuration of the incised portion 2008 due to the elastic characteristics of the incised portion 2008. In some embodiments, the second end 1327 of the hooking body 1322 may not elastically return to its initial configuration (i.e., its configuration prior to being moved by the force) and, instead, may remain in its new, deformed configuration. In some alternative embodiments, the incised portion 2008 may not be elastic and thus may remain in a deformed configuration after a force is removed from the incised portion 2008.

In some embodiments, at least one dimension of the one or more incisions 2009*a*, 2009*b* in the incised portion 2008 may be larger while the incised portion 2008 is in a deformed configuration than at least one dimension of the one or more incisions 2009*a*, 2009*b* in the incised portion 2008 when the incised portion 2008 is in the initial, resting configuration. In such embodiments, the effectiveness or completeness of the encapsulation and/or acoustic seal formed by the sealing body 2002 may be less while the incised portion 2008 is in a deformed configuration because a size of at least one dimension of the one or more incisions 2009*a*, 2009*b* of the incised portion 2008 are relatively larger than when the incised portion 2008 is in an initial, resting configuration. However, once the force is removed from the incised portion 2008, the incised portion 2008 may return to the initial, resting configuration, and the effectiveness or completeness of the encapsulation and/or acoustic seal formed by the sealing body 2002 may increase or improve because the size of at least one dimension of the one or more incisions 2009*a*, 2009*b* of the incised portion 2008 may decrease. For example, the one or more incisions 2009*a*, 2009*b* may elastically open or otherwise increase in size as the incised portion 2008 is stretched by an applied force into the deformed configuration, thereby enabling ambient sound to more easily enter the chamber 2010. In this example, when the one or more incisions 2009*a*, 2009*b* elastically close or otherwise decrease in size when the force is removed from the incised portion 2008, ambient sound that enters the chamber 2010 may be reduced or eliminated.

In some embodiments, the one or more incisions 2009*a*, 2009*b* of the incised portion 2008 may allow enable the incised portion 2008 to deform to a greater extent than the extent to which other portions of the sealing body 2002 deforms when a force is applied to the incised portion 2008. By way of a non-limiting example, a user may push through the incised portion 2008 in order to adjust the hooking body 1322. In this example, the elastic material of the incised portion 2008 may be deformed and urged toward the hooking body 1322, whereas other portions of the second sealing portion 2006 may not be deformed by the pushing force or may not be deformed to the same extent.

In some embodiments, an elasticity of the incised portion 2008 may be relatively higher than an elasticity of the remainder of the second sealing portion 2006 (and/or the remainder of the sealing body 2002 as a whole). In such embodiments, the incised portion 2008 may be configured to be particularly suitable for receiving a deforming force that enables a user to apply a force to the hooking body 1322 via the incised portion 2008 (e.g., as described above). In such embodiments, applying a force to the incised portion 2008 may deform the incised portion 2008 without any or substantial deformation of other portions of the sealing body 2002. The relatively higher elasticity of the incised portion 2008 may be a result of the using one or more materials to form the incised portion 2008 that are different than the one or more materials used to form the remainder of the sealing body 2008. In some alternative (or additional) embodiments, the incised portion 2008 may be comparatively thinner than the thickness of the remainder of the sealing body 2002, and the relatively higher elasticity of the incised portion 2008 may be a result of the comparatively lower thickness of the incised portion 2008 in relation to the remainder of the sealing body 2002. In some embodiments, the one or more incisions 2009*a*, 2009*b* of the incised portion 2008 may run substantially parallel to the opening formed by the sealing body 2002. In some embodiments in which the incised portion 2008 includes multiple incisions, the multiple incisions of the incised portion 2008 may be at least substantially parallel to one another (e.g., the incisions 2009*a*, 2009*b* as illustrated in FIGS. 20A-20B).

Figure 21A:
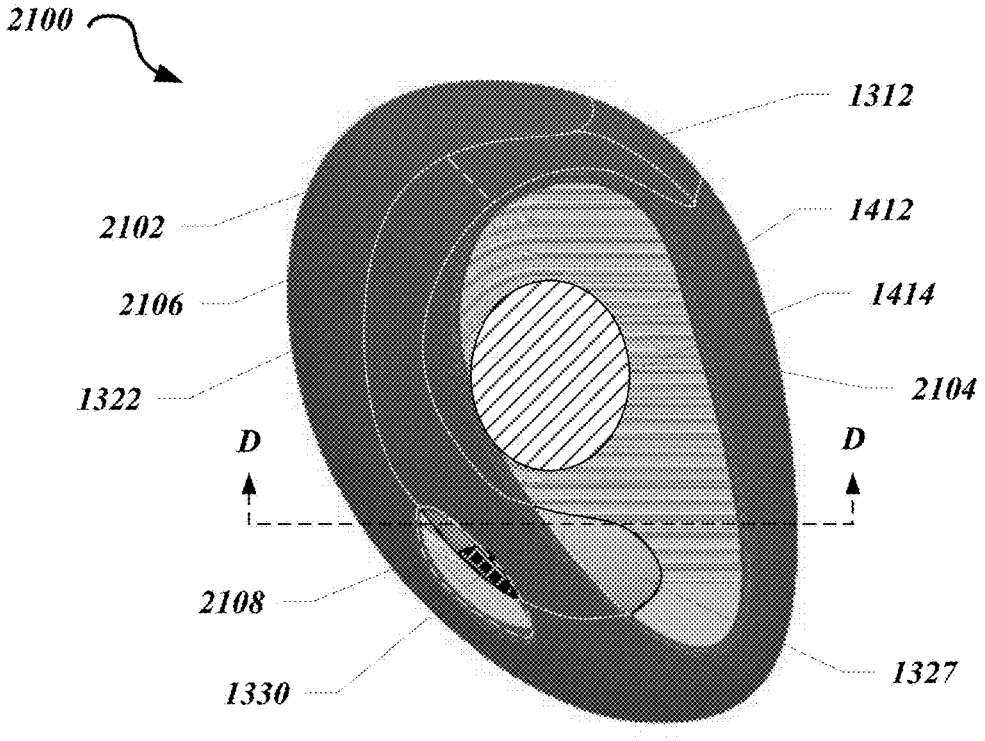
FIGS. 21A-21B are exterior views of an alternative attachment apparatus, according to some embodiments.
Figure 21B:
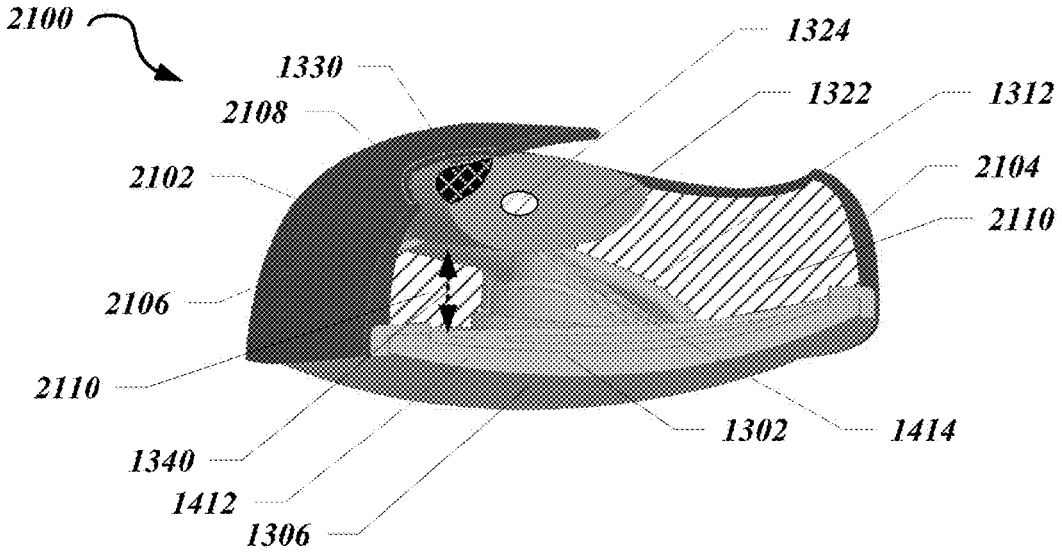

FIG. 21A illustrates an exterior view of a back side of an alternative attachment apparatus 2100, according to some embodiments. FIG. 21B illustrates a semi-transparent cross-sectional view of the attachment apparatus 2100 taken along referential line D depicted in FIG. 21A. In some embodiments, the attachment apparatus 2100 may include, but is not limited to including: the attachment body 1302, which may include the plate member 1306, the bridging member 1312, and the optional mid-ear portion 1304; the optional earpad 1412 that may include the protruding portion 1414; and the hooking body 1322 that may include the deformable core 1324 and optional cutout 1330. Some of the structural features of the attachment apparatus 2100 may be analogous to structural features described above, for example, with reference to one or more of the attachment apparatuses 1300, 1400, 1500, 1600, 1700, 1800, 1900, 2000 described with reference to FIGS. 13A-20B. For clarity and simplicity of description, duplicative descriptions of such structural features of the attachment apparatus 2100 may not be repeated in the following descriptions.

With reference to FIGS. 21A-21B, the attachment apparatus 2100 may include a sealing body 2102. In some embodiments, the sealing body 2102 may be made from or may include, at least partially, one or more pliable or elastomeric materials, such as plastic, foam, rubber, silicone, or the like or combinations of any of the foregoing. The sealing body 2102 may define or form an opening configured to be suitable for enabling a user's ear to pass through the opening (e.g., as described with reference to the sealing body 1402 illustrated in FIG. 14). For example, the sealing body 2102 may define an opening having a shape that approximates the shape of a profile of a user's ear or, in another example, having a roughly elliptical shape.

The sealing body 2102 may be coupled to the attachment body 1302 (e.g., along the coupling edge 1305 of the attachment body 1302—not shown) so that the sealing body 2102 at least partially defines or forms a chamber 2110. The hooking body 1322 and the bridging member 1312 may be encapsulated, at least substantially, within the chamber 2110. In some embodiments, when a user's ear is secured to the hooking body 1322 (e.g., as described with reference to FIG. 13A-13E), at least a portion of the user's ear may have passed through the opening into the chamber 2110, and at least a posterior portion of the user's ear may be positioned within the space 1340 in the chamber 2110 between the hooking body 1322 and the attachment body 1302 or, optionally, the earpad 1412 (e.g., as illustrated in the examples depicted in FIGS. 16A-16B).

In some embodiments, the sealing body 2102 may be configured to encapsulate, at least substantially, the user's ear within the chamber 2110 while the attachment apparatus 2100 is secured to the user's ear via the hooking body 1322. The sealing body 2102 may be further configured to engage an area of the user's anatomy around the user's ear to form at least a partial acoustic seal against the user's anatomy. Accordingly, while the attachment apparatus 2100 is secured to the user's ear via the hooking body 1322, the sealing body 2102 may at least substantially encapsulate the user's ear in the chamber 2110 and/or form at least a partial acoustic seal around the user's ear, thereby reducing or blocking ambient sounds from reaching the user's ear canal.

In some embodiments, a shape of a cross section of the sealing body 2102 may be curved so that portions of the sealing body 2102 proximate to the opening engage an area around a user's ear when the user's ear is inserted through the opening. In such embodiments, the portions of the sealing body 2102 proximate to the opening may form at least a partial acoustic seal around the user's ear while the attachment apparatus 2100 is secured to the user's ear. By way of a non-limiting example illustrated in FIG. 21B, the sealing body 2102 may be configured so that the sealing body 2102 curves towards (at least partially) the center position 1303 of the attachment body 1302.

In some embodiments, the sealing body 2102 may be configured similarly to one or more other sealing bodies described herein (e.g., with reference to the sealing body 1802 described with reference to FIGS. 18A-18B). For example, the sealing body 2102 may be configured to have a curved cross section so that portions of the sealing body 2102 proximate to the opening engage an area around a user's ear when the user's ear is inserted through the opening. In another example, the sealing body 2102 may include a first sealing portion 2104 and a second sealing portion 2106 that are collectively configured to engage and be biased by a user's anatomy while the attachment apparatus 2100 is secured to or is being secured to the user's ear in order to form at least a partial acoustic seal against the user's anatomy. In yet another example (e.g., as illustrated in FIG. 21B), while the sealing body 2102 is coupled—directly or indirectly—to the attachment body 1302, the first sealing portion 2104 of the sealing body 2102 may extend or protrude from the attachment body 1302 to a lesser extent to the extent to which the second sealing portion 2106 extends or protrudes from the attachment body 1302 in order to cause the attachment apparatus 2100 to be rotated or angled on the user's head towards the user's face due to the difference in the extents to which the first sealing portion 2104 and the second sealing portion 2106 protrude from the attachment body 1302.

When the attachment apparatus 2100 is secured to the user's ear, the second end 1327 of the hooking body 1322 may be moved/adjusted towards or away from the posterior portion of the user's ear to achieve a more or less secure fit to the individual physical features of the user's ear. However, as described, the sealing body 2102 may at least partially encapsulate the user's ear while the user's ear is secured to the hooking body 1322. In order to facilitate the user's ability to adjust or deform the hooking body 1322 to achieve a desired fit, the second sealing portion 2106 may be configured to include an opening 2108. The opening 2108 may be configured to improve or to facilitate the user's access to the hooking body 1322. Particularly, in some embodiments, the opening 2108 of the second sealing portion 2106 may be formed in a part of the second sealing portion 2106 in proximity to the second end 1327 of the hooking body 1322 (e.g., as illustrated in FIG. 21B). In some embodiments, the opening 2108 may be configured to enable a force from a user to be directed through the opening 2108 and toward the second end 1327 of the hooking body 1322. For example, while the hooking body 1322 is positioned around a root of the user's ear, the user may insert a finger (or various other objects) through the opening 2108 until the finger engages and moves the second end 1327 of the hooking body 1322 in a direction of the applied force. The user may continue applying a force through the opening 2108 until the second end 1327 of the hooking body 1322 is comfortably secured to the user's ear.

In some embodiments, portions of the second sealing portion 2106 surrounding the opening 2108 may be made from or include one or more known elastic materials. As such, these portions of the second sealing portion 2106 may be configured to transition from a resting configuration (e.g., an initial or non-deformed configuration) to a deformed configuration in response to receiving a force. Specifically, these portions of the second sealing portion 2106 surrounding the opening 2108 may remain in a resting configuration when no force is applied regardless of whether the attachment apparatus 2100 is secured to a user's ear. Upon receiving a force that is applied to portions of the second sealing portion 2106 surrounding/forming the opening 2108, such portions of the second sealing portion 2106 may transition to a deformed configuration by deforming or moving in the direction that the force is applied. In such embodiments, such portions of the second sealing portion 2106 surrounding/forming the opening 2108 may then return to the resting configuration when such force is removed from the area of the opening 2108. By way of a non-limiting example, the attachment apparatus 2100 may be secured to a user's ear via the hooking body 1322. The user may insert a finger or other object through the opening 2108 to move the second end of the hooking body 1322. If the force applied to the opening 2108 is sufficient to move/deform the deformable core 1324, the second end 1327 of the hooking body 1322 may be moved along the direction of the applied force. When the force is removed, the second end 1327 of the hooking body 1322 may not elastically return to its initial configuration (i.e., its configuration prior to being moved by the force) and, instead, may remain in its new, deformed configuration.

In some embodiments, an elasticity of portions of the second sealing portion 2106 surrounding/forming the opening 2108 may be relatively higher than an elasticity of the remainder of the second sealing portion 2106 (and/or the remainder of the sealing body 2102 as a whole). In such embodiments, portions of the second sealing portion 2106 surrounding the opening 2108 may be configured to be particularly suitable for receiving a deforming force that enables a user to apply a force to the hooking body 1322 via the opening 2108 (e.g., as described above). In such embodiments, applying a force through the opening 2108 may deform portions of the second sealing portion 2106 surrounding/forming the opening 2108 without any or substantial deformation of other portions of the sealing body 2102. The relatively higher elasticity of the portions of the second sealing portion 2106 surrounding the opening 2108 may be a result of the using one or more materials that are different than the one or more materials used to form the remainder of the sealing body 2108. In some alternative (or additional) embodiments, the portions of the second sealing portion 2106 surrounding the opening 2108 may be comparatively thinner than the thickness of the remainder of the sealing body 2102, and the relatively higher elasticity of the portions of the second sealing portion 2106 surrounding the opening 2108 may be a result of the comparatively lower thickness of these portions.

Figure 22A:
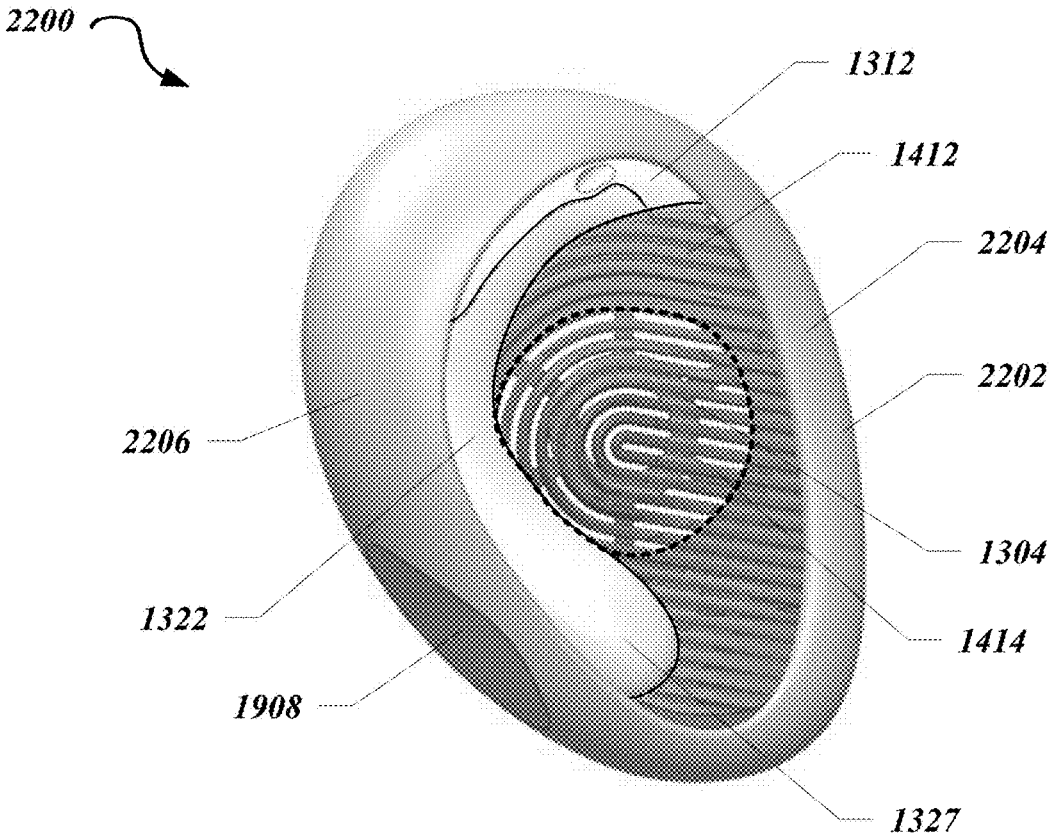
FIGS. 22A-22B are exterior views of an alternative attachment apparatus, according to some embodiments.
Figure 22B:
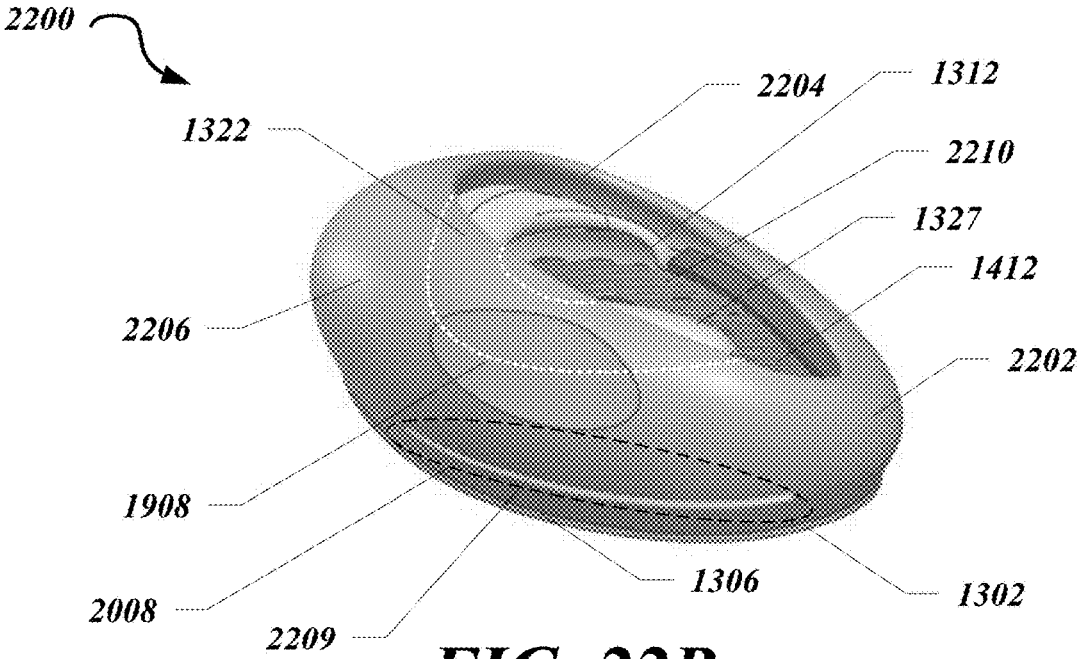

FIG. 22A illustrates an exterior view of a back side of an alternative attachment apparatus 2200, according to some embodiments. FIG. 22B illustrates a perspective view of the back side of the attachment apparatus 2200. In some embodiments, the attachment apparatus 2200 may include, but is not limited to including: the attachment body 1302, which may include the plate member 1306, the bridging member 1312, and the optional mid-ear portion 1304; the optional earpad 1412 that may include a protruding portion 1414; and the hooking body 1322 that may include the deformable core 1324 and optional cutout 1330. Some of the structural features of the attachment apparatus 2200 may be analogous to structural features described above, for example, with reference to the attachment apparatuses 1300, 1400, 1500, 1600, 1700, 1800, 1900, 2000, 2100 described with reference to FIGS. 13A-21B. For clarity and simplicity of description, duplicative descriptions of such structural features of the attachment apparatus 2200 may not be repeated in the following descriptions.

With reference to FIGS. 22A-22B, the attachment apparatus 2200 may include a sealing body 2202. In some embodiments, the sealing body 2202 may be made from or may include, at least partially, one or more pliable or elastomeric materials, such as plastic, foam, rubber, silicone, or the like or combinations of any of the foregoing. The sealing body 2202 may define or form an opening configured to be suitable for enabling a user's ear to pass through the opening (e.g., as described with reference to the sealing body 1402 illustrated in FIG. 14). For example, the sealing body 2202 may define an opening having a shape that approximates the shape of a profile of a user's ear or, in another example, having a roughly elliptical shape.

The sealing body 2202 may be coupled to the attachment body 1302 (e.g., along the coupling edge 1305 of the attachment body 1302—not shown) so that the sealing body 2202 at least partially defines or forms a chamber 2210. The hooking body 1322 and the bridging member 1312 may be encapsulated, at least substantially, within the chamber 2210. In some embodiments, when a user's ear is secured to the hooking body 1322 (e.g., as described with reference to FIG. 13A-13E), at least a portion of the user's ear may have passed through the opening into the chamber 2210, and at least a posterior portion of the user's ear may be positioned within the space 1340 (not shown) between the hooking body 1322 and the attachment body 1302 or, optionally, the earpad 1412 (e.g., as illustrated in the examples depicted in FIGS. 16A-16B).

In some embodiments, the sealing body 2202 may be configured to encapsulate, at least substantially, the user's ear within the chamber 2210 while the attachment apparatus 2200 is secured to the user's ear via the hooking body 1322. The sealing body 2202 may be further configured to engage an area of the user's anatomy around the user's ear to form at least a partial acoustic seal against the user's anatomy. Accordingly, while the attachment apparatus 2200 is secured to the user's ear via the hooking body 1322, the sealing body 2202 may at least substantially encapsulate the user's ear in the chamber 2210 and/or form at least a partial acoustic seal around the user's ear, thereby reducing or blocking ambient sounds from reaching the user's ear canal.

In some embodiments, the sealing body 2202 may be configured similarly to one or more other sealing bodies described herein (e.g., with reference to the sealing body 1802 described with reference to FIGS. 18A-18B). For example, the sealing body 2202 may be configured to have a curved cross section so that portions of the sealing body 2202 proximate to the opening engage an area around a user's ear when the user's ear is inserted through the opening. In another example, the sealing body 2202 may include a first sealing portion 2204 and a second sealing portion 2206 that are collectively configured to engage and be biased by a user's anatomy while the attachment apparatus 2200 is secured to or is being secured to the user's ear in order to form at least a partial acoustic seal against the user's anatomy. In yet another example, while the sealing body 2202 is coupled—directly or indirectly—to the attachment body 1302, the first sealing portion 2204 of the sealing body 2202 may extend or protrude from the attachment body 1302 to a lesser extent to the extent to which the second sealing portion 2206 extends or protrudes from the attachment body 1302 in order to cause the attachment apparatus 2200 to be rotated or angled on the user's head towards the user's face due to the difference in the extents to which the first sealing portion 2204 and the second sealing portion 2206 protrude from the attachment body 1302.

When the attachment apparatus 2200 is secured to the user's ear, the second end 1327 of the hooking body 1322 may be moved/adjusted towards or away from the posterior portion of the user's ear in order to achieve a more or less secure fit to the individual physical features of the user's ear. However, as described, the sealing body 2202 may at least partially encapsulate the user's ear while the user's ear is secured to the hooking body 1322. In order to facilitate the user's ability to adjust or deform the hooking body 1322 to achieve a desired fit, the second sealing portion 2206 may be configured to include an indented portion (e.g., the indented portion 1908 as described with reference to FIGS. 19A-19B).

In some embodiments, an elasticity of the indented portion 1908 may be relatively higher than an elasticity of the remainder of the second sealing portion 2206 (and/or the remainder of the sealing body 2202 as a whole). In such embodiments, the indented portion 1908 may be configured to be particularly suitable for receiving a deforming force that enables a user to apply a force to the hooking body 1322 via the indented portion 1908 (e.g., as described above). In such embodiments, applying a force to the indented portion 1908 may deform the indented portion 1908 without any or substantial deformation of other portions of the sealing body 2202. The relatively higher elasticity of the indented portion 1908 may be a result of the using one or more materials to form the indented portion 1908 that are different than the one or more materials used to form the remainder of the sealing body 2208. In some alternative (or additional) embodiments, the indented portion 1908 may be comparatively thinner than the thickness of the remainder of the sealing body 2202, and the relatively higher elasticity of the indented portion 1908 may be a result of the comparatively lower thickness of the indented portion 1908 in relation to the remainder of the sealing body 2202.

In some embodiments (not shown), the indented portion 1908 may include one or more guiding protrusions (e.g., the guiding protrusions 1920*a*, 1920*b* as described with reference to FIGS. 19A-19B) that may function as physical barriers that cause the hooking body 1322 to maintain a relatively consistent position relative to the indented portion 1908 of the sealing body 2202 when a force is applied to the hooking body 1322 through the indented portion 1908. In some optional embodiments, the guiding protrusions may be positioned on the second sealing portion 2206 to run along at least a portion of the indented portion 1908 of the second sealing portion 2206. In some alternative (or additional) embodiments, the guiding protrusions may be positioned to run along at least a portion of the indented portion 1908 of the second sealing portion 2206 and at least a portion of an un-indented portion of the second sealing portion 2206.

In some embodiments, the second sealing portion 2206 may be configured to include an incised portion (e.g., the incised portion 2008 as described with reference to FIGS. 20A-20B) that enables or improves the user's access to the hooking body 1322. Particularly, in some embodiments, the incised portion 2008 of the second sealing portion 2206 may be a portion of the second sealing portion 2206 featuring one or more incisions or slits (e.g., an incision 2209). In some embodiments, the incised portion 2008 may be positioned and/or oriented on or in the second sealing portion 2206 to be in proximity to the second end 1327 of the hooking body 1322.

In some embodiments, the incised portion 2008 may be made from or include one or more known elastic materials. As such, the incised portion 2008 may be configured to transition from a resting configuration (e.g., an initial or non-deformed configuration) to a deformed configuration in response to receiving a force. Specifically, the incised portion 2008 may remain in a resting configuration when no force is applied to the incised portion 2008 regardless of whether the attachment apparatus 2200 is secured to a user's ear. Upon receiving a force that is applied to the incised portion 2008, the incised portion 2008 may transition to a deformed configuration by deforming or moving in the direction that the force is applied. In such embodiments, the incised portion 2008 may then return to the resting configuration when such force is removed from the incised portion 2008.

In some embodiments, the incised portion 2008 may be configured to receive a force (e.g., from a user's finger) that causes the incised portion 2008 to move into the chamber 2010 towards the second end 1327 of the hooking body 1322. In response to receiving the force, the incised portion 2008 may move toward the second end 1327 of the hooking body 1322 until the incised portion 2008 physically engages the second end 1327. If the force applied to the incised portion 2008 is sufficient to move/deform the deformable core 1324, both the incised portion 2008 and the second end of the hooking body 1322 may be moved along the direction of force. When the force is removed from the incised portion 2008, the incised portion 2008 may transition back to the resting configuration of the incised portion 2008 due to the elastic characteristics of the incised portion 2008. In this example, the second end 1327 of the hooking body 1322 may not elastically return to its initial configuration (i.e., its configuration prior to being biased by the force) and, instead, may remain in its new, deformed configuration. In some alternative embodiments, the incised portion 2008 may not be elastic and thus may remain in a deformed configuration after a force is removed from the incised portion 2008.

In some embodiments, at least one dimension of the incision 2209 in the incised portion 2008 may be larger while the incised portion 2008 is in a deformed configuration than at least one dimension of the incision 2209 in the incised portion 2008 when the incised portion 2008 is in the initial, resting configuration. In such embodiments, the effectiveness or completeness of the encapsulation and/or acoustic seal formed by the sealing body 2002 may be less while the incised portion 2008 is in a deformed configuration because a size of at least one dimension of the incision 2209 of the incised portion 2008 are relatively larger than when the incised portion 2008 is in an initial, resting configuration. However, once the force is removed from the incised portion 2008, the incised portion 2008 may return to the initial, resting configuration, and the effectiveness or completeness of the encapsulation and/or acoustic seal formed by the sealing body 2202 may increase or improve because the size of at least one dimension of the incision 2209 of the incised portion 2008 may decrease. For example, the incision 2209 may elastically open or otherwise increase in size as the incised portion 2008 is stretched by an applied force into the deformed configuration, thereby enabling ambient sound to more easily enter the chamber 2210. In this example, when the incision 2209 elastically close or otherwise decrease in size when the force is removed from the incised portion 2008, ambient sound that enters the chamber 2210 may be reduced or eliminated.

In some embodiments, the incision 2209 of the incised portion 2008 may allow enable the incised portion 2008 to deform to a greater extent than the extent to which other portions of the sealing body 2202 deforms when a force is applied to the incised portion 2008. By way of a non-limiting example, a user may push through the incised portion 2008 to adjust the hooking body 1322. In this example, the elastic material of the incised portion 2008 may be deformed and urged toward the hooking body 1322, whereas other portions of the second sealing portion 2206 may not be deformed by the pushing force or may not be deformed to the same extent.

In some embodiments, an elasticity of the incised portion 2008 may be relatively higher than an elasticity of the remainder of the second sealing portion 2206 (and/or the remainder of the sealing body 2202 as a whole). In such embodiments, the incised portion 2008 may be configured to be particularly suitable for receiving a deforming force that enables a user to apply a force to the hooking body 1322 via the incised portion 2008 (e.g., as described above). In such embodiments, applying a force to the incised portion 2008 may deform the incised portion 2008 without any or substantial deformation of other portions of the sealing body 2202. The relatively higher elasticity of the incised portion 2008 may be a result of the using one or more materials to form the incised portion 2008 that are different than the one or more materials used to form the remainder of the sealing body 2202. In some alternative (or additional) embodiments, the incised portion 2008 may be comparatively thinner than the thickness of the remainder of the sealing body 2202, and the relatively higher elasticity of the incised portion 2008 may be a result of the comparatively lower thickness of the incised portion 2008 in relation to the remainder of the sealing body 2202. In some embodiments, the incision 2209 of the incised portion 2008 may run substantially parallel to the opening formed by the sealing body 2202. In some embodiments in which the incised portion 2008 includes multiple incisions, the multiple incisions of the incised portion 2008 may be at least substantially parallel to one another.

Figure 23B:
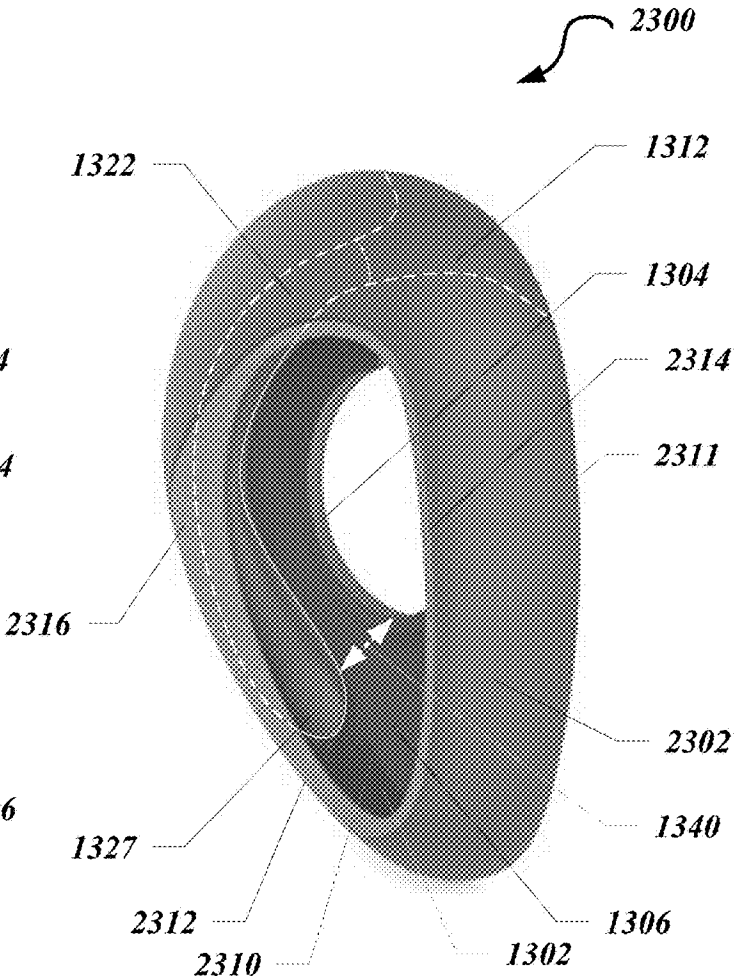
FIGS. 23A-23B are exterior views of an alternative attachment apparatus, according to some embodiments.
Figure 23A:
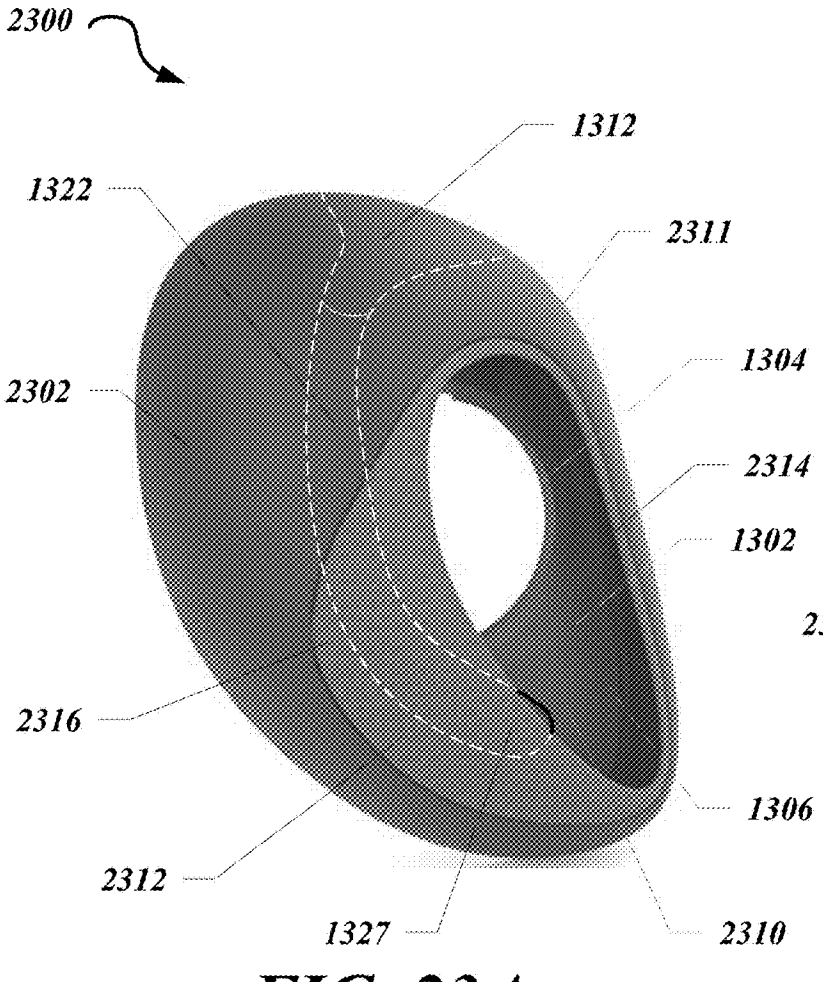

FIG. 23A illustrates an exterior, perspective view of a back side of an alternative attachment apparatus 2300, according to some embodiments. FIG. 23B illustrates another exterior, perspective view of the back side of the alternative attachment apparatus 2300. In some embodiments, the attachment apparatus 2300 may include, but is not limited to including: the attachment body 1302, which may include the plate member 1306, the bridging member 1312, and the optional mid-ear portion 1304; and the hooking body 1322. Some of the structural features of the attachment apparatus 2300 may be analogous to structural features described above, for example, with reference to the attachment apparatuses 1300, 1400, 1500, 1600, 1700, 1800, 1900, 2000, 2100, 2200 described with reference to FIGS. 13A-22B. For clarity and simplicity of description, duplicative descriptions of such structural features of the attachment apparatus 2300 may not be repeated in the following descriptions.

With reference to FIGS. 23A-23B, the attachment apparatus 2300 may include a sealing body 2302. The sealing body 2302 may be made from or may include, at least partially, one or more pliable or elastomeric materials, such as plastic, foam, rubber, silicone, or the like or combinations of any of the foregoing. In some embodiments, the sealing body 2302 may be coupled to (or, alternatively, may be formed with) an opening member 2312, for example, around a perimeter of the sealing body 2302. The opening member 2312 may define or form an opening 2311 suitable for enabling at least a portion of a user's ear to pass through the opening. In a non-limiting example, the opening member 2312 may define an opening 2311 having a shape that approximates the shape of a profile of a user's ear or, generally, having a roughly elliptical shape.

The sealing body 2302 may be coupled to the attachment body 1302 (e.g., along the coupling edge 1305 of the attachment body 1302—not shown) so that the sealing body 2302 and/or the opening member 2312 at least partially defines or forms a chamber 2310. In the examples illustrated in FIGS. 23A-23B, the opening 2311 formed by or defined by the opening member 2312 may at least partially define the chamber 2310. The hooking body 1322 and the bridging member 1312 may be encapsulated, at least substantially, within the chamber 2310. In some embodiments, when a user's ear is secured to the hooking body 1322 (e.g., as described with reference to FIG. 13A-13E), at least a portion of the user's ear may have passed through the opening 2311 into the chamber 2310, and at least a posterior portion of the user's ear may be positioned within the space 1340 in the chamber 2310 between the hooking body 1322 and the attachment body 1302 or, optionally, the earpad 1412 (e.g., as illustrated in the examples depicted in FIGS. 16A-16B).

In some embodiments, the sealing body 2302 and/or the opening member 2312 may be configured to encapsulate, at least substantially, the user's ear within the chamber 2310 while the attachment apparatus 2300 is secured to the user's ear via the hooking body 1322. The opening member 2312 may be further configured to engage an area of the user's anatomy around the user's ear to form at least a partial acoustic seal against the user's anatomy. For example, at least some of the opening member 2312 may engage the area around the user's ear to form at least a partial acoustic seal. Accordingly, while the attachment apparatus 2300 is secured to the user's ear via the hooking body 1322, the sealing body 2302 and/or the opening member 2312 may at least substantially encapsulate the user's ear in the chamber 2310 and/or form at least a partial acoustic seal around the user's ear, thereby reducing or blocking ambient sounds from reaching the user's ear canal.

The opening member 2312 may include a first opening portion 2314 and a second opening portion 2316. When the attachment apparatus 2300 is secured to the user via the hooking body 1322, the first opening portion 2314 may be proximate to a front side of the user's body (e.g., closer to the face of the user), whereas the second opening portion 2316 may be proximate to a back side of the user's body (e.g., closer to the back of the user's head). In some embodiments, at least some of the first opening portion 2314 and at least some of the second opening portion 2316 may engage and be biased by a user's anatomy while the attachment apparatus 2300 is secured to or is being secured to the user's ear. For example, as the user inserts the user's ear into the portion of the chamber 2310 between the hooking body 1322 and the attachment body 1302 (or optionally the earpad 1412), at least some part of the first opening portion 2314 and the second opening portion 2316 (e.g., portions proximate to the opening and distal to the attachment body) may physically engage and be biased in a direction towards the attachment body 1302 (and away from the median plane of the user's body) by the user's ear and/or by anatomical features surrounding the user's ear.

In some embodiments (e.g., as illustrated in FIG. 23B), the opening member 2312 may be made from one or more materials that are different from the one or more materials making up the remainder of the sealing body 2302. By way of a non-limiting example, the opening member 2312 may be made from a relatively elastic and/or compliant material (e.g., an elastic fabric), and the sealing body 2302 may be made from a relatively inelastic and/or less compliant material (e.g., a higher-shore plastic or heavy rubber). In some embodiments, the second opening portion 2316 may be made from or include one or more known elastic materials. As such, the second opening portion 2316 may be configured to transition from a resting configuration (e.g., an initial or non-deformed configuration) to a deformed in response to receiving a force. Specifically, the second opening portion 2316 may remain in a resting configuration when no force is applied to the second opening portion 2316 regardless of whether the attachment apparatus 2300 is secured to a user's ear. Upon receiving a force that is applied to the second opening portion 2316, the second opening portion 2316 may transition a deformed configuration by deforming or biasing in the direction that the force is applied. In such embodiments, the second opening portion 2316 may then return to the resting configuration when such force is removed from the second opening portion 2316.

In some embodiments, while the attachment apparatus 2300 is secured to a user's ear via the hooking body 1322, the user may use a finger or other object to push against the second opening portion 2316, which may cause the second opening portion 2316 to move toward the second end of the hooking body 1322 until the second opening portion 2316 engages the second end 1327 of the hooking body 1322. If the force applied to the second opening portion 2316 is sufficient to move/deform the deformable core 1324, both the second opening portion 2316 and the second end of the hooking body 1322 may be moved along the direction of force. When the force is removed from the second opening portion 2316, the second opening portion 2316 may transition back to the resting configuration of the second opening portion 2316 due to the elastic characteristics of the second opening portion 2316. In this example, the second end 1327 of the hooking body 1322 may not elastically return to its initial configuration (i.e., its configuration prior to being biased by the force) and, instead, may remain in its new, deformed configuration. In some alternative embodiments, the second opening portion 2316 may not be elastic and thus may remain in a deformed configuration after a force is removed from the second opening portion 2316.

Figure 24B:
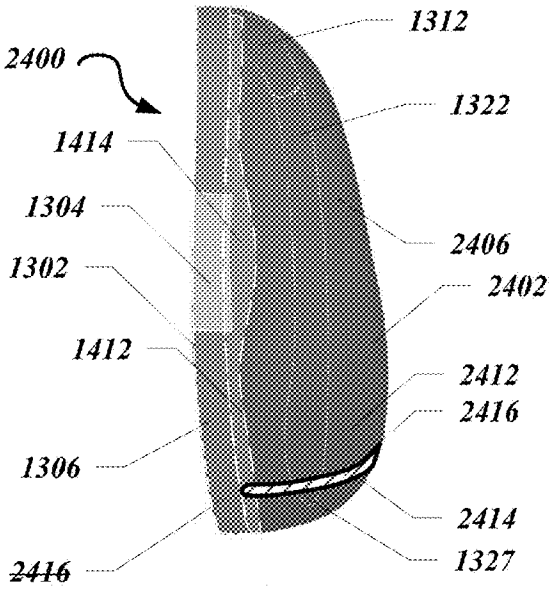
FIGS. 24A-24C are exterior views of an alternative attachment apparatus, according to some embodiments.
Figure 24C:
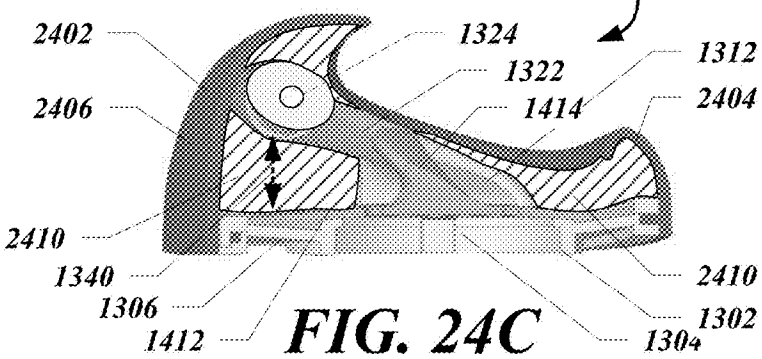
Figure 24A:
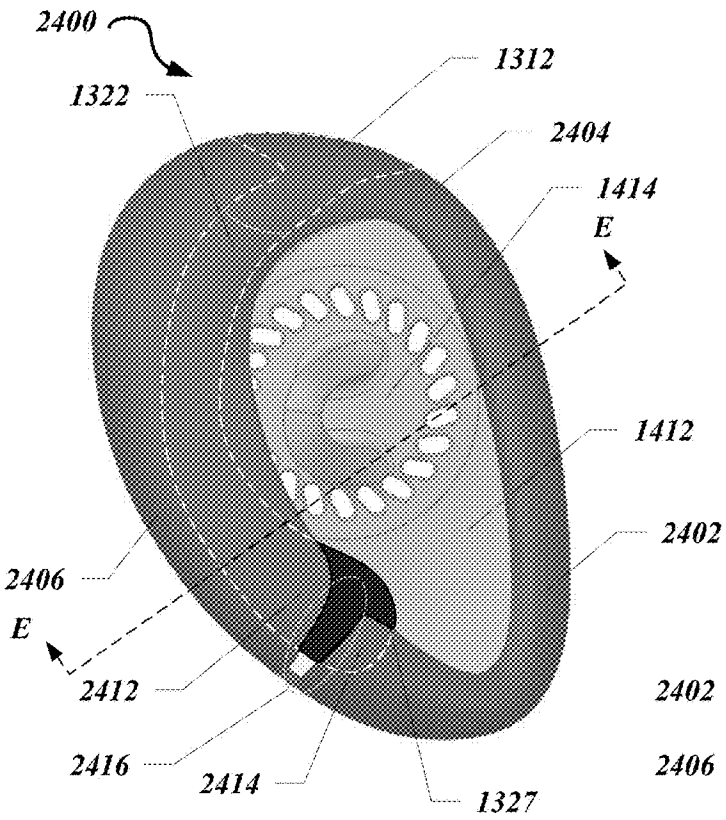

FIG. 24A illustrates an exterior view of a back side of an alternative attachment apparatus 2400, according to some embodiments. FIG. 24B illustrates an exterior view of a posterior side of an alternative attachment apparatus 2400, according to some embodiments. FIG. 24C illustrates a semi-transparent cross-sectional view of the attachment apparatus 2400 taken along referential line E depicted in FIG. 24A. In some embodiments, the attachment apparatus 2400 may include, but is not limited to including: the attachment body 1302, which may include the plate member 1306, the bridging member 1312, and the optional mid-ear portion 1304; the optional earpad 1412 that may include a protruding portion 1414; and the hooking body 1322 that may include the deformable core 1324 and optional cutout 1330. Some of the structural features of the attachment apparatus 2400 may be analogous to structural features described above, for example, with reference to the attachment apparatuses 1300, 1400, 1500, 1600, 1700, 1800, 1900, 2000, 2100, 2200, 2300 described with reference to FIGS. 13A-23B. For clarity and simplicity of description, duplicative descriptions of such structural features of the attachment apparatus 2400 may not be repeated in the following descriptions.

With reference to FIGS. 24A-24C, the attachment apparatus 2400 may include a sealing body 2402. In some embodiments, the sealing body 2402 may be made from or may include, at least partially, one or more pliable or elastomeric materials, such as plastic, foam, rubber, silicone, or the like or combinations of any of the foregoing. The sealing body 2402 may define or form an opening configured to be suitable for enabling a user's ear to pass through the opening (e.g., as described with reference to the sealing body 1402 illustrated in FIG. 14). For example, the sealing body 2402 may define an opening having a shape that approximates the shape of a profile of a user's ear or, in another example, having a roughly elliptical shape.

The sealing body 2402 may be coupled to the attachment body 1302 (e.g., along the coupling edge 1305 of the attachment body 1302—not shown) so that the sealing body 2402 at least partially defines or forms a chamber 2410. The hooking body 1322 and the bridging member 1312 may be encapsulated, at least substantially, within the chamber 2410. In some embodiments, when a user's ear is secured to the hooking body 1322 (e.g., as described with reference to FIG. 13A-13E), at least a portion of the user's ear may have passed through the opening into the chamber 2410, and at least a posterior portion of the user's ear may be positioned within the space 1340 in the chamber 2410 between the hooking body 1322 and the attachment body 1302 or, optionally, the earpad 1412 (e.g., as illustrated in the examples depicted in FIGS. 16A-16B).

In some embodiments, the sealing body 2402 may be configured to encapsulate, at least substantially, the user's ear within the chamber 2410 while the attachment apparatus 2400 is secured to the user's ear via the hooking body 1322. The sealing body 2402 may be further configured to engage an area of the user's anatomy around the user's ear to form at least a partial acoustic seal against the user's anatomy. Accordingly, while the attachment apparatus 2400 is secured to the user's ear via the hooking body 1322, the sealing body 2402 may at least substantially encapsulate the user's ear in the chamber 2410 and/or form at least a partial acoustic seal around the user's ear, thereby reducing or blocking ambient sounds from reaching the user's ear canal.

In some embodiments, the sealing body 2402 may be configured similarly to one or more other sealing bodies described herein (e.g., with reference to the sealing body 1802 described with reference to FIGS. 18A-18B). For example, the sealing body 2402 may be configured to have a curved cross section so that portions of the sealing body 2402 proximate to the opening engage an area around a user's ear when the user's ear is inserted through the opening. In another example, the sealing body 2402 may include an anterior sealing portion 2404 and a posterior sealing portion 2406 that are collectively configured to engage and be biased by a user's anatomy while the attachment apparatus 2400 is secured to or is being secured to the user's ear in order to form at least a partial acoustic seal against the user's anatomy. In yet another example (e.g., as illustrated in FIG. 24B), while the sealing body 2402 is coupled—directly or indirectly—to the attachment body 1302, the anterior sealing portion 2404 of the sealing body 2402 may extend or protrude from the attachment body 1302 to a lesser extent to the extent to which the posterior sealing portion 2406 extends or protrudes from the attachment body 1302 in order to cause the attachment apparatus 2400 to be rotated or angled on the user's head towards the user's face due to the difference in the extents to which the anterior sealing portion 2404 and the posterior sealing portion 2406 protrude from the attachment body 1302.

When the attachment apparatus 2400 is secured to the user's ear, the second end 1327 of the hooking body 1322 may be moved/adjusted towards or away from the posterior portion of the user's ear in order to achieve a more or less secure fit to the individual physical features of the user's ear. However, as described, the sealing body 2402 may at least partially encapsulate the user's ear while the user's ear is secured to the hooking body 1322. In order to facilitate the user's ability to adjust or deform the hooking body 1322 to achieve a desired fit, the posterior sealing portion 2406 may be configured to include a first portion 2412 and a second portion 2414. In some embodiments, the posterior sealing portion 2406 may be configured to include at least a partial gap 2416 between the first portion 2412 and the second portion 2414. The gap 2416 may at least partially separate the first portion 2406 from the second portion 2414. In such embodiments, the gap 2416 between the first portion 2412 and the second portion 2414 may enable the first portion 2412 and the second portion 2414 to be deformed independently of each other (at least substantially). For example, a force may be applied to the first portion 2412 that may move or deform the first portion 2412 without moving or deforming (or without substantially moving or deforming) the second portion 2414. Similarly, another force may be applied to the second portion 2414 without moving or deforming (or without substantially moving or deforming) the first portion 2412.

At least one of the first portion 2412 or the second portion 2414 may be configured to improve or to facilitate the user's access to the hooking body 1322. Particularly, in some embodiments, the posterior portion 2406 may be configured such that the gap 2416 is formed proximate to the hooking body 1322 (e.g., as illustrated in FIG. 24A). Accordingly, in such embodiments, the first portion 2412 of the posterior portion 2406 may be positioned and/or oriented on or in the posterior sealing portion 2406 to be in proximity to the second end 1327 of the hooking body 1322. In some embodiments, the first portion 2412 may be configured to receive a force from a user that is directed toward the second end 1327 of the hooking body 1322. In response to receiving the force, the first portion 2412 may move toward the second end 1327 of the hooking body 1322 until the first portion 2412 physically engages the second end 1327, at which point the force that is applied to the first portion 2412 may be transferred through the first portion 2412 to the second end 1327 of the hooking body 1322, thereby causing both the first portion 2412 and the second end 1327 of the hooking body 1322 to deform/move in the direction of the force.

In some embodiments, the first portion 2412 may be made from or include one or more known elastic materials. As such, the first portion 2412 may be configured to transition from a resting configuration (e.g., an initial or non-deformed configuration) to a deformed configuration in response to receiving a force. Specifically, the first portion 2412 may remain in a resting configuration when no force is applied to the first portion 2412 regardless of whether the attachment apparatus 2400 is secured to a user's ear. Upon receiving a force that is applied to the first portion 2412, the first portion 2412 may transition a deformed configuration by deforming or moving in the direction that the force is applied. In such embodiments, the first portion 2412 may then return to the resting configuration when such force is removed from the first portion 2412. By way of a non-limiting example, the attachment apparatus 2400 may be secured to a user's ear via the hooking body 1322. The user may use a finger or other object to push against the first portion 2412, which may cause the first portion 2412 to move toward the second end of the hooking body 1322 until the first portion 2412 engages the second end 1327 of the hooking body 1322. If the force applied to the first portion 2412 is sufficient to move/deform the deformable core 1324, both the first portion 2412 and the second end of the hooking body 1322 may be moved along the direction of force. When the force is removed from the first portion 2412, the first portion 2412 may transition back to the resting configuration of the first portion 2412 due to the elastic characteristics of the first portion 2412. In this example, the second end 1327 of the hooking body 1322 may not elastically return to its initial configuration (i.e., its configuration prior to being biased by the force) and, instead, may remain in its new, deformed configuration. In some alternative embodiments, the first portion 2412 may not be elastic and thus may remain in a deformed configuration after a force is removed from the first portion 2412.

In some embodiments, an elasticity of the first portion 2412 may be relatively higher than an elasticity of the remainder of the posterior sealing portion 2406 (and/or the remainder of the sealing body 2402 as a whole). In such embodiments, the first portion 2412 may be configured to be particularly suitable for receiving a deforming force that enables a user to apply a force to the hooking body 1322 via the first portion 2412 (e.g., as described above). In such embodiments, applying a force to the first portion 2412 may deform the first portion 2412 without any or substantial deformation of other portions of the sealing body 2402, such as the second portion 2414. When the attachment apparatus 2400 is secured to the user's ear, the second portion 2414 may form at least a partial acoustic seal against the user's anatomy. Thus, because the first portion 2412 may be moved/deformed at least substantially independently of the second portion 2414, and the second portion 2414 may maintain at least a partial acoustic seal against the user's anatomy while the first portion 2412 is deformed or biased, thereby improving the overall audio experience of the user while the user is adjusting the attachment apparatus 2400.

Figure 25A:
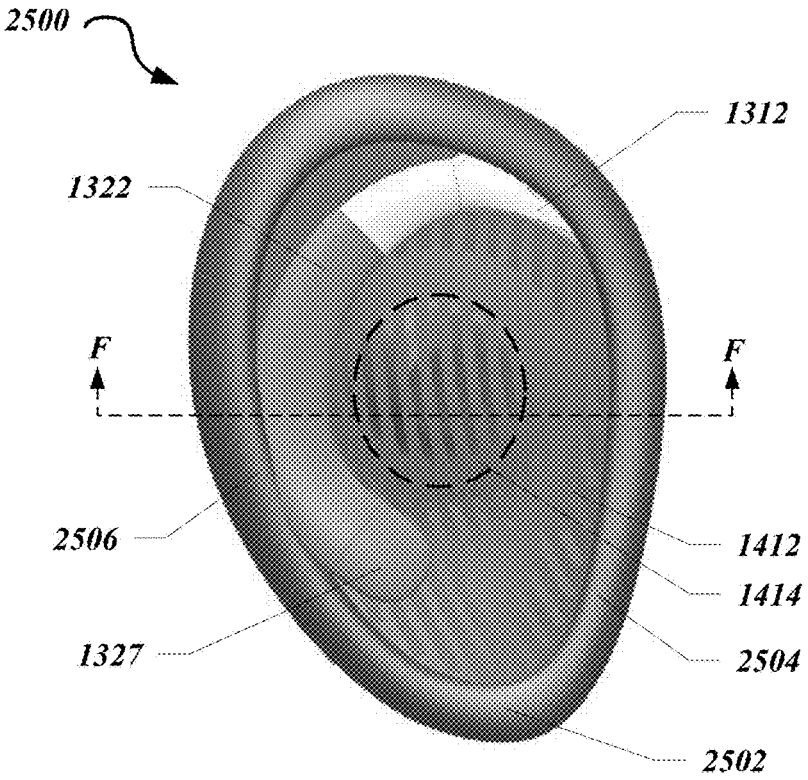
FIGS. 25A-25B are exterior views of an alternative attachment apparatus, according to some embodiments.
Figure 25B:
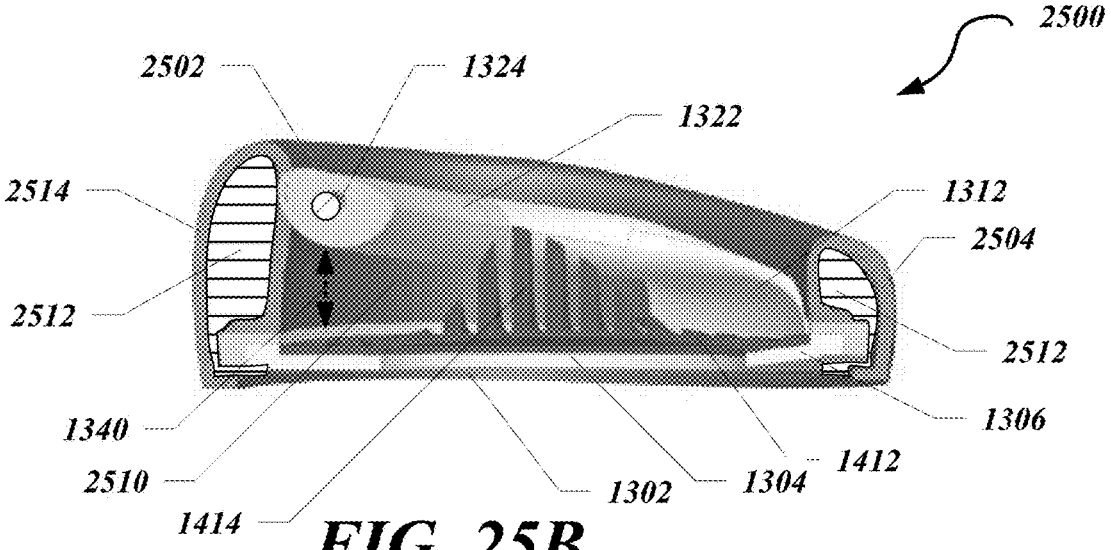

FIG. 25A illustrates an exterior view of a back side of an alternative attachment apparatus 2500, according to some embodiments. FIG. 25B illustrates a cross-sectional view of the attachment apparatus 2500 taken along referential line F depicted in FIG. 25A. In some embodiments, the attachment apparatus 2500 may include, but is not limited to including: the attachment body 1302, which may include the plate member 1306, the bridging member 1312, and the optional mid-ear portion 1304; the optional earpad 1412 that may include a protruding portion 1414; and the hooking body 1322 that may include the deformable core 1324. Some of the structural features of the attachment apparatus 2500 may be analogous to structural features described above, for example, with reference to the attachment apparatuses 1300, 1400, 1500, 1600, 1700, 1800, 1900, 2000, 2100, 2200, 2300, 2400 described with reference to FIGS. 13A-24C. For clarity and simplicity of description, duplicative descriptions of such structural features of the attachment apparatus 2500 may not be repeated in the following descriptions.

With reference to FIGS. 25A-25B, the attachment apparatus 2500 may include a sealing body 2502. In some embodiments, the sealing body 2502 may be made from or may include, at least partially, one or more pliable or elastomeric materials, such as plastic, foam, rubber, silicone, or the like or combinations of any of the foregoing. The sealing body 2502 may define or form an opening configured to be suitable for enabling a user's ear to pass through the opening (e.g., as described with reference to the sealing body 1402 illustrated in FIG. 14). For example, the sealing body 2502 may define an opening having a shape that approximates the shape of a profile of a user's ear or, in another example, having a roughly elliptical shape.

The sealing body 2502 may be coupled to the attachment body 1302 (e.g., along the coupling edge 1305 of the attachment body 1302—not shown) so that the sealing body 2502 at least partially defines or forms a chamber 2510. The hooking body 1322 and the bridging member 1312 may be encapsulated, at least substantially, within the chamber 2510. In some embodiments, when a user's ear is secured to the hooking body 1322 (e.g., as described with reference to FIG. 13A-13E), at least a portion of the user's ear may have passed through the opening into the chamber 2510, and at least a posterior portion of the user's ear may be positioned within the space 1340 in the chamber 2510 between the hooking body 1322 and the attachment body 1302 or, optionally, the earpad 1412 (e.g., as illustrated in the examples depicted in FIGS. 16A-16B).

In some embodiments, the sealing body 2502 may be configured to encapsulate, at least substantially, the user's ear within the chamber 2510 while the attachment apparatus 2500 is secured to the user's ear via the hooking body 1322. The sealing body 2502 may be further configured to engage an area of the user's anatomy around the user's ear to form at least a partial acoustic seal against the user's anatomy. Accordingly, while the attachment apparatus 2500 is secured to the user's ear via the hooking body 1322, the sealing body 2502 may at least substantially encapsulate the user's ear in the chamber 2510 and/or form at least a partial acoustic seal around the user's ear, thereby reducing or blocking ambient sounds from reaching the user's ear canal.

In some embodiments, the sealing body 2502 may be configured similarly to one or more other sealing bodies described herein (e.g., with reference to the sealing body 1802 described with reference to FIGS. 18A-18B). For example, the sealing body 2502 may be configured to have a curved cross section so that portions of the sealing body 2502 proximate to the opening engage an area around a user's ear when the user's ear is inserted through the opening. In another example, the sealing body 2502 may include a first sealing portion 2504 and a second sealing portion 2506 that are collectively configured to engage and be biased by a user's anatomy while the attachment apparatus 2500 is secured to or is being secured to the user's ear in order to form at least a partial acoustic seal against the user's anatomy. In yet another example (e.g., as illustrated in FIG. 25B), while the sealing body 2502 is coupled directly or indirectly—to the attachment body 1302, the first sealing portion 2504 of the sealing body 2502 may extend or protrude from the attachment body 1302 to a lesser extent to the extent to which the second sealing portion 2506 extends or protrudes from the attachment body 1302 in order to cause the attachment apparatus 2500 to be rotated or angled on the user's head towards the user's face due to the difference in the extents to which the first sealing portion 2504 and the second sealing portion 2506 protrude from the attachment body 1302.

In some embodiments, the sealing body 2502 may be configured to include an inner portion 2512 and an exterior portion 2514. The exterior portion 2514 may be configured to engage physically with the anatomy of a user and may be made from one or more materials suitable for that purpose. (e.g., silicone, rubber, or the like). The exterior portion 2514 may, at least substantially, cover or surround the interior portion 2512. In some embodiments, the exterior portion 2514 may be configured to form at least a partial acoustic seal against the user's anatomy while the attachment apparatus 2500 is secured to the user's ear (e.g., as generally described above).

In some embodiments, the inner portion 2512 may be configured to improve sound attenuation and/or acoustic isolation of a user's ear while the attachment apparatus 2500 is secured to the user's ear. The inner portion 2512 may be hollow or substantially hollow. Alternatively (or additionally), the inner portion 2512 may be made from one or more sound absorbing materials, including but not limited to one or more of foam, fabric, or the like. In such embodiments, the inner portion 2512 may be configured to be deformed as a result of securing the attachment apparatus 2500 to the user's ear. For example, the sealing body 2502 may physically engage the user's anatomy while the attachment apparatus 2500 is secured to the user's ear, thereby causing the inner portion 2512 of the sealing body 2502 to become at least partially compressed/deformed. In some embodiments, the inner portion 2512 may be configured to revert or return to an uncompressed or non-deformed configuration when the attachment apparatus 2500 is unsecured from the user's ear.

In various embodiments described herein (e.g., with reference to FIGS. 18A-25), the hooking body may not be coupled directly to the sealing body. Accordingly, in such embodiments, the hooking body may be biased or adjusted independently of the sealing body, and vice versa. However, in some alternative embodiments (e.g., as further described below), at least a portion of the sealing body may be coupled to at least a portion of the hooking body. In this configuration, at least portions of the sealing body and the hooking body may be adjusted or biased collectively. Specifically, as the hooking body is deformed or biased (e.g., in response to receiving an applied force), the portion of the sealing body may move in concert with the hooking body so that manipulation of the hooking body is simplified while maintaining the at least partial acoustic seal formed by the sealing body against the user's anatomy when the attachment apparatus is secured to the user's ear.

Figure 26A:
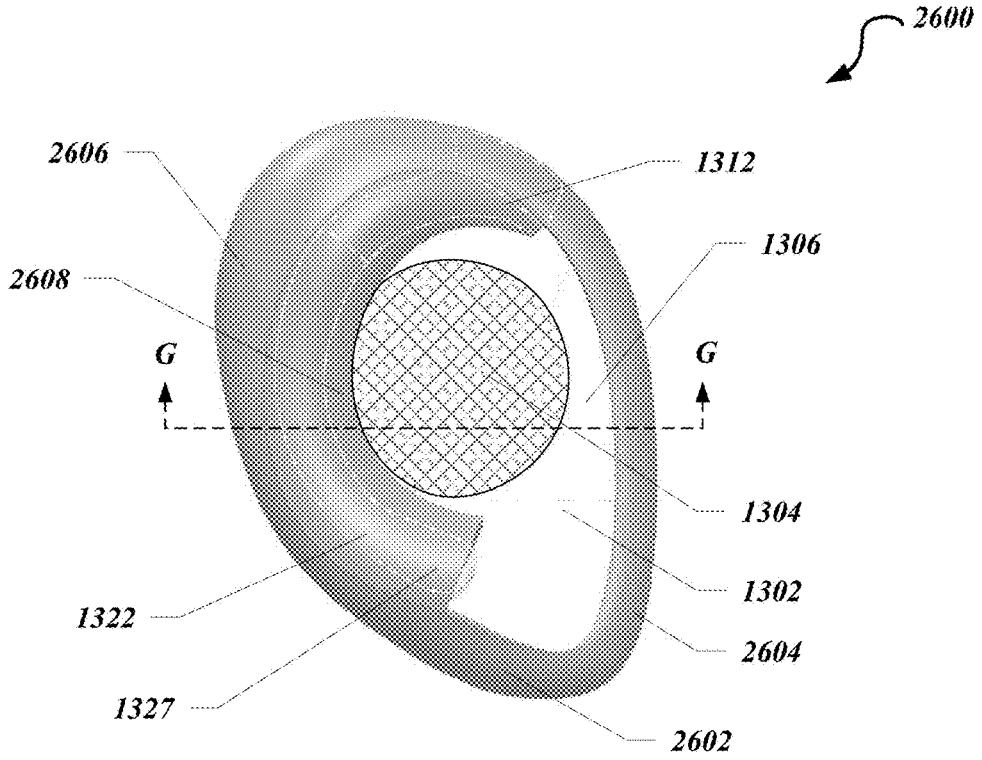
FIGS. 26A-26B are exterior views of an alternative attachment apparatus, according to some embodiments.
Figure 26B:
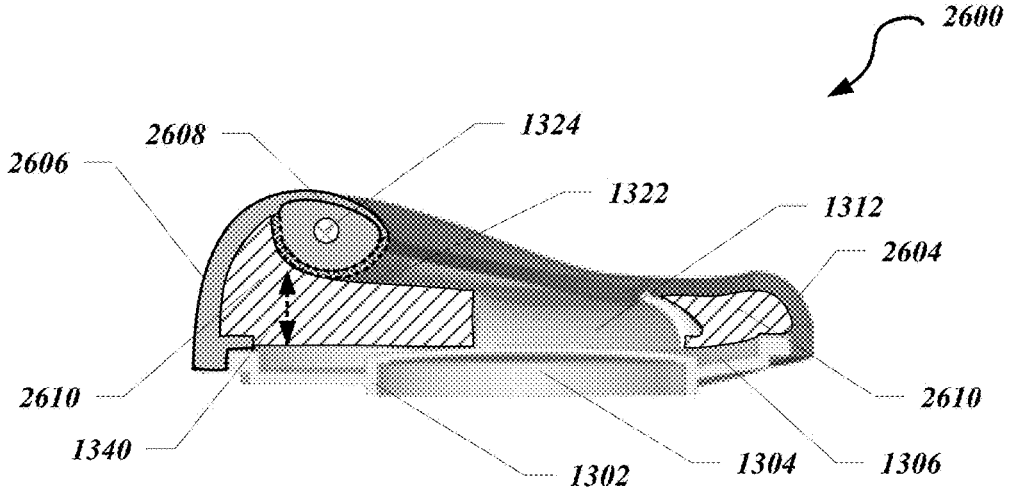

FIG. 26A illustrates an exterior view of a back side of an alternative attachment apparatus 2600, according to some embodiments. FIG. 26B illustrates a cross-sectional view of the attachment apparatus 2600 taken along referential line G depicted in FIG. 26A. In some embodiments, the attachment apparatus 2600 may include, but is not limited to including: the attachment body 1302, which may include the plate member 1306, the bridging member 1312, and the optional mid-ear portion 1304; the optional earpad 1412 that may include a protruding portion 1414; and the hooking body 1322 that may include the deformable core 1324 and optional cutout 1330. Some of the structural features of the attachment apparatus 2600 may be analogous to structural features described above, for example, with reference to the attachment apparatuses 1300, 1400, 1500, 1600, 1700, 1800, 1900, 2000, 2100, 2200, 2300, 2400, 2500 described with reference to FIGS. 13A-25B. For clarity and simplicity of description, duplicative descriptions of such structural features of the attachment apparatus 2600 may not be repeated in the following descriptions.

With reference to FIGS. 26A-26B, the attachment apparatus 2600 may include a sealing body 2602. In some embodiments, the sealing body 2602 may be made from or may include, at least partially, one or more pliable or elastomeric materials, such as plastic, foam, rubber, silicone, or the like or combinations of any of the foregoing. The sealing body 2602 may define or form an opening configured to be suitable for enabling a user's ear to pass through the opening (e.g., as described with reference to the sealing body 1402 illustrated in FIG. 14). For example, the sealing body 2602 may at least partially define an opening having a shape that approximates the shape of a profile of a user's ear or, in another example, having a roughly elliptical shape. In some embodiments, the sealing body 2602 and the hooking body 1322 may be configured collectively to define the opening.

The sealing body 2602 may be coupled to the attachment body 1302 (e.g., along the coupling edge 1305 of the attachment body 1302—not shown) so that the sealing body 2602 at least partially defines or forms a chamber 2610. In some embodiments, the sealing body 2602 and at least part of the hooking body 1322 may define or form the chamber 2610. The hooking body 1322 and the bridging member 1312 may be included, at least partially, within the chamber 2610. In some embodiments, when a user's ear is secured to the hooking body 1322 (e.g., as described with reference to FIG. 13A-13E), at least a portion of the user's ear may have passed through the opening into the chamber 2610, and at least a posterior portion of the user's ear may be positioned within the space 1340 in the chamber 2610 between the hooking body 1322 and the attachment body 1302 or, optionally, the earpad 1412 (e.g., as illustrated in the examples depicted in FIGS. 16A-16B).

In some embodiments, the sealing body 2602 may be configured to encapsulate, at least substantially, the user's ear within the chamber 2610 while the attachment apparatus 2600 is secured to the user's ear via the hooking body 1322. The sealing body 2602 may be further configured to engage an area of the user's anatomy around the user's ear to form at least a partial acoustic seal against the user's anatomy. Accordingly, while the attachment apparatus 2600 is secured to the user's ear via the hooking body 1322, the sealing body 2602 may at least substantially encapsulate the user's ear in the chamber 2610 and/or form at least a partial acoustic seal around the user's ear, thereby reducing or blocking ambient sounds from reaching the user's ear canal.

The sealing body 2602 may include a first sealing portion 2604 and a second sealing portion 2606. When the attachment apparatus 2600 is secured to the user via the hooking body 1322, the first sealing portion 2604 may be proximate to a front side of the user's body (e.g., closer to the face of the user), whereas the second sealing portion 2606 may be proximate to a back side of the user's body (e.g., closer to the back of the user's head). In some embodiments, at least a portion of the first sealing portion 2604 and at least a portion of the second sealing portion 2606 may engage and be biased by a user's anatomy while the attachment apparatus 2600 is secured to or is being secured to the user's ear. For example, as the user inserts the user's ear into the portion of the chamber 2610 between the hooking body 1322 and the attachment body 1302 (or optionally the earpad 1412), at least some part of the first sealing portion 2604 and the second sealing portion 2606 (e.g., portions proximate to the opening and distal to the attachment body) may physically engage and be biased in a direction towards the attachment body 1302 (and away from the median plane of the user's body) by the user's ear and/or by anatomical features surrounding the user's ear. Accordingly, while the attachment apparatus 2600 is secured to the user's ear, at least some part of the first sealing portion 2604 and the second sealing portion 2606 may transition from an uncompressed, non-deformed configuration to a compressed, deformed configuration in which at least some part of the first sealing portion 2604 and the second sealing portion 2606 form at least a partial acoustic seal against the user's anatomy. For example, the first and/or second attachment portions 2604, 2606 may physically engage and form at least a partial acoustic seal against a portion of the user's head surrounding the user's ear. When the attachment apparatus 2600 is removed or decoupled from the user's ear, the first and second sealing portions 2604, 2606 may transition from the compressed, deformed configuration back to the uncompressed, non-deformed configuration. By way of a non-limiting example, as the user's ear is removed from the attachment apparatus 2600, the first and second sealing portions 2604, 2606 may elastically return to the uncompressed, non-deformed configuration illustrated in FIGS. 26A-26B by biasing in a direction away from the attachment body 1302.

In some embodiments, a portion 2608 of the sealing body 2602 may be directly coupled to the hooking body 1322. In the examples illustrated in FIGS. 26A-26B, the portion 2608 of the sealing body 2602 may be coupled to at least a surface of the hooking body 1322 that is distal from the plate member 1306. In some embodiments, the portion 2608 of the sealing body 2602 may be coupled to the hooking body 1322 so that the portion 2608 wraps around all or substantially all of the hooking body 1322 (e.g., as shown by the dotted lines illustrated in FIG. 26B). The portion 2608 of the sealing body 2602 may be coupled to the hooking body 1322 so that the portion 2608 wraps around the hooking body 1322 in a clockwise fashion (e.g., as illustrated in FIGS. 26A-26B) or, alternatively, in a counterclockwise fashion (not shown). In a similar manner, a portion of a sealing body of a mirror-image of the attachment apparatus 2600 may be coupled to a hooking body of the mirror-image attachment apparatus so that that the hooking body wraps around the hooking body in a counterclockwise or clockwise fashion.

In some embodiments, the sealing body 2602 or the hooking body 1322 may receive a force (e.g., a pushing force from a user's finger) that causes the portion 2608 of the sealing body 2602 to move/bias in the direction of the applied force. Because the portion 2608 of the sealing body 2602 is coupled to the hooking body 1322, the portion 2608 and the hooking body 1322 may move in the same direction of the applied force (if the applied force is sufficient to deform the deformable core 1324). When the applied force is removed, the hooking body 1322 may not revert to its initial position because the deformable core is not elastic (e.g., as described above) and may remain in the biased position instead. Further, while the sealing body 2602 is at least partially elastic, the portion 2608 of the sealing body 2602 may also remain in the biased position and may not revert to its initial position (e.g., before the force was applied) because the portion 2608 of the sealing body 2602 is coupled to the hooking body 1322. Specifically, the portion 2608 of the sealing body 2602 may be configured so that the elasticity of at least the portion 2608 of the sealing body 2602 does not generate a force that is sufficient to move the hooking body 1322 into a substantially different position once the external applied force is removed. In some embodiments, at least the portion 2608 of the sealing body 2602 may not be elastic and thus may not exert any (or an appreciable) force on the hooking body 1322. In some embodiments, because the portion 2608 of the sealing body 2602 moves and/or deforms in conjunction with the hooking body 1322, the sealing body 2602 may be configured to enable a user to manipulate or otherwise adjust the hooking body 1322 via interacting directly with the portion 2608 of the sealing body 2602 and without degrading or losing the at least partial acoustic seal formed by the sealing body 2602 against the user's anatomy.

Figure 27B:
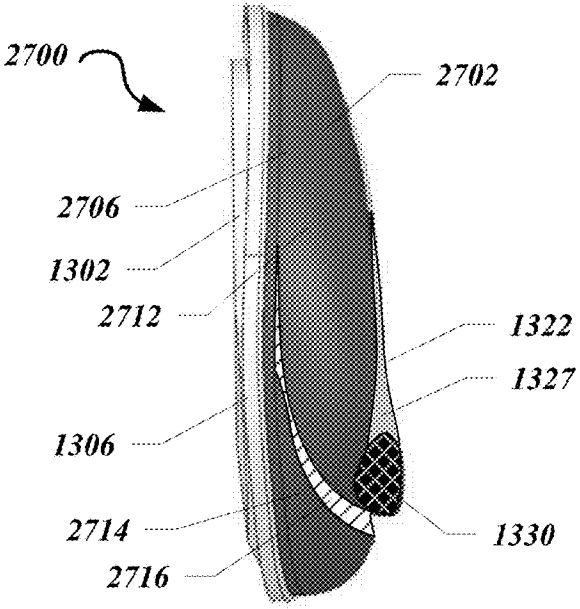
FIGS. 27A-27C are exterior views of an alternative attachment apparatus, according to some embodiments.
Figure 27C:
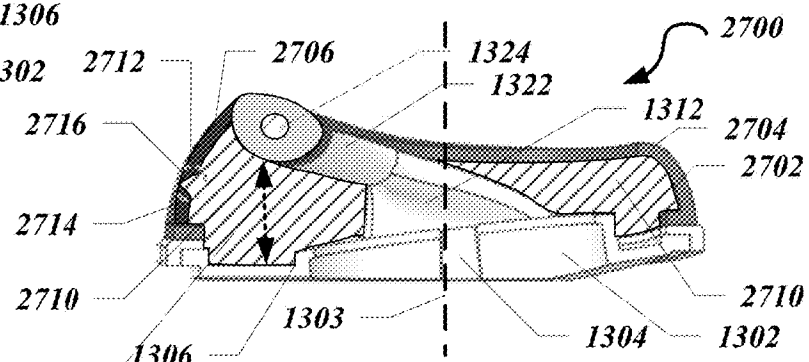
Figure 27A:
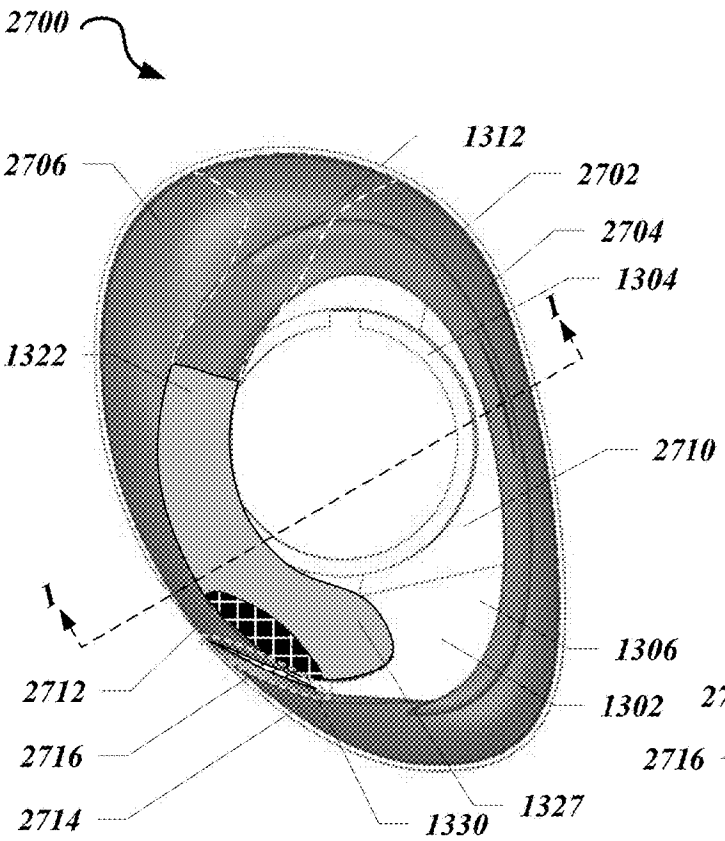

FIG. 27A illustrates an exterior view of a back side of an alternative attachment apparatus 2700, according to some embodiments. FIG. 27B illustrates an exterior view of a posterior side of an alternative attachment apparatus 2700, according to some embodiments. FIG. 27C illustrates a cross-sectional view of the attachment apparatus 2700 taken along referential line I depicted in FIG. 27A. In some embodiments, the attachment apparatus 2700 may include, but is not limited to including: the attachment body 1302, which may include the plate member 1306, the bridging member 1312, and the optional mid-ear portion 1304; the optional earpad 1412 that may include a protruding portion 1414; and the hooking body 1322 that may include the deformable core 1324 and optional cutout 1330. Some of the structural features of the attachment apparatus 2700 may be analogous to structural features described above, for example, with reference to the attachment apparatuses 1300, 1400, 1500, 1600, 1700, 1800, 1900, 2000, 2100, 2200, 2300, 2400, 2500, 2600 described with reference to FIGS. 13A-26B. For clarity and simplicity of description, duplicative descriptions of such structural features of the attachment apparatus 2700 may not be repeated in the following descriptions.

With reference to FIGS. 27A-27C, the attachment apparatus 2700 may include a sealing body 2702. In some embodiments, the sealing body 2702 may be made from or may include, at least partially, one or more pliable or elastomeric materials, such as plastic, foam, rubber, silicone, or the like or combinations of any of the foregoing. The sealing body 2702 may define or form an opening configured to be suitable for enabling a user's ear to pass through the opening (e.g., as described with reference to the sealing body 1402 illustrated in FIG. 14). For example, the sealing body 2702 may define an opening having a shape that approximates the shape of a profile of a user's ear or, in another example, having a roughly elliptical shape.

The sealing body 2702 may be coupled to the attachment body 1302 (e.g., along the coupling edge 1305 of the attachment body 1302—not shown) so that the sealing body 2702 at least partially defines or forms a chamber 2710. The hooking body 1322 and the bridging member 1312 may be encapsulated, at least substantially, within the chamber 2710. In some embodiments, when a user's ear is secured to the hooking body 1322 (e.g., as described with reference to FIG. 13A-13E), at least a portion of the user's ear may have passed through the opening into the chamber 2710, and at least a posterior portion of the user's ear may be positioned within the space 1340 in the chamber 2710 between the hooking body 1322 and the attachment body 1302 or, optionally, the earpad 1412 (e.g., as illustrated in the examples depicted in FIGS. 16A-16B).

In some embodiments, the sealing body 2702 may be configured to encapsulate, at least substantially, the user's ear within the chamber 2710 while the attachment apparatus 2700 is secured to the user's ear via the hooking body 1322. The sealing body 2702 may be further configured to engage an area of the user's anatomy around the user's ear to form at least a partial acoustic seal against the user's anatomy. Accordingly, while the attachment apparatus 2700 is secured to the user's ear via the hooking body 1322, the sealing body 2702 may at least substantially encapsulate the user's ear in the chamber 2710 and/or form at least a partial acoustic seal around the user's ear, thereby reducing or blocking ambient sounds from reaching the user's ear canal.

In some embodiments, the sealing body 2702 may be configured similarly to one or more other sealing bodies described herein (e.g., with reference to the sealing body 1802 described with reference to FIGS. 18A-18B). For example, the sealing body 2702 may be configured to have a curved cross section so that portions of the sealing body 2702 proximate to the opening engage an area around a user's ear when the user's ear is inserted through the opening. In another example, the sealing body 2702 may include an anterior sealing portion 2704 and a posterior sealing portion 2706 that are collectively configured to engage and be biased by a user's anatomy while the attachment apparatus 2700 is secured to or is being secured to the user's ear in order to form at least a partial acoustic seal against the user's anatomy. In yet another example (e.g., as illustrated in FIG. 27B), while the sealing body 2702 is coupled—directly or indirectly—to the attachment body 1302, the anterior sealing portion 2704 of the sealing body 2702 may extend or protrude from the attachment body 1302 to a lesser extent to the extent to which the posterior sealing portion 2706 extends or protrudes from the attachment body 1302 in order to cause the attachment apparatus 2700 to be rotated or angled on the user's head towards the user's face due to the difference in the extents to which the anterior sealing portion 2704 and the posterior sealing portion 2706 protrude from the attachment body 1302.

When the attachment apparatus 2700 is secured to the user's ear, the second end 1327 of the hooking body 1322 may be moved/adjusted towards or away from the posterior portion of the user's ear in order to achieve a more or less secure fit to the individual physical features of the user's ear. However, as described, the sealing body 2702 may at least partially encapsulate the user's ear while the user's ear is secured to the hooking body 1322. In order to facilitate the user's ability to adjust or deform the hooking body 1322 to achieve a desired fit, the posterior sealing portion 2706 may be configured to include a first portion 2712 and a second portion 2714. In some embodiments, the posterior sealing portion 2706 may be configured to include at least a partial gap 2716 between the first portion 2712 and the second portion 2714, and the gap 2716 may at least partially separate the first portion 2712 from the second portion 2714. In such embodiments, the gap 2716 between the first portion 2712 and the second portion 2714 may enable the first portion 2712 and the second portion 2714 to be deformed or moved independently of each other (at least substantially). For example, a force may be applied to the first portion 2712 that may move or deform the first portion 2712 without moving or deforming (or without substantially moving or deforming) the second portion 2714. Similarly, another force may be applied to the second portion 2714 without moving or deforming (or without substantially moving or deforming) the first portion 2712.

At least one of the first portion 2712 or the second portion 2714 may be configured to improve or to facilitate the user's access to the hooking body 1322. Particularly, in some embodiments, the posterior portion 2706 may be configured such that the gap 2716 is formed proximate to the hooking body 1322 (e.g., as illustrated in FIG. 27A). Accordingly, in such embodiments, the first portion 2712 may be positioned and/or oriented on or in the posterior sealing portion 2706 to be in proximity to the second end 1327 of the hooking body 1322. In some embodiments, the first portion 2712 may be configured to receive a force from a user that is directed toward the second end 1327 of the hooking body 1322. In response to receiving the force, the first portion 2712 may bias toward the second end 1327 of the hooking body 1322 until the first portion 2712 physically engages the second end 1327, at which point the force that is applied to the first portion 2712 may be transferred through the first portion 2712 to the second end 1327 of the hooking body 1322, thereby causing both the first portion 2712 and the second end 1327 of the hooking body 1322 to deform/move in the direction of the force.

In some embodiments, the first portion 2712 may be made from or include one or more known elastic materials. In some embodiments, an elasticity of the first portion 2712 may be relatively higher than an elasticity of the remainder of the posterior sealing portion 2706 (and/or the remainder of the sealing body 2702 as a whole). In such embodiments, the first portion 2712 may be configured to be particularly suitable for receiving a deforming force that enables a user to apply a force to the hooking body 1322 via the first portion 2712 (e.g., as described above). In such embodiments, applying a force to the first portion 2712 may deform the first portion 2712 without any or substantial deformation of other portions of the sealing body 2702, such as the second portion 2714. When the attachment apparatus 2700 is secured to the user's ear, the second portion 2714 may form at least a partial acoustic seal against the user's anatomy. Thus, because the first portion 2712 may be moved/deformed at least substantially independently of the second portion 2714, and the second portion 2714 may maintain at least a partial acoustic seal against the user's anatomy while the first portion 2712 is deformed or moved, thereby improving the overall audio experience of the user while the user is adjusting the attachment apparatus 2700.

In some embodiments, the first portion 2712 of the posterior portion 2706 may be directly (or indirectly) coupled to the hooking body 1322. In the examples illustrated in FIGS. 27A-27C, the first portion 2712 of the posterior portion 2706 may be coupled to at least a surface of the hooking body 1322 that is distal from the plate member 1306. In some embodiments (not shown), the first portion 2712 of the posterior portion 2706 may be coupled to the hooking body 1322 so that the first portion 2712 wraps around all or substantially all of the hooking body 1322. The first portion 2712 of the posterior portion 2706 may be coupled to the hooking body 1322 so that the first portion 2712 wraps around the hooking body 1322 in a clockwise fashion (e.g., as illustrated in FIGS. 27A-26B) or, alternatively, in a counterclockwise fashion (not shown). In a similar manner, a portion of a sealing body of a mirror-image of the attachment apparatus 2700 may be coupled to a hooking body of the mirror-image attachment apparatus so that that the hooking body wraps around the hooking body in a counterclockwise or clockwise fashion.

In some embodiments, the first portion 2712 of the posterior portion 2706 may be configured to receive a force (e.g., a pushing force from a user's finger) that causes the first portion 2712 of the posterior portion 2706 to move in the direction of the applied force. Because the first portion 2712 of the posterior portion 2706 is coupled to the hooking body 1322, the first portion 2712 may transfer the applied force to the hooking body 1322, thereby causing the hooking body 1322 to also move in the direction of the applied force (if the applied force is sufficient to deform the deformable core). When the applied force is removed, the hooking body 1322 may not revert to its initial position because the deformable core is not elastic (e.g., as described above) and may remain in the deformed position instead. Further, the first portion 2712 of the posterior portion 2706 may also remain in the deformed position and may not revert back to its initial position (e.g., before the force was applied) because the first portion 2712 of the posterior portion 2706 is coupled to the hooking body 1322. Specifically, the first portion 2712 of the posterior portion 2706 may be configured so that the elasticity of at least the first portion 2712 of the posterior portion 2706 does not generate a force that is sufficient to move the hooking body 1322 into a substantially different position once the external applied force is removed. In some embodiments, at least the first portion 2712 of the sealing body 2702 may not be elastic and thus may not exert any (or an appreciable) force on the hooking body 1322. In some embodiments, because the first portion 2712 of the sealing body 2702 moves and/or deforms in conjunction with the hooking body 1322, the sealing body 2702 may be configured to enable a user to manipulate or otherwise adjust the hooking body 1322 via interacting directly with the first portion 2712 of the sealing body 2702 and without degrading or losing the at least partial acoustic seal formed by the sealing body 2702 against the user's anatomy.

Figure 28A:
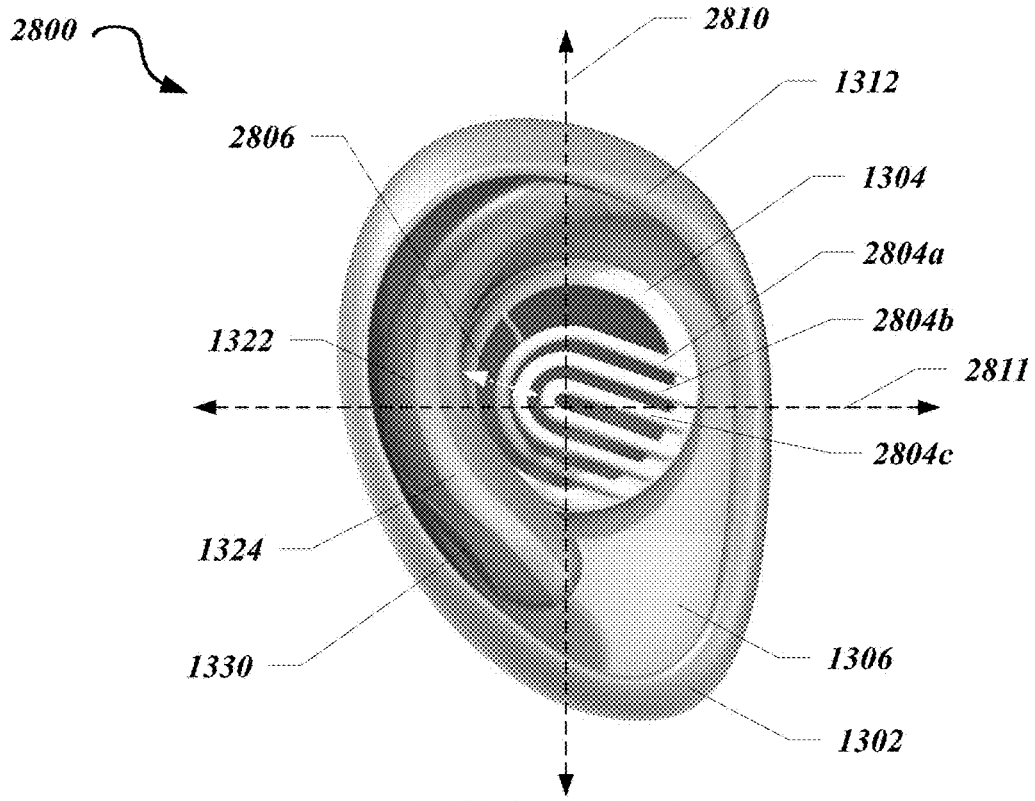
FIGS. 28A-28D are exterior views of an alternative attachment apparatus, according to some embodiments.
Figure 28B:
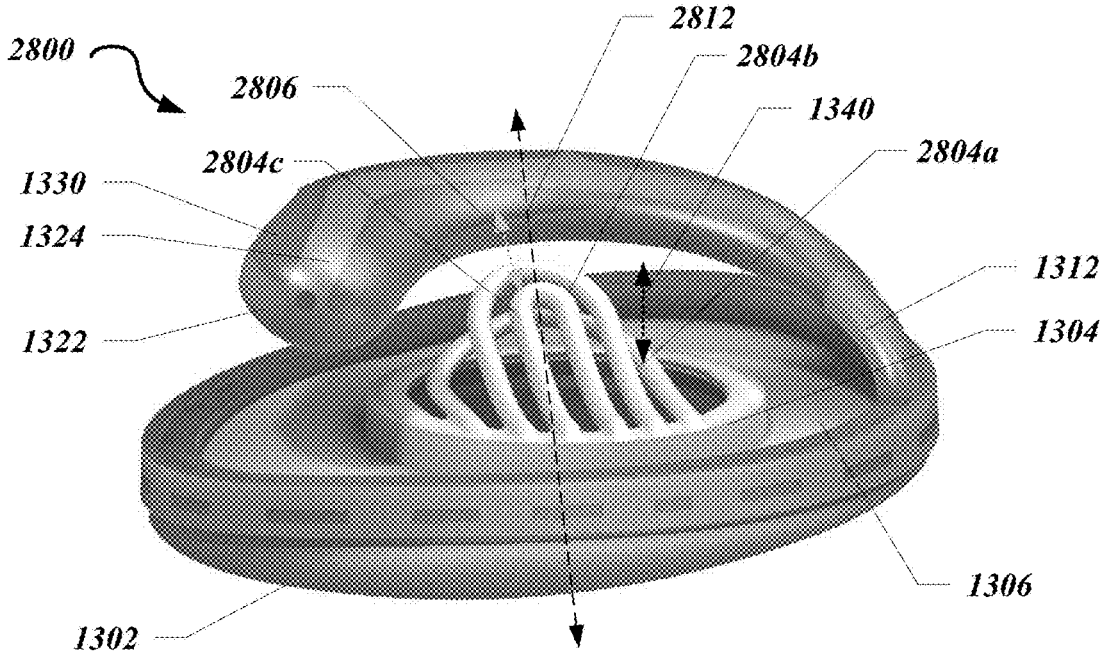
Figure 28C:
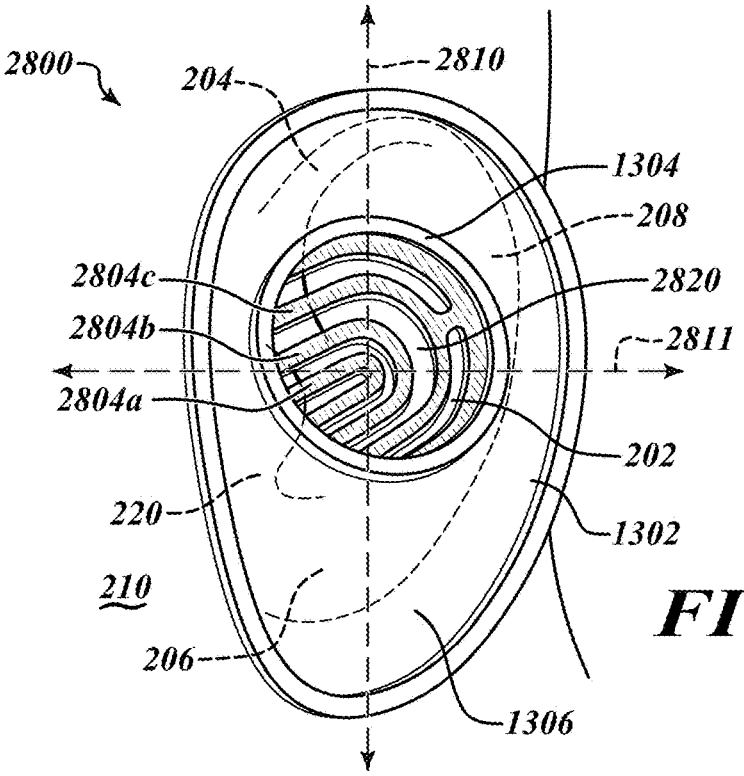
Figure 28D:
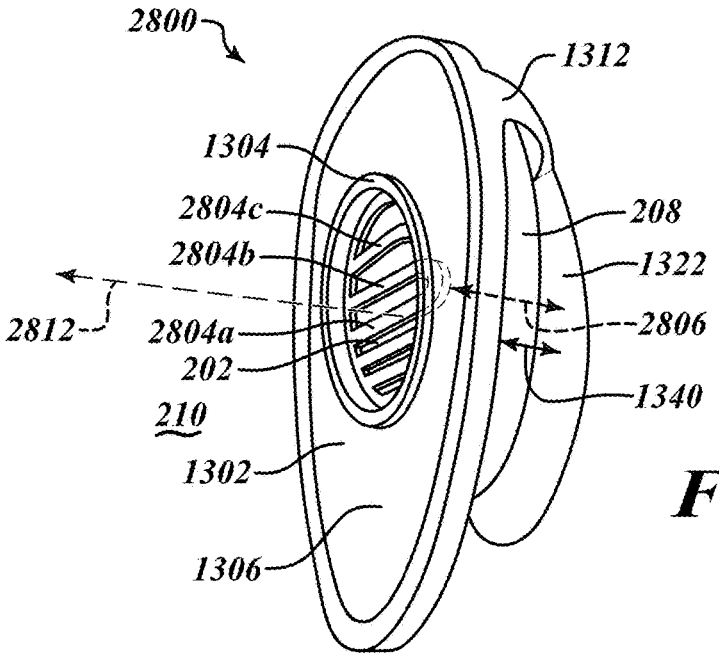

FIGS. 28A-28D illustrate different views of an alternative attachment apparatus 2800, according to some embodiments. FIG. 28A illustrates an exterior view of a back side of the attachment apparatus 2800. FIG. 28B illustrates a perspective, profile view of a bottom left side of the attachment apparatus 2800. FIG. 28C illustrates an external, front-side view of the attachment apparatus 2800 while the attachment apparatus 2800 is secured to the ear 202 of a user. FIG. 28D illustrates an external, perspective view of a right side of the attachment apparatus 2800 while the attachment apparatus 2800 is secured to the ear 202 of a user. In some embodiments, the attachment apparatus 2800 may include, but is not limited to including: the attachment body 1302, which may include the plate member 1306, the bridging member 1312, and the mid-ear portion 1304; and the hooking body 1322 that may include the deformable core 1324 and optional cutout 1330. Some of the structural features of the attachment apparatus 2800 may be analogous to structural features described above, for example, with reference to the attachment apparatuses 1300, 1400, 1500, 1600, 1700, 1800, 1900, 2000, 2100, 2200, 2300, 2400, 2500, 2600, 2700 described with reference to FIGS. 13A-27C. For clarity and simplicity of description, duplicative descriptions of such structural features of the attachment apparatus 2800 may not be repeated in the following descriptions.

In some embodiments, the mid-ear portion 1304 may be coupled to or otherwise include one or more engaging portions, such as engaging portions 2804*a*-2804*c*. The engaging portions 2804*a*-2804*c* may be made from or may include, at least partially, one or more pliable or elastomeric materials, such as plastic, foam, rubber, silicone, or the like or combinations of any of the foregoing. In some alternative embodiments, the engaging portions 2804*a*-2804*c* may be made from or may include non-elastic or minimally elastic materials, such as hard plastics, metal, or the like.

In some embodiments, at least some part of the engaging portions 2804*a*-2804*c* may protrude from the plate member 1306. For example, the engaging portions 2804*a*-2804*c* may protrude away from the plate member 1306 in a direction (e.g., as illustrated by a referential line 2812 in FIG. 28B) that intersects with (or is perpendicular to) a directional plane of the plate member 1306 of the attachment body 1302 (e.g., as depicted by referential lines 2810, 2811 in FIG. 28A). In some embodiments, one or more of the engaging portions 2804*a*-2804*c* may protrude from the plate member 1306 in different directions and/or to different extents. In the non-limiting examples illustrated in FIGS. 28A-28B, the engaging portion 2804*a* may protrude from the plate member 1306 in the direction represented by the referential line 2812 to a lesser extent than the extent to which the engaging portion 2804*b* protrudes from the plate member 1304 in that direction. Continuing with this example, the engaging portion 2804*c* may protrude from the plate member 1306 in the direction represented by the referential line 2812 to a further extent than the extent to which the engaging portion 2804*a* protrudes from the plate member 1306 in the same direction, but to a lesser extent than the extent to which the engaging portion 2804*b* protrudes from the plate member 1306. The differences in the extent to which the engaging portions 2804*a*-2804*c* extend from the plate member 1306 may cause the overall shape formed by the engaging portions 2804*a*-2804*c* to correspond, at least generally, with a shape of an interior portion of a human auricle (e.g., as illustrated in FIGS. 28C-28D).

In some embodiments, each of the engaging portions 2804*a*-2804*c* may include at least one end that is coupled to or formed as part of the mid-ear portion 1304. For example, as illustrated in FIGS. 28A-28B, the engaging portions 2804*a*-2804*c* may be substantially tubular and may form loops or loop-like structures extending from the mid-ear portion 1304. In this example, the engaging portions 2804*a*-2804*c* may have two ends coupled to (or protruding from) the mid-ear portion 1304. In some embodiments, the engaging portions 2804*a*-2804*c* may be configured such that internal spaces exist between the engaging portions 2804*a*-2804*c* (or that each of the engaging portions 2804*a*-2804*c* define an opening). In some embodiments in which a speaker system is coupled to the mid-ear portion 1304 (e.g., as described with reference to FIGS. 13A-13E), the spaces between the engaging portions 2804*a*-2804*c* may enable sound generated from the speaker system to pass through the engaging portions 2804*a*-2804*c*, at least substantially, without substantially dampening, distorting, or otherwise negatively impacting the sound. Further, because the engaging portions 2804*a*-2804*c* protrude from a back side of the mid-ear portion 1304 that faces the median plane of the user when the attachment apparatus 2800 is secured to the user's ear, the engaging portions 2804*a*-2804*c* may engage the interior portion 2820 of the user's ear 202 while creating space/distance between the user's ear canal and a speaker system mounted to a front side of the mid-ear portion 1304 that does not face the median plane of the user. As a result, the engaging portions 2804*a*-2804*c* may secure the attachment apparatus 2800 to the ear 202 and may also improve the user's listening experiencing by ensuring that the speaker system is not too close to the user's ear canal (e.g., is not positioned within the interior portion 2820 of the ear 202), thereby reducing the likelihood of damaging the user's ear.

Some embodiments described above may refer to one or more of the engaging portions 2804*a*-2804*c* being coupled to the mid-ear portion 1304. According to such embodiments, the engaging portions 2804*a*-2804*c* may be separate structural components that are coupled to the mid-ear portion 1304 via one or more coupling methods, including without limitation, adhesives, fasteners, welding, or one or more other known techniques. However, according to some alternative (or additional) embodiments, the engaging portions 2804*a*-2804*c* may be formed as part of the mid-ear portion 1304. For example, the mid-ear portion 1304 and the engaging portions 2804*a*-2804*c* may be formed from a single cast, mold, or the like.

With reference to FIGS. 28C-28D, the attachment apparatus 2800 may be secured to the ear 202 such that linear and rotational movement of the attachment apparatus 2800 in relation to the ear 202 (e.g., with respect to the first, second, and third axes of movement represented by the referential lines 2810, 2811, 2812) is limited or prevented by the hooking body 1322 and/or the engaging portions 2804*a*-2804*c*. As further described herein, the hooking body 1322 may secure the attachment apparatus 2800 to the root of the posterior portion 208 of the ear 202; the engaging portions 2804*a*-2804*c* may secure the attachment apparatus 2800 to an interior portion 2820 of the ear 202 outside of the ear canal; and the engaging portions 2804*a*-2804*c* and the hooking body 1322 may collectively secure the attachment apparatus 2800 to the interior portion 2820 of the ear 202 via compressive force(s) and corresponding frictional resistance forces.

In some embodiments, the engaging portions 2804*a*-2804*c* may be configured to extend into or to engage with, at least substantially, the interior portion 2820 of the user's ear 202. The interior portion 2820 of the ear may include, without limitation, at least part of one or more of the concha, anti-helix, anti-tragus, tragus, or one or other anatomical features of the user's outer ear proximate to and outside of the user's ear canal. By way of a non-limiting example, at least one of the engaging portions 2804*a*-2804*c* may extend into and/or engage the concha of the ear 202, and at least one other engaging portions 2804*a*-2804*c* may engage the anti-helix of the ear 202. As a result of engaging the interior portion 2820 of the ear 202, the engaging portions 2804*a*-2804*c* may prevent or limit the ability of the attachment apparatus 2800 to move in relation to the ear 202. For example, the engaging portions 2804*a*-2804*c* may prevent or limit rotational movement of the attachment apparatus 2800 around the ear 202 (e.g., clockwise or counterclockwise movement about an axis represented by the referential line 2812) by physically engaging anatomical structures of the interior portion 2820 of the ear 202. In another example, the engaging portions 2804*a*-2804*c* may similarly (or alternatively) be configured to prevent or limit movement of the attachment apparatus 2800 in relation to the ear 202 in directions represented by the referential lines 2810, 2811 by engaging physical structures of the interior portion 2820 of the ear 202 when the attachment apparatus 2800 is moved in such directions. Thus, while inserted into or engaging the interior portion 2820 of the ear 202, the engaging portions 2804*a*-2804*c* may secure or further secure the attachment apparatus 2800 to the ear 202 by limiting or preventing rotational and/or linear movement of the attachment apparatus 2800.

While the hooking body 1322 is secured to the root of the ear 202, the hooking body 1322 may be configured to prevent (or limit) movement of the attachment apparatus 2800 in at least one direction represented by the referential line 2812, which may be at least substantially perpendicular to the plane of movement depicted by referential lines 2810, 2811. For example, the hooking body 1322 may prevent a user from accidentally pulling the attachment apparatus 2800 off the user's ear 202 in the direction represented by the referential line 2812. The hooking body 1322 may also limit or prevent movement of the attachment apparatus 2800 in relation to the ear 202 in at least one other direction represented by the referential lines 2810, 2811. For example, the hooking body 1322 may physically engage the root of the posterior portion 208 of the ear 208 when the attachment apparatus 2800 is urged to move towards the user's face 210, thereby preventing or limiting movement of the attachment apparatus 2800 in that direction.

In some additional (or alternative) embodiments, the engaging portions 2804*a*-2804*c* and the hooking body 1322 may collectively be configured to limit or prevent movement of the attachment apparatus 2800 about the user's ear 202. In such embodiments, the attachment apparatus 2800 may be configured so that a space 2806 (e.g., as illustrated in FIGS. 28B and 28D) is formed between the hooking body 1322 and the engaging portions 2804*a*-2804*c*. The space 2806 may accommodate the interior portion 2820 of the user's ear 202. The interior portion 2820 of the user's ear 202 may be engaged by (e.g., wedged between) both the hooking body 1322 and the engaging portions 2804*a*-2804*c* when the attachment apparatus 2800 is secured to the ear 202. As described (e.g., with reference to FIGS. 13A-13E), the hooking body 1322 may not be resilient (or only marginally resilient). Accordingly, in some embodiments, the hooking body 1322 may be urged toward the engaging portions 2804*a*-2804*c*, thereby causing the space 2806 between the hooking body 1322 and the engaging portions 2804*a*-2804*c* to reduce in at least one dimension. As the at least one dimension of the space 2806 decreases, the hooking body 1322 and/or the engaging portions 2804*a*-2804*c* may apply increasingly amounts of compressive force to the interior portion 2820 of the user's ear 202, and this compressive force may secure (or further secure) the user's ear to the attachment apparatus 2800. This compression may be maintained until the hooking body 1322 is non-elastically moved to a different position (such as by a user when he or she desired to remove the attachment apparatus 2800), thereby ensuring that the attachment apparatus 2800 is securely attached to the user's ear 202.

In some embodiments in which the engaging portions 2804*a*-2804*c* are made from or include elastic material or materials, the engaging portions 2804*a*-2804*c* may be configured to enable a user to attach the attachment apparatus 2800 to the user's ear 202 easily. Specifically, in such embodiments, the engaging portions 2804*a*-2804*c* may be configured to deform or otherwise move from a resting configuration (e.g., as illustrated in FIGS. 28A-28B) by a portion of the user's ear 202 (e.g., the anterior portion 204 of the ear 202 (not shown)) while the attachment apparatus 2800 is being attached to a user's ear 202. The engaging portions 2804*a*-2804*c* may elastically transition from a resting configuration to a deformed configuration to accommodate the user's ear 202 while the ear 202 is partially inserted into the space 2806. In a non-limiting example, the user's tragus may press against the engaging portions 2804*a*-2804*c* (at least temporarily) while the user's ear 202 is partially inserted into the space 2806, thereby causing the engaging portions 2804*a*-2804*c* to be biased away from the user's ear 202 and move in a direction towards the plate member 1306. Once the user's ear 202 is inserted fully into the space 2806 (e.g., when a surface of the root of the posterior portion 208 of the ear 202 contacts the hooking body 1322), the portion of the user's ear 202 that was biasing the engaging portions 2804*a*-2804*c* may be removed from and may no longer engage the engaging portions 2804*a*-2804*c* (or may engage the engaging portions 2804*a*-2804*c* to a lesser extent). As a result, the engaging portions 2804*a*-2804*c* may elastically transition from the deformed configuration to the initial or resting configuration in which the engaging portions 2804*a*-2804*c* are positioned within or engaged with (at least substantially) the interior portion 2820 the user's ear 202 and may secure or further secure the attachment apparatus 2800 to the ear 202 (e.g., as described above). By way of a non-limiting example, once the user's ear 202 is fully inserted into the space 2806, one or more of the engaging portions 2804*a*-2804*c* may spring into the interior portion 2820 of the user's ear 202, thereby locking the posterior portion 208 of the user's ear 202 in the space 2806 between the hooking body 1322 and the one or more engaging portions 2804*a*-2804*c*.

In some alternative (or additional embodiments), while the attachment apparatus 2800 is secured to the user's ear 202, the engaging portions 2804*a*-2804*c* may continue to engage (at least partially) the interior portion 2820 of the user's ear 202 and/or another part of the ear 202 (e.g., the anterior portion 204 of the ear 202). As a result, the engaging portions 2804*a*-2804*c* may remain in a deformed or slightly deformed configuration. In embodiments in which the engaging portions 2804*a*-2804*c* are made from at least partially elastic materials, the engaging portions 2804*a*-2804*c* may remain in an elastically deformed state while in the deformed or slightly deformed configuration and may therefore continuously exert a force against the interior portion 2820 of the user's ear 202 so long as the engaging portions 2804*a*-2804*c* remain in the deformed or slightly deformed configuration. Such force may urge the attachment apparatus 2800 away from the user's ear 202 (e.g., in the direction represented by the referential line 2812). As described, the user's ear 202 may be secured in a space 1340 between the hooking body 1322 and the plate member 1306 (and/or the space 2806 between the hooking body 1322 and the engaging portions 2804*a*-2804*c*) while the engaging portions 2804*a*-2804*c* engage the interior portion 2820 of the ear 202. Thus, while the attachment apparatus 2800 is engaging the interior portion 2820 of the ear 202, the force generated by the engaging portions 2804*a*-2804*c* that urges the attachment apparatus 2800 away from the user's ear 202 may cause the hooking body 1322 to engage the posterior portion 208 of the user's ear 202 tightly, thereby improving the overall ability of the hooking body 1322 to secure the attachment apparatus 2800 to the user's ear.

In some embodiments, the engaging portions 2804*a*-2804*c* may protrude from the mid-ear portion 1304 so that parts of the engaging portions 2804*a*-2804*c* not coupled to (or formed as part of) the mid-ear portion 1304 engage with a part of the interior portion 2820 of the ear 202 in proximity to the posterior portion 208 of the ear 202. By way of non-limiting examples illustrated in FIGS. 28C-28D, the engaging portions 2804*a*-2804*c* may protrude from the mid-ear portion 1304 at an angle that causes the engaging portions 2804*a*-2804*c* to engage some of the concha and/or some of the anti-helix proximal to the posterior portion 208 of the ear 202 and, in some embodiments, not to engage some of the interior portion 2820 of the ear 202 not in proximity to the posterior portion 208 of the ear 202. While the hooking body 1322 is secured to the posterior portion 208 of the ear 202, the engaging portions 2804*a*-2804*c* may be deformed as a result of physically engaging the concha and/or the anti-helix proximal to the posterior portion 208 of the ear 202. Because the engaging portions 2804*a*-2804*c* are at least partially elastic, the engaging portions 2804*a*-2804*c* may exert a force against the interior portion 2820 of the ear 202, and the corresponding counterforce received on engaging portions 2804*a*-2804*c* from the ear 202 may urge the engaging portions 2804*a*-2804*c* in a direction away from the ear 202 (e.g., in a direction represented by referential line 2812). This movement of the engaging portions 2804*a*-2804*c* may cause the attachment apparatus 2800 to pivot about the bridging member 1312 (which may be secured to the root of the upper portion 204 of the ear 202 as described with reference to FIGS. 13A-13E), thereby urging an anterior portion of the attachment apparatus 2800 closest to the face 210 of the user into the face 210 of the user. In some embodiments in which the attachment apparatus 2800 further includes a sealing body (not shown), the urging of the anterior portion of the attachment apparatus 2800 into the face 210 of the user may enable or improve the ability of the sealing body to form at least a partial acoustic seal against the user's face 210.

In some embodiments described above, the engaging portions 2804*a*-2804*c* are described as directly engaging the user's ear. In some alternative (or additional) embodiments, a compliant, comfortable material (e.g., fabric or silicone) may be formed over the engaging portions 2804*a*-2804*c* to improve comfort. For example, in some embodiments, an earpad may be coupled to or formed over the mid-ear portion 1304 and/or the engaging portions 2804*a*-2804*c*. In such embodiments, the engaging portions 2804*a*-2804*c* may cause at least a portion of the earpad to engage the user's ear while the attachment apparatus 2800 is secured to the user's ear in a way that similar to the way in which the engaging portions 2804*a*-2804*c* are described above as engaging the user's ear 202.

Figure 28E:
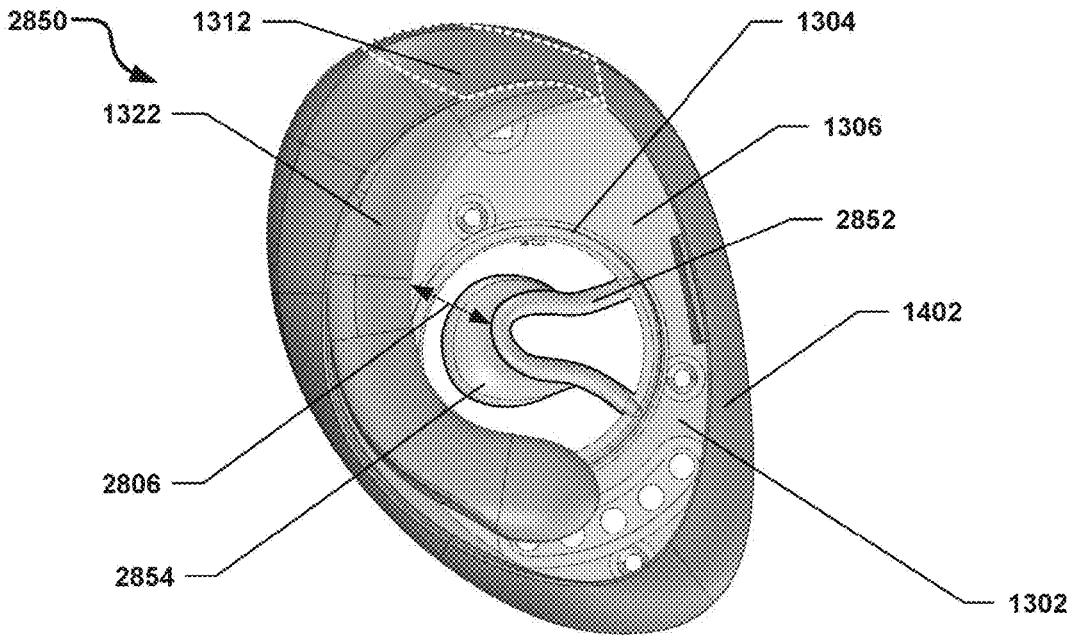
FIGS. 28E-28F are exterior views of an alternative attachment apparatus, according to some embodiments.
Figure 28F:
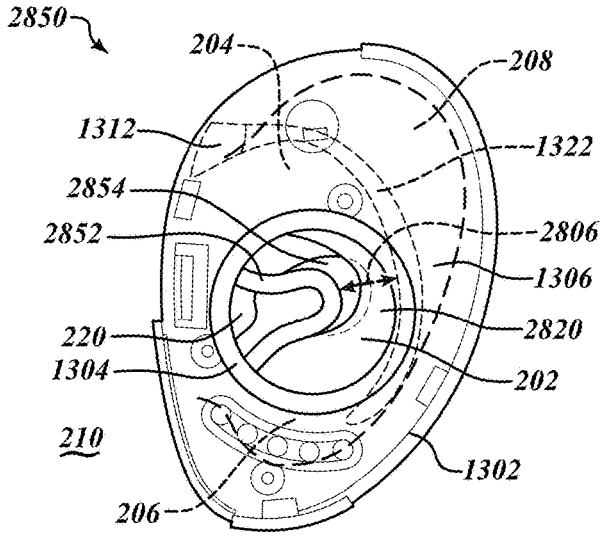

FIGS. 28E-28F illustrate different views of an alternative attachment apparatus 2850, according to some embodiments. FIG. 28E illustrates an exterior view of a back side of the attachment apparatus 2850. FIG. 28F illustrates an external, front-side view of the attachment apparatus 2850 while the attachment apparatus 2850 is secured to the ear 202 of a user. In some embodiments, the attachment apparatus 2850 may include, but is not limited to including: the attachment body 1302, which may include the plate member 1306, the bridging member 1312, and the mid-ear portion 1304; the sealing body 1402; and the hooking body 1322 that may include the deformable core 1324 and optional cutout 1330. Some of the structural features of the attachment apparatus 2850 may be analogous to structural features described above, for example, with reference to the attachment apparatuses 1300, 1400, 1500, 1600, 1700, 1800, 1900, 2000, 2100, 2200, 2300, 2400, 2500, 2600, 2700, 2800 described with reference to FIGS. 13A-28D. For clarity and simplicity of description, duplicative descriptions of such structural features of the attachment apparatus 2850 may not be repeated in the following descriptions.

With reference to the examples illustrated in FIGS. 28E-28F, the mid-ear portion 1304 may include an engaging portion 2852. The engaging portion 2852 may be made from or may include, at least partially, one or more pliable or elastomeric materials, such as plastic, foam, rubber, silicone, or the like or combinations of any of the foregoing. In some alternative embodiments, the engaging portion 2852 may be made from or may include non-elastic or minimally elastic materials, such as hard plastics, metal, or the like. Generally described, the engaging portion 2852 may be configured to secure (or further secure) the attachment apparatus 2850 to a user's ear 202 by engaging or extending into the interior portion 2820 of the user's ear 202 outside of the ear canal (e.g., as described with reference to the engaging portions 2804*a*-2804*c* illustrated in FIGS. 28A-28D). The engaging portion 2852 and the hooking body 1322 may be configured to form the space 2806 between the hooking body 1322 and the engaging portion 2852, which may accommodate the interior portion 2820 of the user's ear 202. The engaging portion 2852 may also be configured to limit movement of the attachment apparatus 2850 about the user's ear 202. In such embodiments (e.g., as described above), the engaging portion 2852 may be configured to extend into or to engage, at least substantially, an interior portion 2820 of the user's ear 202. As a result of engaging the interior portion 2820 of the ear 202, the engaging portion 2852 may prevent or limit the ability of the attachment apparatus 2850 to rotate around the ear 202 (clockwise or counterclockwise), thereby securing or further securing the attachment apparatus 2850 to the ear 202. As also described (e.g., with reference to FIGS. 28A-28D), the hooking body 1322 may be urged toward the engaging portion 2852, thereby causing the space 2806 between the hooking body 1322 and the engaging portion 2852 to reduce in at least one dimension. As the at least one dimension of the space 2806 decreases, the hooking body 1322 and/or the engaging portion 2852 may apply increasingly more compressive forces to the user's ear 202, and these compressive forces may secure (or further secure) the user's ear to the attachment apparatus 2850. This compression may be maintained until the hooking body 1322 is moved/adjusted, thereby ensuring that the attachment apparatus 2850 is securely attached to the user's ear 202.

In some embodiments, the engaging portion 2852 may be coupled to (or formed as single structural unit with) a compliant member 2854. The compliant member 2854 may be configured to engage at least a portion of the interior portion 2820 of the user's ear 202. The compliant member 2854 may be made from one or more or a combination of at least partially elastic materials that may suitable for comfortably engaging the interior portion 2820 of the user's ear 202. In some embodiments, while the engaging portion 2852 is positioned in the interior portion 2820 of the ear 202 (e.g., while the attachment apparatus 2850 is secured to the ear 202), the compliant member 2854 may be configured to engage physically with at least some of the interior portion 2820 of the ear 202 and may at least substantially conform to the contours of the interior portion 2820 of the ear 202. Because the compliant member 2854 is at least partially elastic, the compliant member 2854 may at least substantially conform to ears with interior portions of various shapes and sizes.

In some embodiments, the elasticity of the compliant member 2854 may be higher than the elasticity of the engaging portion 2852. In such embodiments, the relatively lower elasticity of the engaging portion 2852 may enable the engaging portion 2852 to resist, at least partially, deforming forces received on the engaging portion 2852 from one or more portions of the ear 202 as the attachment apparatus 2852 is secured to the ear 202. For example, as the interior portion 2820 of the ear 202 is inserted into the space 2806 between the engaging portion 2852 and the hooking body 1322, the engaging portion 2852 may slightly deform as a result of physically engaging the ear 202. Once a sufficient portion of the ear 202 is inserted into the space 2806, the engaging portion 2852 may revert to an initial configuration in the interior portion 2820 of the ear 202. While the engaging portion 2852 is positioned in the interior portion 2820 of the ear 202, the compliant member 2854 may elastically engage and deform in conformance to the interior portion 2820 of the ear 202, but the engaging portion 2852 may not be deformed or may only be deformed slightly.

In some embodiments, as the hooking body 1322 is biased towards the engaging portion 2852 (e.g., as described above), the compliant portion 2854 may deform to a greater extent than the extent to which the engaging portion 2852 deforms. Specifically, the engaging portion 2852 may at least substantially resist deformation as at least one dimension of the space 2806 decreases in order to maintain a compressive force on the portion of the ear 202 occupying the space 2806, which maintains or improves the security of attachment apparatus 2850 to the ear 202. In contrast, the compliant portion 2854 may be configured to deform to a comparatively greater degree to maintain a physical and comfortable engagement with the user's ear 202.

Figure 29A:
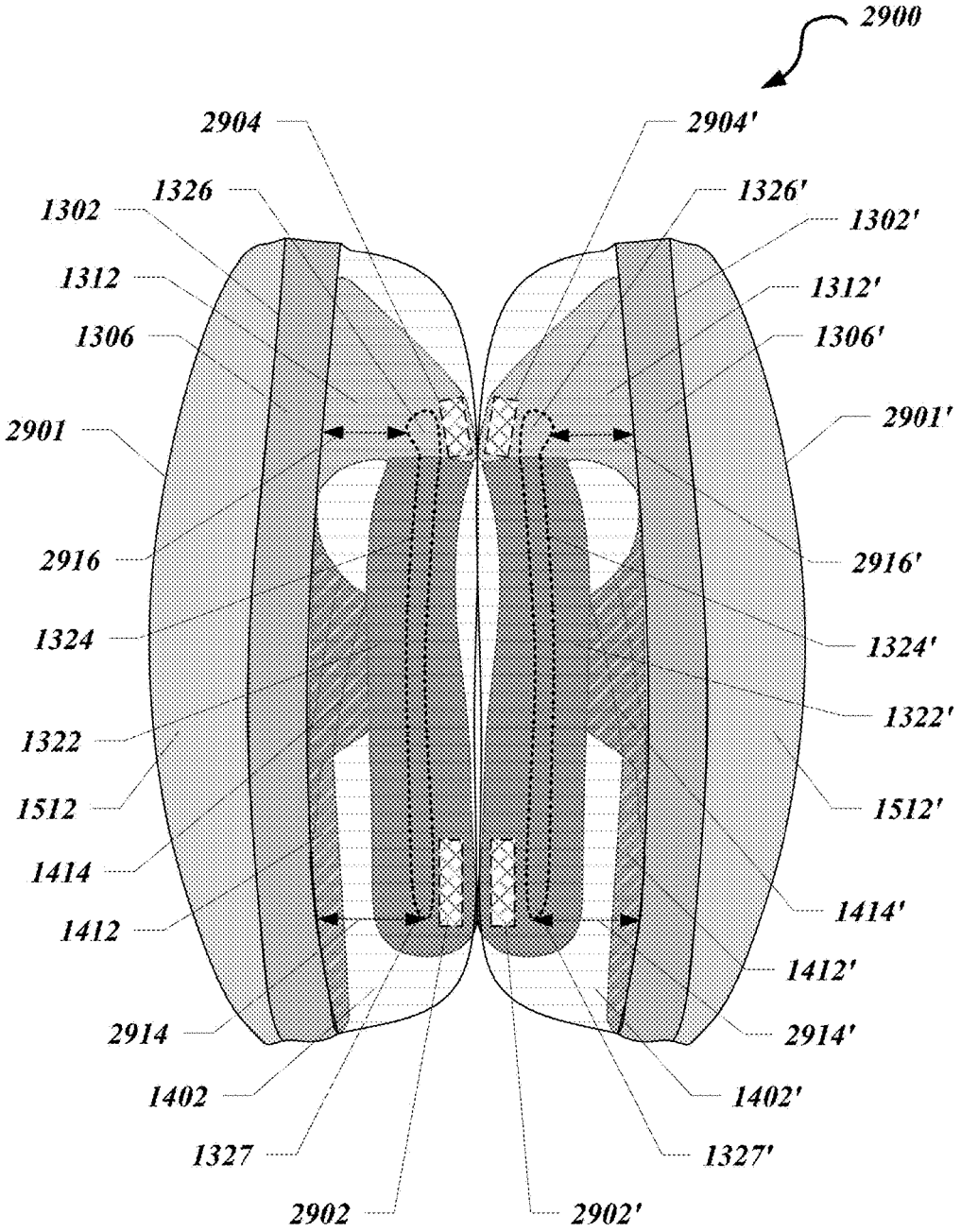
FIGS. 29A-29C are exterior views of alternative attachment apparatuses configured to be removably coupled together, according to some embodiments.
Figure 29B:
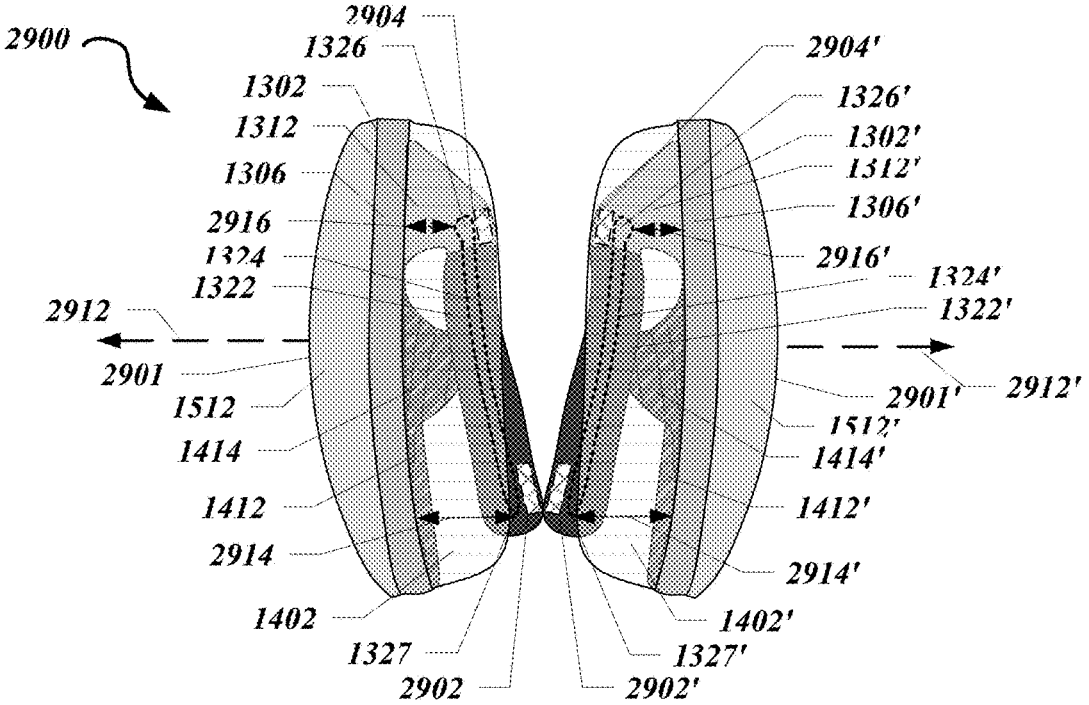
Figure 29C:
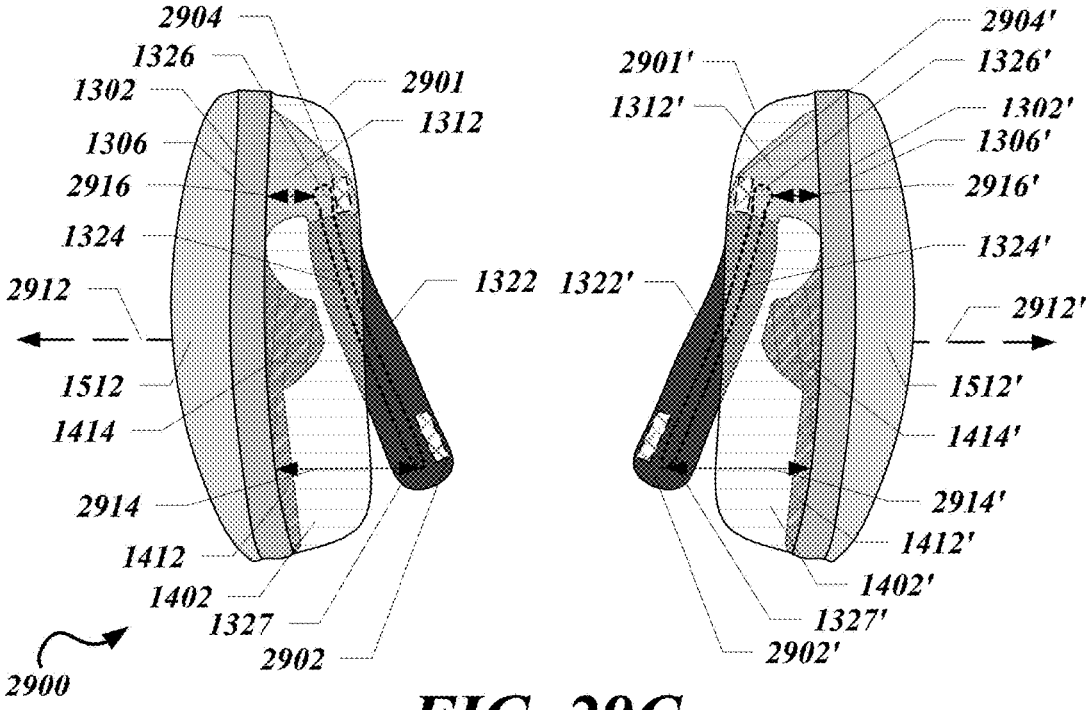

FIGS. 29A-29C illustrate different views of an attachment system 2900 that includes a first attachment apparatus 2901 and a second attachment apparatus 2901', according to some embodiments. FIG. 29A illustrates an exterior, profile view of a side of the attachment system 2900 in which the first attachment apparatus 2901 and the second attachment apparatus 2901' are in a closed configuration. FIG. 29B illustrates an exterior, profile view of a side of the attachment system 2900 in which the first attachment apparatus 2901 and the second attachment apparatus 2901' are in a partially open configuration. FIG. 29C illustrates an exterior, profile view of a side of the attachment system 2900 in which the first attachment apparatus 2901 and the second attachment apparatus 2901' are in an open configuration.

In some embodiments, the first attachment apparatus 2901 may include, but is not limited to including: the attachment body 1302, which may include the plate member 1306, the bridging member 1312, and an optional mid-ear portion (not shown); the hooking body 1322 that may include the deformable core 1324 having the first end 1326 and the second end 1327; the sealing body 1402; the ear pad 1412 and protruding portion 1414; and the cover body 1512. Some of the structural features of the first attachment apparatus 2901 may be analogous to structural features described above, for example, with reference to the attachment apparatuses 1300, 1400, 1500, 1600, 1700, 1800, 1900, 2000, 2100, 2200, 2300, 2400, 2500, 2600, 2700, 2800, 2850 described with reference to FIGS. 13A-28F. For clarity and simplicity of description, duplicative descriptions of such structural features of the attachment apparatus 2900 may not be repeated in the following descriptions.

The second attachment apparatus 2901' may be a mirror image of the first attachment apparatus 2901. As such, the second attachment apparatus 2901' may be configured similarly to the first attachment apparatus 2901 and may include one or more structures, components, or features that are analogous to and mirrored-versions of one or more structures, components, or features included in the first attachment apparatus 2901. In some embodiments, the second attachment apparatus 2901' may include, but is not limited to including: an attachment body 1302', which may include a plate member 1306', a bridging member 1312', and an optional mid-ear portion (not shown); a hooking body 1322' that may include a deformable core 1324' having a first end 1326' and a second end 1327'; a sealing body 1402'; an ear pad 1412' and a protruding portion 1414'; and a cover body 1512'. Some of the structural features of the second attachment apparatus 2901 may be analogous to (e.g., mirrored versions of) structural features described above, for example, with reference to the attachment apparatuses 1300, 1400, 1500, 1600, 1700, 1800, 1900, 2000, 2100, 2200, 2300, 2400, 2500, 2600, 2700, 2800, 2850 described with reference to FIGS. 13A-28F. For clarity and simplicity of description, descriptions of analogous, mirrored structural features of the second attachment apparatus 2901' may not be included in the following descriptions.

With reference to FIG. 29A, the first attachment apparatus 2901 may include a first coupling device 2902 and a second coupling device 2904. The first coupling device 2902 may be coupled to, embedded in, or otherwise included in the hooking body 1322 in proximity to the second end 1327 of the hooking body 1322. The second coupling device 2902 may be coupled to, embedded in, or otherwise included in the bridging member 1312 (or, alternatively, the hooking body 1322) in proximity to the first end 1326 of the hooking body 1322.

The second attachment apparatus 2901' may include a first coupling device 2902' and a second coupling device 2902'. The first coupling device 2902' may be coupled to, embedded in, or otherwise included in the hooking body 1322' in proximity to the second end 1327' of the hooking body 1322'. The second coupling device 2902' may be coupled to, embedded in, or otherwise included in the bridging member 1312' (or, alternatively, the hooking body 1322') in proximity to the first end 1326' of the hooking body 1322'.

The coupling devices 2902, 2904 included on or in the first attachment apparatus 2901 may be configured to engage one or more of the coupling devices 2902', 2904' included on or in the second attachment apparatus 2901'. In some embodiments, the positions of the coupling devices 2902', 2904' in or on the second attachment apparatus 2901' may mirror positions of the coupling devices 2902, 2904 in or on the first attachment apparatus 2901 (e.g., as illustrated in FIG. 29A). In such embodiments, in response to positioning the first attachment apparatus 2901 in proximity to or in physical contact with the second attachment apparatus 2901', the coupling devices 2902, 2904 may engage the coupling devices 2902', 2904'. Once engaged, the coupling devices 2902, 2902', 2904, 2904' may be configured to resist forces that would separate the first attachment apparatus 2901 from the second attachment apparatus 2901'.

In some embodiments, the coupling devices 2902, 2904 and the coupling devices 2902', 2904' may be complementary fasteners. For example, the coupling devices 2902, 2904 may be configured to mate physically with the coupling devices 2902', 2904' via one or more attachment systems, such as male/female interlocking components, hook-and-loop fasteners, non-permanent or reusable adhesives, clips, pins, latches, or the like. In such embodiments, once coupled together, the coupling devices 2902, 2902', 2904, 2904' may be decoupled by pulling the first attachment apparatus 2901 away from the second attachment apparatus 2901' with a force that is greater than the force holding the coupling devices 2902, 2902', 2904, 2904' together. In some embodiments, the coupling devices 2902, 2902', 2904, 2904' may include magnetic elements or may have magnetic properties. The coupling devices 2902, 2904 may be configured to have a magnetic polarity that is opposite of the magnetic polarity of the coupling devices 2902', 2904'. As such, as the first attachment apparatus 2901 is positioned closer to the second attachment apparatus device 2901', the coupling devices 2902, 2904 and the coupling devices 2902', 2904' may pull towards each other magnetically, thereby urging the first attachment apparatus 2901 towards the second attachment apparatus 2901' until the attachment apparatuses 2901, 2901' couple together.

In some embodiments, the first attachment apparatus 2901 may be configured in a closed configuration when the hooking body 1322 is proximate to the attachment body 1302 and the first coupling device 2902 is coupled to the first coupling device 2902'. For example, the first attachment apparatus 2901 may be configured in a closed configuration when the hooking body 1322 is completely or substantially encapsulated within a chamber formed by the sealing body 1402 (e.g., the chamber 1508 as described with reference to FIG. 15). In another example, the first attachment apparatus 2901 may be configured in a closed configuration when a vertical median plane of the hooking body 1322 is at least substantially parallel with a vertical median plane of the plate member 1306. In yet another example, the first attachment apparatus 2901 may be configured in a closed configuration when both the coupling devices 2902, 2904 of the first attachment apparatus 2901 are coupled to the coupling devices 2902', 2904' of the second attachment apparatus 2901'. The second attachment apparatus 2901' may similarly be configured in a closed configuration.

In the example illustrated in FIG. 29A, while the first attachment apparatus 2901 is in a closed configuration, the second end 1327 of the hooking body 1322 may be a first distance 2914 from the plate member 1306 of the attachment body 1302. In some optional embodiments, the second end 1327 of the hooking body 1322 may be the first distance 2914 from the plate member 1306 when the hooking body 1322 is at least substantially encapsulated in the sealing body 1402 (e.g., as described with reference to FIG. 14) and/or when the coupling devices 2902, 2904 are coupled to the coupling devices 2902', 2904'. In some optional, additional, or alternative embodiments, while the first attachment apparatus 2901 is in a closed configuration, the first end 1326 of the hooking body 1322 may be a second distance 2916 from the plate member 1306 of the attachment body 1302. Similarly, while the second attachment apparatus 2901' is in a closed configuration, the second end 1327' of the hooking body 1322' may be a first distance 2914' from the plate member 1306' of the attachment body 1302' and the first end 1326' may be a second distance 2916' from the plate member 1306'.

The first attachment apparatus 2901 may be configured in a partially open configuration in the example illustrated in FIG. 29B. For ease of description, the first attachment apparatus 2901 may be referred to as being in a "partially open" configuration when the second end 1327 of the hooking body 1322 has moved in response to one or more separating forces while the first coupling device 2902 remains at least partially coupled to the first coupling device 2902'. For example, the first attachment apparatus 2901 may be configured in a partially open configuration when the first distance 2914 has increased from when the first attachment apparatus 2901 is in a closed configuration as illustrated in FIG. 29A, but the first distance 2914 has not increased to the point in which the first coupling device 2902 has decoupled from the first coupling device 2902'. In another example, the first attachment apparatus 2901 may be configured in a partially open configuration when the coupling device 2902 is coupled to the coupling device 2902' but a portion of the hooking body 1322 is not encapsulated by a chamber formed by the sealing body 1402 (e.g., the chamber 1508 as described with reference to FIG. 15) or when a vertical median plane of the hooking body 1322 is not at least substantially parallel with a vertical median plane of the plate member 1306. Similarly, the second attachment apparatus 2901' may be configured in a partially open configuration in a similar (but mirrored) manner.

In some embodiments, the hooking body 1322 of the first attachment apparatus 2901 may be configured to transition from a closed configuration to a partially open configuration. In such embodiments, the first attachment apparatus 2901 may receive a separating force (e.g., represented by dotted line 2912) that causes the first attachment apparatus 2901 to begin separating from the second attachment apparatus 2901'. Additionally (or alternatively), the second attachment apparatus 2901' may receive a separating force (e.g., represented by dotted line 2912') that causes the first attachment apparatus 2901 to begin separating from the second attachment apparatus 2901'. By way of a non-limiting example, the first attachment apparatus 2901 and the second attachment apparatus 2901' may each receive a pulling force that causes the attachment apparatuses 2901, 2901' to move in opposite directions. In some embodiments, only one of the attachment apparatuses 2901, 2901' may receive a force that causes the attachment apparatuses 2901, 2901' to separate, such as when one of the attachment apparatuses 2901, 2901' is held in place while the other is pulled away.

As described (e.g., with reference to FIGS. 13A-13E), the deformable core 1324 of the hooking body 1322 is configured to enable the hooking body 1322 to deform in response to receiving a force and configured to remain deformed until another force is applied to the hooking body 1322. Accordingly, in response to receiving a separating force on one or both of the attachment apparatuses 2901, 2901', the hooking body 1322 of the attachment apparatus 2901 may begin to bias away from the plate member 1306 of the attachment body 1302 as the first attachment apparatus 2901 separates from the second attachment apparatus 2901' as a result of the coupling force holding the first coupling device 2902 together with the first coupling device 2902'. In some embodiments in which the separating force is applied to the first attachment apparatus 2901, the hooking body 1322 may begin to move relative to the remainder of the attachment apparatus 2901 in a direction that is opposite of the direction that the separating force is applied to the first attachment apparatus 2901. In some additional (or alternative) embodiments in which the separating force is applied to the second attachment apparatus 2901', the hooking body 1322 may begin to move relative to the remainder of the attachment apparatus 2901 in the same direction that the separating force is applied to the second attachment apparatus 2901' for similar reasons.

In the example illustrated in FIG. 29B, one or both of the separating forces 2912, 2912' may cause the second end 1327 of the hooking body 1322 to move relative to the remainder of the attachment apparatus 2901 while the first coupling device 2902 remains coupled to the first coupling device 2902'. As a result, the first distance 2914 between the second end 1327 of the hooking body 1322 and the plate member 1306 of the attachment body 1302 may increase. In some embodiments, the first coupling device 2902 may remain at least partially coupled to the first coupling device 2902' because the moving of the second end of the hooking body 1322 (as described) may reduce the effect of one or more separating forces acting on the first coupling device 2902. As a result, the separating forces may not initially exceed the coupling force holding the coupling device 2902 together with the coupling device 2902'.

In some embodiments, the coupling device 2904 may be included in the bridging member 1312 of the attachment body 1302 or included in the hooking body 1322 in proximity to the first end 1326 of the hooking body 1322. In such embodiments, the first end 1326 of the hooking body 1322 may be anchored to the bridging member 1312, and as a result, the first end 1326 of the hooking body 1322 may not move (or may move only minimally) in response to receiving one or more separating forces on the first attachment apparatus 2901. In such embodiments, the first end 1326 of the hooking body 1322 may experience the one or more separating forces to a relatively higher degree than the second end 1327 of the hooking body 1322 because the first end 1326 of the hooking body 1322 may not be able to move (or may move only slightly) in response to the one or more separating forces, whereas the second end 1327 of the hooking body 1322 may freely move in response to the one or more separating forces (e.g., as described above). As a result, the coupling force that causes the coupling device 2904 to remain coupled to the coupling device 2904' may be overcome by the one or more separating forces more easily than the coupling force holding the coupling device 2902 together with the coupling device 2902'. In the example illustrated in FIG. 29B, in response to one or more of the separating forces 2912, 2912', the first coupling device 2902 may remain at least partially coupled to the coupling device 2902', but the second coupling device 2904 may be decoupled from the second coupling device 2904'.

If one or more of the separating forces 2912, 2912' continue to act on the first attachment apparatus 2901, one or more the separating forces 2912, 2912' may eventually overcome the coupling force that couples the first coupling device 2902 to the coupling device 2902', as depicted in the example illustrated in FIG. 29C. Specifically, as the second end 1327 continues to move away from the plate member 1306 of the attachment body 1302 in response to one or more of the separating forces 2912, 2912', the ability of the second end 1327 of the hooking body 1322 to mitigate one or more of the separating forces 2912, 2912' may decrease until one or more the separating forces 2912, 2912' exceeds the coupling force that couples the first coupling device 2902 to the coupling device 2902'. Once the one or more the separating forces 2912, 2912' exceed the coupling force, the first coupling device 2902 may decouple from the first coupling device 2902', the second end 1327 of the hooking body 1322 may cease moving away from the plate member 1306, and the first distance 2914 may cease increasing. For ease of reference, the first attachment apparatus 2901 may be referred to as being in an "open" configuration when the first coupling device 2902 is no longer coupled to the first coupling device 2902'. While the first attachment apparatus 2901 is in an open configuration, the first distance 2914 may be larger than while the first attachment apparatus 2901 is in a partially open or closed configuration. Accordingly, while the first attachment apparatus 2901 is in an open configuration, the first distance 2914 between the second end 1327 of the hooking body 1322 and the plate member 1306 of the attachment body 1302 may be particularly well suited for receiving and accommodating a user's ear, which may be inserted between the hooking body 1322 and the plate member 1306. The hooking body 1322 may then be deformed around the user's ear to secure the attachment apparatus 2901 comfortably to the user's ear (e.g., as generally described with reference to FIGS. 13A-13E).

Some embodiments described above refer to configurations and characteristics of the first attachment apparatus 2901. However, in some embodiments, the second attachment apparatus 2901' may be a mirror implementation of the first attachment apparatus 2901, and the second attachment apparatus 2901' may be configured similarly to the configuration of the first attachment apparatus 2901 (e.g., as described above). According to such embodiments, the second attachment apparatus 2901' may be configured to transition from a closed configuration (e.g., as illustrated in FIG. 29A), to a partially open configuration (e.g., as illustrated in FIG. 29B), and to an open configuration (e.g., as illustrated in FIG. 29C) in response to one or more of the separating forces 2912, 2912'.

Some embodiments described above describe the first attachment apparatus 2901 as being coupled to the second attachment apparatus 2901'. In some additional (or alternative) embodiments (not shown), the first attachment apparatus 2901 may be configured to couple to another device (e.g., a charging station, cradle, holder, or the like) that includes one or more coupling devices that may couple to at least the first coupling device 2902. In such embodiments, the first attachment apparatus 2901 may couple to the other device via the first coupling device 2902 and may be in a closed configuration (e.g., as described with reference to FIG. 29A). The second end 1327 of the hooking body 1322 may move away from the plate member 1306 of the attachment body 1302 as a result of a separating force received on the first attachment apparatus 2901 and/or the other device that causes the first attachment apparatus 2901 to separate from the other device. While the second end 1327 of the hooking body 1322 is moving as a result of the separating force but while the first coupling device 2902 is still coupled to a coupling device on the other device, the first attachment apparatus 2901 may be in a partially open configuration (e.g., as described with reference to FIG. 29B). The second end 1327 of the hooking body 1322 may continue moving in response to the separating force until the separating force exceeds the coupling force holding the first coupling device 2902 to the coupling device included in the other device. Once the separating force exceeds the coupling force, the first coupling device 2902 may be decoupled from the one or more coupling devices of the other device, the second end 1327 of the hooking body 1322 may cease to move as a result of the separating force, and the first attachment apparatus 2901 may be in an open configuration (e.g., as described with reference to FIG. 29C).

Figure 30A:
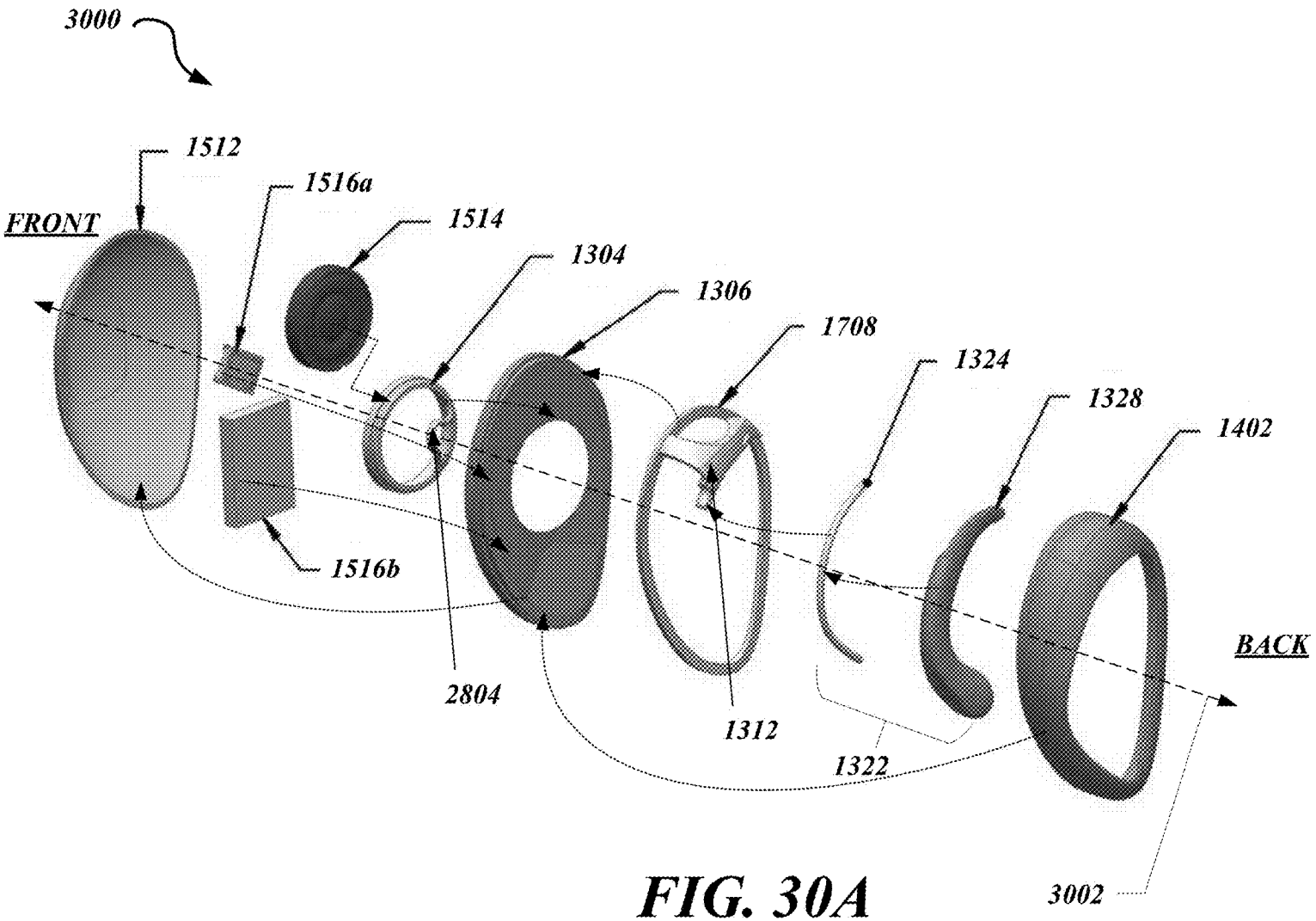
FIG. 30A is an exploded view of an alternative attachment apparatus, according to some embodiments.

FIG. 30A illustrates an exploded, exterior perspective view of a back side of an alternative attachment apparatus 3000, according to some embodiments. In some embodiments, the attachment apparatus 3000 may include, but is not limited to including: the cover body 1512, the electronic components 1514, 1516*a*, 1516*b*, the mid-ear portion 1304 with the engaging portion 2804, the plate member 1306, the coupling ring 1708, the bridging member 1312, the hooking body 1322 including the deformable core 1324 and the cushioning portion 1328, and the sealing body 1402. Some of the structural features of the attachment apparatus 3000 may be analogous to structural features described above, for example, with reference to the attachment apparatuses 1300, 1400, 1500, 1600, 1700, 1800, 1900, 2000, 2100, 2200, 2300, 2400, 2500, 2600, 2700, 2800, 2850, 2900 described with reference to FIGS. 13A-29C. For clarity and simplicity of description, duplicative descriptions of such structural features of the attachment apparatus 3000 may not be repeated in the following descriptions.

The example illustrated in FIG. 30A includes dotted referential lines representing possible coupling relationships between various components of the attachment apparatus 3000, according to some embodiments. However, such dotted referential lines are not intended to limit the configuration of the attachment apparatus 3000 to only the coupling relationships illustrated in this example. Instead, unless otherwise limited by the claims, various components of the attachment apparatus 3000 may be coupled together or otherwise assembled in other ways (e.g., as indicated in various embodiments described herein) without limiting the scope of this disclosure.

In the example illustrated in FIG. 30A, the attachment apparatus 3000 may include one or more of the structures/components described above, and these structures/components may, generally, be coupled together and/or assembled along referential line 3002. Specifically, in some embodiments, the electronic components 1514, 1516*a*, 1516*b* may be coupled to the plate member 1306, for example on one or more facets of the plate member 1306 (e.g., as described with reference to the facets 1310*a*-1310*d* illustrated in FIGS. 13A-13C). In some embodiments, the electronic component 1514 may be a speaker system that is coupled to an interior surface of the mid-ear portion 1304. The mid-ear portion 1304 may be a separate structural component and may be coupled to the plate member 1306 via an opening in the plate member 1306. In such embodiments, the mid-ear portion 1304 may at least partially protrude through the opening in the plate member 1306 and may be configured to function, in whole or in part, as described previously (e.g., with reference to FIGS. 28A-28F). In some alternative embodiments (not shown), the mid-ear portion 1304 may be formed as part of the plate member 1306. The plate member 1306 may be coupled to the cover body 1512 (e.g., along a coupling edge on a first side of the plate member 1306—not shown) so that the electronic components 1514, 1516 are at least substantially encapsulated in a chamber formed between the plate member 1306 and the cover body 1512.

In some embodiments, the coupling ring 1708 may be coupled to the bridging member 1312 or, alternatively, the bridging member 1312 may be formed as part of the coupling ring 1708. The coupling ring 1708 may be configured to couple to the plate member 1306 (e.g., via a coupling edge on a second side of the plate member 1306 opposite of the coupling edge to which the cover body 1512 is coupled to the plate member 1306—not shown). One end of the deformable core 1324 may be coupled to, embedded in, or otherwise anchored to the bridging member 1312. Accordingly, the second end of the deformable core 1324 may be able to be freely moved in response to receiving a force. The cushioning portion 1328 may be coupled to the deformable core 1324 (and, optionally, a portion of the bridging member 1312) so that the deformable core 1324 is at least substantially encapsulated within the cushioning portion 1328 (e.g., as illustrated with reference to FIGS. 13A-13E).

The sealing body 1402 may be coupled to the plate member 1306 (and/or, alternatively, to the coupling ring 1708). When the sealing edge 1708 is also coupled to the plate member 1306, the sealing body 1402 and the plate member 1306 may form a chamber suitable for accommodating an outer portion of a user's ear as described previous in various embodiments. In some embodiments, the sealing body 1402 may be configured similar to one or more sealing bodies described above (e.g., with reference to FIGS. 14A-29C).

Various embodiments described with reference to FIG. 30A refer to coupling one or more structural features or components of the attachment apparatus 3000. In some embodiments, these one or more structural features or components may be coupled together using one or more known coupling methods or mechanisms. By way of a non-limiting example, structural features or components of the attachment apparatus 3000 may be coupled together via one or more of: fasteners, adhesives, welding, molding (e.g., overmolding), or the like.

Figure 30B:
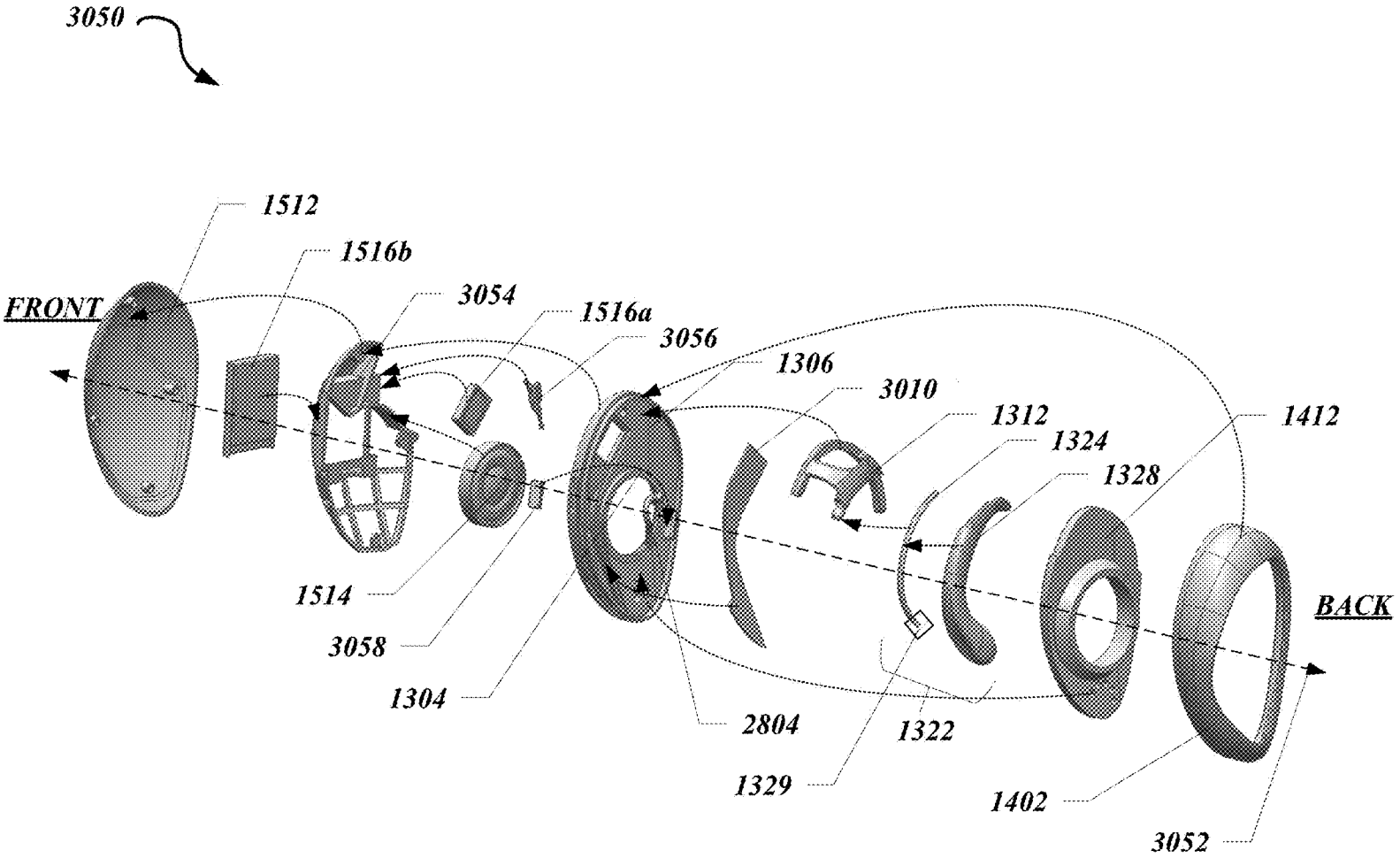
FIG. 30B is an exploded view of an alternative attachment apparatus, according to some embodiments.

FIG. 30B illustrates an exploded, exterior perspective view of a back side of an alternative attachment apparatus 3050, according to some embodiments. In some embodiments, the attachment apparatus 3050 may include, but is not limited to including: the cover body 1512, the electronic components 1514, 1516*a*, 1516*b*, the mid-ear portion 1304 with the engaging portion 2804, the plate member 1306, the bridging member 1312, the hooking body 1322 including the deformable core 1324, the end piece 1329, and the cushioning portion 1328, and the sealing body 1402. Some of the structural features of the attachment apparatus 3050 may be analogous to structural features described above, for example, with reference to the attachment apparatuses 1300, 1400, 1500, 1600, 1700, 1800, 1900, 2000, 2100, 2200, 2300, 2400, 2500, 2600, 2700, 2800, 2900, 3000 described with reference to FIGS. 13A-30A. For clarity and simplicity of description, duplicative descriptions of such structural features of the attachment apparatus 3050 may not be repeated in the following descriptions. For additional ease of description, the example illustrated in FIG. 30B includes dotted referential lines representing possible coupling relationships between various components of the attachment apparatus 3050, according to some embodiments. However, such dotted referential lines are not intended to limit the configuration of the attachment apparatus 3050 to only the coupling relationships illustrated in this example. Instead, unless otherwise limited by the claims, various components of the attachment apparatus 3050 may be coupled together or otherwise assembled in other ways without limiting the scope of this disclosure.

In the example illustrated in FIG. 30B, the attachment apparatus 3050 may include one or more of the structures/components described above, and these structures/components may, generally, be coupled together and/or assembled along referential line 3052. In some embodiments, the attachment apparatus 3050 may include a mounting system (or chassis) 3054. The electronic components 1514, 1516*a*, 1516*b* may be coupled to the mounting system 3054. A lighting system 3056 (e.g., a light-emitting diode system) may be included in the attachment apparatus 3050 and may be coupled to the mounting system 3054.

A front surface of the mounting system 3054 may be configured to couple to a back surface of the cover body 1512. A back surface of the mounting system 3054 may be configured to couple to a front surface of the plate member 1306. In some embodiments, the electronic component 1514 coupled to the mounting system 3054 may be a speaker system configured to couple to an interior surface of the mid-ear portion 1304 when the mounting system 3054 is coupled to the plate member 1306.

The plate member 1306 may be coupled to the cover body 1512 via the mounting system 3054. A coupling device 3058 (e.g., a magnetic element) may be coupled to the plate member 1306. In some embodiments (not shown), the mid-ear portion 1304 may be a separate structural component and may be coupled to the plate member 1306 via an opening in the plate member 1306. In such embodiments, the mid-ear portion 1304 may protrude through the opening in the plate member 1306 and may be configured to function, in whole or in part, as described previously (e.g., with reference to FIGS. 28A-28D).

In some embodiments, the attachment apparatus 3050 may include an internal waveguide 3010 configured to guide sound generated from a secondary speaker system to ambient air (not shown). The internal waveguide 3010 may be coupled to the plate member 1306 (e.g., along a back surface of the plate member 1306). The bridging member 1312 may be coupled to the plate member 1306 or, alternatively, the bridging member 1312 may be formed as part of the plate member 1306. One end of the deformable core 1324 may be coupled to, embedded in, or otherwise anchored to the bridging member 1312. Accordingly, the second end of the deformable core 1324 may be able to be freely biased in response to receiving a force. The cushioning portion 1328 may be coupled to the deformable core 1324 (and, optionally, a portion of the bridging member 1312) so that the deformable core 1324 is at least substantially encapsulated within the cushioning portion 1328 (e.g., as illustrated with reference to FIGS. 13A-13E).

The earpad 1412 and the sealing body 1402 may each be coupled to the plate member 1306. In some embodiments, the earpad 1412 may be configured so that the protruding portion 2804 of the mid-ear portion 1304 may extend through an opening in the ear pad 1412. When the sealing body 1402 is coupled to the plate member 1306, the sealing body 1402 and the plate member 1306 may form a chamber suitable for accommodating an outer portion of a user's ear as described previous in various embodiments. In some embodiments, the sealing body 1402 may be configured similar to one or more sealing bodies described above (e.g., with reference to FIGS. 14A-29C).

Various embodiments described with reference to FIG. 30B refer to coupling one or more structural features or components of the attachment apparatus 3050. In some embodiments, these one or more structural features or components may be coupled together using one or more known coupling methods or mechanism. By way of a non-limiting example, structural features or components of the attachment apparatus 3050 may be coupled together via one or more of: fasteners, adhesives, welding, molding (e.g., overmolding), or the like.

Figure 31:
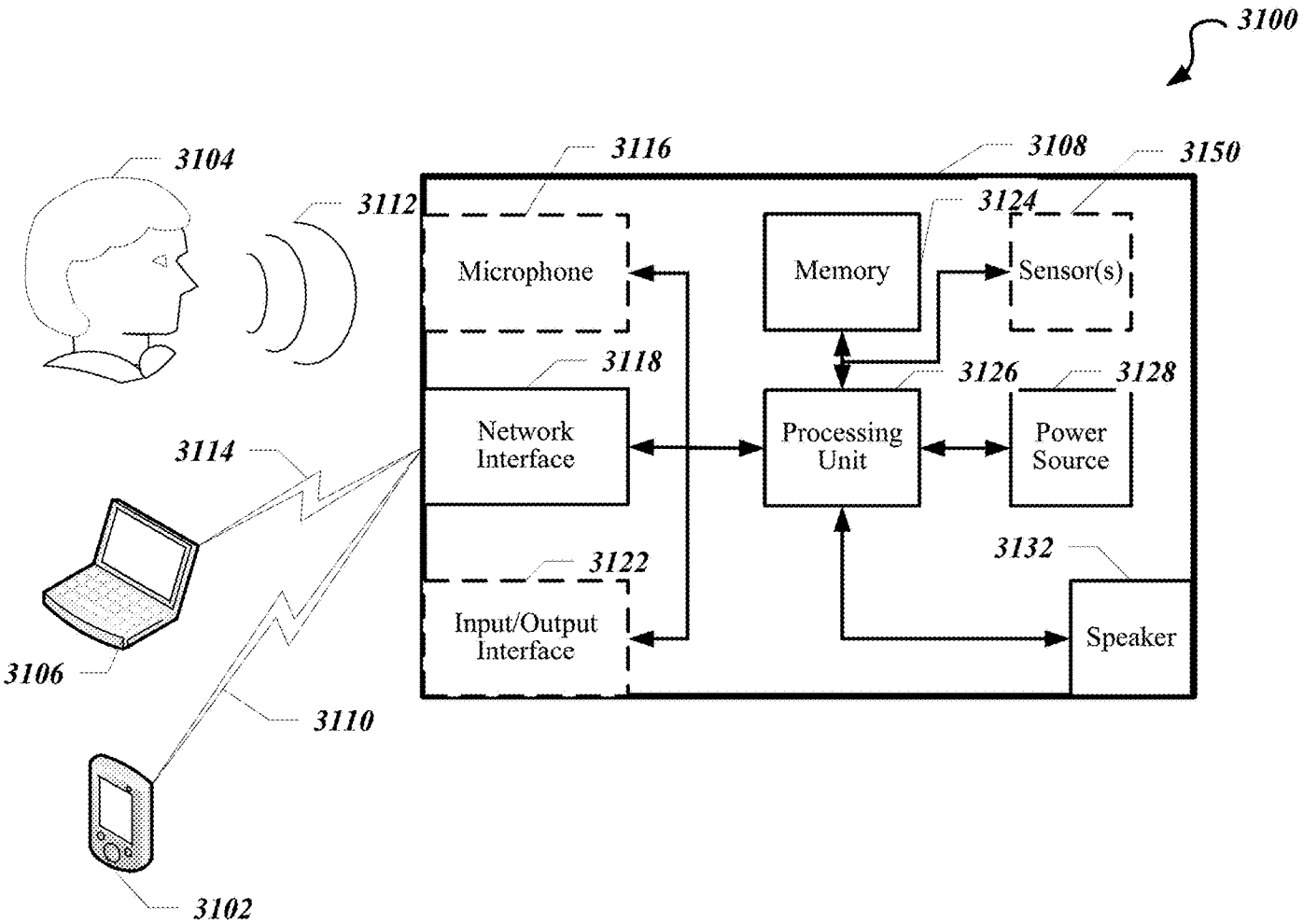
FIG. 31 is a communication system diagram illustrating an attachment apparatus configured as a wearable audio system, according to some embodiments.

FIG. 31 is a functional block diagram of an illustrative operating environment 3100 suitable for implementing aspects of the present disclosure. The operating environment 3100 includes an attachment apparatus 3108 that may be configured to receive audio data from various sources, including a mobile computing device 3102, an analog source of sound 3104 (e.g., a human), or another computing device 3106.

The example illustrated in FIG. 31 depicts a general architecture of the attachment apparatus 3108 that may be configured to playout audio, among other functions. The general architecture of the attachment apparatus 3108 includes an arrangement of computer hardware and/or software components. The attachment apparatus 3108 may include more (or fewer) elements than those shown in FIG. 31. It is not necessary, however, that all of these generally conventional elements be shown in order to provide an enabling disclosure. In some embodiments, the attachment apparatus 3108 may be configured as described above with reference to any one or more of the apparatuses 100, 310, 400, 500, 600, 700, 800, 860, 900, 1000, 1200, 1300, 1400, 1500, 1600, 1700, 1750, 1800, 1900, 2000, 2100, 2200, 2300, 2400, 2500, 2600, 2700, 2800, 2850, 2900, 3000, 3050.

As illustrated, the attachment apparatus 3108 may include an input/output device interface 3122, a network interface 3118, an optional microphone 3116, a memory 3124, a processing unit 3126, a power source 3128, and a speaker 3132, all of which may communicate with one another by way of a communication bus. The network interface 3118 may provide connectivity to one or more networks or computing systems, and the processing unit 3126 may receive and/or send information and instructions from/to other computing systems or services via the network interface 3118. In some embodiments, the network interface 3118 may be configured to communicate with the mobile computing device 3102 and/or the other computing device 3106 via wireless communication links 3110 and 3114, such as via a Wi-Fi Direct or Bluetooth communication links. The network interface 3118 may also (or alternatively) be configured to communicate with the computing devices 3102 and 3106 via a wired communication link (not shown). Those skilled in the art will recognize that the computing devices 3102 and 3106 may be any of a number of computing devices capable of communicating via a wireless or wired link including, but not limited to, a laptop, personal computer, personal digital assistant (PDA), hybrid PDA/mobile phone, mobile phone, smartphone, wearable computing device (e.g., wireless headphones or earphones), electronic book reader, digital media player, tablet computer, gaming console or controller, kiosk, augmented or virtual reality device, other wireless device, set-top or other television box, or the like. In such embodiments, the network interface 3118 may receive audio data from the mobile computing devices 3102 and/or 3106 and may provide the audio data to the processing unit 3126. In such embodiments, the processing unit 3126 may cause the audio data to be transformed into an electrical audio signal that is provided to the speaker 3132 for output as sound.

The processing unit 3126 may communicate to and from memory 3124. In some embodiments, the memory 3124 may include RAM, ROM, and/or other persistent, auxiliary or non-transitory computer-readable media. The memory 3124 may store an operating system that provides computer program instructions for use by the processing unit 3126 in the general administration and operation of the attachment apparatus 3108. In some embodiments, the memory 3124 may contain digital representations of audio data or electronic audio signals (e.g., digital copies of songs or videos with audio). In such embodiments, the processing unit 3126 may obtain the audio data or electronic audio signals from the memory 3124 and may provide electronic audio signals to the speaker 3132 for playout as sound.

In some embodiments, the input/output interface 3122 may also receive input from an input device (not shown), such as a keyboard, mouse, digital pen, microphone, touch screen, gesture recognition system, voice recognition system, image recognition through an imaging device (which may capture eye, hand, head, body tracking data and/or placement), gamepad, accelerometer, gyroscope, or another input device known in the art. In some embodiments, the microphone 3116 may be configured to receive sound 3112 from an analog sound source 3104. For example, the microphone 3116 may be configured to receive human speech. The microphone 3116 may further be configured to convert the sound into audio data or electrical audio signals that are directly or indirectly provided to the speaker 3132 for output as sound.

Each of the communication links 3110 and 3114 may be communication paths through networks (not shown), which may include wired networks, wireless networks or combination thereof. In addition, such networks may be personal area networks, local area networks, wide area networks, cable networks, satellite networks, cellular telephone networks, etc. or combination thereof. In addition, the networks may be a personal area network, local area network, wide area network, over-the-air broadcast network (e.g., for radio or television), cable network, satellite network, cellular telephone network, or combination thereof. In some embodiments, the networks may be private or semi-private networks, such as a corporate or university intranets. The networks may also include one or more wireless networks, such as a Global System for Mobile Communications (GSM) network, a Code Division Multiple Access (CDMA) network, a Long Term Evolution (LTE) network, or some other type of wireless network. Protocols and components for communicating via the Internet or any of the other aforementioned types of communication networks are well known to those skilled in the art and, thus, are not described in more detail herein.

In some embodiments, the attachment apparatus 3108 may include one or more sensors 3150. The one or more sensors 3150 may include, but are not limited to, one or more biometric sensors, heat sensors, gyroscopic sensors, accelerometers, pressure sensors, force sensors, light sensors, or the like. In such embodiment, the one or more sensors 3150 may be configured to obtain sensor information from a user of the attachment apparatus 3108 and/or from an environment in which the attachment apparatus 3108 is worn by the user. The processing unit 3126 may receive sensor readings from the one or more sensors 3150 and may generate one or more outputs based on these sensor readings. For example, the processing unit 3126 may configure a light-emitting diode included on the attachment apparatus (not shown) to flash according to a preconfigured patterned based on the sensor readings.

Examples illustrated in the accompanying drawings may depict one or more embodiments of the attachment apparatus as being configured for use with a left ear of a user. However, any descriptions or illustrations of the foregoing attachment apparatuses that cause the attachment apparatus to be suitable for use with a left ear of a user are made merely for ease of description. As such, unless otherwise limited by the claims, there is no requirement that the attachment apparatuses described above must be configured for use only with left ears. For example, without loss of generality, any of the above attachment apparatuses may be configured to couple to a right ear of a user by mirroring the structures described and illustrated above. Further, in some embodiments (not shown), any of the various attachment apparatuses described above may be utilized with a mirrored attachment apparatus that is configured to function on an opposite ear. In such embodiments, an attachment apparatus and a mirrored attachment apparatus may operate together as part of a single audio system because the attachment apparatus may be configured for use with one ear of the user, and the mirrored attachment apparatus may be coupled for use with the other ear (or vice versa). For example, in some embodiments in which the attachment apparatus and the mirrored attachment apparatus are configured as wearable audio systems, the user may utilize the attachment apparatus and the mirrored attachment apparatus together to experience stereophonic sounds in which an audio source is played simultaneously or nearly simultaneously through both the attachment apparatus and the mirrored attachment apparatus.

Non-exclusive example embodiments of the attachment apparatuses and related systems described herein are further described in the following clauses.

A. An attachment apparatus for coupling to an ear of a user, comprising:
- an attachment body comprising a plate member and a bridging member;
- an engaging portion coupled to a mid-ear portion of the plate member; and
- a hooking body coupled to the bridging member,
- wherein:
  - the engaging portion is configured to protrude from the mid-ear portion of the plate member in a direction towards the hooking body,
  - the engaging portion and the hooking body are configured to define a first space suitable for receiving an interior portion of the ear,
  - the plate member and the hooking body are configured to define a second space suitable for receiving a posterior portion of the ear, and
  - while the attachment apparatus is secured to the ear of the user:
    - the bridging member is configured to engage a root of an upper portion of the ear,
    - the hooking body is configured to engage a root of the posterior portion of the ear positioned in the first space,
    - the engaging portion is configured to protrude into an interior portion of the ear and to engage the interior portion of the ear proximal to the hooking body, and
    - the hooking body and the engaging portion are collectively configured to apply a compressive force to the interior portion of the ear positioned in the second space.

B. The attachment apparatus of clause A, wherein:
the attachment apparatus further comprises a sealing body coupled to the plate member; and
the sealing body is configured to define a chamber suitable for encapsulating the hooking body and at least a portion of the ear while the attachment apparatus is secured to the ear.

C. The attachment apparatus of clause A, wherein the attachment apparatus further comprises a speaker system coupled to a side of the mid-ear portion of the plate member that does not face a median plane of the user.

D. The attachment apparatus of clause A, wherein the engaging portion is configured to:
receive a force from an anterior portion of the ear while the posterior portion of the ear is passing through the second space, and
move in a direction towards the plate member in response to receiving the force from the anterior portion of the ear.

E. The attachment apparatus of clause D, wherein:
the force received by the engaging portion from the anterior portion of the ear is removed or substantially reduced when at least a majority of the posterior portion of the ear passes through the second space; and
the engaging portion is configured to move into engagement with an interior portion of the ear in proximity to the hooking body when the force is removed or substantially reduced.

F. An attachment apparatus for coupling to an ear of a user, comprising:
an attachment body comprising a first engaging portion; and
a hooking body coupled to the attachment body, wherein:
the first engaging portion and the hooking body are configured to define a first space suitable for receiving an interior portion of the ear,
the attachment body and the hooking body are configured to define a second space suitable for receiving a posterior portion of the ear,
the hooking body and the first engaging portion are collectively configured to secure the attachment apparatus to at least part of the interior portion of the ear positioned in the first space, and
the hooking body is configured to secure the attachment apparatus to at least part of the posterior portion of the ear that is positioned in the second space.

G. The attachment apparatus of clause F, wherein the first engaging portion is configured to engage the interior portion of the ear indirectly via a compliant material coupled to the first engaging portion.

H. The attachment apparatus of clause F, wherein the first engaging portion comprises, at least partially, one or more elastomeric materials.

I. The attachment apparatus of clause F, wherein the first engaging portion is configured to protrude from the attachment body in a direction towards the hooking body.

J. The attachment apparatus of clause I, wherein the direction in which the first engaging portion protrudes from the attachment body intersects with a directional plane of the attachment body.

K. The attachment apparatus of clause F, wherein the first engaging portion is configured to engage a surface of the interior portion of the ear proximal to the hooking body.

L. The attachment apparatus of clause F, wherein the first engaging portion is configured not to engage a surface of the interior portion of the ear distal to the hooking body.

M. The attachment apparatus of clause F, wherein the first engaging portion and the hooking body are collectively configured to apply a compressive force to at least part of the interior portion of the ear positioned in the first space.

N. The attachment apparatus of clause F, wherein the hooking body is configured to secure the attachment apparatus to a root of at least part of the posterior portion of the ear positioned in the second space.

O. The attachment apparatus of clause F, wherein the hooking body is configured to move between an initial configuration and a deformed configuration in response to receiving an external force.

P. The attachment apparatus of clause O, wherein the hooking body comprises a non-resilient deformable core configured to move in response to receiving the external force.

Q. The attachment apparatus of clause O, wherein:
the external force causes the hooking body to move in a direction towards the first engaging portion; and
a dimension of the first space defined by the hooking body and the first engaging portion is smaller while the hooking body is configured in the deformed configuration than while the hooking body is configured in the initial configuration.

R. The attachment apparatus of clause O, wherein:
while the hooking body is configured in the initial configuration, at least one of the hooking body and the first engaging portion is configured to apply a first compressive force to at least part of the interior portion of the ear positioned in the first space;
while the hooking body is configured in the deformed configuration, at least one of the hooking body and the first engaging portion is configured to apply a second compressive force to at least part of the interior portion of the ear; and
the second compressive force is greater than the first compressive force.

S. The attachment apparatus of clause F, wherein the first engaging portion is configured as a loop.

T. The attachment apparatus of clause F, wherein the first engaging portion is configured to define an opening.

U. The attachment apparatus of clause T, wherein the first engaging portion is configured such that sound is able to pass through the opening of the first engaging portion.

V. The attachment apparatus of clause U, further comprising a speaker system coupled to the attachment body and configured to output sound through the opening of the first engaging portion, wherein the speaker system is coupled to a side of the attachment body facing away from a median plane of the user, and wherein the first engaging portion is coupled to a side of the attachment body facing the median plane of the user.

W. The attachment apparatus of clause F, wherein the first engaging portion is configured to transition between an initial configuration and a displaced configuration in response to receiving an external force.

X. The attachment apparatus of clause W, wherein the first engaging portion receives the external force from an anterior portion of the ear while the posterior portion of the ear is passing through the second space.

Y. The attachment apparatus of clause X, wherein, when the first engaging portion is configured in the displaced configuration:
- the first engaging portion is configured to urge the attachment apparatus in a direction away from the median plane of the user; and
- the hooking body is configured to at least partially restrict movement of the attachment apparatus in the direction.

Z. The attachment apparatus of clause X, wherein
- the force received by the first engaging portion from the anterior portion of the ear is removed or at least partially reduced when at least a majority of the posterior portion of the ear passes through the second space; and
- the first engaging portion is configured to move into engagement with at least part of the interior portion positioned in the first space when the force is removed.

AA. The attachment apparatus of clause F, wherein the first engaging portion is configured to at least partially restrict movement of the attachment apparatus while the attachment apparatus is secured to the ear by engaging the interior portion of the ear.

BB. The attachment apparatus of clause AA, wherein the movement that is restricted is at least one of:
- a rotational movement of the attachment apparatus around a first directional axis at least substantially perpendicular to a median plane of the user; or
- a linear movement of the attachment apparatus in at least one of a second directional axis and a third directional axis distinct from the second directional axis, wherein the second directional axis and the third directional axis are at least substantially parallel to the median plane of the user.

CC. The attachment apparatus of clause F, wherein the attachment apparatus comprises a second engaging portion.

DD. The attachment apparatus of clause CC, wherein:
- the first engaging portion is configured to protrude in a first direction that intersects with a directional plane of the plate member;
- the second engaging portion is configured to protrude in a second direction that intersects with the directional plane of the plate member; and
- the first direction is distinct from the second direction.

EE. The attachment apparatus of clause CC, wherein:
- the first engaging portion is configured to engage a first portion of the interior portion of the ear; and
- the second engaging portion is configured to engage a second portion of the interior portion of the ear distinct from the first portion of the interior portion of the ear.

FF. The attachment apparatus of clause EE, wherein:
- the first portion of the interior portion of the ear is a concha; and
- the second portion of the interior portion of the ear is an anti-helix of the ear.

GG. The attachment apparatus of clause F, wherein, when the attachment apparatus is secured to the ear:
- the first engaging portion is configured to at least partially restrict movement of the attachment apparatus in a first direction; and
- the hooking body is configured to at least partially restrict movement of the attachment apparatus in a second direction.

HH. The attachment apparatus of clause GG, wherein:
- the first direction is at least substantially parallel to a median plane of the user;
- the second direction is at least substantially perpendicular to the median plane of the user.

II. The attachment apparatus of clause GG, wherein:
- the first direction is at least substantially parallel to a directional plane of the attachment body;
- the second direction is at least substantially perpendicular to the directional plane of the attachment body.

JJ. The attachment apparatus of clause F, wherein, while the attachment apparatus is secured to the ear, at least one of an anterior portion or the interior portion of the ear may engage with and cause the first engaging portion to move in a direction towards the attachment body.

KK. The attachment apparatus of clause JJ, wherein, while biased in the direction towards the attachment body, the first engaging portion urges the attachment apparatus away from the ear, causing the hooking body to one of engage or further engage the posterior portion of the ear.

LL. The attachment apparatus of clause JJ, wherein, while biased in the direction towards the attachment body, the first engaging portion causes the attachment apparatus to pivot towards a face of the user.

MM. A system comprising:
- a first attachment apparatus comprising:
  - an attachment body comprising an engaging portion; and
  - a hooking body coupled to the attachment body, wherein:
    - the engaging portion and the hooking body are configured to define a first space suitable for receiving an interior portion of the ear,
    - the attachment body and the hooking body are configured to define a second space suitable for receiving a posterior portion of the ear,
    - the hooking body and the engaging portion are collectively configured to secure the attachment apparatus to at least part of the interior portion of the ear positioned in the first space, and
    - the hooking body is configured to secure the attachment apparatus to at least part of the posterior portion of the ear that is positioned in the second space.

NN. The system of clause MM, wherein the first attachment apparatus further comprises a compliant member coupled to the engaging portion.

OO. The system of clause NN, wherein, while the first attachment apparatus is secured to the ear of the user, the compliant member engages and is deformed to a first extent by a force received from at least a part of the interior portion of the ear positioned in the first space.

PP. The system of clause OO, wherein, the compliant member is configured to at least substantially conform to a shape of at least part of the interior portion of the ear positioned in the first space in response to receiving the force.

QQ. The system of clause OO, wherein the compliant member is configured to transfer a portion of the force received from at least part of the interior portion of the ear to the engaging portion.

RR. The system of clause QQ, wherein an elasticity of the compliant member is greater than an elasticity of the engaging portion.

SS. The system of clause MM, further comprising a second attachment apparatus.

TT. The system of clause SS, wherein the second attachment apparatus is configured as a mirror image of the first attachment apparatus.

UU. The system of clause SS, wherein:

the first attachment apparatus further comprises a first coupling device; and the second attachment apparatus comprises a second coupling device configured to couple to the first coupling device.

VV. An attachment apparatus for coupling to an ear of a user, comprising:

an attachment body; and a sealing body coupled to the attachment body via a joint to enable the attachment apparatus to move between an open configuration and a closed configuration, wherein:

the attachment body is configured to secure the attachment apparatus to at least a portion of a root of the ear, and the sealing body is configured to:

receive a first force that causes the sealing body to articulate about the joint, from the open configuration, in a direction towards the attachment body to move the attachment apparatus toward the closed configuration, engage the attachment body in response to receiving the first force, and, when in the closed configuration, form at least a partial acoustic seal against the user in response to engaging the attachment body.

WW. The attachment apparatus of clause VV, wherein:

the attachment body comprises a displacement portion configured to displace a posterior portion of the ear in a direction away from a median plane of the user while the attachment apparatus is secured to the ear, and displacement of the posterior portion of the ear by the displacement portion biases a portion of the sealing body into engagement with the user such that the portion of the sealing body forms at least the partial acoustic seal against the user.

XX. The attachment apparatus of clause WW, wherein the displacement portion is configured to have a thickness greater than a space between a back surface of the posterior portion of the ear and the head of the user behind the ear with the ear in a non-displaced condition.

YY. The attachment apparatus of clause VV, wherein the sealing body comprises a grooved portion to receive a portion of the attachment body when the attachment apparatus is in the closed configuration.

ZZ. The attachment apparatus of clause YY, wherein, while the sealing body is engaged with the attachment body, a surface of the attachment body is configured to lie proximate to or substantially flush against a surface of the grooved portion of the sealing body.

AAA. The attachment apparatus of clause ZZ, wherein, while the sealing body is engaged with the attachment body:

the surface of the attachment body is configured to face away from a median plane of the user; and the surface of the sealing body is configured to face the median plane of the user.

BBB. The attachment apparatus of clause VV, wherein, while the sealing body is engaged with the attachment body, a surface of the attachment body and a surface of the sealing body are each configured to lie proximate to or substantially flush against the user.

CCC. The attachment apparatus of clause VV, wherein at least the partial acoustic seal against the user comprises at least a partial acoustic seal around at least a portion of a perimeter of the root of the ear.

DDD. The attachment apparatus of clause VV, wherein the sealing body is configured to receive a second force that causes the sealing body to disengage from the attachment body by articulating the sealing body about the joint in a direction away from the attachment body to thereby move the attachment apparatus from the closed configuration toward the open configuration.

EEE. The attachment apparatus of clause DDD, wherein at least the partial acoustic seal against the user is unformed when the sealing body disengages the attachment body.

FFF. The attachment apparatus of clause VV, wherein:

the sealing body comprises a first coupling device; and the attachment body comprises a second coupling device.

GGG. The attachment apparatus of clause FFF, wherein the first coupling device is configured to engage the second coupling device when the sealing body engages the attachment body.

HHH. The attachment apparatus of clause GGG, wherein the first coupling device is configured to couple to the second coupling device via at least one of magnetic attraction, friction, or interlocking components.

III. The attachment apparatus of clause VV, wherein the attachment body comprises a first attachment portion configured to secure the attachment apparatus to a root of the upper portion of the ear.

JJJ. The attachment apparatus of clause III, wherein the attachment body comprises a second attachment portion configured to secure the attachment apparatus to a root of a posterior portion of the ear.

KKK. The attachment apparatus of clause JJJ, wherein the second attachment portion is further configured to secure the attachment apparatus to a root of a lower portion of the ear.

LLL. The attachment apparatus of clause JJJ, wherein the attachment body further comprises a third attachment portion configured to secure the attachment apparatus to a root of an anterior portion of the ear.

MMM. The attachment apparatus of clause VV, wherein:

the attachment apparatus further comprises a cover body coupled to the sealing body to form a chamber that encapsulates the ear when the attachment apparatus is in the closed configuration with the sealing body engaged with the attachment body; and the sealing body and the cover body are configured jointly to form an acoustic seal around an entirety of the ear.

NNN. The attachment apparatus of clause MMM, wherein:

the cover body comprises a speaker element positioned within a portion of the chamber that encapsulates the ear; and the speaker element is positioned in the chamber in proximity to an ear canal of the ear.

OOO. The attachment apparatus of clause MMM, wherein the acoustic seal around the entirety of the ear comprises at least the partial acoustic seal.

PPP. The attachment apparatus of clause MMM, wherein the cover body comprises a mid-ear portion configured to:

protrude into the chamber; and engage an anterior portion of the ear when the attachment apparatus is in the closed configuration with the sealing body engaged with the attachment body.

QQQ. The attachment apparatus of clause PPP, wherein the mid-ear portion of the cover body is further configured to limit clockwise and/or counterclockwise rotation of the attachment apparatus around the ear.

RRR. The attachment apparatus of clause PPP, wherein:

the mid-ear portion of the cover body comprises a speaker element; and the speaker element is positioned in the chamber in proximity to an ear canal of the ear when the attachment apparatus is in the closed configuration with the sealing body engaged with the attachment body.

SSS. An attachment apparatus for coupling to an ear of a user, comprising:

an attachment body; and a sealing body coupled to the attachment body via a joint to enable the attachment apparatus to move between an open configuration and a closed configuration, wherein:

the attachment body is coupleable to at least a portion of a root of the ear, the attachment body is configured to engage at least the portion of the root of the ear and to limit rotation of the attachment apparatus around the ear in a first rotational direction, and the sealing body is configured to:

receive a first force that causes the sealing body to articulate about the joint from the open configuration in a direction towards the attachment body to move the attachment apparatus toward the closed configuration, and engage the attachment body in response to receiving the first force, and limit rotation of the attachment apparatus in a second rotational direction opposite the first rotational direction when the attachment apparatus is in the closed configuration with the sealing body engaged with the attachment body.

TTT. The attachment apparatus of clause SSS, wherein the sealing body is configured to receive a second force that causes the sealing body to disengage from the attachment body by articulating the sealing body about the joint in a direction away from the attachment body to thereby move the attachment apparatus from the closed configuration toward the open configuration.

UUU. The attachment apparatus of clause TTT, wherein the sealing body is configured to enable rotation of the attachment apparatus around the ear in the second rotational direction when the sealing body disengages the attachment body.

VVV. The attachment apparatus of clause SSS, wherein:

a shape of the attachment body approximates a profile shape of at least a portion of a root of a human ear; and a shape of the sealing body approximates a profile shape of at least an outer portion of a human ear.

WWW. The attachment apparatus of clause SSS, wherein the sealing body is further configured to form at least a partial acoustic seal against the user when the attachment apparatus is in the closed configuration.

XXX. The attachment apparatus of clause WWW, wherein at least the partial acoustic seal formed between the sealing body and the user inhibits movement of the attachment apparatus in relation to the ear.

YYY. The attachment apparatus of clause XXX, wherein a surface of the sealing body comprises a textured pattern that increases an amount of friction generated between the sealing body and the user.

ZZZ. The attachment apparatus of clause SSS, wherein:

at least a portion of the attachment body comprises viscoelastic material configured to transition from a resting configuration to a deformed configuration in response to receiving a deforming force on the attachment body; and a dimension of the opening defined by the attachment body is larger while the viscoelastic material is in the deformed configuration than while the viscoelastic material is in the resting configuration.

AAAA. The attachment apparatus of clause ZZZ, wherein the viscoelastic material is further configured to:

transition from the deformed configuration to the resting configuration in response to removing the deforming force from the attachment body; and while the attachment body is coupled to the ear, apply a compressive force on the ear while configured in the resting configuration.

BBBB. The attachment apparatus of clause SSS, wherein:

the attachment apparatus further comprises a cover body coupled to the attachment body to form a chamber that encapsulates the ear when the attachment apparatus is in the closed configuration; and the attachment body and the cover body are configured jointly to form at least a partial acoustic seal around an entirety of the ear.

CCCC. The attachment apparatus of clause BBBB, wherein:

the cover body comprises a speaker element positioned within a portion of the chamber that encapsulates the ear; and the speaker element is positioned in the chamber in proximity to an ear canal of the ear.

DDDD. An attachment apparatus for coupling to an ear of a user, the attachment apparatus comprising:

an attachment body; and a sealing body coupled to the attachment body via a joint to enable the attachment apparatus to move between an open configuration and a closed configuration, and the sealing body comprising a biasing portion, a first portion, and a second portion, wherein:

the attachment body is configured to secure the attachment apparatus to at least a portion of a root of the ear, the sealing body is configured to:

receive a force that causes the sealing body to articulate about the joint from the open configuration in a direction towards the attachment body to move the attachment apparatus toward the closed configuration, and engage the attachment body in response to receiving the force, the biasing portion of the sealing body is configured to displace the first portion of the sealing body in a direction away from a median plane of the user in response to engagement of the sealing body with the attachment body, and displacement of the first portion of the sealing body biases the second portion of the sealing body into engagement with the user such that the second portion of the sealing body forms at least a partial acoustic seal against the user.

EEEE. The attachment apparatus of clause DDDD, wherein the biasing portion comprises an elastic material.

FFFF. The attachment apparatus of clause DDDD, wherein the biasing portion transitions from an uncompressed state to a compressed state in response to engagement of the sealing body with the attachment body.

GGGG. The attachment apparatus of clause DDDD, wherein the biasing portion is configured to urge at least the first portion of the sealing body in a direction away from the median plane of the user while in the compressed configuration.

HHHH. The attachment apparatus of clause DDDD, wherein the biasing portion is configured to protrude from a portion of the sealing body that is proximal to a root of a posterior portion of the ear.

IIII. The attachment apparatus of clause DDDD, wherein the second portion of the sealing body is in proximity to an anterior portion of the ear.

JJJJ. An attachment apparatus for coupling to an ear of a user, comprising:

an attachment body configured to secure the attachment apparatus to at least a portion of a root of the ear; and a sealing body movably coupled to the attachment body to enable the attachment apparatus to move between a closed configuration, in which the sealing body engages the attachment body to encapsulate the ear and to form at least a partial acoustic seal against the user, and an open configuration, in which the ear is not encapsulated.

KKKK. An attachment apparatus for coupling to an ear of a user, comprising:

an attachment body configured to secure the attachment apparatus to at least a portion of a root of the ear and to limit rotation of the attachment apparatus around the ear in a first rotational direction; and a sealing body movably coupled to the attachment body to enable the attachment apparatus to move between a closed configuration, in which the sealing body engages the attachment body and limits rotation of the attachment apparatus around the ear in a second rotational direction opposite the first rotational direction, and an open position, in which rotation of the attachment apparatus around the ear in the second rotational direction is not limited by the sealing body.

LLLL. An attachment apparatus for coupling to an ear of a user, comprising:

an attachment body configured to secure the attachment apparatus to at least a portion of a root of the ear; and a sealing body movably coupled to the attachment body to enable the attachment apparatus to move between a closed configuration, in which the sealing body engages the attachment body to encapsulate the ear and to form at least a partial acoustic seal against the user, and an open configuration, in which the ear is not encapsulated.

MMMM. An attachment apparatus for coupling to an ear of a user, the attachment apparatus comprising:

an attachment body comprising a first attachment portion and a second attachment portion; and a biasing body coupled to the attachment body, wherein, while the attachment apparatus is secured to the ear of the user:

the biasing body is configured to receive a force that biases at least a portion of the biasing body in a direction towards the second attachment portion of the attachment body;

while biased in response to receiving the force, the biasing body is configured to displace the first attachment portion of the attachment body in a direction away from a median plane of the user, and displacement of the first attachment portion of the attachment body biases the second attachment portion of the attachment body into engagement with the user such that the second attachment portion of the attachment body forms at least a partial acoustic seal against the user.

NNNN. The attachment apparatus of clause MMMM, wherein the first attachment portion of the attachment body and the biasing body are configured to form a gap between the sealing body and the attachment body.

OOOO. The attachment apparatus of clause NNNN, wherein a dimension of the gap while the attachment apparatus is secured to the ear is less than a dimension of the gap while the attachment apparatus is not secure to the ear.

PPPP. The attachment apparatus of clause MMMM, wherein the biasing body comprises an elastic material.

QQQQ. The attachment apparatus of clause MMMM, wherein the biasing body is configured to protrude from a portion of the attachment body that is proximal to a root of a posterior portion of the ear.

RRRR. The attachment apparatus of clause MMMM, wherein:

the first portion of the attachment body is in proximity to a posterior portion of the ear; and the second portion of the attachment body is in proximity to an anterior portion of the ear.

SSSS. An attachment apparatus for coupling to an ear of a user, comprising:

an attachment body comprising a bridging member and a plate member having a mid-ear portion;

a hooking body;

an earpad comprising a protruding portion;

a coupling ring comprising a recessed portion; and a sealing body comprising a cutout portion, wherein:

a first end of the hooking body is coupled to the bridging body such that the hooking body and the plate body form a space suitable for receiving at least a part of a posterior portion of a human ear, a second end of the hooking body is freely movable, the earpad is coupled to the plate member such that the protruding portion is at least substantially aligned with the mid-ear portion of the plate member, a first side of the coupling ring is coupled to a side of the plate member facing the hooking body such that the bridging portion resides at least partially in the recessed portion of the coupling ring, a second side of the coupling ring is coupled to the sealing body;

the hooking body is configured to secure to the attachment apparatus to the human ear, the sealing body is configured to form a chamber suitable for at least substantially encapsulating the posterior portion of the human ear, and the cutout portion of the sealing body is configured to enable an external force to be applied to the hooking body while the attachment apparatus is secured to the human ear.

TTTT. An attachment apparatus for coupling to an ear of a user, comprising:

a cover body;

an electronic component;

a speaker system;

a mid-ear portion;

a plate member comprising a facet having at least a substantially flat surface positioned on a front side of the plate member;

a hooking body comprising a deformable core and a cushioning portion;

a coupling ring comprising a bridging portion; and a sealing body, wherein:

the speaker system is coupled to the front side of the mid-ear portion;

the electronic component is coupled to the facet of the plate member;

the mid-ear portion is coupled to the plate member;

the cover body is coupled to the front side of the plate member;

a first end of the hooking body is coupled to the bridging body, a second end of the hooking body is freely movable, a front side of the coupling ring is coupled to the front side of the plate member such that the hooking body and the plate member define a space suitable for receiving at least part of a posterior portion of a human ear, a back side of the coupling ring is coupled to a front side of the sealing body;

the hooking body is configured to secure the attachment apparatus to the human ear, and the sealing body is configured to form a chamber suitable for at least substantially encapsulating the posterior portion of the human ear.

UUUU. An attachment apparatus for coupling to an ear of a user, comprising:

a cover body;

a first electronic component;

a mounting system;

a speaker system;

a lighting system;

a plate member comprising a mid-ear portion having an engaging portion;

an internal waveguide;

a bridging member;

a hooking body comprising a deformable core and a cushioning portion;

an earpad; and a sealing body, wherein:

the electronic component is coupled to a front side of the mounting system, the speaker system is coupled to a back side of the mounting system, the lighting system is coupled to the mounting system, the cover body is coupled to the front side of the mounting system, the back side of the mounting system is coupled to the plate member such that the speaker system is aligned with the mid-ear portion of the plate member, the internal waveguide is coupled to the back side of the plate member, the bridging body is coupled to the back side of the plate member, a first end of the hooking body is coupled to the bridging body such that the hooking body and the plate member define a space suitable for receiving at least part of a posterior portion of a human ear, a second end of the hooking body is freely movable, a front side of the ear pad is coupled to the back side of the plate member, a front side of the sealing body is coupled to the back side of the plate member, the hooking body is configured to secure the attachment apparatus to the human ear, and the sealing body is configured to form a chamber suitable for at least substantially encapsulating the posterior portion of the human ear.

VVVV. An attachment apparatus for coupling to an ear of a user, comprising:

a plate member having a mid-ear portion;

a hooking body;

an earpad comprising a protruding portion;

a coupling ring comprising a bridging portion; and a sealing body, wherein:

the earpad is coupled to the plate member such that the protruding portion is at least substantially aligned with the mid-ear portion of the plate member, a first end of the hooking body is coupled to the bridging body, a second end of the hooking body is freely movable, a first side of the coupling ring is coupled to a side of the plate member facing the hooking body such that the hooking body and the plate member define a space suitable for receiving at least part of a posterior portion of a human ear, a second side of the coupling ring is coupled to the sealing body;

the hooking body is configured to secure to the attachment apparatus to the human ear, and the sealing body is configured to form a chamber suitable for at least substantially encapsulating the posterior portion of the human ear.

WWWW. An attachment apparatus for coupling to an ear of a user, comprising:

a plate member;

a bridging member;

a hooking body comprising a deformable core, an end piece, and a cushioning portion, wherein:

a first portion of the bridging member is coupled to the plate member, a first end of the deformable core is coupled to a second end of the bridging body, a second end of the deformable core is coupled to the end piece, the cushioning portion comprises a cutout portion and is configured to at least substantially encapsulate the deformable core and the end piece, the hooking body is coupled to the attachment body via the bridging member of the attachment body such that the hooking body and the plate member form a space suitable for receiving at least part of a posterior portion of a human ear, and the hooking body is configured to secure the attachment apparatus to at least a portion of a root of the ear.

XXXX. The attachment apparatus of clause WWWW, wherein:

the plate member comprises a mid-ear portion; and the plate member is positioned in proximity to a meatus of the human ear while the attachment apparatus is secured to the human ear.

YYYY. The attachment apparatus of clause XXXX, further comprising a speaker system coupled to the mid-ear portion of the plate member.

ZZZZ. The attachment apparatus of clause WWWW, wherein the plate member is configured to engage at least part of the posterior portion of the human ear positioned in the space between the plate member and the hooking body.

AAAAA. The attachment apparatus of clause WWWW, wherein:

the plate member comprises a plurality of facets;

each facet of the plurality of facets is configured to have an at least substantially flat surface on a side of the facet facing away from the hooking body; and the plate member is configured such that a profile of the plate member is substantially arcuate.

BBBBB. The attachment apparatus of clause AAAAA, further comprising at least one electronic component coupled to an at least substantially flat surface of a facet included in the plurality of facets.

CCCCC. The attachment apparatus of clause BBBBB, wherein:

the attachment apparatus further comprises a cover body coupled to the plate member; and the cover body is configured to encapsulate the at least one electronic component.

DDDDD. The attachment apparatus of clause WWWW, wherein:

the attachment apparatus further comprises a cover body and a sealing body;

the cover body is coupled to the sealing body to form a chamber that encapsulates the ear; and the sealing body and the cover body are configured jointly to form an acoustic seal around an entirety of the ear.

EEEEE. An attachment apparatus for coupling to an ear of a user, comprising:

an attachment body; and a hooking body coupled to the attachment body via a bridging member of the attachment body, wherein the hooking body is configured to secure the attachment apparatus to at least a portion of a root of the ear.

FFFFF. The attachment apparatus of clause EEEEE, wherein the hooking body is configured to move between a first movement position and a second movement position.

GGGGG. The attachment apparatus of clause EEEEE, wherein:

the attachment apparatus further comprises a cover body coupled to the sealing body to form a chamber that encapsulates the ear; and the sealing body and the cover body are configured jointly to form an acoustic seal around an entirety of the ear.

HHHHH. The attachment apparatus of clause EEEEE, wherein the hooking body is further configured to move from an initial configuration to a displaced configuration in response to receiving a force that is applied to the hooking body.

IIIII. The attachment apparatus of clause HHHHH, wherein the hooking body is configured to move in a direction that the force is applied to the hooking body.

JJJJJ. The attachment apparatus of clause IIIII, wherein the hooking body is further configured to remain in the displaced configuration once the force is removed from the hooking body.

KKKKK. The attachment apparatus of clause EEEEE, wherein the hooking body comprises a deformable core comprising at least one non-resilient, deformable material.

LLLLL. The attachment apparatus of clause EEEEE, wherein the hooking body and the attachment body define a space between the hooking body and the attachment body, and wherein the space is configured to be suitable for receiving at least a portion of a human ear.

MMMMM. The attachment apparatus of clause EEEEE, wherein the hooking body is configured to deform around at least a root of a posterior portion of the user's ear in response to receiving a force in a direction of the user's ear.

NNNNN. The attachment apparatus of clause EEEEE, wherein the attachment apparatus further comprises a sealing body.

OOOOO. The attachment apparatus of clause NNNNN, wherein a portion of the sealing body is coupled to the hooking body.

PPPPP. The attachment apparatus of clause OOOOO, wherein the portion of the sealing body is coupled to the hooking body such that the portion of the sealing body wraps around the hooking body in one of a clockwise or counterclockwise fashion.

QQQQQ. The attachment apparatus of clause OOOOO, wherein the portion of the sealing body is configured to receive an external force that causes the portion of the sealing body and the hooking body to move jointly.

RRRRR. The attachment apparatus of clause NNNNN, wherein the sealing body comprises an interior portion and an external portion.

SSSSS. The attachment apparatus of clause NNNNN, wherein:

the sealing body comprises a first portion and a second portion; and the first portion of the sealing body and the second portion of the sealing body are configured to define a gap in the sealing body that is proximate to a free-moving end of the hooking body.

TTTTT. The attachment apparatus of clause SSSSS, wherein the first portion of the sealing body is coupled to the hooking body.

UUUUU. The attachment apparatus of clause SSSSS, wherein:

the first portion of the sealing body is configured to receive an external force that causes the first portion of the sealing body to move towards and engage the hooking body; and receiving the external force on the first portion of the sealing body causes the second portion of the sealing body to move to a lesser extent than an extent to which the first portion of the sealing body moves in response to receiving the external force.

VVVVV. The attachment apparatus of clause NNNNN, wherein:

the sealing body comprises an incised portion having an incision and positioned in proximity to a free-moving end of the hooking body;

the incised portion is configured to become displaced in a direction towards the free-moving end of the hooking body by an external force until the incised portion engages the free-moving end of the hooking body; and the hooking body is configured to move in the direction while the incised portion is engaging the hooking body and transferring the external force to the hooking body.

WWWWW. The attachment apparatus of clause VVVVV, wherein the incised portion of the sealing body is configured to have an elasticity greater than an elasticity of a remainder of the sealing body.

XXXXX. The attachment apparatus of clause NNNNN, wherein:

the sealing body comprises a plurality of guiding protrusions;

the plurality of guiding protrusions are positioned on the sealing body in proximity to a free-moving end of the hooking body; and in response to receiving an external force the sealing body, the plurality of guiding protrusions may move towards and engage the free-moving end of the hooking body and may limit movement of the hooking body in at least one direction.

YYYYY. The attachment apparatus of clause XXXXX, wherein the sealing body comprises an indented portion configured to receive and guide an external force received on the indented portion, and wherein the plurality of guiding protrusions are located on the indented portion.

ZZZZZ. The attachment apparatus of clause XXXXX, wherein a first guiding protrusion of the plurality of guiding protrusions is at least substantially parallel to a second guiding protrusion of the plurality of guiding protrusions.

AAAAAA. The attachment apparatus of clause ZZZZZ, wherein a distance between the first guiding protrusion and the second guiding protrusion is greater than at least one BBBBBB. The attachment apparatus of clause NNNNN, wherein the sealing body is coupled to the attachment body.

CCCCCC. The attachment apparatus of clause NNNNN, wherein the sealing body and the attachment body are collectively configured to form a cavity, and wherein at least the hooking body and the bridging member of the attachment body reside in the cavity.

DDDDDD. The attachment apparatus of clause NNNNN, wherein the sealing body is configured to engage an area around the user's ear while the hooking body is secured to the user's ear.

EEEEEE. The attachment apparatus of clause NNNNN, wherein the sealing body comprises a portion configured to enable a force to be applied directly to the hooking body while the hooking body is secured to the user's ear.

FFFFFF. The attachment apparatus of clause EEEEEE, wherein the portion of the sealing body comprises a portion of the sealing body that is configured to be more elastic than another portion of the sealing body.

GGGGGG. The attachment apparatus of clause EEEEEE, wherein the portion of the sealing body comprises a portion of the sealing body that comprises a cutout.

HHHHHHH. The attachment apparatus of clause EEEEE, wherein the hooking body comprises at least one first magnet.

IIIIII. The attachment apparatus of clause HHHHHH, wherein the at least one first magnet is configured to couple magnetically to at least one second magnet included in another attachment apparatus.

JJJJJJ. The attachment apparatus of clause IIIIII, wherein the attachment body is configured to receive a force that separates the at least one first magnet from the at least one second magnet, and wherein the hooking body is configured to move in a direction opposite of a direction of the force received on the attachment mechanism.

KKKKKK. A system comprising the attachment apparatus configured according to any of clauses VV-JJJJJJ.

LLLLLL. The system of clause KKKKKK, furthering another attachment apparatus configured as a mirror image of the attachment apparatus configured according to any of clauses VV-JJJJJJ.

MMMMMM. A system, comprising:

a first attachment apparatus; and a second attachment apparatus, wherein:

the first attachment apparatus is configured according to any one of clauses VV-JJJJJJ; and the second attachment apparatus is configured as a mirror version of the first attachment apparatus.

NNNNNN. An audio device, comprising:

a housing including an ear-receiving chamber and being configured to receive and enclose at least a majority of a user's ear within the ear-receiving chamber and to form at least a partial acoustic seal around the user's ear;

an attachment apparatus configured to assist in securing the audio device to the user's ear and in supporting the audio device entirely from the user's ear and immediately adjacent ear area; and a plurality of electrical components received within a region of the housing outward of and adjacent to the ear-receiving chamber, the plurality of electrical components comprising at least one speaker, a processing unit, a network interface and a power source, and being configured to receive audio signals and generate sound directed to the ear canal of the user.

OOOOOO. The audio device of clause NNNNNN, wherein the housing is configured to receive and enclose substantially an entirety of the user's ear within the ear-receiving chamber.

PPPPPP. The audio device of clause NNNNNN, wherein the housing includes a cover body and a sealing body coupled together, the sealing body at least partially defining the ear-receiving chamber and forming the at least partial acoustic seal when the attachment apparatus is secured to the user's ear.

QQQQQQ. The audio device of clause NNNNNN, wherein the attachment apparatus is configured according to any one of clauses VV-JJJJJJ.

RRRRRR. An audio system comprising a pair of audio devices according to clause NNNNNN, and wherein each audio device is adapted to be secured to a respective ear of the user.

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

Conditional language such as, among others, "can," "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. An attachment apparatus for coupling to an ear of a user, comprising:

an attachment body; and a first hooking body comprising a first coupling device and coupled to the attachment body, wherein:

the first hooking body is configured to secure the attachment apparatus to a posterior portion of the ear and to move, relative to the attachment body, between a first movement position and a second movement position, and the first coupling device is configured to be coupleable with a second coupling device included in a second hooking body of another attachment apparatus such that the first hooking body is coupled to the second hooking body when the first coupling device is coupled to the second coupling device.

2. The attachment apparatus of claim 1, wherein:

the attachment apparatus further comprises a speaker element coupled to the attachment body; and the speaker element is configured to output sound through an opening in the attachment body towards the first hooking body.

3. The attachment apparatus of claim 1, wherein:

the attachment body further comprises a bridge member, the attachment body is coupled to the first hooking body via the bridge member;

the bridge member comprises a third coupling device; and the third coupling device is configured to be coupleable with a fourth coupling device included in the other attachment apparatus.

4. The attachment apparatus of claim 1, wherein the first hooking body comprises a deformable core comprising a non-resilient, deformable material.

5. The attachment apparatus of claim 1, wherein the first coupling device is configured to be coupleable with the second coupling device when the first hooking body is in the first movement position.

6. The attachment apparatus of claim 1, wherein the first coupling device is a magnetic element and the first coupling device is magnetically coupleable with the second coupling device.

7. The attachment apparatus of claim 1, wherein the first hooking body and the attachment body are configured to define a space suitable for receiving the posterior portion of the ear.

8. The attachment apparatus of claim 7, wherein a dimension of the space is larger when the first hooking body is in the second movement position than when the first hooking body is in the first movement position.

9. The attachment apparatus of claim 1, wherein the first hooking body is configured to transition from the first movement position to the second movement position in response to receiving an external force.

10. The attachment apparatus of claim 9, wherein the first hooking body is further configured to remain in the second movement position once the external force is removed from the first hooking body.

11. The attachment apparatus of claim 9, wherein, when the first coupling device is coupled to the second coupling device, the first hooking body is configured to transition from the first movement position to the second movement position by moving in a direction that is opposite of a direction of the external force that is received on the first hooking body.

12. The attachment apparatus of claim 9, wherein the first coupling device is coupleable to the second coupling device when the first hooking body is in the first movement position.

13. The attachment apparatus of claim 12, wherein, when the first coupling device is coupled to the second coupling device, the external force causes the first coupling device to decouple from the second coupling device once the first hooking body has transitioned from the first movement position to the second movement position.

14. The attachment apparatus of claim 13, wherein:

the attachment body further comprises a third coupling device that is coupleable to a fourth coupling device included in the other attachment when the first hooking body is in the first movement position, and when the third coupling device is coupled to the fourth coupling device and while the first hooking body is between the first movement position and the second movement position, the external force causes the third coupling device to decouple from the fourth coupling device without decoupling the first coupling device from the second coupling device.

15. A system, comprising:

a first attachment apparatus, comprising:

a first attachment body, and a first hooking body comprising a first coupling device and coupled to the first attachment body, and a second attachment apparatus, comprising:

a second attachment body, and a second hooking body comprising a second coupling device and coupled to the second attachment body, and wherein:

the first hooking body is configured to secure the first attachment apparatus to a posterior portion of an ear of a user and to move between a first movement position and a second movement position, and the first coupling device and the second coupling device are configured to be coupleable together such that the first hooking body is coupled to the second hooking body when the first coupling device is coupled to the second coupling device.

16. The system of claim 15, wherein the second attachment apparatus is configured as a mirror image of the first attachment apparatus.

17. The system of claim 15, wherein the first coupling device and the second coupling device are configured to be coupleable together when the first hooking body is in the first movement position.

18. The system of claim 15, wherein at least one of the first coupling device and the second coupling device is a magnet and the first coupling device and the second coupling device are coupleable together magnetically.

19. The system of claim 15, wherein, when the first coupling device is coupled to the second coupling device, an external force received on at least the first attachment apparatus causes the first coupling device to decouple from the second coupling device once the first hooking body has transitioned fully from the first movement position to the second movement position.

20. The system of claim 19, wherein:

the first attachment body further comprises a third coupling device;

the second attachment body further comprises a fourth coupling device that is coupleable to the third coupling device when the first hooking body is in the first movement position; and when the third coupling device is coupled to the fourth coupling device and while the first hooking body is between the first movement position and the second movement position, the external force causes the third coupling device to decouple from the fourth coupling device without decoupling the first coupling device from the second coupling device.

21. An attachment apparatus for coupling to an ear of a user, comprising:

an attachment body; and a first hooking body comprising a first coupling device and coupled to the attachment body, wherein:

the first hooking body is configured to secure the attachment apparatus to a posterior portion of the ear, and the first coupling device is configured to be coupleable with a second coupling device included in a second hooking body of a separate device such that the first hooking body is coupled to the second hooking body when the first coupling device is coupled to the second coupling device.

22. The attachment apparatus of claim 21, wherein the first coupling device is positioned at an end of the first hooking body that is distal to the attachment body and that is movable in relation to the attachment body.

23. The attachment apparatus of claim 22, wherein the first hooking body comprises a third coupling device positioned at an end of the first hooking body that is coupled to the attachment body and that is not movable in relation to the attachment body.

24. The attachment apparatus of claim 22, wherein the attachment body comprises a third coupling device positioned proximate to an end of the first hooking body that is coupled to the attachment body.

* * * * *